US008182336B2

(12) United States Patent
Kato et al.

(10) Patent No.: US 8,182,336 B2
(45) Date of Patent: May 22, 2012

(54) GAMING MACHINE HAVING A PLURALITY OF TERMINALS AND PLAYING METHOD THEREOF

(75) Inventors: Yoichi Kato, Tokyo (JP); Arata Ajiro, Tokyo (JP); Kenta Sugano, Tokyo (JP)

(73) Assignee: Universal Entertainment Corporation, Tokyo (JP)

( * ) Notice: Subject to any disclaimer, the term of this patent is extended or adjusted under 35 U.S.C. 154(b) by 424 days.

(21) Appl. No.: 12/476,468

(22) Filed: Jun. 2, 2009

(65) Prior Publication Data

US 2009/0312091 A1 Dec. 17, 2009

Related U.S. Application Data

(60) Provisional application No. 61/061,094, filed on Jun. 12, 2008, provisional application No. 61/078,167, filed on Jul. 3, 2008, provisional application No. 61/083,842, filed on Jul. 25, 2008, provisional application No. 61/084,592, filed on Jul. 29, 2008.

(51) Int. Cl.
*A63F 9/24* (2006.01)

(52) U.S. Cl. ..... 463/25

(58) Field of Classification Search ..... 463/16–25
See application file for complete search history.

(56) References Cited

U.S. PATENT DOCUMENTS

| | | | | |
|---|---|---|---|---|
| 4,283,709 | A | 8/1981 | Lucero et al. | |
| 5,820,459 | A | 10/1998 | Acres et al. | |
| 6,003,013 | A | 12/1999 | Boushy et al. | |
| 6,142,872 | A | 11/2000 | Walker et al. | |
| 6,312,332 | B1 | 11/2001 | Walker et al. | |
| 6,361,441 | B1 | 3/2002 | Walker et al. | |
| 6,375,569 | B1 * | 4/2002 | Acres | 463/27 |
| 6,733,390 | B2 | 5/2004 | Walker et al. | |
| 2002/0042296 | A1 | 4/2002 | Walker et al. | |
| 2005/0143166 | A1 * | 6/2005 | Walker et al. | 463/25 |
| 2006/0166731 | A1 * | 7/2006 | Yoshimi et al. | 463/20 |
| 2007/0060316 | A1 * | 3/2007 | O'Halloran | 463/25 |
| 2009/0124390 | A1 * | 5/2009 | Seelig et al. | 463/42 |
| 2009/0291737 | A1 * | 11/2009 | Ajiro et al. | 463/20 |
| 2011/0130192 | A1 * | 6/2011 | Englman et al. | 463/20 |

* cited by examiner

*Primary Examiner* — Ha Tran T Nguyen
*Assistant Examiner* — Vongsavanh Sengdara
(74) *Attorney, Agent, or Firm* — Sheppard, Mullin, Richter & Hampton LLP

(57) ABSTRACT

A gaming machine of the present invention is configured to include: terminal devices each of which executes a base game with a game value being bet and awards a prize according to a predetermined winning; routes each formed by continuously disposing route light emitters from a corresponding terminal device out of the terminal devices to a common display; the common display having common display light emitters arranged in a matrix and route light emitters arranged so as to form several straight lines each acting as an extension route, the common display being attachably/detachably unitized with the routes; and a controller.

7 Claims, 107 Drawing Sheets

FIG. 7

BASE GAME WINNING COMBINATION LOTTERY TABLE

130

| WINNING COMBINATION | RANDOM NUMBER VALUE |
|---|---|
| ☀ × 5 | 0～29 |
| ♥ × 5 | 30～51 |
| ☾ × 5 | 52～107 |
| K × 5 | 108～207 |
| A × 5 | 208～407 |
| Q × 5 | 408～807 |
| J × 5 | 808～1477 |
| 10 × 5 | 1478～1807 |
| LOSS | 1808～5998 |

FIG. 8

BASE GAME PAYOUT TABLE

131

| WINNING COMBINATION | PAYOUT (PAYING OUT COINS) |
|---|---|
| ☀ × 5 | 70COINS |
| ♥ × 5 | 50COINS |
| ☾ × 5 | 30COINS |
| K × 5 | 25COINS |
| A × 5 | 20COINS |
| Q × 5 | 15COINS |
| J × 5 | 10COINS |
| 10 × 5 | 5COINS |
| LOSS | 0COIN |

FIG. 9

JACKPOT POINT TABLE

132

| THE NUMBER OF SYMBOLS OF SUN (THE NUMBER OF JACKPOT POINT SYMBOLS) | THE NUMBER OF POINTS OBTAINED |
|---|---|
| 0 | 0PT |
| 1 | 1PT |
| 2 | 2PT |
| 3 | 3PT |
| 4 | 4PT |
| 5 | 5PT |
| 6 | 6PT |
| 7 | 7PT |
| 8 | 8PT |
| 9 | 9PT |

FIG. 12

| | SYMBOL LINE A | SYMBOL LINE B | SYMBOL LINE C | SYMBOL LINE D | SYMBOL LINE E |
|---|---|---|---|---|---|
| CODE NO. | SYMBOL | SYMBOL | SYMBOL | SYMBOL | SYMBOL |
| 00 | SUN | J | J | HEART | 10 |
| 01 | 10 | HEART | MOON | SUN | J |
| 02 | SUN | J | SUN | 10 | SUN |
| 03 | A | HEART | J | K | HEART |
| 04 | SUN | 10 | A | HEART | J |
| 05 | 10 | SUN | 10 | A | Q |
| 06 | SUN | A | SUN | J | SUN |
| 07 | A | MOON | K | Q | J |
| 08 | Q | HEART | A | 10 | A |
| 09 | MOON | J | K | SUN | HEART |
| 10 | SUN | HEART | SUN | HEART | Q |
| 11 | HEART | K | 10 | SUN | 10 |
| 12 | SUN | MOON | HEART | 10 | HEART |
| 13 | K | Q | Q | MOON | SUN |
| 14 | Q | HEART | SUN | J | J |
| 15 | SUN | J | HEART | K | A |
| 16 | J | HEART | MOON | MOON | MOON |
| 17 | K | K | 10 | HEART | SUN |
| 18 | SUN | 10 | SUN | 10 | HEART |
| 19 | 10 | MOON | 10 | SUN | SUN |
| 20 | Q | HEART | SUN | MOON | 10 |
| 21 | MOON | SUN | Q | A | K |

INITIAL PROCESS

EXECUTION OF BASE GAME

FIG. 19

SECOND BASE GAME PAYOUT TABLE

| NUMBER OF BETS | WINNING | AMOUNT OF PAYOUT |
|---|---|---|
| 1 | BAR BAR BAR / BAR BAR BAR / BAR BAR BAR | 60 |
| 1 | BAR BAR / BAR BAR / BAR BAR | 40 |
| 1 | BAR BAR BAR | 20 |
| 1 | ANY BAR ANY BAR ANY BAR | 10 |
| 1 | BLANK BLANK BLANK | 1 |
| 2 | BAR BAR BAR / BAR BAR BAR / BAR BAR BAR | 120 |
| 2 | BAR BAR / BAR BAR / BAR BAR | 80 |
| 2 | BAR BAR BAR | 40 |
| 2 | ANY BAR ANY BAR ANY BAR | 20 |
| 2 | BLANK BLANK BLANK | 2 |
| 3 | 7 7 7 | 1800 |
| 3 | 7 7 7 | 100 |
| 3 | ANY ANY ANY | 100 |

FIG.21

BONUS GAME PAYOUT TABLE

| WINNING | PAYOUT-POINTS |
|---|---|
| 7 7 7 | 7000 |
| 7 | 300 |
| 7 | 150 |
| BAR BAR BAR | 30 |
| BAR BAR | 20 |
| BAR | 10 |

FIG. 28

| | DISPLAY WINDOW151 | DISPLAY WINDOW152 | DISPLAY WINDOW153 | DISPLAY WINDOW154 | DISPLAY WINDOW155 |
|---|---|---|---|---|---|
| CODE No. | SYMBOL | SYMBOL | SYMBOL | SYMBOL | SYMBOL |
| 00 | Angelfish | Tuna | Tuna | Coelacanth | Clownfish |
| 01 | Clownfish | Coelacanth | Tuna | Angelfish | Tuna |
| 02 | Angelfish | Tuna | Angelfish | Clownfish | Angelfish |
| 03 | Clownfish | Coelacanth | Tuna | BONUS | Coelacanth |
| 04 | Angelfish | Tuna | Angelfish | Coelacanth | Clownfish |
| 05 | Clownfish | Angelfish | Clownfish | Clownfish | 7 |
| 06 | Angelfish | Clownfish | Angelfish | Tuna | Angelfish |
| 07 | Clownfish | Tuna | Clownfish | 7 | Tuna |
| 08 | 7 | Coelacanth | Angelfish | Clownfish | Clownfish |
| 09 | Tuna | Tuna | Clownfish | Angelfish | Coelacanth |
| 10 | Angelfish | Coelacanth | Angelfish | Coelacanth | Tuna |
| 11 | Coelacanth | BONUS | Clownfish | Angelfish | Clownfish |
| 12 | Angelfish | Clownfish | Coelacanth | Clownfish | Coelacanth |
| 13 | BONUS | 7 | BONUS | Tuna | Angelfish |
| 14 | 7 | Coelacanth | 7 | Tuna | Tuna |
| 15 | Angelfish | Tuna | Coelacanth | BONUS | Clownfish |
| 16 | Tuna | Coelacanth | Tuna | Tuna | Tuna |
| 17 | Clownfish | BONUS | Clownfish | Coelacanth | Angelfish |
| 18 | Angelfish | Clownfish | Angelfish | Clownfish | Coelacanth |
| 19 | Clownfish | Tuna | Clownfish | Angelfish | Angelfish |
| 20 | 7 | Coelacanth | Angelfish | Tuna | Clownfish |
| 21 | Tuna | Tuna | Clownfish | Clownfish | BONUS |

FIG. 35

POSITION INFORMATION TABLE

| LATERAL AXIS RANGE | VERTICAL AXIS RANGE | SET COLOR |
|---|---|---|
| 110 ~ 290 | 380 ~ 500 | PINK |
| 310 ~ 490 | 380 ~ 500 | RED |
| 510 ~ 690 | 380 ~ 500 | ORANGE |
| 710 ~ 890 | 380 ~ 500 | YELLOW |
| 910 ~ 1090 | 380 ~ 500 | YELLOWISH GREEN |
| 110 ~ 290 | 580 ~ 700 | GREEN |
| 310 ~ 490 | 580 ~ 700 | LIGHT BLUE |
| 510 ~ 690 | 580 ~ 700 | BLUE |
| 710 ~ 890 | 580 ~ 700 | PURPLE |
| 910 ~ 1090 | 580 ~ 700 | WHITE |
| 420 ~ 780 | 780 ~ 900 | RANDOM |

FIG. 36

SET COLOR MANAGEMENT TABLE

| GAMING TERMINAL | SET COLOR |
|---|---|
| 1 | BLUE |
| 2 | RED |
| 3 | WHITE |
| 4 | YELLOW |
| ... | ... |

FIG. 37

PATH UNIT ACTIVATION STATE TABLE

| PATH UNIT | NUMBER OF ACTIVATIONS | NUMBER OF NON-ACTIVATIONS |
|---|---|---|
| 301a | 10 | 90 |
| 301b | 0 | 110 |
| 301c | 100 | 20 |
| 301d | 30 | 70 |
| ・・・ | ・・・ | ・・・ |

FIG. 38

CONTRIBUTION AMOUNT MANAGEMENT TABLE

| GAMING TERMINAL | CONTRIBUTION AMOUNT |
|---|---|
| 10a | 130 |
| 10b | 26 |
| 10c | 86 |
| 10d | 112 |
| ・・・ | ・・・ |

FIG. 39

EMISSION COLOR CONTROL TABLE

| GAMING TERMINAL | RED LED TONE | GREEN LED TONE | BLUE LED TONE |
|---|---|---|---|
| RED | 8 | 0 | 0 |
| GREEN | 0 | 8 | 0 |
| BLUE | 0 | 0 | 8 |
| ORANGE | 4 | 4 | 0 |
| ... | ... | ... | ... |

FIG.45

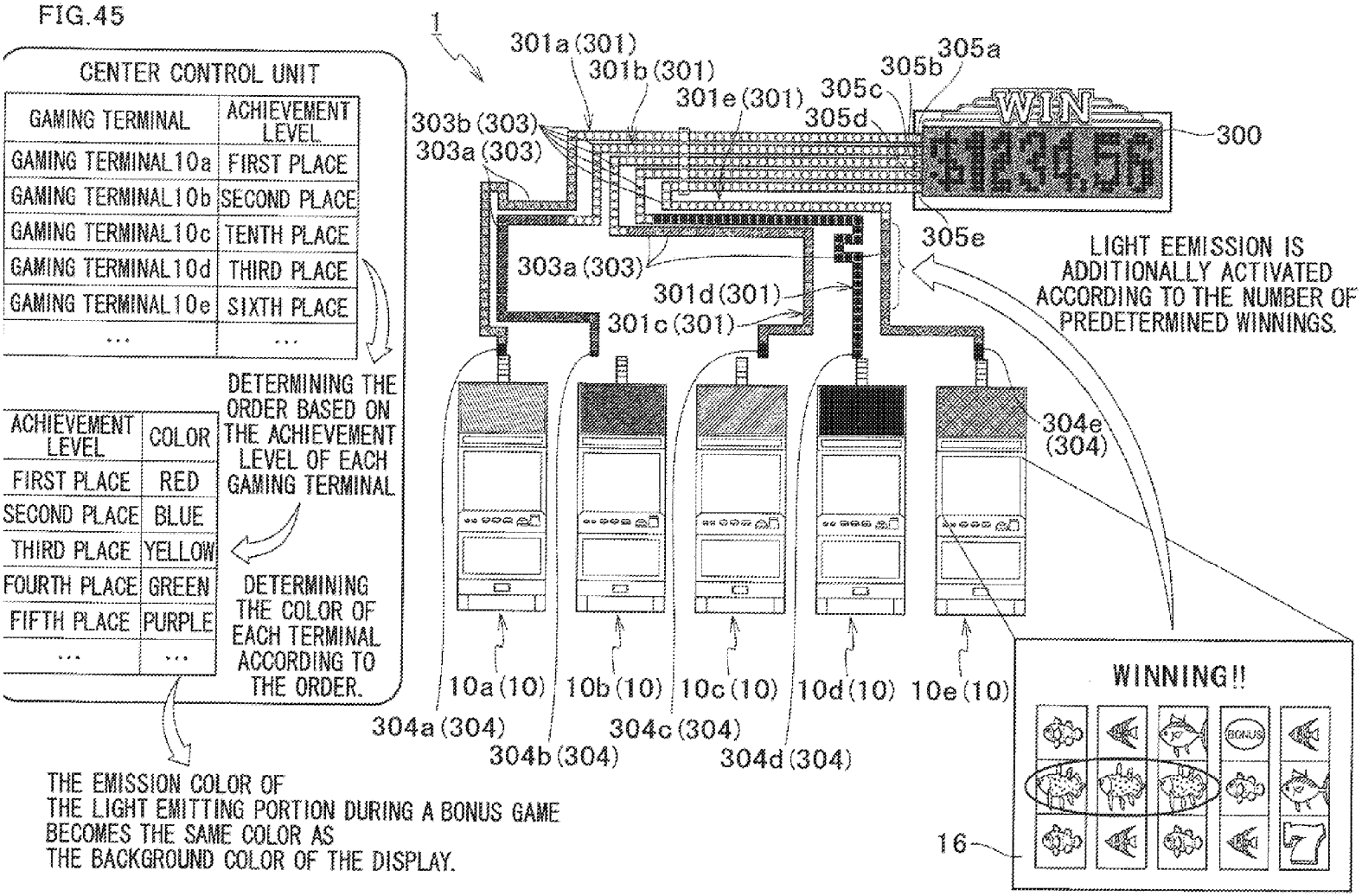

CENTER CONTROL UNIT

| GAMING TERMINAL | ACHIEVEMENT LEVEL |
|---|---|
| GAMING TERMINAL 10a | FIRST PLACE |
| GAMING TERMINAL 10b | SECOND PLACE |
| GAMING TERMINAL 10c | TENTH PLACE |
| GAMING TERMINAL 10d | THIRD PLACE |
| GAMING TERMINAL 10e | SIXTH PLACE |
| ... | ... |

DETERMINING THE ORDER BASED ON THE ACHIEVEMENT LEVEL OF EACH GAMING TERMINAL

| ACHIEVEMENT LEVEL | COLOR |
|---|---|
| FIRST PLACE | RED |
| SECOND PLACE | BLUE |
| THIRD PLACE | YELLOW |
| FOURTH PLACE | GREEN |
| FIFTH PLACE | PURPLE |
| ... | ... |

DETERMINING THE COLOR OF EACH TERMINAL ACCORDING TO THE ORDER.

FIG. 46

ACHIEVEMENT-LEVEL
MAPPING TABLE

| ACHIEVEMENT LEVEL | SET COLOR |
|---|---|
| FIRST PLACE | RED |
| SECOND PLACE | BLUE |
| THIRD PLACE | YELLOW |
| FOURTH PLACE | GREEN |
| FIFTH PLACE | PURPLE |
| ... | ... |

RUNNING A BASE GAME

FIG.48

BASE GAME PAYOUT TABLE

| NUMBER OF BETS | WINNING | NUMBER OF PAYOUTS |
|---|---|---|
| 1 | BAR BAR BAR / BAR BAR BAR / BAR BAR BAR | 60 |
| 1 | BAR BAR BAR / BAR BAR BAR | 40 |
| 1 | BAR BAR BAR | 20 |
| 1 | ANY BAR ANY BAR ANY BAR | 10 |
| 1 | BLANK BLANK BLANK | 1 |
| 2 | BAR BAR BAR / BAR BAR BAR / BAR BAR BAR | 120 |
| 2 | BAR BAR BAR / BAR BAR BAR | 80 |
| 2 | BAR BAR BAR | 40 |
| 2 | ANY BAR ANY BAR ANY BAR | 20 |
| 2 | BLANK BLANK BLANK | 2 |
| 3 | 7 7 7 | 1800 |
| 3 | 7 7 7 | 100 |
| 3 | ANY ANY ANY | 100 |

FIG.50

BONUS GAME PAYOUT TABLE

| WINNING | PAYOUT POINT |
|---|---|
| 7 7 7 | 7000 |
| 7 | 300 |
| 7 | 150 |
| BAR BAR BAR | 30 |
| BAR BAR | 20 |
| BAR | 10 |

FIG. 59

| | DISPLAY WINDOW151 | DISPLAY WINDOW152 | DISPLAY WINDOW153 | DISPLAY WINDOW154 | DISPLAY WINDOW155 |
|---|---|---|---|---|---|
| CODE No. | SYMBOL | SYMBOL | SYMBOL | SYMBOL | SYMBOL |
| 00 | Angelfish | Tuna | Tuna | Coelacanth | Clownfish |
| 01 | Clownfish | Coelacanth | Tuna | Angelfish | Tuna |
| 02 | Angelfish | Tuna | Angelfish | Clownfish | Angelfish |
| 03 | Clownfish | Coelacanth | Tuna | BONUS | Coelacanth |
| 04 | Angelfish | Tuna | Angelfish | Coelacanth | Clownfish |
| 05 | Clownfish | Angelfish | Clownfish | Clownfish | 7 |
| 06 | Angelfish | Clownfish | Angelfish | Tuna | Angelfish |
| 07 | Clownfish | Tuna | Clownfish | 7 | Tuna |
| 08 | 7 | Coelacanth | Angelfish | Clownfish | Clownfish |
| 09 | Tuna | Tuna | Clownfish | Angelfish | Coelacanth |
| 10 | Angelfish | Coelacanth | Angelfish | Coelacanth | Tuna |
| 11 | Coelacanth | BONUS | Clownfish | Angelfish | Clownfish |
| 12 | Angelfish | Clownfish | Coelacanth | Clownfish | Coelacanth |
| 13 | BONUS | 7 | BONUS | Tuna | Angelfish |
| 14 | 7 | Coelacanth | 7 | Tuna | Tuna |
| 15 | Angelfish | Tuna | Coelacanth | BONUS | Clownfish |
| 16 | Tuna | Coelacanth | Tuna | Tuna | Tuna |
| 17 | Clownfish | BONUS | Clownfish | Coelacanth | Angelfish |
| 18 | Angelfish | Clownfish | Angelfish | Clownfish | Coelacanth |
| 19 | Clownfish | Tuna | Clownfish | Angelfish | Angelfish |
| 20 | 7 | Coelacanth | Angelfish | Tuna | Clownfish |
| 21 | Tuna | Tuna | Clownfish | Clownfish | BONUS |

FIG. 62

PATH UNIT ACTIVATION STATE TABLE

| PATH UNIT | NUMBER OF ACTIVATIONS | NUMBER OF NON-ACTIVATIONS |
|---|---|---|
| 301a | 10 | 90 |
| 301b | 0 | 110 |
| 301c | 100 | 20 |
| 301d | 30 | 70 |
| ... | ... | ... |

FIG. 63

EVENT PARTICIPATION STATE TABLE

| GAMING TERMINAL | STATE |
|---|---|
| 10a | PARTICIPATE |
| 10b | NOT PARTICIPATE |
| 10c | PARTICIPATE |
| 10d | PARTICIPATE |
| 10e | PARTICIPATE |
| ... | ... |

INITIAL PROCESS

RUN BASE GAME

WIN!!

BASE GAME PAYOUT TABLE

| NUMBER OF BETS | WINNING | NUMBER OF PAYOUTS |
|---|---|---|
| 2 | BAR BAR BAR / BAR BAR BAR / BAR BAR BAR | 120 |
| 2 | BAR BAR / BAR BAR | 80 |
| 2 | BAR BAR | 40 |
| 2 | ANY BAR ANY BAR | 20 |
| 2 | BLANK BLANK BLANK | 2 |
| ..... | ..... | .... |

FIG. 76

BASE GAME PAYOUT TABLE

| NUMBER OF BETS | WINNING | NUMBER OF PAYOUTS |
|---|---|---|
| 1 | BAR BAR BAR / BAR BAR BAR / BAR BAR BAR | 60 |
| 1 | BAR BAR BAR / BAR BAR BAR | 40 |
| 1 | BAR BAR BAR | 20 |
| 1 | ANY BAR ANY BAR ANY BAR | 10 |
| 1 | BLANK BLANK BLANK | 1 |
| 2 | BAR BAR BAR / BAR BAR BAR / BAR BAR BAR | 120 |
| 2 | BAR BAR BAR / BAR BAR BAR | 80 |
| 2 | BAR BAR BAR | 40 |
| 2 | ANY BAR ANY BAR ANY BAR | 20 |
| 2 | BLANK BLANK BLANK | 2 |
| 3 | 7 7 7 | 1800 |
| 3 | 7 7 7 | 100 |
| 3 | ANY ANY ANY | 100 |

FIG.78

BONUS GAME PAYOUT TABLE

| WINNING | PAYOUT POINT |
|---|---|
| 7 7 7 | 7000 |
| 7 | 300 |
| 7 | 150 |
| BAR BAR BAR | 30 |
| BAR BAR | 20 |
| BAR | 10 |

RUN BASE GAME
300a(300)
300b(300)
400
WIN
310
1
33
16
21
22
10A(10)
10B(10)
10C(10)
10D(10)
MYSTERY GAME STARTING CONDITION IS SATISFIED!!
UPON STOPPING OF SCROLL, MYSTERY GAME IS ANNOUNCED
MYSTERY GAME!!
ANNOUNCEMENT OF MYSTERY GAME ENDS IN ALL GAMING TERMINALS
MYSTERY GAME IS RUN ALL AT ONCE
RESULT OF MYSTERY GAME IS GIVEN
PAY OUT MYSTERY BONUS
LOSS
WIN

DURING JP GAME

FIG. 86

| | ARRANGEMENT AREAS 151 | ARRANGEMENT AREAS 152 | ARRANGEMENT AREAS 153 | ARRANGEMENT AREAS 154 | ARRANGEMENT AREAS 155 |
|---|---|---|---|---|---|
| CODE NO. | SYMBOL | SYMBOL | SYMBOL | SYMBOL | SYMBOL |
| 00 | Coelacanth | Q | Q | Tuna | J |
| 01 | J | Tuna | Clownfish | Coelacanth | Q |
| 02 | Coelacanth | Q | Coelacanth | J | Coelacanth |
| 03 | A | Tuna | Q | Angelfish | Tuna |
| 04 | Coelacanth | J | A | Tuna | Q |
| 05 | J | Coelacanth | J | A | K |
| 06 | Coelacanth | A | Coelacanth | Q | Coelacanth |
| 07 | A | Clownfish | Angelfish | K | Q |
| 08 | K | Tuna | A | J | A |
| 09 | Clownfish | Q | Angelfish | Coelacanth | Tuna |
| 10 | Coelacanth | Tuna | Coelacanth | Tuna | Clownfish |
| 11 | Tuna | Angelfish | J | Coelacanth | J |
| 12 | Coelacanth | Clownfish | Tuna | J | Tuna |
| 13 | Angelfish | K | K | Clownfish | Coelacanth |
| 14 | K | Tuna | Coelacanth | Q | Q |
| 15 | Coelacanth | Q | Tuna | Angelfish | A |
| 16 | Q | Tuna | Clownfish | Clownfish | Clownfish |
| 17 | Angelfish | Angelfish | J | Tuna | Coelacanth |
| 18 | Coelacanth | J | Coelacanth | J | Tuna |
| 19 | J | Clownfish | J | Coelacanth | Coelacanth |
| 20 | K | Tuna | Coelacanth | Clownfish | J |
| 21 | Clownfish | Coelacanth | K | A | Angelfish |

FIG.91

WINNING COMBINATION TABLE

| WINNING COMBINATION | RANDOM NUMBER |
|---|---|
| × 5 | 0~49 |
| × 5 | 50~51 |
| × 5 | 52~57 |
| × 5 | 58~97 |
| A × 5 | 98~177 |
| K × 5 | 178~277 |
| Q × 5 | 278~477 |
| J × 5 | 478~777 |
| LOSS | 778~5998 |

FIG.92

BASE GAME PAYOUT TABLE

| WINNING COMBINATION | PAYOUT (COINS AWARDED) |
|---|---|
| × 5 | 50枚 |
| × 5 | 40枚 |
| × 5 | 30枚 |
| × 5 | 25枚 |
| A × 5 | 20枚 |
| K × 5 | 15枚 |
| Q × 5 | 10枚 |
| J × 5 | 5枚 |
| LOSS | 0 |

FIG.93
RACE-USE LIGHT EMITTING PORTION ACTIVATION TABLE FOR JP GAME
| JP WINNING COMBINATION | RACE-USE LIGHT EMITTING PORTION ACTIVATION COUNT | | | |
|---|---|---|---|---|
| | CURVE | | | STRAIGHT PART |
| | Gr.1 | Gr.2 | Gr.3 | ALL GROUPS |
| 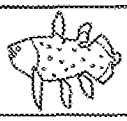 ×5 | 5 | 5 | 4 | 3 |
| 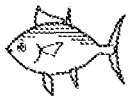 ×5 | 5 | 4 | 4 | 2 |
| 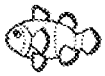 ×5 | 4 | 4 | 3 | 2 |
| 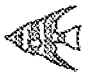 ×5 | 4 | 3 | 3 | 1 |
| A ×5 | 3 | 3 | 2 | 1 |
| K ×5 | 3 | 2 | 2 | 1 |
| Q ×5 | 2 | 2 | 1 | 0 |
| J ×5 | 2 | 1 | 1 | 0 |
| LOSS | 0 | 0 | 0 | 0 |

RUNNING BASE GAME

WIN!!

BASE GAME PAYOUT TABLE

| BET AMOUNT | WINNING COMBINATION | PAYOUT AMOUNT |
|---|---|---|
| 2 | BAR BAR BAR / BAR BAR BAR / BAR BAR BAR | 120 |
| 2 | BAR BAR / BAR BAR / BAR BAR | 80 |
| 2 | BAR BAR BAR | 40 |
| 2 | ANY BAR ANY BAR ANY BAR | 20 |
| 2 | BLANK BLANK BLANK | 2 |
| ..... | ..... | ..... |

FIG.109

BASE GAME PAYOUT TABLE

| BET AMOUNT | WINNING COMBINATION | PAYOUT AMOUNT |
|---|---|---|
| 1 | BAR BAR BAR / BAR BAR BAR / BAR BAR BAR | 60 |
| 1 | BAR BAR BAR / BAR BAR BAR | 40 |
| 1 | BAR BAR BAR | 20 |
| 1 | ANY BAR ANY BAR ANY BAR | 10 |
| 1 | BLANK BLANK BLANK | 1 |
| 2 | BAR BAR BAR / BAR BAR BAR / BAR BAR BAR | 120 |
| 2 | BAR BAR BAR / BAR BAR BAR | 80 |
| 2 | BAR BAR BAR | 40 |
| 2 | ANY BAR ANY BAR ANY BAR | 20 |
| 2 | BLANK BLANK BLANK | 2 |
| 3 | 7 7 7 | 1800 |
| 3 | 7 7 7 | 100 |
| 3 | ANY ANY ANY | 100 |

FIG.111

JP GAME PAYOUT TABLE

| JP WINNING COMBINATION | PAYOUT POINT |
|---|---|
| 7 7 7 | 7000 |
| 7 | 300 |
| 7 | 150 |
| BAR BAR BAR | 30 |
| BAR BAR | 20 |
| BAR | 10 |

GAMING MACHINE HAVING A PLURALITY OF TERMINALS AND PLAYING METHOD THEREOF

CROSS REFERENCE TO RELATED APPLICATION

This application claims the benefit of U.S. Provisional Application No. 61/061,094 filed on Jun. 12, 2008; No. 61/078,167 filed on Jul. 3, 2008; No. 61/083,842 filed on Jul. 25, 2008; and No. 61/084,592 filed on Jul. 29, 2008, which applications are incorporated herein by reference in their entireties.

BACKGROUND OF THE INVENTION

1. Field of the Invention

The present invention relates to a gaming machine.

2. Description of Related Art

Among existing gaming machines, there is a gaming machine including: two or more gaming terminals; terminal controllers respectively provided to the gaming terminals, each of which controllers causes associated one of the gaming terminals to run a game; and a center controller which controls the terminal controllers. Such a gaming machine is disclosed in, for example, specifications of U.S. Patent Application Publication No. 2002/0042296, U.S. Pat. Nos. 6,733,390, 6,312,332, 6,142,872, 6,361,441, 5,820,459, 4,283,709, and 6,003,013. A terminal controller of a gaming terminal runs a game and awards a payout based on the result of the game independently from another terminal controller of another gaming terminal. The center controller provides a bonus game, in which two or more players compete against one another for various jackpots, such as a progressive jackpot and a mystery jackpot, through the gaming terminals.

An object of the present invention is to provide a gaming machine providing an entertainment characteristic which is not brought about by the above mentioned prior art, and a playing method thereof.

SUMMARY OF THE INVENTION

The present invention provides a gaming machine including: a plurality of terminal devices each of which executes a base game with a game value being bet and awards a prize according to a predetermined winning; a plurality of routes each of which is formed by continuously disposing a plurality of route light emitters from a corresponding terminal device out of the terminal devices to a common display; the common display having a plurality of common display light emitters arranged in a matrix and a plurality of route light emitters arranged so as to form a plurality of straight lines each acting as an extension route, the common display being attachably/detachably unitized with the plurality of routes; and a jackpot controller. The jackpot controller is programmed to execute the following steps of: (a1) accumulating a percentage of a game value which is bet in each base game executed at each of the terminal devices; (a2) causing the common display to display an amount of accumulated game values; (a3) every time a predetermined winning is achieved at a terminal device after the amount of accumulated game values reaches a predetermined value, causing a predetermined number of route light emitters to be turned on toward the common display so as to emit light, the predetermined number of route light emitters being disposed on a route corresponding to the terminal device having the predetermined winning and/or on an extension route associated with that route; and (a4) when all route light emitters disposed on any one route of the plurality of routes and an extension route associated with that route are turned on to emit light, awarding the accumulated game values to a terminal device corresponding to that route and that extension route on which all the route light emitters emit light.

As described above, the common display of the gaming machine has common display light emitters arranged in a matrix and route light emitters arranged so as to form several straight lines each acting as an extension route. The common display is attachably/detachably unitized with the routes. The route light emitters arranged on the common display and the route light emitters continuously disposed on the routes are formed of same components.

Generally, a gaming machine having a bonus game needs a large-scale device to present effects, which results in a need for a large installation space. In addition, since many members are needed for assembling such a gaming machine, it is more likely to lead to poor efficiency in assembling. However, the present invention provides a gaming machine which helps to secure the installation space of the gaming machine and increases the efficiency in assembling the gaming machine at a time of installation.

The arrangement described above enables the common display to display the amount of accumulated game values by using the common display light emitters, and to display the extension routes by using the route light emitters. In addition, since the common display is structured so as to be attachable to/detachable from the routes, it is possible to increase the efficiency in assembling the gaming machine at a time of installation.

The present invention also provides the above-described gaming machine, in which a lateral length of the common display is smaller than a total sum of respective lateral lengths of the plurality of terminal devices used in the gaming machine.

In this structure, the lateral length of the common display is smaller than the total sum of the respective lateral lengths of the terminal devices used in the gaming machine. Therefore, the lateral length of the common display is kept within a range of the total sum of respective lateral lengths of the terminal devices used in the gaming machine. This is helpful to secure an installation space of the gaming machine at a time of installation.

The present invention also provides the above-described gaming machine, in which the route light emitters and the common display light emitters are constituted by LEDs.

In this structure, the common display light emitters are constituted by low-cost, lightweight, long-life LEDs. Accordingly, it is possible to reduce the cost of manufacturing.

The present invention also provides the above-described gaming machine, in which: the route light emitters are constituted by at least three types of LEDs including a red-base LED, a green-base LED, and a blue-base LED; and the common display light emitters are constituted by one or two types of LEDs.

In this structure, the route light emitters are structured using at least three types of LEDs including a red-base LED, a green-base LED, and a blue-base LED. This structure can realize image representation using the primary colors of light, which are R, G, and B. Meanwhile, the common display light emitters are structured using one or two types of LEDs. Because of this structure, the number of types of LEDs used for the common display light emitters is less than the number of types of LEDs used for the route light emitters. That is, the light emitted from the common display light emitters has low contrast or low brightness than the light emitted from the route light emitters, so that the light emitted from the common display light emitters is suitable for low-contrast or low-brightness display. Using light having different degrees of contrast or brightness in accordance with purposes improves the utilization rate of light. In addition, wasteful use of LEDs can be reduced, thereby reducing the cost of manufacturing.

The present invention also provides another gaming machine including: a plurality of terminal devices each of which executes a base game with a game value being bet and awards a prize according to a predetermined winning; a common display having a plurality of common display light emitters arranged in a matrix and a plurality of route light emitters arranged so as to form a plurality of straight lines; and a jackpot controller. The jackpot controller is programmed to execute the following steps of: (b1) accumulating a percentage of a game value which is bet in each base game executed at each of the terminal devices; (b2) causing the common display to display an amount of accumulated game values; (b3) every time a predetermined winning is achieved at a terminal device after the amount of accumulated game values reaches a predetermined value, causing a predetermined number of route light emitters to be turned on so as to emit light, the predetermined number of route light emitters being arranged on a straight line corresponding to the terminal device having the predetermined winning; and (b4) when all route light emitters disposed on any one of the plurality of straight lines each formed by arranging the plurality of route light emitters are turned on to emit light, awarding the accumulated game values to a terminal device corresponding to the one of the straight lines on which all the route light emitters emit light.

As described above, the common display of the gaming machine has common display light emitters arranged in a matrix and route light emitters arranged so as to form several straight lines. This arrangement enables the common display to display the amount of accumulated game values by using the common display light emitters, and to display, by using the route light emitters, the courses to the obtainment of the accumulated game values.

The present invention provides said another gaming machine, in which a lateral length of the common display is smaller than a total sum of respective lateral lengths of the plurality of terminal devices used in the gaming machine.

In this structure, the lateral length of the common display is smaller than the total sum of the respective lateral lengths of the terminal devices used in the gaming machine. Therefore, the lateral length of the common display is kept within a range of the total sum of respective lateral lengths of the terminal devices used in the gaming machine. This is helpful to secure an installation space of the gaming machine at a time of installation.

The present invention provides said another gaming machine, in which the route light emitters and the common display light emitters are constituted by LEDs.

In this structure, the common display light emitters are constituted by low-cost, lightweight, long-life LEDs. Accordingly, it is possible to reduce the cost of manufacturing.

The present invention provides said another gaming machine, in which: the route light emitters are constituted by at least three types of LEDs including a red-base LED, a green-base LED, and a blue-base LED; and the common display light emitters are constituted by one or two types of LEDs.

In this structure, the route light emitters are structured using at least three types of LEDs including a red-base LED, a green-base LED, and a blue-base LED. This structure can realize image representation using the primary colors of light, which are R, G, and B. Meanwhile, the common display light emitters are structured using one or two types of LEDs. Because of this structure, the number of types of LEDs used for the common display light emitters is less than the number of types of LEDs used for the route light emitters. That is, the light emitted from the common display light emitters has low contrast or low brightness than the light emitted from the route light emitters, so that the light emitted from the common display light emitters is suitable for low-contrast or low-brightness display. Using light having different degrees of contrast or brightness in accordance with purposes improves the utilization rate of light. In addition, wasteful use of LEDs can be reduced, thereby reducing the cost of manufacturing.

The present invention is a gaming machine including a plurality of gaming terminals, each having a terminal display unit that has a background display area for displaying a background image and a terminal controller programmed for carrying out the following steps (a1) to (a3);

a color-setting unit that sets a color corresponding to each of the gaming terminals;

a bonus payout display unit which displays a bonus payout in a bonus game, the bonus payout being greater than a payout of a base game which awards the payout according to a predetermined winning;

a plurality of path units, each corresponding to any of the plurality of gaming terminals, wherein a plurality of light-emitting portions that emit light upon activation are arranged from the first end, which is closer to the respectively associated gaming terminal of the plurality of gaming terminals, to the second end, which is closer to the bonus payout display unit;

and a center controller programmed to carry out the following steps of (b1) to (b3), wherein the terminal controller carries out the steps of:

(a1) running the base game independently of another gaming terminal and awarding a payout according to a predetermined winning;

(a2) displaying the background image according to a color that is set by the color-setting unit in the background display area of the gaming terminal based on a predetermined timing; and (a3) awarding the bonus payout based on a command from the center controller, wherein the center controller carries out the steps of:

(b1) running the base game based on a predetermined condition;

(b2) each time that a predetermined winning is achieved in the gaming terminal, additionally activating a light-emitting portion based on the number of predetermined winnings with a light-emitting color based on the color that is set by the color-setting unit from the first end to the second end of the path unit associated with the gaming terminal;

(b3) when the path unit is activated up to a light-emitting portion at the second end of the path unit, commanding the terminal controller of the gaming terminal associated with the path unit to award the bonus payout.

In other words, the present invention is a gaming machine, including a base game which awards a payout according to a predetermined winning;

a plurality of gaming terminals, each having a terminal display unit that has a background display area for displaying a background image, and a terminal controller programmed to carry out the following steps (a1) to (a3);

a color-setting unit that sets a color associated with each of the gaming terminals;

a bonus game configured to award a bonus payout greater than the payout awarded in the base game;

a bonus payout display unit that displays the bonus payout;

a plurality of path units, each corresponding to any of the plurality of gaming terminals, wherein a plurality of light-emitting portions that emit light upon activation are arranged from the first end, which is closer to the respectively associated gaming terminal of the plurality of gaming terminals, to the second end, which is closer to the bonus payout display unit;

and a center controller programmed to carry out the following steps of (b1) to (b3), wherein the terminal controller carries out the steps of:

(a1) running the base game independently of another gaming terminal and awarding a payout according to a predetermined winning;

(a2) displaying the background image based on a color that is set by the color-setting unit, in the background display area of the gaming terminal according to a predetermined timing;

(a3) awarding the bonus payout based on a command from the center controller, wherein the center controller carries out the steps of:

(b1) running the base game based on a predetermined condition;

(b2) each time a predetermined winning has been achieved in the gaming terminal, additionally activating a light-emitting portion based on the number of predetermined winnings in an emission color according to the color that is set by the color-setting unit, from the first end to the second end of the path unit associated with the gaming terminal;

(b3) when the path unit is activated up to a light-emitting portion at the second end of the path unit, commanding the terminal controller of the gaming terminal associated with the path unit in order to award the bonus payout.

According to the abovementioned structure, a base game is run in a plurality of gaming terminals independently of another gaming terminal, and a payout is awarded according to a predetermined winning. A background image according to the color associated with each of the gaming terminals that is set by the color-setting unit is displayed in a background display area of a terminal display unit of a gaming terminal according to a predetermined timing. Further, a bonus game is run based on a predetermined condition. Each time a predetermined winning is achieved in a gaming terminal, light-emitting portions based on the number of predetermined winnings are additionally activated in an emission color according to the color that is set by a color-setting unit from the first end to the second end of a path unit associated with the gaming terminal. When the path unit is activated up to a light-emitting portion at the second end, a bonus payout is awarded through a gaming terminal associated with the path unit.

This realizes a background image displayed in a terminal display unit of a gaming terminal and a path unit associated with the gaming terminal in a mode according to the color that is set by a color-setting unit. As a result, the plurality of gaming terminals are easily associated with the plurality of path units, respectively. This realizes a new entertainment characteristic.

The present invention is a gaming machine, including a plurality of gaming terminals, each having a terminal display unit that has a background display area to display a background image, an input device capable of receiving input from outside, and a terminal controller programmed to carry out the following steps (c1) to (c5), the plurality of gaming terminals each being configured to run a base game which is started in response to a bet from outside and awards a payout according to a predetermined winning;

a bonus payout display unit which displays a bonus payout in a bonus game configured to award the bonus payout which is an accumulated part of a value entered as a bet;

a contribution amount memory which stores how much each of the gaming terminals contribute to the bonus payout, associating with each of the gaming terminals;

a plurality of path units, each associated with any of the plurality of gaming terminals, wherein a plurality of light-emitting portions that emit light upon activation are arranged from the first end, which is closer to the respectively associated gaming terminal of the plurality of gaming terminals, to the second end, which is closer to the bonus payout display unit; and the center controller, which is programmed to carry out the following steps (d1) to (d4), wherein the terminal controller carries out the steps of:

(c1) running the base game independently of another gaming terminal and awarding a payout according to a predetermined winning;

(c2) allowing the reception of input through the input device based on a command from the center controller;

(c3) determining a color associated with a game terminal based on input through the input device;

(c4) displaying the background image according to the determined color in the background display area of the gaming terminal based on a predetermined timing;

(c5) awarding the bonus payout based on a command from the center controller, wherein the center controller carries out the steps of:

(d1) commanding the terminal controller of the plurality of gaming terminals to allow the reception of input through the input device in descending order based on the contribution amount;

(d2) running the bonus game based on a predetermined condition;

(d3) each time that a predetermined winning is achieved in the gaming terminal, additionally activating a light-emitting portion according to the number of predetermined winnings with a light-emitting color based on the color that is set by the color-setting unit from the first end to the second end of the path unit associated with the gaming terminal;

(d4) when the path unit is activated up to a second light-emitting portion at the second end, commanding the terminal controller of the gaming terminal associated with the path unit to award the bonus payout.

In other words, the present invention is a gaming machine, including a base game which is started in response to a bet from outside, and awards a payout according to a predetermined winning;

a plurality of gaming terminals, each having a terminal display unit that has a background display area to display a background image, an input device capable of receiving input from outside, and a terminal controller programmed to carry out the following steps (c1) to (c5);

a bonus game configured to award a bonus payout which is an accumulated part of a value entered as a bet;

a contribution amount memory which stores how much each of the gaming terminals contribute to the bonus payout, associating with each of the gaming terminals;

a bonus payout display unit which displays the bonus payout;

a plurality of path units, each corresponding to any of the plurality of gaming terminals, wherein a plurality of light-emitting portions that emit light upon activation are arranged from the first end, which is closer to each associated gaming terminal among the plurality of gaming terminals, to the second end, which is closer to the bonus payout display unit; and a center controller that is programmed to carry out the following steps (d1) to (d4), wherein the terminal controller carries out the steps of:

(c1) running the base game independently of another gaming terminal and awarding a payout according to a predetermined winning;

(c2) allowing the reception of input through the input device according to commands from the center controller;

(c3) determining the color associated with a gaming terminal according to input through the input device;

(c4) displaying the background image according to the determined color in the background display area of the gaming terminal based on a predetermined timing; and (c5) awarding the bonus payout based on a command from the center controller, wherein the center controller carries out the steps of:

(d1) commanding the terminal controller of the plurality of gaming terminals to allow the reception of input through the input device in descending order of the contribution amount;

(d2) running the base game based on a predetermined condition;

(d3) each time a predetermined winning is achieved in the gaming terminal, additionally activating light-emitting portions based on the number of predetermined winnings in an emission color according to the color that is determined by the gaming terminal from the first end to the second end of the path unit associated with the gaming terminal;

(d4) when the path unit is activated up to a light-emitting portion at the second end, commanding the terminal controller of the gaming terminal associated with the path unit to award the bonus payout.

According to the abovementioned structure, a base game is run in a plurality of gaming terminals independently of another gaming terminal, and a payout is awarded according to a predetermined winning. In descending order of the contribution amount that is stored and accumulated in a contribution amount memory for a plurality of gaming terminals, reception through an input device capable of receiving input from outside is allowed. The color associated with a gaming terminal is determined based on input through an input device. A background image according to a determined color is displayed in the background display area of a terminal display unit of a gaming terminal according to a predetermined timing. Further, a bonus game is run based on a predetermined condition. Each time a predetermined winning is achieved in a gaming terminal, light-emitting portions based on the number of predetermined winnings are additionally activated in an emission color according to the color that is determined by the gaming terminal from the first end to the second end of the path unit associated with the gaming terminal. When the path unit is activated up to a light-emitting portion at the second end, a bonus payout is awarded through a gaming terminal associated with the path unit.

This realizes a background image displayed in a terminal display unit of a gaming terminal and the path unit associated with the gaming terminal in a mode according to the color determined on the basis of input through an input device. As a result, the plurality of gaming terminals are respectively associated with the plurality of path units easily. Further, a gaming terminal may receive input through an input device, depending on the contribution amount. This realizes new entertainment characteristics.

The present invention is a gaming machine, including a plurality of gaming terminals, each having a terminal display unit that has a background display area for displaying a background image and a terminal controller programmed to carry out the following steps (e1) to (e3);

a bonus payout display unit which displays a bonus payout in a bonus game, the bonus payout being greater than a payout of a base game which awards the payout according to a predetermined winning;

a plurality of path units, each corresponding to any of the plurality of gaming terminals, wherein a plurality of light-emitting portions that emit light upon activation are arranged from the first end, which is closer to the respectively associated gaming terminal of the plurality of gaming terminals, to the second end, which is closer to the bonus payout display unit;

an achievement level memory that associates and memorizes an achievement level determined based on the number of light-emitting portions activated in the path unit in a color based on the achievement level; and a center controller programmed to carry out the following steps (f1) to (f5), wherein the terminal controller carries out the steps of:

(e1) running the base game independently of another gaming terminal and awarding a payout according to a predetermined winning;

(e2) displaying the background image according to a color associated with the command in the background display area of the gaming terminal based on a command from the center controller;

(e3) awarding the bonus payout based on a command from the center controller, wherein the center controller carries out the steps of:

(f1) running the bonus game based on a predetermined condition;

(f2) every time that a predetermined winning is achieved in the gaming terminal, determining the number of light-emitting portions to be activated additionally based on the predetermined winning and determining the achievement level based on the number of light-emitting portions activated in the path unit as a result of the additional activation;

(f3) additionally activating the determined number of light-emitting portions from the first end to the second end of the path unit associated with the gaming terminal, as well as changing the color of the light-emitting portion to be activated according to the achievement level;

(f4) commanding the terminal controller of the gaming terminal to display the background image based on a color associated with the achievement level;

(f5) when the path unit is activated up to a light-emitting portion at the second end of the path unit, commanding the terminal controller of the gaming terminal associated with the path unit to award a bonus payout.

In other words, the present invention is a gaming machine, including a base game which awards a payout according to a predetermined winning;

a plurality of gaming terminals, each having a terminal display unit that has a background display area for displaying a background image, and a terminal controller programmed to carry out the following steps (e1) to (e3);

a bonus game configured to award a bonus payout greater than the payout awarded in the base game;

a bonus payout display unit which displays the bonus payout;

a plurality of path units, each corresponding to any of the plurality of gaming terminals, wherein a plurality of light-emitting portions that emit light upon activation are arranged from the first end, which is closer to the respectively associated gaming terminal of the plurality of gaming terminals, to the second end, which is closer to the bonus payout display unit;

an achievement level memory that associates and memorizes achievement levels determined according to the number of light-emitting portions that are activated in the path unit, and the color associated with the achievement level; and a center controller programmed to carry out the following steps (f1) to (f5), wherein the terminal controller carries out the steps of:

(e1) running the base game independently of another gaming terminal and awarding a payout according to a predetermined winning;

(e2) displaying the background image according to the color associated with the command in the background display area of the gaming terminal based on commands from the center controller; and (e3) awarding the bonus payout based on a command from the center controller, wherein the center controller carries out the steps of:

(f1) running the bonus game based on a predetermined condition;

(f2) each time a predetermined winning is achieved in the gaming terminal, determining the number of light-emitting portions that are additionally activated according to the predetermined winning and determining the achievement level based on the number of light-emitting portions that are activated in the path unit as a result of additional activation;

(f3) additionally activating the determined number of light-emitting portions from the first end to the second end of the path unit associated with the gaming terminal and changing the color of the light-emitting portions that are activated into a color associated with the achievement level;

(f4) commanding the terminal controller of the gaming terminal to display the background image according to the color associated with the achievement level;

(f5) when the path unit is activated up to a light-emitting portion at the second end, commanding the terminal controller of the gaming terminal associated with the path unit to award the bonus payout.

According to the abovementioned structure, a base game is run in a plurality of gaming terminals independently of another gaming terminal, and a payout is awarded according to a predetermined winning. Further, a bonus game is run based on a predetermined condition. Each time a predetermined winning is achieved in a gaming terminal, along with the number of light-emitting portions that are additionally activated according to the predetermined winning, the achievement level is determined according to the number of light-emitting portions that are activated in a path unit as a result of additional activation. The determined number of light-emitting portions are additionally activated from the first end to the second end of the path unit associated with the gaming terminal, and the color of the light-emitting portions that are activated is changed to the color associated with the achievement level. A background image according to the color associated with the achievement level is displayed in a background display area of a gaming terminal. When the path unit is activated up to a light-emitting portion at the second end, a bonus payout is awarded through a gaming terminal associated with the path unit.

This realizes a background image displayed in a terminal display unit of a gaming terminal and a path unit associated with the gaming terminal in a mode based on the color associated with the achievement level that is determined according to the number of light-emitting portions that are activated in a path unit. As a result, a plurality of gaming terminals and a plurality of path units are easily associated, allowing the achievement level to be easily recognized. This realizes a new entertainment characteristic.

The present invention relates to a playing method of a gaming machine including the steps of:

(g1) running a base game that awards a payout according to a predetermined winning in a plurality of gaming terminals independently of another gaming terminal and awarding a payout according to a predetermined winning.

(g2) setting a color associated with each of the gaming terminals;

(g3) displaying a background image based on the determined color in the background display area of the gaming terminal according to a predetermined timing;

(g4) running a bonus game that awards a bonus payout greater than the payout awarded in the base game;

(g5) displaying the bonus payout in a bonus payout display unit;

(g6) in a plurality of path units, each corresponding to any of the plurality of gaming terminals, wherein a plurality of light-emitting portions that emit light upon activation are arranged from the first end to the second end, each time a predetermined winning is achieved in the gaming terminal, additionally activating light-emitting portions based on the number of predetermined winnings in an emission color according to the set color from the first end to the second end of the path unit associated with the gaming terminal; and (g7) when the path unit is activated up to a light-emitting portion at the second end, awarding the bonus payout through the gaming terminal associated with the path unit.

Here, the first end refers to the end of the path unit that is closer to the respectively associated gaming terminal among the plurality of gaming terminals. The second end is the other end from the first end in a path unit and refers to the end of the path unit that is closer to a bonus payout display unit.

According to the structure above, a background image displayed in a terminal display unit of a gaming terminal and a path unit associated with a gaming terminal are realized in a mode based on the set color. As a result, the plurality of gaming terminals are easily associated with the plurality of path units, respectively. This realizes a new entertainment characteristic.

The present invention is a gaming machine including a plurality of gaming terminals each having a terminal controller programmed to carry out the following steps of (a1) to (a3); and a center controller programmed to carry out the following steps of (b1) to (b3), wherein the terminal controller carries out the steps of:

(a1) running the base game independently of any other gaming terminals, which game repeats a unit game started in response to a bet to consume a predetermined time and awards a payout according to the results of the unit game, and awarding a payout according to the predetermined results of the unit game;

(a2) prohibiting the starting of the unit game based on the unit game prohibition command from the center controller;

(a3) based on an event start command from the center controller, participating in an event started in accordance with a predetermined condition, wherein the plurality of gaming terminals can participate in the event;

the center controller carries out the steps of:

(b1) determining whether the predetermined condition has been met;

(b2) when the predetermined condition has been met, running the unit game prohibition command in the terminal controller of the plurality of gaming terminals and starting a count for a predetermined standby time that is longer than the predetermined time from the timing at which the predetermined condition has been met; and (b3) at the timing at which the count is finished, running the event start command in the terminal controller of the plurality of gaming terminals and running the event.

In other words, the present invention is a gaming machine, including a base game that repeats a unit game started in response to a bet to consume a predetermined time and awards a payout according to the results of the unit game;

a plurality of gaming terminals each having a terminal controller programmed to carry out the following steps (a1) to (a3);

an event that is started in accordance with a predetermined condition in which the plurality of gaming terminals can participate in the event;

and a center controller programmed to carry out the following steps (b1) to (b3), wherein the terminal controller carries out the steps of:

(a1) running the base game independently of any other gaming terminals and awarding a payout according to the predetermined results of the unit game;

(a2) prohibiting the starting of the unit game based on a unit game prohibition command from the center controller;

(a3) participating in the event based on an event start command from the center controller; the center controller carries out the steps of:

(b1) determining whether the predetermined condition has been met;

(b2) when the predetermined condition has been met, executing a unit game prohibition command in the terminal controller of the plurality of gaming terminals and starting a count for a predetermined standby time that is longer than the predetermined time from the timing at which the predetermined condition has been met; and (b3) at the timing at which the count is finished, running an event start command in the terminal controller of the plurality of gaming terminals and running the event.

According to the above structure, a base game that repeats a unit game started in a plurality of gaming terminals in response to a bet to consume a predetermined time is run independently of any other gaming terminals, and a payout is awarded according to the predetermined results of the unit game. It is determined whether a predetermined condition has been met to start an event in which a plurality of gaming terminals can participate. When a predetermined condition has been met, a count is started for a predetermined standby time that is longer than a predetermined time from the timing at which the predetermined condition has been met, and starting of a unit game is prohibited. An event is run at the timing at which the count is finished.

This allows for the gaming terminals to participate in an event altogether after a predetermined standby time that is longer than the unit game has elapsed since the timing at which a predetermined condition has been met, regardless of the run timing of the unit game of the base game that is implemented in each of the gaming terminals. This realizes a new entertainment characteristic.

The present invention is a gaming machine including a plurality of gaming terminals each having an input device capable of receiving an input from outside and a terminal controller programmed to carry out the following steps of (c1) to (c5); and a controller programmed to perform the steps of (d1) to (d3), the terminal controller carries out the steps of:

(c1) running a base game independently of any other gaming terminals, which game repeats a unit game started in response to a bet to consume a predetermined time and awards a payout according to the results of the unit game, and awarding a payout according to the predetermined results of the unit game;

(c2) prohibiting the starting of the unit game based on a unit game prohibition command from the center controller and presenting in the plurality of gaming terminals options in which participation in an event can be selected through input into the input device, the event being started in accordance with a predetermined condition wherein the plurality of gaming terminals can participate in the event;

(c3) determining whether to participate in the event based on input into the input device;

(c4) when the determination is to not participate in the event, allowing the starting of the unit game;

(c5) when the determination is to participate in the event, participating in the event based on an event start command from the center controller;

the center controller carries out the steps of:

(d1) determining whether the predetermined condition has been met;

(d2) when the predetermined condition has been met, running a unit game prohibition command in the terminal controller of the plurality of gaming terminals, and starting a count for a predetermined standby time that is longer than the predetermined time from the timing at which the predetermined condition has been met; and (d3) at the timing at which the count is finished, running an event start command in the terminal controller of the plurality of gaming terminals and running the event.

In other words, the present invention is a gaming machine, including a base game that repeats a unit game started in response to a bet to consume a predetermined time and awards a payout according to the results of the unit game;

a plurality of gaming terminals each having an input device capable of receiving an input from outside and a plurality of gaming terminals each having a terminal controller programmed to carry out the following steps of (c1) to (c5)

an event that is started in accordance with a predetermined condition in which the plurality of gaming terminals can participate;

a center controller programmed to perform the steps (d1) to (d3); and options that are presented in the plurality of gaming terminals and in which participation in the event can be selected via input into the input device, the terminal controller carries out the steps of:

(c1) running the base game independently of any other gaming terminals and awarding a payout according to a predetermined winning of the unit game;

(c2) prohibiting the starting of the unit game in accordance with a unit game prohibition command from the center controller and presenting the options;

(c3) determining whether to participate in the event based on input into the input device;

(c4) when the determination is to not participate in the event, allowing the starting of the unit game;

(c5) when the determination is to participate in the event, participating in the event based on an event start command from the center controller;

the center controller carries out the steps of:

(d1) determining whether the predetermined condition has been met;

(d2) when the predetermined condition has been met, executing a unit game prohibition command in the terminal controller of the plurality of gaming terminals and starting a count for a predetermined standby time that is longer than the predetermined time from the timing at which the predetermined condition has been met; and (d3) at the timing at which the count is finished, executing an event start command in the terminal controller of the plurality of gaming terminals and running the event.

According to the above structure, a base game that repeats a unit game started in a plurality of gaming terminals in response to a bet to consume a predetermined time is run independently of any other gaming terminals, and a payout is awarded according to the predetermined results of the unit game. It is determined whether a predetermined condition has been met to start an event in which a plurality of gaming terminals can participate. When a predetermined condition has been met, a count is started for a predetermined standby time that is longer than a predetermined time from the timing at which the predetermined condition has been met. Starting of a unit game is prohibited in each of the gaming terminals, and options are presented in which participation in an event can be selected. Whether to participate or not in an event is determined based on input into an input device capable of receiving input from outside. When the determination is to not participate in an event, starting of the unit game is allowed. When the gaming terminal participates in an event, an event is run at the timing at which the count is finished.

This allows for the gaming terminals to participate in an event altogether after a predetermined standby time that is longer than the unit game from the timing at which a predetermined condition has been met, regardless of the run timing of the unit game of the base game that is implemented in each of the gaming terminals. Further, participation in an event can be selected. This realizes a new entertainment characteristic.

The present invention is a gaming machine including a plurality of gaming terminals each having a terminal controller programmed to carry out the following steps of (e1) to (e4), the terminal controller carries out the steps of:

(e1) running a base game independently of any other gaming terminals, which game repeats a unit game started in response to a bet to consume a predetermined time and awards a payout according to the results of the unit game, and awarding a payout according to the predetermined results of the unit game;

(e2) prohibiting the starting of the unit game in accordance with a unit game prohibition command from any of the terminal controllers of the plurality of gaming terminals;

(e3) based on an event start command from the terminal controller, participating in an event started in accordance with a predetermined condition, wherein the plurality of gaming terminals can participate in the event;

(e4-1) determining whether the predetermined condition has been met;

(e4-2) when the predetermined condition has been met, running a unit game prohibition command in the terminal controller of the plurality of gaming terminals, and starting a count for a predetermined standby time that is longer than the predetermined time from the timing at which the predetermined condition has been met; and (e4-3) at the timing at which the count is finished, running an event start command in the terminal controller of the plurality of gaming terminals and running the event.

In other words, the present invention is a gaming machine, including a base game that repeats a unit game started in response to a bet to consume a predetermined time and awards a payout according to the results of the unit game;

a plurality of gaming terminals each having a terminal controller programmed to carry out the following steps (e1) to (e4);

an event that is started in accordance with a predetermined condition in which the plurality of gaming terminals can participate, the terminal controller carries out the steps of: (e1) running the base game independently of any other gaming terminals and awarding a payout according to the predetermined results of the unit game;

(e2) prohibiting the starting of the unit game in accordance with a unit game prohibition command from any of the terminal controllers of the plurality of gaming terminals;

(e3) participating in the event in accordance with an event start command from the terminal controller;

(e4-1) determining whether the predetermined condition has been met;

(e4-2) when the predetermined condition has been met, executing a unit game prohibition command in the terminal controller of the plurality of gaming terminals and starting a count for a predetermined standby time that is longer than the predetermined time from the timing at which the predetermined condition has been met; and (e4-3) at the timing at which the count is finished, executing an event start command in the terminal controller of the plurality of gaming terminals and running the event.

According to the above structure, a base game that repeats a unit game started in a plurality of gaming terminals in response to a bet to consume a predetermined time is run independently of any other gaming terminals, and a payout is awarded according to the predetermined results of the unit game. It is determined whether a predetermined condition has been met to start an event in which a plurality of gaming terminal can participate. When a predetermined condition has been met, a count is started for a predetermined standby time that is longer than a predetermined time from the timing at which the predetermined condition has been met, and starting of the unit game is prohibited. An event is run at the timing at which the count is finished.

This allows for the gaming terminals to participate in an event altogether after a predetermined standby time that is longer than the unit game from the timing at which a predetermined condition has been met, regardless of the run timing of the unit game of the base game that is implemented in each of the gaming terminals. This realizes a new entertainment characteristic.

The present invention is a gaming machine including a plurality of gaming terminals each having an input device capable of receiving an input from outside, and a terminal controller programmed to carry out the following steps of (f1) to (f6), the terminal controller carries out the steps of:

(f1) running a base game independently of any other gaming terminals, which game repeats a unit game started in response to a bet to consume a predetermined time and awards a payout according to the results of the unit game, and awarding a payout according to the predetermined results of the unit game;

(f2) prohibiting the starting of the unit game based on a unit game prohibition command from any of the terminal controllers of the plurality of gaming terminals and presenting in the plurality of gaming terminals options in which participation in an event can be selected through input into the input device, the event being started in accordance with a predetermined condition wherein the plurality of gaming terminals can participate in the event;

(f3) determining whether to participate in the event based on input into the input device;

(f4) when the determination is to participate in the event, allowing starting of the unit game;

(f5) when the determination is to participate in the event, participating in the event based on an event start command from the terminal controller;

(f6-1) determining whether the predetermined condition has been met;

(f6-2) when the predetermined condition has been met, running a unit game prohibition command on a terminal controller of the plurality of gaming terminals and starting a count for a predetermined standby time that is longer than the predetermined time from the timing at which the predetermined condition has been met;

(f6-3) at the timing at which the count is finished, executing an event start command on a terminal controller of the plurality of gaming terminals and running the event.

In other words, the present invention is a gaming machine, including a base game that repeats a unit game started in response to a bet to consume a predetermined time and awards a payout according to the results of the unit game;

a plurality of gaming terminals each having an input device capable of receiving an input from outside and a terminal controller programmed to carry out the following steps (f1) to (f6);

an event that is started according to a predetermined condition in which the plurality of gaming terminals can participate; and options that are presented in the plurality of gaming terminals in which participation in the event can be selected via input into the input device.

the terminal controller carries out the steps of:

(f1) running the base game independently of any other gaming terminals and awarding a payout according to the predetermined results of the unit game;

(f2) prohibiting the starting of the unit game based on a unit game prohibition command from any of the terminal controllers of the plurality of gaming terminals and presenting the options;

(f3) determining whether to participate in the event based on input into the input device;

(f4) when the determination is to not participate in the event, allowing the starting of the unit game;

(f5) when the determination is to participate in the event, participating in the event based on an event start command from the terminal controller;

(f6-1) determining whether the predetermined condition has been met;

(f6-2) when the predetermined condition has been met, executing a unit game prohibition command to a terminal controller of the plurality of gaming terminals and starting a count for a predetermined standby time that is longer than the predetermined time from the timing at which the predetermined condition has been met;

(f6-3) at the timing at which the court is finished, executing an event start command to a terminal controller of the plurality of gaming terminals and running the event.

According to the above structure, a base game that repeats a unit game started in a plurality of gaming terminals in response to a bet to consume a predetermined time is run independently of any other gaming terminals, and a payout is awarded according to the predetermined results of the unit game. It is determined whether a predetermined condition has been met to start an event in which a plurality of gaming terminals can participate. When a predetermined condition has been met, a count is started for a predetermined standby time that is longer than a predetermined time from the timing at which the predetermined condition has been met, and starting of a unit game is prohibited. An event is run at the timing at which the count is finished.

This allows for the gaming terminals to participate in an event altogether after a predetermined standby time that is longer than the unit game has elapsed since the timing at which a predetermined condition has been met, regardless of the run timing of the unit game of the base game that is implemented in each of the gaming terminals. This realizes a new entertainment characteristic.

The present invention relates to a playing method of a gaming machine including the steps of:

(g1) running a base game that repeats a unit game started in a plurality of gaming terminals in response to a bet to consume a predetermined time independently of any other gaming terminals and awarding a payout according to the predetermined results of the unit game;

(g2) determining whether a predetermined start condition has been met for an event in which the plurality of gaming terminals can participate;

(g3) when the predetermined condition has been met, starting a count for a predetermined standby time that is longer than the predetermined time from the timing at which the predetermined condition has been met and prohibiting the starting of the unit game in the plurality of gaming terminals; and (g4) at the timing at which the count is finished, running the event in the plurality of gaming terminals.

The above structure enables the gaming terminals to participate in an event altogether after a predetermined standby time that is longer than a unit game has elapsed since a predetermined condition has been met, regardless of the run timing of the unit game of the base game that is implemented in each of the gaming terminals. This realizes a new entertainment characteristic.

The present invention provides a gaming machine comprising: a plurality of gaming terminals each of which runs a base game to award a payout corresponding to a predetermined winning and a bonus game to award a bonus payout which is greater than the payout of the base game, the gaming terminal including a terminal display which displays an image and a terminal controller; and a center controller. The terminal controller is programmed to perform the steps of: (a1) running the base game and awarding a payout corresponding to a predetermined winning, independently of another terminal controller of another gaming terminal; (a2) determining whether the base game has ended or not, based on a first command from the center controller; (a3) displaying on the terminal display a bonus game screen concerning the bonus game, when it is determined that the base game has ended; (a4) running the bonus game based on a second command from the center controller; and (a5) awarding the bonus payout in accordance with a result of the bonus game, after running the bonus game. The center controller is programmed to perform the steps of: (b1) outputting the first command to all of the gaming terminals, when a predetermined condition is satisfied; and (b2) outputting the second command to all of the gaming terminals, when the bonus game screen is displayed on the terminal display of every gaming terminal.

According to the above-described structure, the base game is run in each of the gaming terminals. When the predetermined condition is satisfied, whether the base game being run has ended or not is determined in each gaming terminal. Then, the gaming terminals, sequentially from the one having determined that the base game has ended, have the bonus game image displayed on their terminal displays. When the bonus game image is displayed on the terminal displays of all the gaming terminals, the bonus game is run all at once in all the gaming terminals. When the bonus game is run all at once, a bonus payout is awarded to each gaming terminal in accordance with a result of the bonus game. Thus, in all the gaming terminals, the bonus game is run all at once after the base game ends. Accordingly, a player can share his/her expectation for the bonus payout with other players. In addition, the gaming terminals, sequentially from the one having ended the base game, have the bonus game image displayed on the terminal displays. This can give a player expectation for the bonus game starting soon, even before the other gaming terminals end the base game. Like this, a player may enjoy the bonus game with sympathy with players playing on the other gaming terminals, as compared with when the bonus game is individually run in one gaming terminal independently of in another gaming terminal.

The present invention may also provide a gaming machine comprising: a plurality of gaming terminals each of which includes a terminal controller and runs a base game to award a payout corresponding to a predetermined winning and a bonus game to award a bonus payout which is greater than the payout of the base game; and a center controller. The terminal controller is programmed to perform the steps of: (c1) running the base game and awarding a payout corresponding to a predetermined winning, independently of another terminal controller of another gaming terminal; (c2) determining whether the base game has ended or not, based on a first command from the center controller; (c3) running the bonus game, when it is determined that the base game has ended; and (c4) awarding the bonus payout in accordance with a result of the bonus game, based on a second command from the center controller. The center controller is programmed to perform the steps of: (d1) outputting the first command to all of the gaming terminals, when a predetermined condition is satisfied; and (d2) outputting the second command to all of the gaming terminals, when the bonus game is run in every gaming terminal.

According to the above-described structure, the base game is run in each of the gaming terminals. When the predetermined condition is satisfied, whether the base game being run has ended or not is determined in each gaming terminal. The gaming terminals, sequentially from the one having determined that the base game has ended, start a bonus game. After the bonus game is run in all the gaming terminals, a bonus payout is awarded to each of the gaming terminals in accordance with a result of the bonus game. Thus, in all the gaming terminals, after the base game ends, the bonus payout is awarded in accordance with the result of the bonus game. Accordingly, a player can share his/her expectation for the bonus payout with other players. In addition, the gaming terminals, sequentially from the one having ended the base game, start the bonus game. This can give a player expectation for the bonus payout being awarded soon, even before the other gaming terminals end the base game. Like this, a player may enjoy the bonus game with sympathy with players playing on the other gaming terminals, as compared with when the bonus game is individually run and a result of the game is given in one gaming terminal independently of in another gaming terminal.

The present invention may also provide a plurality of gaming terminals each of which runs a base game to award a payout corresponding to a predetermined winning and a bonus game to award a bonus payout which is greater than the payout of the base game, the gaming terminal including a terminal display which displays an image and a terminal controller. The terminal controller is programmed to perform the steps of: (e1) running the base game and awarding a payout corresponding to a predetermined winning, independently of another terminal controller of another gaming terminal; (e2) determining whether the base game has ended or not, when a predetermined condition is satisfied; (e3) displaying on the terminal display a bonus game screen concerning the bonus game, when it is determined that the base game has ended; (e4) running the bonus game, after all the other gaming terminals display the bonus game screen on their terminal displays; and (e5) awarding the bonus payout in accordance with a result of the bonus game, after running the bonus game.

According to the above-described structure, the base game is run in each of the gaming terminals. When the predetermined condition is satisfied, whether the base game being run has ended or not is determined in each gaming terminal. Then, the gaming terminals, sequentially from the one having determined that the base game has ended, have the bonus game image displayed on their terminal displays. When the bonus game image is displayed on the terminal displays of all the gaming terminals, the bonus game is run all at once in all the gaming terminals. When the bonus game is run all at once, a bonus payout is awarded to each gaming terminal in accordance with a result of the bonus game. Thus, in all the gaming terminals, the bonus game is run all at once after the base game ends. Accordingly, a player can share his/her expectation for the bonus payout with other players. In addition, the gaming terminals, sequentially from the one having ended the base game, have the bonus game image displayed on the terminal displays. This can give a player expectation for the bonus game starting soon, even before the other gaming terminals end the base game. Like this, a player may enjoy the bonus game with sympathy with players playing on the other gaining terminals, as compared with when the bonus game is individually run in one gaming terminal independently of in another gaming terminal.

The present invention may also provide a plurality of gaming terminals each of which includes a terminal controller and runs a base game to award a payout corresponding to a predetermined winning and a bonus game to award a bonus payout which is greater than the payout of the base game. The terminal controller is programmed to perform the steps of: (f1) running the base game and awarding a payout corresponding to a predetermined winning, independently of another terminal controller of another gaming terminal; (f2) determining whether the base game has ended or not, when a predetermined condition is satisfied; (f3) running the bonus game, when it is determined that the base game has ended; and (f4) awarding the bonus payout in accordance with a result of the bonus game, after the bonus game is run in all the other gaming terminals.

According to the above-described structure, the base game is run in each of the gaming terminals. When the predetermined condition is satisfied, whether the base game being run has ended or not is determined in each gaming terminal. The gaming terminals, sequentially from the one having determined that the base game has ended, start a bonus game. After the bonus game is run in all the gaming terminals, a bonus payout is awarded to each of the gaming terminals in accordance with a result of the bonus game. Thus, in all the gaming terminals, after the base game ends, the bonus payout is awarded in accordance with the result of the bonus game. Accordingly, a player can share his/her expectation for the bonus payout with other players. In addition, the gaming terminals, sequentially from the one having ended the base game, start the bonus game. This can give a player expectation for the bonus payout being awarded soon, even before the other gaming terminals end the base game. Like this, a player may enjoy the bonus game with sympathy with players playing on the other gaming terminals, as compared with when the bonus game is individually run and a result of the game is given in one gaming terminal independently of in another gaming terminal.

The present invention may also provide a playing method of a gaming machine comprising a plurality of gaming terminals each of which includes a terminal display which displays an image and each of which runs a base game to award a payout corresponding to a predetermined winning and a bonus game to award a bonus payout which is greater than the payout of the base game. The method includes the steps of: (g1) in each one of the gaming terminals, running the base game and awarding a payout corresponding to a predetermined winning, independently of another gaming terminal; (g2) determining whether the base game has ended or not, when a predetermined condition is satisfied; (g3) displaying on the terminal display a bonus game screen concerning the bonus game, when it is determined that the base game has ended; (g4) running the bonus game, when the bonus game screen is displayed on the terminal displays of all the gaming terminals; and (g5) awarding the bonus payout in accordance with a result of the bonus game, after running the bonus game.

According to the above-described structure, the base game is run in each of the gaming terminals. When the predetermined condition is satisfied, whether the base game being run has ended or not is determined in each gaming terminal. Then, the gaming terminals, sequentially from the one having determined that the base game has ended, have the bonus game image displayed on their terminal displays. When the bonus game image is displayed on the terminal displays of all the gaming terminals, the bonus game is run all at once in all the gaming terminals. When the bonus game is run all at once, a bonus payout is awarded to each gaming terminal in accordance with a result of the bonus game. Thus, in all the gaming terminals, the bonus game is run all at once after the base game ends. Accordingly, a player can share his/her expectation for the bonus payout with other players. In addition, the gaming terminals, sequentially from the one having ended the base game, have the bonus game image displayed on the terminal displays. This can give a player expectation for the bonus game starting soon, even before the other gaming terminals end the base game. Like this, a player may enjoy the bonus game with sympathy with players playing on the other gaming terminals, as compared with when the bonus game is individually run in one gaming terminal independently of in another gaming terminal.

BRIEF DESCRIPTION OF THE DRAWINGS

FIG. 7 is an explanatory view showing a base game winning combination lottery table.

FIG. 8 is an explanatory view showing a base game payout table.

FIG. 9 is an explanatory view showing a jackpot point table.

FIG. 12 is a table showing symbol columns and code numbers of respective symbols.

FIG. 19 is a view showing a second base game payout table of the slot machine according to the variation of the first embodiment of the present invention.

FIG. 21 is an explanatory view showing a bonus game payout table in the slot machine according to the variation of the first embodiment of the present invention.

FIG. 28 is an explanatory diagram illustrating a symbol column of symbols rearranged on a terminal display.

FIG. 35 illustrates a position information table.

FIG. 36 illustrates a set color management table.

FIG. 37 illustrates a path unit activation state table.

FIG. 38 illustrates a contribution amount management table according to the embodiment 2-1.

FIG. 39 illustrates an emission color control table.

FIG. 45 is an explanatory diagram illustrating a gaming machine and a playing method thereof according to an embodiment 2-2.

FIG. 46 illustrates an achievement level mapping table according to the embodiment 2-2.

FIG. 48 illustrates a base game payout table of a gaming machine according to the variation of the second embodiment of the present invention.

FIG. 50 is an explanatory diagram illustrating a bonus game payout table of a gaming machine according to the variation of the second embodiment of the present invention.

FIG. 59 is an explanatory diagram illustrating a symbol column of symbols rearranged on the lower image display panel.

FIG. 62 is a diagram illustrating a path unit activation state table.

FIG. 63 is a diagram illustrating an event participation state table.

FIG. 76 is a diagram illustrating a base game payout table of the gaming machine according to the variation of the third embodiment of the present invention.

FIG. 78 is an explanatory diagram illustrating a bonus game payout table of the gaming machine according to the variation of the third embodiment of the present invention.

FIG. 86 is an explanatory diagram illustrating a symbol column of symbols to be rearranged on a terminal display.

FIG. 91 is a diagram illustrating a winning combination table;

FIG. 92 shows a base game payout table.

FIG. 93 illustrates a table of activation of the race-use light emitting portions during the JP game.

FIG. 109 is a diagram showing a base game payout table in a gaming machine according to the variation of the fourth embodiment of the present invention.

FIG. 111 is a diagram showing a JP game payout table in a gaming machine according to the variation of the fourth embodiment of the present invention.

DESCRIPTION OF THE PREFERRED EMBODIMENTS (First Embodiment)

With reference to FIGS. 1 to 21, the following describes a first embodiment of a gaming machine according to the present invention. Note that reference numbers and symbols given to members and steps of flowcharts are only applicable to those described within the present embodiment, and do not represent the members or the steps of the other embodiments.

The present invention provides a gaming machine including: a plurality of terminal devices each of which executes a base game with a game value being bet and awards a prize according to a predetermined winning; a plurality of routes each of which is formed by continuously disposing a plurality of route light emitters from a corresponding terminal device out of the terminal devices to a common display; the common display having a plurality of common display light emitters arranged in a matrix and a plurality of route light emitters arranged so as to form a plurality of straight lines each acting as an extension route, the common display being attachably/detachably unitized with the plurality of routes; and a jackpot controller. The gaming machine is characterized by performing the steps of: accumulating a percentage of a game value which is bet in each base game executed at each of the terminal devices; causing the common display to display an amount of accumulated game values; every time a predetermined winning is achieved at a terminal device after the amount of accumulated game values reaches a predetermined value, causing a predetermined number of route light emitters to be turned on toward the common display so as to emit light, the predetermined number of route light emitters being disposed on a route corresponding to the terminal device having the predetermined winning and/or on an extension route associated with that route; and when all route light emitters disposed on any one route of the plurality of routes and an extension route associated with that route are turned on to emit light, awarding the accumulated game values to a terminal device corresponding to that route and that extension route on which all the route light emitters emit light.

In the embodiment, "jackpot game" is a game played for the purpose of obtaining coins corresponding to an accumulated value. The accumulated value is a value resulting from accumulative calculation of a percentage of an amount bet at each terminal device. A jackpot game is a sideshow game played independently of a main plot of a base game.

Figure 2:
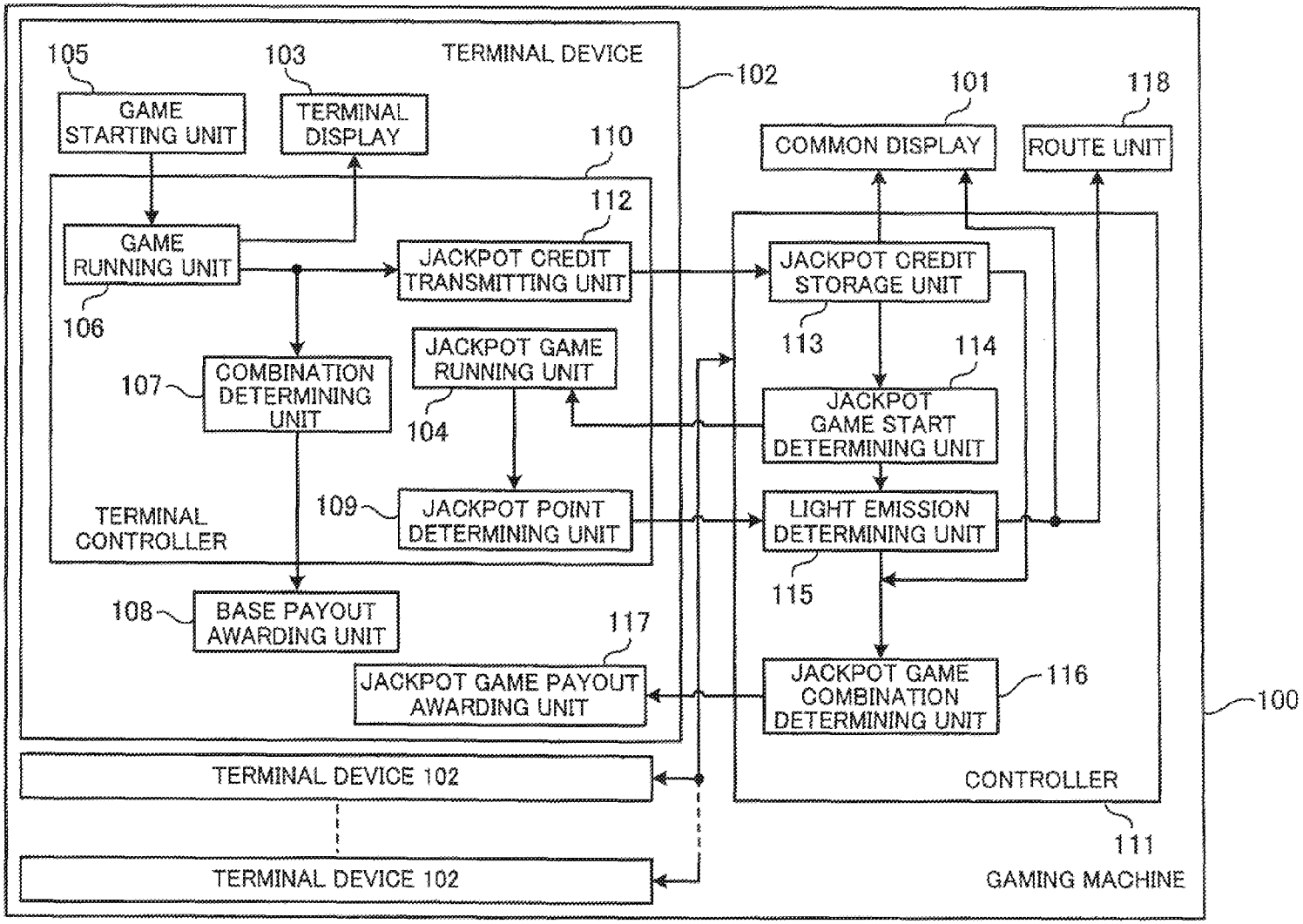
FIG. 2 is a block diagram of a gaming machine.

A gaming machine 100 which runs the above game includes a controller 111, a common display 101, a route unit 118, and two or more terminal devices 102, as shown in FIG. 2. The common display 101 displays thereon an image indicating a value resulting from accumulative calculation of a percentage of an amount bet at each of the terminal devices 102.

The controller 111 has a jackpot credit storage unit 113, a jackpot game start determining unit 114, a light emission determining unit 115, and a jackpot game combination determining unit 116. Each of the terminal devices 102 has a game starting unit 105, a terminal controller 110, a terminal display 103, a base payout awarding unit 108, and a jackpot game payout awarding unit 117.

Further, the terminal controller 110 has a game running unit 106, a jackpot credit transmitting unit 112, a combination determining unit 107, a jackpot game running unit 104, and a jackpot point determining unit 109.

The terminal display 103 may have a mechanical structure adopting a reel device which rotates a reel to arrange symbols 180. Alternatively, the terminal display 103 may have an electrical structure in which a video reel is displayed as an image to arrange symbols 180. Further, a combination of the mechanical structure (reel) and the electric structure (video reel) may also be possible. Examples of the electrical structure include a liquid crystal display device, a CRT (cathode-ray tube), a plasma display device, and the like. A specific structure of the terminal display 103 will be detailed later.

[Controller 111 and Terminal Controller 110]

The controller 111 and the terminal controller 110 are configured to execute: a first process of accumulating a percentage of a game value which is bet in each base game executed at each of the terminal devices; a second process of causing the common display to display an amount of accumulated game values; a third process of every time a predetermined winning is achieved at a terminal device after the amount of accumulated game values reaches a predetermined value, causing a predetermined number of route light emitters to be turned on toward the common display so as to emit light, the predetermined number of route light emitters being disposed on a route corresponding to the terminal device having the predetermined winning and/or on an extension route associated with that route; and a fourth process of when all route light emitters disposed on any one route of the plurality of routes and an extension route associated with that route are turned on to emit light, awarding the accumulated game values to a terminal device corresponding to that route and that extension route on which all the route light emitters emit light. In other words, the controller 111 and the terminal controller 110 include four process stages.

[Operations of Controller 111 and Terminal Controller 110]

A description will be given to operations of the controller 111 and the terminal controller 110 having the above-described structure. First, after a game value is bet, triggered by a game start signal from the game starting unit 105, the game running unit 106 starts to variably display the 20 symbols 180 which have been arranged on the terminal display 103. That is, a base game is executed at each terminal device 102.

When the game running unit 106 executes a base game, the 25 jackpot credit transmitting unit 112 transmits, to the controller 111, a percentage of a game value which has been bet. Then, the jackpot credit storage unit 113 accumulates that percentage of game value transmitted and stores the amount thereof. In short, the terminal controller 110 and the controller 111 execute the first process.

Next, the controller 111 causes the common display 101 to display thereon the amount of accumulated game values which is stored in the jackpot credit storage unit 113. In short, the controller 111 executes the second process.

Next, the jackpot game start determining unit 114 determines whether the amount of accumulated game values stored in the jackpot credit storage unit 113 reaches a predetermined value. When the amount of accumulated game values reaches the predetermined value, the jackpot game start determining unit 114 transmits a jackpot game start signal to the jackpot game running unit 104. Then, triggered by the jackpot game start signal, the jackpot game running unit 104 runs a jackpot game. Next, the jackpot point determining unit 109 determines whether a predetermined winning is achieved at a terminal device 102. When the predetermined winning is achieved, the light emission determining unit 115 turns on, to emit light, a predetermined number of route light emitters disposed on a route corresponding to that terminal device 102 having the predetermined winning and/or on the associated extension route of the common display 101. In short, the terminal controller 110 and the controller 111 execute the third process.

When all the route light emitters are turned on any one route of the routes of the route unit 118 and on the associated extension route of the common display 101, the jackpot game combination determining unit 116 transmits a jackpot game winning signal to a jackpot game payout awarding unit 117 of a terminal device 102 corresponding to the route and the extension route on which all the route light emitters are turned on. Triggered by reception of a jackpot game winning signal, the jackpot game payout awarding unit 117 awards the accumulated game values stored in the jackpot credit storage unit 113. In short, the terminal controller 110 and the controller 111 execute the fourth process.

Each block of the controller 111 and the terminal controller 110 may be formed by hardware or by software as needed.

As seen from the above-described operations, the present invention is the gaming machine 100 including: the plurality of terminal devices 102 each of which executes a base game with a game value being bet and awards a prize according to a predetermined winning; the route unit 118 having the routes each of which is formed by continuously disposing the plurality of route light emitters from a corresponding terminal device 102 out of the terminal devices 102 to the common display 101; the common display 101 having the plurality of common display light emitters arranged in a matrix and the plurality of route light emitters arranged so as to form the plurality of straight lines each acting as an extension route, the common display 101 being attachably/detachably unitized with the route unit 118; and the controller 111 and the terminal controller 110. The present invention is realized as the gaming machine 100 including the steps of: accumulating a percentage of a game value which is bet in each base game executed at each of the terminal devices 102; causing the common display 101 to display an amount of accumulated game values; every time a predetermined winning is achieved at a terminal device 102 after the amount of accumulated game values reaches a predetermined value, causing a predetermined number of route light emitters to be turned on toward the common display 101 so as to emit light, the predetermined number of route light emitters being disposed on a route corresponding to the terminal device 102 having the predetermined winning and/or on an extension route associated with that route; and when all route light emitters disposed on any one route of the routes and an extension route associated with that route are turned on to emit light, awarding the accumulated game values to a terminal device 102 corresponding to that route and that extension route on which all the route light emitters emit light.

In the above structure, the common display 101 of the gaming machine 100 has common display light emitters arranged in a matrix and route light emitter arranged so as to form several straight lines each acting as an extension route. The common display 101 is attachably/detachably unitized with the route unit 118. The route light emitters arranged on the common display 101 and the route light emitters continuously disposed on the route unit 118 are formed of same components. This arrangement enables the common display 101 to display the amount of accumulated game values by using the common display light emitters, and to display the extension routes from the route unit 118 by using the route light emitters. Since the common display 101 is structured so as to be attachable to/detachable from the route unit 118, it is possible to increase the efficiency in assembling the gaming machine 100 at a time of installation.

[Embodiment]

[Mechanical Structure of Slot Machine 1]

The following describes an embodiment (the first embodiment) where the gaming machine 100 having the above-described structure is applied to a slot machine 1 and specifically structured in mechanical, electrical, and operational senses.

The slot machine 1 is placed in a gaming facility or the like. The slot machine 1 performs a unit game by use of a game value. The game value is a coin, a bill, or a value in the form of electronic information. However, the game value in the present invention is not particularly limited. For example, a medal, token, electronic money, a ticket and the like are also possible. Further, the ticket is not particularly limited and may be a barcoded ticket which will be described later, and the like.

Figure 3:
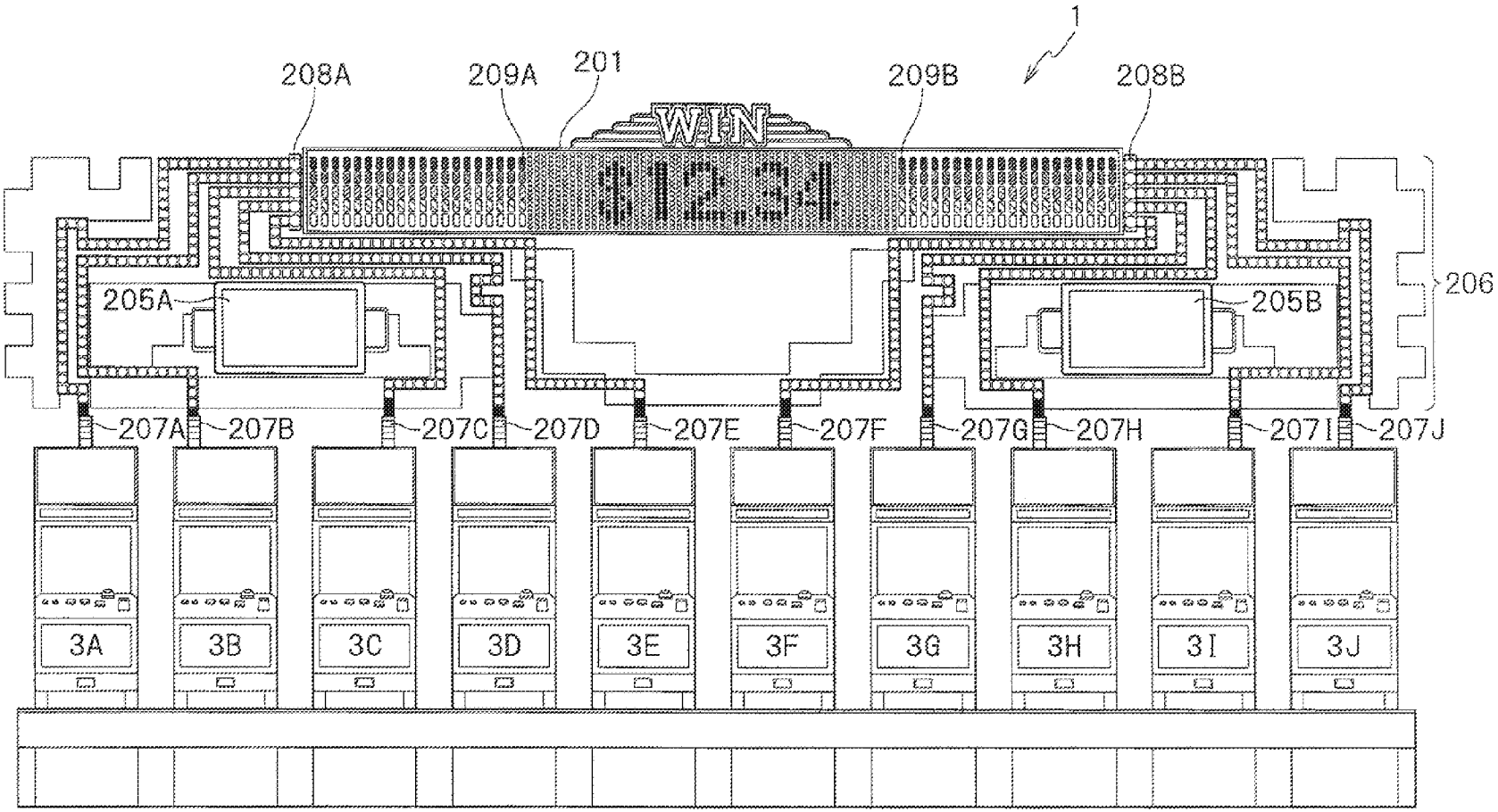
FIG. 3 is a front view showing an external appearance of a slot machine.

The first embodiment will be described with reference to FIG. 3. FIG. 3 is a front view of the slot machine 1 according to the first embodiment of the present invention.

As shown in FIG. 3, the slot machine 1 includes: ten terminal devices 3A to 3J; a shared display 201; two small shared displays 205A and 205B; a central control board 210 (see FIG. 10) provided to the shared display 201; and a route board 206. These components are connected to one another via a network.

On the route board 206, routes 207A to 207J are disposed so as to correspond to the terminal devices 3A to 3J respectively. Each of the routes 207A to 207J includes many LEDs continuously arranged from corresponding one terminal device out of the terminal devices 3A to 3J to the shared display 201. Note that the route board 206 and the routes 207A to 207J correspond to the route unit 118 of FIG. 2.

The LEDs arranged on the route board 206 are constituted by a combination of at least three types of LEDs, including a red-base LED, a green-base LED, and a blue-base LED. This structure can realize color representation using the primary colors of light, which are R(red), G(green) and B(blue).

The routes 207A to 207J are constituted of bending portions respectively. The bending portions are from on and off light lines 208A and 208B provided adjacent to the shared display 201to the terminal devices 3A to 3J, respectively.

In the slot machine 1 according to this embodiment, a percentage of an amount bet at each of the terminal devices 3A to 3J is accumulatively calculated, so that an accumulated value is obtained. An image showing the accumulated value resulting from the accumulative calculation is displayed on the shared display 201. For example, in FIG. 3, "$12.34" is displayed on the shared display 201, which indicates that the accumulated value is "$12.34". When the accumulated value reaches a predetermined value, a jackpot game is run at the terminal devices 3A to 3J for the purpose of obtaining one or more coins equivalent to the accumulated value.

In a jackpot game, the positions corresponding to the respective connection points between the terminal devices 3A to 3J and the routes 207A to 207J are the 0 point positions, and the respective positions where the extension routes intersect with the goal line 209A or 209B are the 50 point positions. For example, when a jackpot game is started, zero or more point is awarded according to the number of jackpot point symbols (described later) (see FIG. 9). Then, the thus awarded point is cumulated, and when the cumulative points reach a predetermined value (50 points), there is awarded coins equivalent to the accumulated value displayed on the shared display 201 (i.e. "$12.34"). Here, the number of cumulative points awarded at each of the terminal devices 3A to 3J is indicated by the number of light-emitting LEDs disposed on a corresponding route out of the routes 207A to 207J plus the number of light-emitting LEDs 275 disposed on the associated extension route of the shared display 201.

Figure 1:
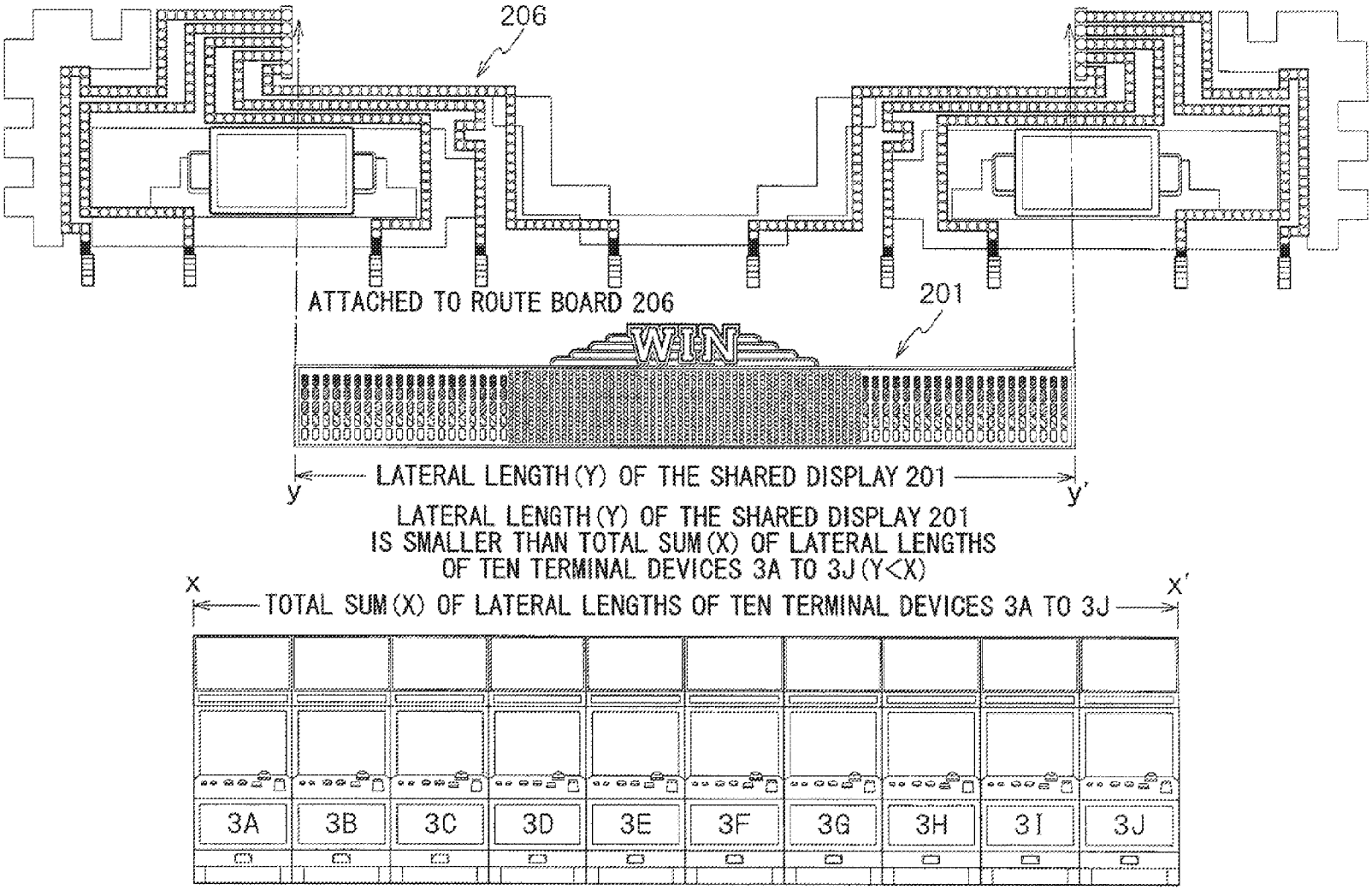
FIG. 1 is an explanatory view showing an external appearance of a shared display.
Figure 4:
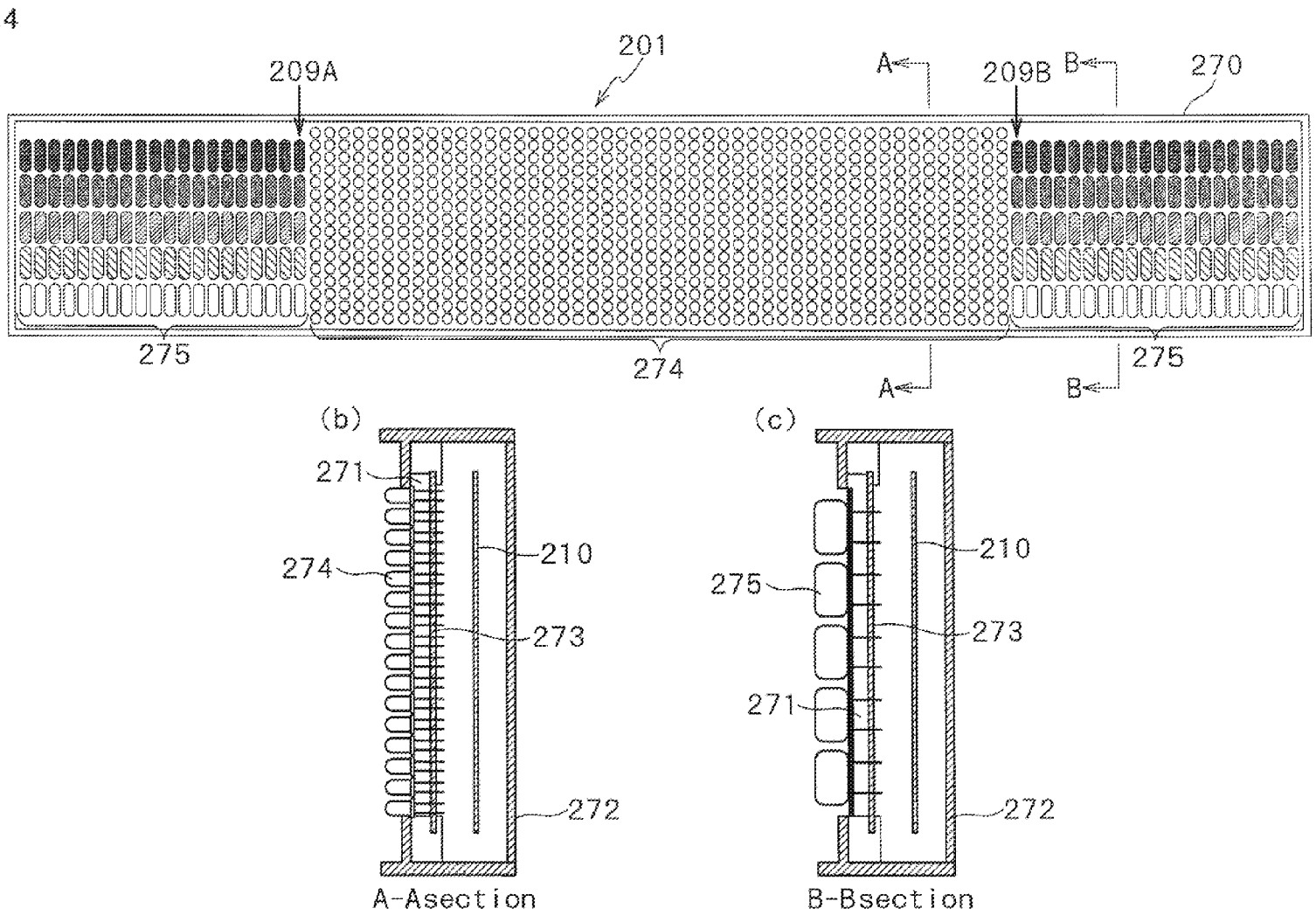
FIGS. 4 (A) to (C) are explanatory views for a shared display.

Next, the shared display 201 will be described with reference to FIGS. 1 and 4. FIG. 1 is an explanatory view showing an external appearance of the shared display 201. FIG. 4 (A) is a front view of the shared display 201, and FIG. 4 (B) is a longitudinal cross sectional view of the shared display 201 taken along A-A of FIG. 4 (A). FIG. 4 (C) is a longitudinal cross sectional view of the shared display 201 taken along B-B of FIG. 4 (A). Note that the shared display 201 corresponds to the common display 101 of FIG. 2.

The outer casing of the shared display 201 is formed of an LED module 270. The LED modules 270 includes, at least, an LED substrate 271, a central control board 210, and a back plate 272. The LED substrate 271 and the central control board 210 are fixed to the LED module 270 by not-shown fixing means. Although not shown, the LED module 270 has, at both ends, terminals being attachably/detachably connectable with routes 207A to 207J respectively.

The LED substrate 271 has LEDs 274 for indicating an accumulated value resulted from the accumulative calculation of a percentage of amount bet at each of the terminal devices 3A to 3J. The LEDs 274 are arrayed on a printed circuit board 273 in a form of dot matrix of 16 rows and 48 columns. Using the LEDs 274 arrayed in the dot matrix of 16 rows and 48 columns, a desired value is displayed. For example, as shown in FIG. 3, a value such as "$12.34" is displayed on the shared display 201 using the LEDs 274. Thus, light emitters used for the shared display 201 are constituted by low-cost, lightweight, long-life LEDs. Accordingly, it is possible to reduce the cost of manufacturing.

The LEDs 274 are constituted by a combination of one or two types of LEDs. Because of this, the number of types of LEDs used as the LEDs 274 is less than the number of types of LEDs arranged on the route board 206 and used as the LEDs 275. That is, the light emitted from the LEDs 274 has low contrast or low brightness than the light emitted from the LEDs arranged on the route board 206 and from the LEDs used for the LEDs 275, so that the light emitted from the LEDs 274 is suitable for low-contrast or low-brightness display. Using light having different degrees of contrast or brightness in accordance with purposes improves the utilization rate of light. In addition, wasteful use of LEDs can be reduced, thereby reducing the cost of manufacturing.

Furthermore, the LED substrate 271 has, on the printed circuit board 273, the LEDs 275 for displaying straight lines, each acting as an extension route, from the goal line 209A to the on and off light line 208A, or the goal line 209B to the on and off light line 208B. The LEDs 275 are arrayed in two dot matrixes of 5 rows and 20 columns so that the dot matrixes are respectively adjacent to both sides of the dot matrix of 16 rows and 48 columns of the LEDs 274. In a jackpot game, the LEDs 275 arrayed in the dot matrixes of 5 rows and 20 columns indicates the number of points obtained at each of the terminal devices 3A to 3J, by emitting light.

Similar to the LEDs arranged on the route board 206, the LEDs 275 are constituted by a combination of at least three kinds of LEDs, including a red-base LED, a green-base LED, and a blue-base LED. This structure can realize color representation using the primary colors of light, which are R(red), G(green) and B(blue).

In addition, the routes 207A to 207J are coupled with the shared display 201 by respectively connecting the terminals of the LED module 270 to the respective terminals of the routes 207A to 207J.

The LED module 270 having the LEDs 274 and the LEDs 275 is attachably/detachably unitized with the routes 207A to 207J.

As described above, the shared display 201 of the slot machine 1 includes the LEDs 274 arranged in a matrix and the LEDs 275 arranged so as to form several straight lines each acting as an extension route. The shared display 201 is attachably/detachably unitized with the routes 207A to 207J. The LEDs 275 arranged on the shared display 201 and the LEDs continuously disposed on the routes 207A to 207J are formed of the same components. This arrangement enables the shared display 201 to display the amount of accumulated game values by using the LEDs 274, and to display the respective extension routes from the routes 207A to 207J by using the LEDs 275. Since the shared display 201 is structured so as to be attachable to/detachable from the routes 207A to 207J, it is possible to increase the efficiency in assembling the slot machine 1 at a time of installation. Also, it is possible to display an effect image by causing the LEDs 274 and the LEDs 275 to emit light in combination. To be more specific, a text such as "WIN" can be displayed on the shared display 201 when a winning is achieved in a jackpot game, by causing the LEDs 274 and the LEDs 275 to emit light in combination.

A gap created on connection faces between the routes 207A to 207J the LED module 270 may result in light leakage or a bad external appearance. Such a gap may be prevented by engagement of a pair of recess and protrusion (not-shown)

provided on each of the two connection faces between the routes 207A to 207J and the LED module 270.

Further, as shown in FIG. 1, the slot machine 1 is configured so that the lateral length Y (y-y') of the shared display 201 is smaller than the total sum X (x-x') of the respective lateral lengths of the terminal devices 3A to 3J (i.e., Y<X).

With this structure, the lateral length of the shared display 201 is kept within a range of the total sum of the respective lateral lengths of the terminal devices 3A to 3J used in the slot machine 1. This is helpful to secure an installation space of the slot machine 1 when the slot machine 1 is installed in a game arcade.

In the meantime, the route board 206 may be omitted from the slot machine 1. That is, the slot machine 1 may be configured to include: the shared display 201 having the LEDs 274 arranged in a matrix and the LEDs 275 arranged so as to form several straight lines; and the terminals devices 3A to 3J. This arrangement enables the shared display 201 to display the amount of accumulated game values by using the LEDs 274, and to display, by using the LEDs 275, the courses to the obtainment of the accumulated game values.

Figure 5:
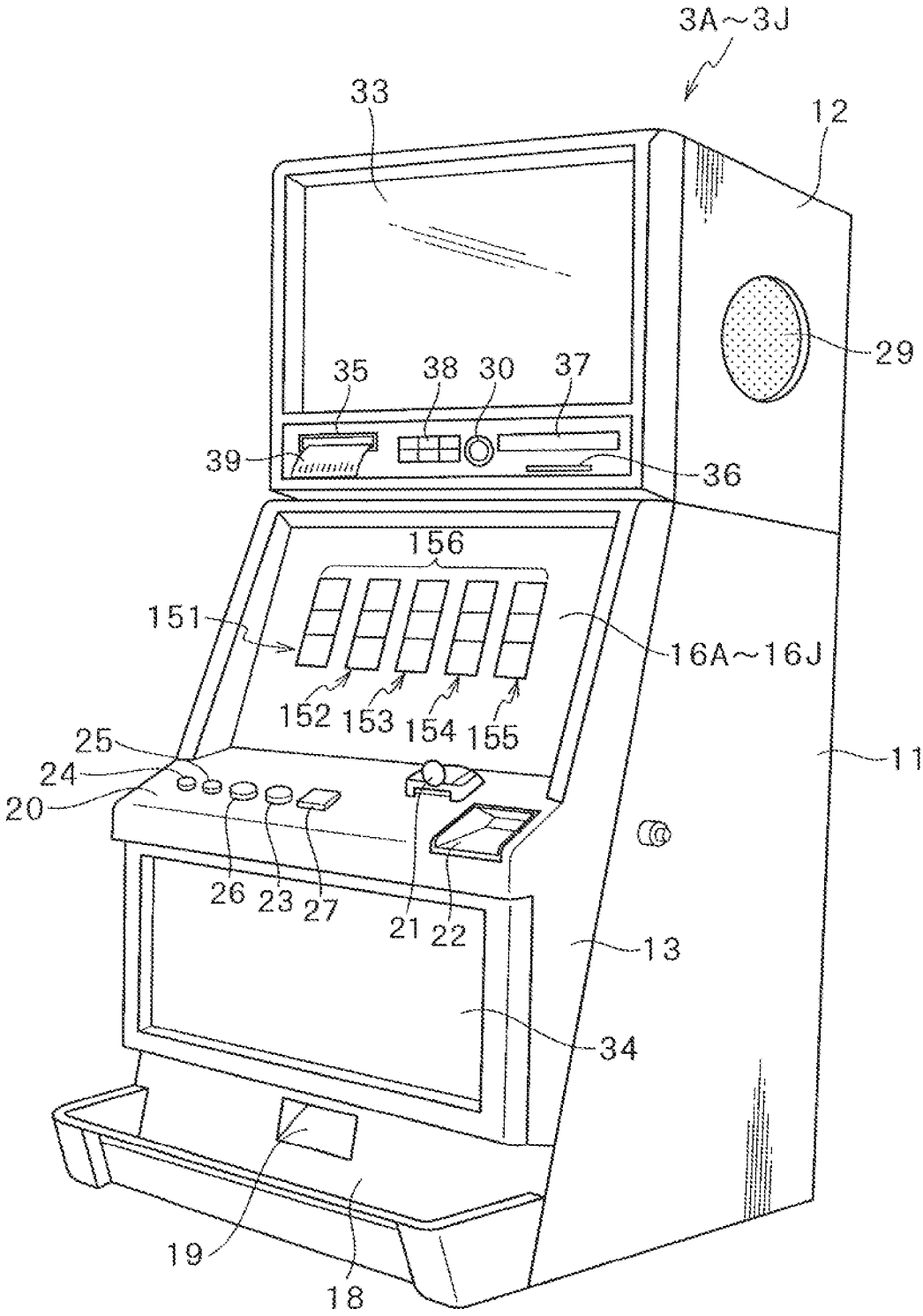
FIG. 5 is a perspective view showing an external appearance of a terminal device.

As shown in FIG. 5, the terminal device (3A to 3J) has a cabinet 11, a top box 12 placed on an upper side of the cabinet 11, and a main door 13 provided on a front surface of the cabinet 11. To the main door 13, a lower image display panel (16A to 16J) is provided. The lower image display panel (16A to 16J) has a transparent liquid crystal panel which displays various information. In addition, the lower image display panel (16A to 16J) displays thereon display windows 151 to 155 (a matrix 156) where more than one symbols 180 are arranged, and displays game-related various information, an effect image, and the like, as needed. Also, the shared display 201 and two small shared displays 201A and 201B have similar structures. Note that the terminal device (3A to 3J) corresponds to the terminal device 102 of FIG. 2. The lower image display panel (16A to 16J) serving as a terminal display corresponds to the terminal display 103 of FIG. 2.

Here, "arranging" means making a state where symbols 180 are visibly identifiable by a player. For example, in FIG. 11, it means making a state where symbols 180 are displayed in the display windows 151 to 155. Arranging symbols 180 again after dismissing symbols 180 is called "rearranging".

This embodiment deals with, as an example, a case where the lower image display panel (16A to 16J) electrically displays symbols 180 to thereby display five columns and three rows of symbols. However, the present invention is not limited thereto. For example, three columns and three rows of symbols, or five columns and five rows of symbols, may be acceptable.

In this example, symbols 180 arranged in the display windows 151 to 155 are scatter symbols. Here, scatter symbols means such symbols that activation occurs (i.e., a payout is awarded, a bonus game is given, or the like) when a predetermined number of them stop in the matrix of arrangement areas made up of the five columns and three rows of the display windows 151 to 155. For example, in a base game where scatter symbols are adopted, a payout is awarded when a predetermined number (e.g., five or more) of scatter symbols are displayed in the display windows 151 to 155 (fifteen arrangement regions). That is, when a predetermined number of scatter symbols are displayed in the display windows 151 to 155, a payout is awarded regardless of display positions or an arrangement way of the scatter symbols.

Note that the lower image display panel (16A to 16J) may have a credit value indicator and a payout value indicator. The credit value indicator displays a total value (hereinafter also referred to as total credit value) which the terminal device (3A to 3J) can pay out to a player. The payout value indicator displays the number of coins to be paid out.

Below the lower image display panel (16A to 16J), provided are a control panel 20, a coin receiving slot 21, and a bill validator 22. The control panel 20 is provided with buttons 23 to 27. These buttons 23 to 27 allow a player to input commands relating to a game progress. The coin receiving slot 21 enables coins to be received into the cabinet 11.

The control panel 20 includes a spin button 23, a change button 24, a cashout button 25, a 1-BET button 26, and a MAX-BET button 27. The spin button 23 is for inputting a command to start scrolling the symbols 180. The change button 24 is used to ask a staff person of the gaming facility for money exchange. The cash out button 25 is for inputting a command to pay out coins corresponding to the total credit-value into a coin tray 18. Note that the control panel 20 corresponds to the game starting unit 105 of FIG. 2, which starts a base game.

The 1-BET button 26 is for inputting a command to bet, on a game, one coin among coins corresponding to the total credit value. The MAX-BET button 27 is for inputting a command to bet, on a game, the maximum number of coins bettable on one game (e.g., fifty coins) among coins corresponding to the total credit value.

The bill validator 22 validates whether a bill is genuine or not and receives the genuine bill into the cabinet 11. Note that the bill validator 22 is capable of reading a barcoded ticket 39 which will be described later. When the bill validator 22 reads the barcoded ticket 39, the bill validator 22 outputs to the main CPU 41 a read signal relating to what has been read.

On a front surface of a lower part of the main door 13, that is, below the control panel 20, a belly glass 34 is provided. On the belly glass 34, a character of the terminal device (3A to 3J), or the like is drawn. On a front surface of the top box 12 is provided an upper image display panel 33. The upper image display panel 33 has a liquid crystal panel, and displays an effect image, an image representing game introduction or game rules, or the like.

Further, the top box 12 has a lamp 30 for presenting an effect, and a speaker 29 for performing an audio output. Below the upper image display panel 33 are provided a ticket printer 35, a card reader 36, a data displayer 37, and a keypad 38. The ticket printer 35 prints, on to a ticket, a barcode which is an encoded form of data such as a credit-value, time and date, identification number of the terminal device (3A to 3J), and the like. As a result, the ticket printer 35 issues a barcoded ticket 39. A player can play a game in another terminal device (3A to 3J) using the barcoded ticket 39, or can exchange the barcoded ticket 39 with a bill or the like at a change booth of the gaming facility.

The card reader 36 reads and writes data from and into a smart card. The smart card is carried by a player, and stores therein data for identifying the player and data relating to a history of games played by the player, for example.

The data displayer 37 includes a fluorescent display or the like, and displays the data read by the card reader 36 and the data input by the player through the keypad 38, for example. The keypad 38 is for entering a command or data relating to issuing of a ticket.

[Electrical Structure of Slot Machine]

Figure 6:
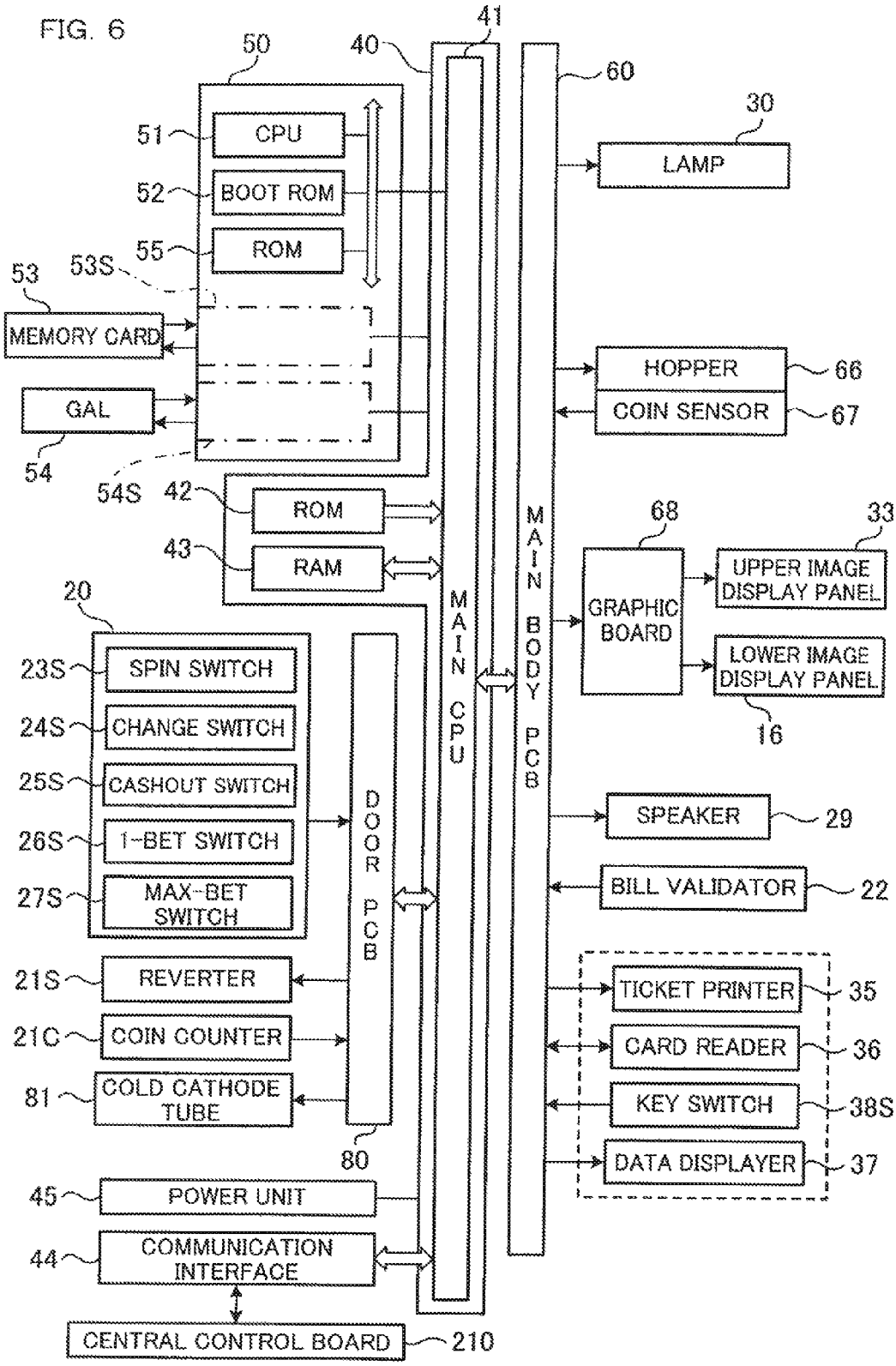
FIG. 6 is a block diagram showing an electrical structure of the terminal device.
Figure 10:
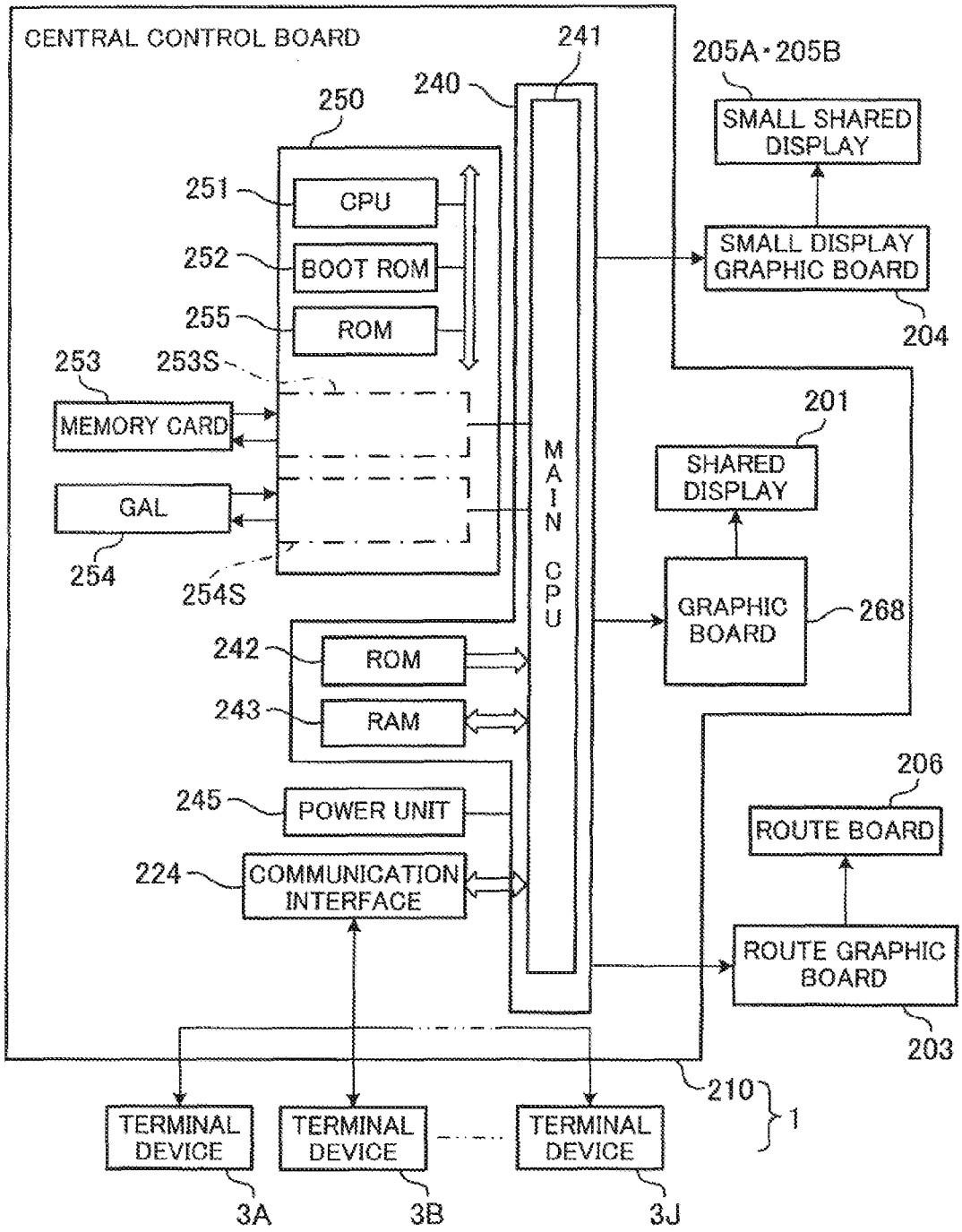
FIG. 10 is a block diagram showing an electrical structure of a central control board.

FIGS. 6 and 10 are block diagrams illustrating an electrical structure of the entire slot machine 1.

[Electrical Structure of Terminal Device]

FIG. 6 is a block diagram showing an electrical structure of the terminal device (3A to 3J). As illustrated in FIG. 6, a control unit is provided within the cabinet 11. As illustrated in FIG. 6, the control unit includes a motherboard 40, a main body PCB (Printed Circuit Board) 60, a gaming board 50, a door PCB 80, various switches, sensors, or the like.

The gaming board 50 has a CPU (Central Processing Unit) 51, a ROM 55, a boot ROM 52, a card slot 53S corresponding to a memory card 53, and an IC socket 54S corresponding to a GAL (Generic Array Logic) 54. The CPU 51, the ROM 55, and the boot ROM 52 are connected to one another through an internal bus.

The memory card 53 stores therein a game program and a game system program. The game program contains a stop symbol determining program. The stop symbol determining program determines symbols (code numbers corresponding to the symbols) to be stopped on the matrix 156.

This stop symbol determining program may contain sets of symbol weighting data respectively corresponding to various payout rates (e.g., 80%, 84%, and 88%). Each set of the symbol weighting data indicates, for each of the display windows 151 to 155, correspondence between a code number of each symbol column (symbol lines A to E) and at least one random number value belonging to a predetermined range. The payout rate is determined based on payout rate setting data output from the GAL 54. Based on a set of the symbol weighting data corresponding to the payout rate determined, symbols to be stopped are determined.

The memory card 53 stores therein various types of data for use in the game program and the game system program. For example, the memory card 53 stores data indicating correspondence between each of symbols 180 displayed in the display windows 151 to 155 and a range of random number values, in the form of a base game winning combination lottery table 130 (see FIG. 7). The memory card 53 also stores payout data which are based on a lottery result obtained from the base game winning combination lottery table 130, in the form of a base game payout table 131 (see FIG. 8). In addition, the memory card 53 stores, in the form of jackpot point table 132 (see FIG. 9), data indicating correspondence between the number of symbols of "SUN" 181 which are displayed in the display windows 151 to 155 in a jackpot game and the number of points to be obtained. These sets of data are transferred to a RAM 43 of the motherboard 40, at the time of running a game.

The card slot 53S is structured so as to allow the memory card 53 to be attached and detached to and from the card slot 53S. This card slot 53S is connected to the motherboard 40 through an IDE bus. Thus, a type and contents of a game run at the terminal device (3A to 3J) can be chanced by detaching the memory card 53 from the card slot 53S, writing a different game program and a different game system program into the memory card 53, and inserting the memory card 53 back into the card slot 53S.

The game program includes a program relating to a game progress. The game program also includes data of images and sounds to be output during a game.

The GAL 54 has input and output ports. When the GAL 54 receives data via the input port, it outputs, from its output port, data corresponding to the input data.

The IC socket 54S is structured so as to allow the GAL 54 to be attached and detached to and from the IC socket 54S. The IC socket 54S is connected to the motherboard 40, via a PCI bus. Thus, data to be output from the GAL 54 can be changed by detaching the GAL 54 from the IC socket 54S, overwriting the program stored in the GAL 54, and then attaching the GAL 54 back to the IC socket 54S.

The CPU 51, the ROM 55, and the boot ROM 52 connected to one another through the internal bus are connected to the motherboard 40 through a PCI bus. The PCI bus communicates signals between the motherboard 40 and the gaming board 50, and supplies power from the motherboard 40 to the gaming board 50. The ROM 55 stores country identification information and an authentication program. The boot ROM 52 stores a preliminary authentication program, a program (boot code) for enabling the CPU 51 to run the preliminary authentication program, and the like.

The authentication program is a program (falsification check program) for authenticating the game program and the game system program. The authentication program is a program for confirming and verifying that the game program and the game system program are not falsified. In other words, the authentication program is described in accordance with a procedure for authenticating the game program and the game system program. The preliminary authentication program is a program for authenticating the authentication program. The preliminary authentication program is described in accordance with a procedure for verifying that the authentication program to be authenticated is not falsified, that is, for authenticating the authentication program.

The motherboard 40 has the main CPU 41, a ROM (Read Only Memory) 42, a RAM (Random Access Memory) 43, and a communication interface 44. Note that the motherboard 40 co-responds to the terminal controller 110 of FIG. 2.

The main CPU 41 has a function of entirely controlling the terminal device (3A to 3J). In particular, the main CPU 41 controls the following operations of: outputting a command signal for making the graphic board 68 variably display symbols 180, at a time when the spin button 23 is pressed after betting of credit; determining symbols 180 to be stopped after the variable-displaying of symbols 180; and stopping the symbols 180 thus determined in the display windows 151 to 155. Note that the main CPU 41 corresponds to the game running unit 106, the combination determining unit 107, the jackpot credit transmitting unit 112, the jackpot game running unit 104, and the jackpot point determining unit 109 of FIG. 2.

In other words, the main CPU 41 serves to control arrangement, by scrolling symbols displayed on the lower image display panel (16A to 16J), then selecting and determining symbols to be rearranged from various kinds of symbols, to rearrange new symbols, and stopping scrolling of the symbols to present the symbols thus determined.

The ROM 42 stores a program such as BIOS (Basic Input/Output System) run by the main CPU 41, and permanently-used data. When the BIOS is run by the main CPU 41, each of peripheral devices is initialized, and the game program and the game system program stored in the memory card 53 are read out through the gaming board 50. The RAM 43 stores data or a program used for the main CPU 41 to perform a process. For example, the base game winning combination lottery table 130, the base game payout table 131, the jackpot point table 132, a game running processing program, and a terminal side jackpot game running processing program are stored in the RAM 43. In addition, a credit value is stored in the RAM 43.

The communication interface 44 communicates with a central control board 210 through a communication line. Further, a main body PCB (Printed Circuit Board) 60 and a door PCB 80 are connected to the motherboard 40, respectively through USBs (Universal Serial Buses) Further, a power unit 45 is connected to the motherboard 40. When the power unit 45 supplies power to the motherboard 40, the main CPU 41 of the motherboard 40 is booted and in addition power is supplied to the gaming board 50 through the PCI bus so that the CPU 51 is booted.

Various devices or units which generate signals to be input to the main CPU 41, and various devices or units whose operations are controlled by signals output from the main CPU 41 are connected to the main body PCB 60 and the door PCB 80. Based on a signal input to the main CPU 41, the main CPU 41 runs the game program and the game system program stored in the RAM 43, to perform an arithmetic process. Then, the main CPU 41 stores a result of the arithmetic process in the RAM 43, or performs a control process on various devices and units by transmitting a control signal to the various devices and units.

A lamp 30, a hopper 66, a coin sensor 67, a graphic board 68, the speaker 29, a bill validator 22, a ticket printer 35, a card reader 36, a key switch 38S, and a data displayer 37 are connected to main body PCB 60.

The lamp 30 is turned on/off based on a control signal output from the main CPU 41.

The hopper 66 is mounted within the cabinet 11 and pays out a predetermined number of coins through a coin outlet 19 into the coin tray 18, based on a control signal output from the main CPU 41. The coin sensor 67 is provided inside the coin outlet 19. When the coin sensor 67 senses that a predetermined number of coins have been delivered from the coin outlet 19, the coin sensor 67 outputs a signal to be input to the main CPU 41. Note that the hopper 66 corresponds to the base payout awarding unit 108 and the jackpot game payout awarding unit 117 of FIG. 2.

The graphic board 68 controls image display on the upper image display panel 33 and the lower image display panel (16A to 16J), based on a control signal from the main CPU 41. Further, the graphic board 68 is provided with a VDP (Video Display Processor) for generating image data based on a control signal output from the main CPU 41, a video RAM for temporarily storing the image data generated by the VDP, and the like. Note that image data used at the time when the VDP generates the image data are included in the game program which has been read out from the memory card 53 and stored into the RAM 43.

The bill validator 22 reads an image on a bill and takes only one recognized to be genuine into the cabinet 11. When taking in a genuine bill, the bill validator 22 outputs, to the main CPU 41, an input signal based on a value of the bill. The main CPU 41 stores into the RAM 43 a credit value equivalent to the value of the bill indicated by the input signal.

Based on a control signal output from the main CPU 41, the ticket printer 35 prints a barcode on a ticket, and outputs it as a barcoded ticket 39. The barcode contains encoded data of the credit value stored in the RAM 43, time and date, an identification number of the terminal device (3A to 3J), and the like.

The card reader 36 reads out data from the smart card and transmits the data to the main CPU 41. Further, the card reader 36 writes data into the smart card based on a control signal output from the main CPU 41. The key switch 38S is mounted to the keypad 38, and outputs a signal to the main CPU 41 in response to a player's operation on the keypad 38. The data displayer 37 displays, based on a control signal output from the main CPU 41, data read by the card reader 36 or data input by the player through the keypad 38.

The door PCB 80 is connected to a control panel 20, a reverter 21S, a coin counter 21C, and a cold cathode tube 81. The control panel 20 is provided with: a spin switch 23S associated with the spin button 23; a change switch 24S associated with the change button 24; a cashout switch 25S associated with the cashout button 25; a 1-BET switch 26S associated with the 1-BET button 26; and a MAX-BET switch 27S associated with the MAX-BET button 27. Each of the switches 23S to 27S outputs a signal to the main CPU 41, when a player presses the associated button.

The coin counter 21C is provided within the coin receiving slot 21, and identifies whether a coin inserted into the coin receiving slot 21 by the player is genuine. A coin other than a genuine coin is discharged from the coin outlet. 19. The coin counter 21C outputs an input signal to the main CPU 41 upon detection of a genuine coin.

The reverter 21S is operated based on a control signal output from the main CPU 41. The reverter 21S distributes a coin, which the coin counter 21C has recognized as a genuine coin, to the hopper 66 or a cash box (not shown) mounted in the terminal device (3A to 3J) In other words, when the hopper 66 is full of coins, a genuine coin is distributed into the cash box by the reverter 21S. On the other hand, when the hopper 66 is not yet full of coins, a genuine coin is distributed into the hopper 66. The cold cathode tube 81 functions as a backlight mounted to the rear side of the lower image display panel (16A to 16J) and the rear side of the upper image display panel 33. The cold cathode tube 81 turns on based on a control signal output from the main CPU 41.

[Base Game Winning Combination Lottery Table]

A base game winning combination lottery table 130 which is used in a game running process executed at the terminal device (3A to 3J) will be described with reference to FIG. 7. FIG. 7 is an explanatory view showing a base game winning combination lottery table. The base game winning combination lottery table 130 is stored in the RAM 43, and read during a symbol determining process of the game running process which will be described later.

As shown in FIG. 7, random number values used in the base game winning combination lottery table 130 range from 0 to 5998. When a random number value sampled by the main CPU 41 is 0 to 29, a winning combination of "SUN" 181 is made. Then, five symbols 180 of "SUN" 181 are stopped in the display windows 151 to 155. When a random number value sampled by the main CPU 41 is 30 to 51, a winning combination of "HEART" 182 is made. Then, five symbols 180 of "HEART" 182 are stopped in the display windows 151 to 155. When a random number value sampled by the main CPU 41 is 52 to 107, a winning combination of "MOON" 183 is made. Then, five symbols 180 of "MOON" 183 are stopped in the display windows 151 to 155. Likewise, when a random number value is 108 to 207, a winning a combination of "K" 186 is made. When a random number value is 208 to 407, a winning combination of "A" 184 is made. When a random number value is 408 to 807, a winning combination of "Q" 187 is made. When a random number value is 808 to 1477, a winning combination of "J" 185 is made. When a random number value is 1478 to 1807, a winning combination of "10" 188 is made. When a random number value sampled by the main CPU 41 is 1808 to 5998, it means a loss, and a losing combination of symbols 180, which is different from any of the above-mentioned winning combinations, is stopped in the display windows 151 to 155. Here, making any of these winning combinations means that a winning combination is achieved.

[Base Game Payout Table]

Next, a base game payout table 131 will be described with reference to FIG. 8. The base game payout table 131 indicates the number of coins to be paid out for a winning combination determined using the base game winning combination lottery table 130 shown in FIG. 7. FIG. 8 shows a base game payout table. The base game payout table 131 is stored in the RAM 43, and is read during a base game payout process of the game running process which will be described later.

For a result of sampling using the base game winning combination lottery table 130, zero or more coins are paid out in accordance with a winning combination displayed in the display windows 151 to 155 based on the base game payout table 131.

More specifically, when five symbols 130 of "SUN" 181 are stopped in the display windows 151 to 155, seventy coins are paid out. When five symbols 180 of "HEART" 182 are stopped in the display windows 151 to 155, fifty coins are paid out. When five symbols 180 of "MOON" 183 are stopped in the display windows 151 to 155, thirty coins are paid out as a payout. Likewise, when five symbols 180 of "K" 186 are stopped in the display windows 151 to 155, twenty-five coins are paid out as a payout. When five symbols 180 of "A" 184 are stopped in the display windows 151 to 155, twenty coins are paid out as a payout. When five symbols 180 of "Q" 187 are stopped in the display windows 151 to 155, fifteen coins are paid out as a payout. When five symbols 180 of "J" 185 are stopped in the display windows 151 to 155, ten coins are paid out as a payout. When five symbols 180 of "10" 188 are stopped in the display windows 151 to 155, five coins are paid out as a payout. When a lottery results in losing, and a losing combination of symbols 180, which is different from any of the above-mentioned winning combinations, is stopped in the display windows 151 to 155, zero coin is paid out as a payout. Note that, when one coin is inserted for a game, the above-mentioned number of coins are paid out as a payout. When two or more coins are inserted for one game, the number of coins actually paid out is calculated by multiplying the number of inserted coins by each of the above-mentioned numbers of coins paid out.

[Jackpot Point Table]

With reference to FIG. 9, the following describes a jackpot point table 132 which is referred to in a jackpot game. The jackpot point table 132 is a table showing the number of points to be awarded to a player, at a time of execution of a jackpot game, in accordance with the number of jackpot point symbols ("SUN" 181) displayed in the display windows 151 to 155. FIG. 9 shows the jackpot point table. In the meantime, the total number of points awarded to each of the terminal devices 3A to 3J is indicated by the number of light-emitting LEDs disposed on a corresponding route out of the routes 207A to 207J and the associated extension route formed of LEDs 275.

Specifically, when the total number of jackpot point symbols ("SUN" 181) displayed in the display windows 151 to 155 at a time of execution of a jackpot game is zero, zero point is obtained. When the total number of jackpot point symbols ("SUN" 181) is one, one point is obtained. When the total number of jackpot point symbols ("SUN" 181) is two, two points are obtained. When the total number of jackpot point symbols ("SUN" 181) is three, three points are obtained. When the total number of jackpot point symbols ("SUN" 181) is four, four points are obtained. When the total number of jackpot point symbols ("SUN" 181) is five, five points are obtained. When the total number of jackpot point symbols ("SUN" 181) is six, six points are obtained. When the total number of jackpot point symbols ("SUN" 181) is seven, seven points are obtained. When the total number of jackpot point symbols ("SUN" 181) is eight, eight points are obtained. When the total number of jackpot point symbols ("SUN" 181) is nine, nine points are obtained.

[Electrical Structure of Central Control Board]

FIG. 10 is a block diagram showing an electrical structure of the central control board 210. A control unit is provided within the central control board 210. As shown in FIG. 10, the control unit includes a motherboard 240, a gaming board 250, an actuator, and the like. The central control board 210 functioning as a controller corresponds to the controller 111 of FIG. 2.

The gaming board 250 has a CPU (Central Processing Unit) 251, a ROM 255, a boot ROM 252, a card slot 253S corresponding to a memory card 253, and an IC socket 254S corresponding to a GAL (Generic Array Logic) 254. The CPU 251, the ROM 255, and the boot ROM 252 are connected to one another through an internal bus. In other words, the gaming board 250 has the same structure and the same functions as those of the gaming board 50.

The motherboard 240 includes: a main CPU 241, a ROM (Read Only Memory) 242, a RAM (Random Access Memory) 243, a power unit 245, a graphic board 268, a shared display 201 connected to the graphic board 268, a route graphic board 203, a route board 206 connected to the route graphic board 203, a small display graphic board 204, the small shared displays 205A and 205B each connected to the small display graphic board 204, and a communication interface 224. The RAM 243 stores therein a center side jackpot game running processing program. The RAM 243 also stores therein an accumulated value resulting from accumulative calculation of a percentage of an amount bet at the terminal device (3A to 3J) (jackpot credit information) Note that the RAM 243 corresponds to the jackpot credit storage unit 113 of FIG. 2.

The shared display 201 displays thereon an image indicating an accumulated value resulting from accumulative calculation of a percentage of an amount bet at each of the terminal devices 3A to 3J. For example, as shown in FIG. 3, "$12.34" is displayed on the shared display 201, which indicates that the accumulated value is "$12.34". When the accumulated value reaches a predetermined value, a jackpot game is run at each of the terminal devices 3A to 3J, for the purpose of obtaining coins corresponding to the accumulated value. In addition, the shared display 201 is capable of displaying thereon various information relating to a game, an effect image, or the like, when needed.

The main CPU 241 controls the entire central control board 210. Particularly, when a jackpot game is executed, the main CPU 241 controls, through the route graphic board 203, operations of turning on and turning off of IEDs provided on each of the routes 207A to 207J disposed on the route board 206. Note that, the main CPU 241 corresponds to the jackpot game start determining unit 114, the light emission determining unit 115, and the jackpot game combination determining unit 116 of FIG. 2.

The communication interface 224 communicates with the communication interfaces 44 of the terminal devices 3A to 3J through communication lines.

The graphic board 268 controls operations of turning on and turning off of the LEDs 274 and the LEDs 275 disposed on the shared display 201, based on a control signal output from the main CPU 241. The small display graphic board 204 controls image displaying on the small shared displays 205A and 205B based on a control signal output from the main CPU 241.

Based on a control signal output from the main CPU 241, the route graphic board 203 controls operations of turning on and turning off of LEDs arranged on each of the routes 207A to 207J disposed on the route board 206.

[Display State of Display Windows 151 to 155 of Terminal Device]

Figure 11:
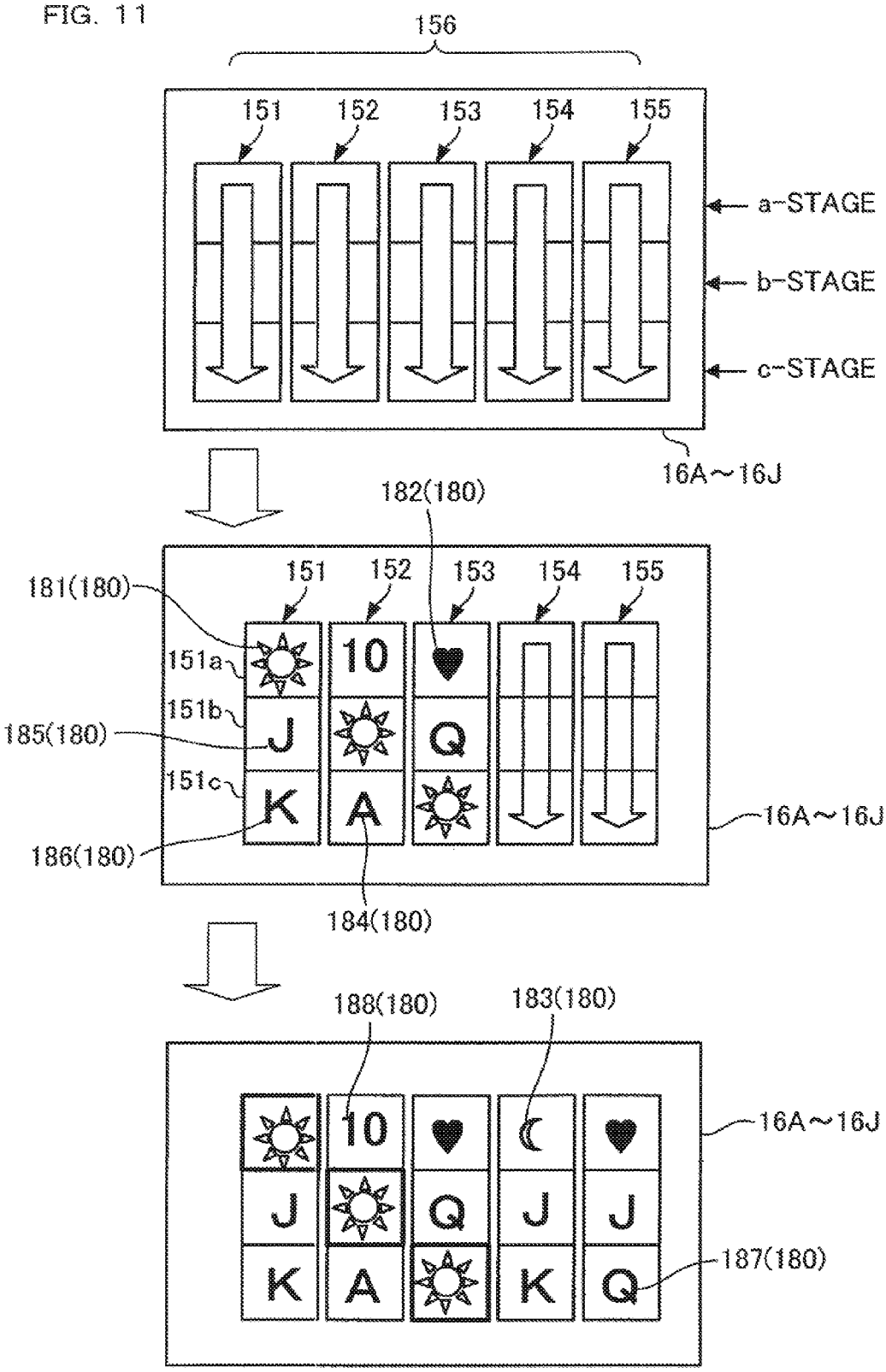
FIG. 11 is an explanatory view for a display screen.

The following details an exemplary display state of the lower image display panel (16A to 16J) of the terminal device (3A to 3J) during operation processes of the slot machine 1. Note that the following example deals with a case where symbols 180 are arranged in the display windows 151 to 155 by means of a video reel method, as shown in FIG. 11.

The lower image display panel (16A to 16J) has display windows 151 to 155 where symbols 180 are arranged. The display windows 151 to 155 are disposed at a center part of the lower image display panel (16A to 16J). In the display windows 151 to 155, symbol columns (symbol lines A to E: see FIG. 12) each made up of symbols 180 are scroll-displayed (see FIG. 11). The display windows 151 to 155 are respectively divided into a-stages 151*a* to 155*a*, b-stages 151*b* to 155*b*, and c-stages 151*c* to 155*c*. The symbols 180 are stopped (arranged) in the stages 151*a* to 155*a*, 151*b* to 155*b*, and 151*c* to 155*c*, respectively. For example, in FIG. 11, a symbol of "SUN" 181 is stopped in 151*a* which is a-stage of the display window 151, a symbol of "J" 185 is stopped in 151*b* which is b-stage of the display window 151, and a symbol of "SUN" 181 is stopped in 153*c* which is c-stage of the display window 153. In short, the display windows 151 to 155 displays a matrix 156 as arrangement regions made up of five columns and three rows. The matrix 156 however is not limited to the matrix of five columns and three rows.

In a base game, a payout awarding process.3 such as paying out coins is executed when a predetermined number of symbols 181 to 188 called scatter symbols are displayed on the lower image display panel (16A to 16J) as a winning combination. Scatter symbols are symbols which provide an effective result (such as awarding a payout, giving a bonus game, or the like) merely when a predetermined number of them are stopped on any of the display areas of the arrangement regions made up of five columns and three rows of the display windows 151 to 155. For example, when five symbols of "J" 185, which is one of the scatter symbols shown in FIG. 11, are rearranged (displayed) in the display windows 151 to 155, ten coins are paid out as a payout. When five symbols of "HEART" 182, which is one of the scatter symbols, are rearranged (displayed) in the display windows 151 to 155, fifty coins are paid out as a payout.

Although in this embodiment the symbols 181 to 188 are defined as scatter symbols, this is not limitative and only a specific symbol may be defined as a scatter symbol. Alternatively, a player may select a scatter symbol. It may also be possible that a coin payout process or the like is executed when a predetermined combination of symbols is stopped on a payline L extending horizontally through the b-stages (151*b* to 155*b*) of the display windows 151 to 155. That is, the payline L is for determining a combination of symbols 180. When symbols 180 are rearranged on the payline L and outside the payline L, only the symbols 180 rearranged on the payline are judged for a combination. It may be possible that, when a winning combination is achieved as a result of the determination of a combination, a coin payout process or the like is executed according to the winning combination.

[Symbol Column, etc.]

Symbols 180 displayed in the display windows 151 to 155 of the lower image display panel (16A to 16J) of the terminal device (3A to 3J) form five symbol columns (symbol lines A to E) each including twenty-two symbols, as shown in FIG. 12. To each of the symbols 180 constituting each column is given one of code numbers 00 to 21. Each of the symbol columns has a combination of picture symbols of "SUN" 181, "HEART" 182, and "MOON" 183, and letter symbols of "A" 184, "J" 185, "K" 186, "Q" 187, and "10" 188.

Three successive symbols in the symbol columns are displayed (arranged) in the upper stages 151*a*, 152*a*, 153*a*, 154*a*, 155*a*, the center stages 151*b*, 152*b*, 153*b*, 154*b*, 155*b* and the lower stages 151*c*, 152*c*, 153*c*, 154*c*, 155*c* of the display windows 151 to 155, respectively, to form a matrix of five columns and three rows in the display windows 151 to 155. When the 1-BET button 26 or the MAX-BET button 27 is pushed and then the spin button 23 is pushed to start a game, the symbols 180 forming the matrix are started to scroll. When the symbols 180 are scrolled for a predetermined period of time, the scroll of the symbols 180 is stopped (rearranged).

The symbols 181 to 188 are set as scatter symbols. Scatter symbols are such symbols that a player is put into an advantageous position when a predetermined number or more of them are displayed in the display windows 151 to 155. The advantageous position is a state where coins corresponding to the scatter symbols are paid out, a state where the number of coins to be paid out is added to a credit value, or the like.

For example, when five or more symbols of "MOON" 183 are stopped in the display windows 151 to 155, thirty coins (game value) per bet are paid out.

In this embodiment, a game value is paid out when a predetermined number of predetermined symbols are stopped in the display windows 151 to 155. However, a bonus game may be given instead. The bonus game is a gaming state which is more advantageous than a basic game. For example, the bonus game is a free game. The free game is a game allowing a player to play a game a predetermined number of times without betting a coin. No particular limitation is put on the bonus game,. as long as it is a gaming state advantageous to the player, that is, it is more advantageous than the basic game. For example, the bonus game may include a state where more game value are obtainable than in the basic game, a state where a game value is obtainable with higher probability than in the basic game, a state where a game value is less consumed than in the basic game, and the like. Specifically, a free game, a second game, a feature game, and the like may be mentioned as examples of the bonus game.

In a jackpot game, a symbol of "SUN" 181 is a jackpot point symbol. When a predetermined number of symbols of "SUN" 181 are displayed in the display windows 151 to 155, a player can obtain one or more points in accordance with the number of jackpot point symbols of "SUN" 181 displayed in the display windows 151 to 155 (see FIG. 9).

[Operation of Slot Machine]

Next, various processes executed in the slot machine 1 will be described. As the main CPU 41 and the main CPU 241 read out and execute programs stored in the ROM 42, the RAM 43, the ROM 242, and the RAM 243, processes relating to various games are run.

[Operation of Slot Machine: Boot Process]

The following describes a boot process which takes place in the slot machine 1. Upon powering on the slot machine 1, a boot processing routine shown in FIG. 13 starts in the motherboard 240 and the gaming board 250 in the central control board 210, and in the motherboard 40 and the gaming board 50 in the terminal device (3A to 3J). The memory cards 53 and 253 are assumed to be inserted into the card slots 53S and 253S of the gaming boards 50 and 250, respectively. Further, the GALs 54 and 254 are assumed to be attached to the IC sockets 54S and 254S, respectively.

First, turning on the power switch of (powering on) the power units 45 and 245 boots the motherboards 40 and 240, and the gaming boards 50 and 250. Booting the motherboards 40 and 240 and the gaming boards 50 and 250 starts separate processes in parallel. Specifically, in the gaming board 50 and 250, the CPUs 51 and 251 read out preliminary authentication programs stored in the boot ROMs 52 and 252, respectively. Then, preliminary authentication is performed according to the read out programs so as to confirm and authenticate that no modification is made to authentication programs, before reading them into the motherboards 40 and 240, respectively (S1). Meanwhile, the main CPUs 41 and 241 of the motherboards 40 and 240 run BIOS stored in the ROMs 42 and 242 to load into the RAMs 43 and 243 compressed data built in the BIOS, respectively (S2). Then, the main CPUs 41 and 241 run a procedure of the BIOS according to the data loaded into the RAMs 43 and 243 so as to diagnose and initialize various peripheral devices (S3).

The main CPUs 41 and 241, which are respectively connected to the ROMs 55 and 255 of the gaming boards 50 and 250 via PCI buses, read out authentication programs stored in the ROMs 55 and 255 and store them into the RAMs 43 and 243 (S4). During this step, the main CPUs 41 and 241 each derives a checksum through ADDSUM method (a standard check function) which is adopted in a standard BIOS, and store the authentication programs into the RAMs 43 and 243 while confirming if the operation of storing is carried out without an error.

Next, the main CPUs 41 and 241 each checks what connects to the IDE bus. Then, the main CPUs 41 and 241 access, via the IDE buses, to the memory cards 53 and 253 inserted into the card slots 53S and 253S, and read out game programs and game system programs from the memory cards 53 and 253, respectively. In this case, the CPUs 41 and 241 each reads out four bytes of data constituting the game program and the game system program at one time. Next, in accordance with the authentication programs stored in the RAMs 43 and 243, the CPUs 41 and 241 authenticate the game programs and the game system programs read out to confirm and prove that these programs are not modified (S5).

When the authentication process properly ends, the main CPUs 41 and 241 write and store the authenticated game programs and game system programs into RAMs 43 and 243 (S6).

Next, the main CPUs 41 and 241 access, via the PCI buses, to the GALs 54 and 254 attached to the IC sockets 54S and 254S, and read out data from the GALs 54 and 254, respectively. The data read out is then written and stored in the RAMs 43 and 243 (S7).

Next, the main CPUs 41 and 241 read out, via the PCI buses, country identification information stored in the ROMs 55 and 255 of the gaming boards 50 and 250, respectively. The country identification information read out is then written and stored in the RAMs 43 and 243 (S8).

Figure 14:
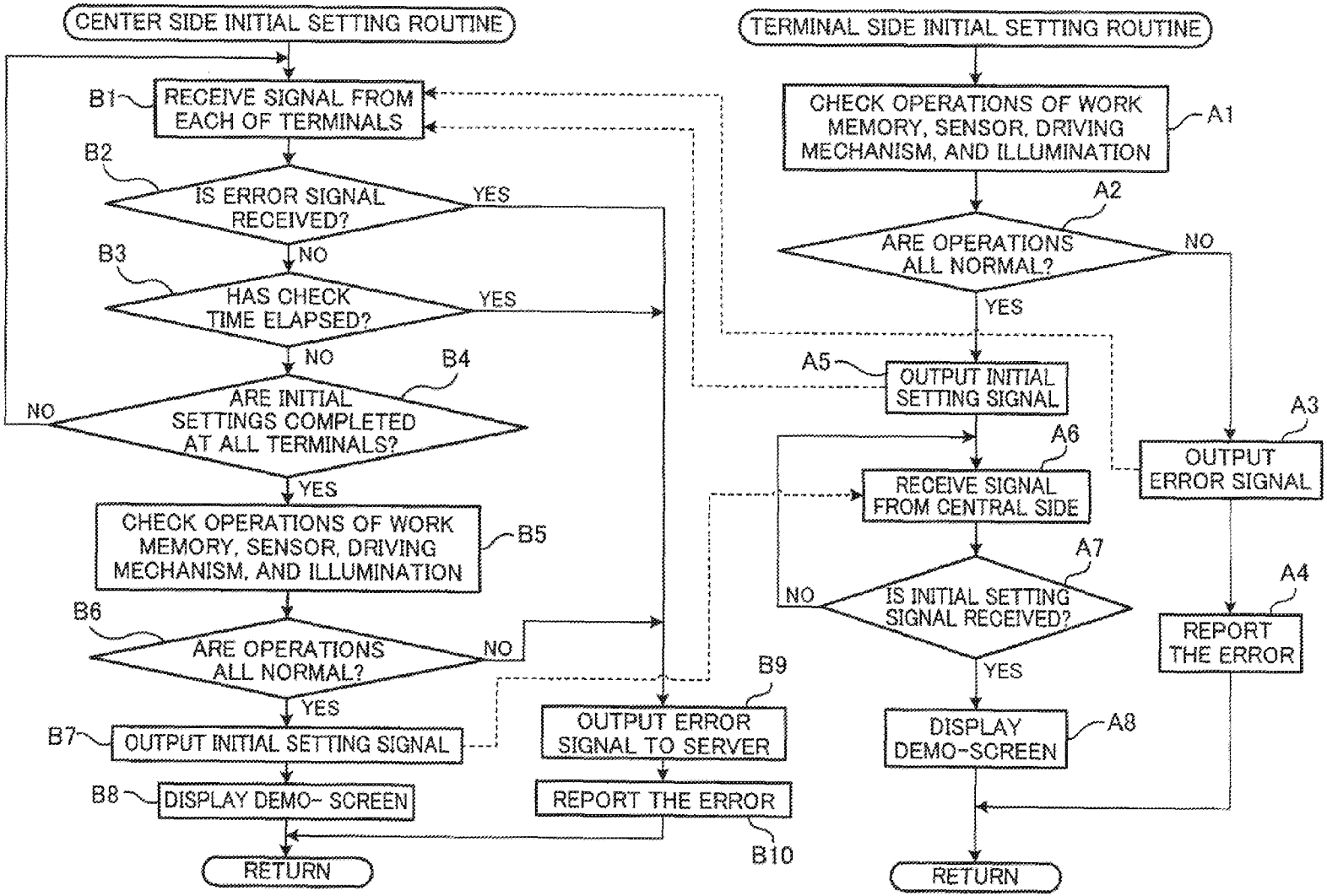
FIG. 14 is a flowchart of an initial process executed in the slot machine.

After this, the main CPUs 41 and 241 each performs an initial process shown in FIG. 14.

[Operation of Slot Machine: Initial Process]

Figure 13:
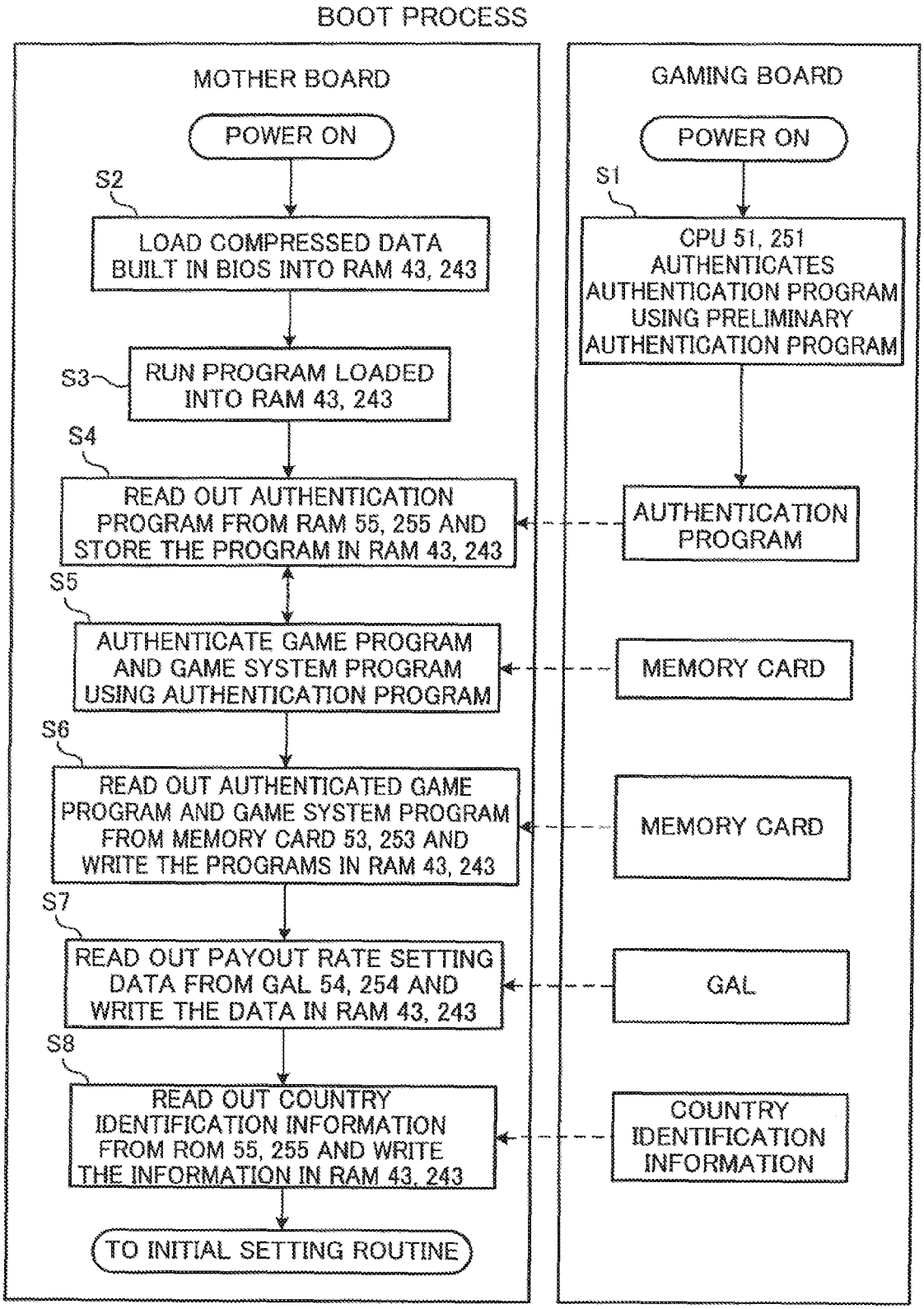
FIG. 13 is a flowchart of a boot process executed in the slot machine.

The following describes an initial process which takes place in the slot machine 1. When the boot process of FIG. 13 is completed, the central control board 210 reads out from the RAM 243 a center side initial setting routine illustrated in FIG. 14 and executes the routine. Meanwhile, after the boot process shown in FIG. 13 is completed, the terminal device (3A to 3J) reads out from the RAM 43 a terminal side initial setting routine illustrated in FIG. 14 and executes the routine. The center side and terminal side initial setting routines are executed in parallel.

First, the main CPU 41 of the terminal device (3A to 3J) checks operations of work memories such as the RAM 43, various sensors, various driving mechanisms, and various decorative illuminations (A1). Then, the main CPU 41 determines if all the check results are normal (A2). When the main CPU 41 determines that the check results are not all normal (A2: NO) the main CPU 41 outputs an error signal to the central control board 210 (A3), reports the error in the form of illuminating the lamp 30 or the like (A4), and then ends the routine.

On the other hand, in A2, when the main CPU 41 determines that all the check results are normal (A2: YES), an initial setting signal is output to the central control board 210 (A5). Then, an initial setting signal is waited from the central control board 210 (A6, A7: NO).

The main CPU 241 of the central control board 210 receives a signal from each of the terminals (B1). Then, the main CPU 241 determines whether a signal received is an error signal (B2) When the main CPU 241 determines that the signal is an error signal (B2:YES), the main CPU 241 outputs an error signal to a management server such as a not-shown host computer (B9) to report the error (B10), and ends the routine.

On the other hand, in B2, when the main CPU 241 determines that the signal is not an error signal (B2: NO), the main CPU 241 determines whether a predetermined time check time) has elapsed from the time of powering on (B3). When the main CPU 241 determines that the check time has elapsed (B3: YES), the step B9 is executed. On the other hand, when the main CPU 241 determines that the check time has not yet elapsed (B3: NO), the main CPU 241 determines whether initial setting signals are received from all of the terminal devices 3A to 3J (B4). When the main CPU 241 determines that initial setting signals are not received from all the terminal devices 3A to 3J (B4: NO), the process returns to the step B1. On the other hand, when it is determined that initial setting signals are received from all the terminal devices 3A to 3J (B4: YES), the main CPU 241 checks operations of work memories such as RAM 243 or the like, various sensors, various driving mechanisms, and various decorative illuminations (B5). Then, the main CPU 241 determines whether all the check results are normal (B6). When the main CPU 241 determines the check results contains an error (B6: NO), the main CPU 241 executes the step B9.

On the other hand, in the step B6, when the main CPU 241 determines that all the check results are normal (B6:YES), the main CPU 241 outputs an initial setting signal to all the terminal devices 3A to 3J (B7), and causes the shared display 201 to display a demo-screen (B8). Then, the main CPU 241 ends this routine.

In the step A7, the main CPU 41 of each of the terminal devices 3A to 3J determines that an initial setting signal is received from the central control board 210 (A7: YES), and causes the upper image display panel 33 to display a demo-screen (A8). The main CPU 41 then ends the routine.

[Operation of Slot Machine: Game Running Process]

Figure 15:
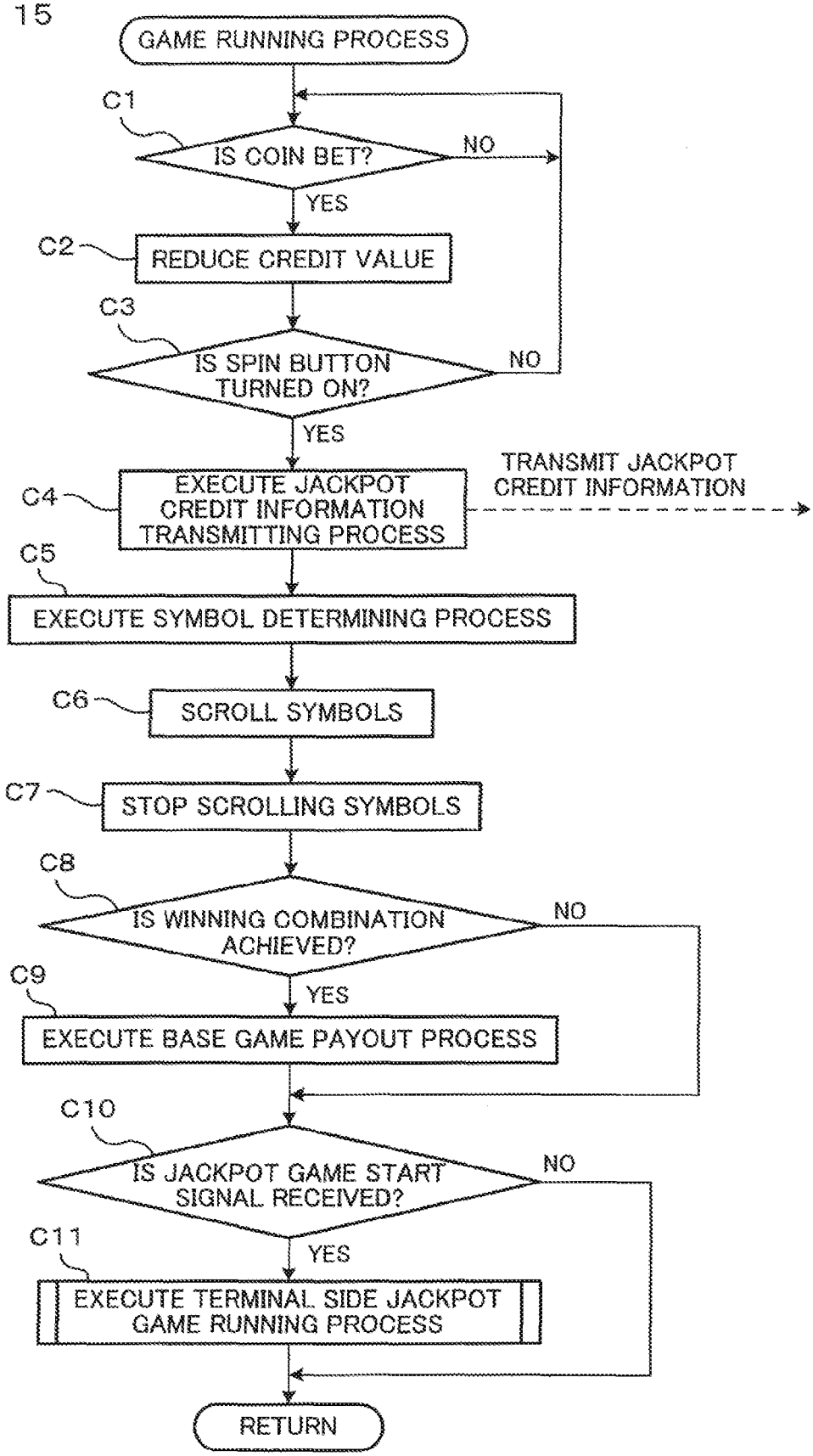
FIG. 15 is a flowchart of a game running process executed in the terminal device.

After the terminal side initial setting routine of FIG. 14 is completed, the main CPU 41 of each of the terminal devices 3A to 3J reads out and executes the game program and the game system program sequentially, thereby executing a game running process shown in FIG. 15. A game running processing program is stored in the RAM 43.

The main CPU 41 of each of the terminal devices 3A to 3J executes the game running process shown in FIG. 15. When the game running process is run, first, the main CPU 41 determines whether a coin is bet or not (C1). In this step, whether an input signal from the 1-BET switch 26S entered by pressing of the 1-BET button 26 is received or not is determined. Meanwhile, whether an input signal from the MAX-BET switch 27S entered by pressing of the MAX-BET button 27 is received or not is determined. When no coin is bet (C1: NO), C1 is repeated so that a standby state continues until a coin is bet.

On the other hand, when it is determined that a coin is bet (C1: YES), the credit value stored in the RAM 43 is reduced according to the number of coins bet (C2). When the number of coins bet surpasses the number of coins equivalent to the credit value stored in the RAM 43, the credit value is reduced to zero and the step C3 is performed. When the number of coins bet exceeds the maximum number of coins bettable on one game (50 pieces in this embodiment), the credit value is reduced by fifty and the step C3 is performed.

Then, whether a spin button 23 is turned on or not is determined (C3). When the spin button 23 is not turned on (C3: NO), the process returns to C1. Here, if the spin button 23 is not turned on (for example, the spin button 23 is not turned on but a command to end the game is input), the reduction of the credit value in the step C2 is canceled.

On the other hand, when it is determined that the spin button 23 is turned on (C3: YES), executed is a jackpot credit information transmitting process (C4). In other words, the main CPU 41 transmits, to the central control board 210, a percentage (5% in this embodiment) of one or more coins bet in the step C1, as jackpot credit information.

Then, a symbol determining process is executed (C5) In other words, a stop symbol determining program is executed based on the base game winning combination lottery table 130 stored in the RAM 43, to determine fifteen symbols 180 to be stopped in the display windows 151 to 155.

Then, symbols 180 in the symbol columns (symbol lines A to E) in the display windows 151 to 155 are scrolled (C6). When a predetermined period of time (base time) has elapsed after the scroll of the symbols 180 is started, the symbols 180 determined in the step C5 are stopped (rearranged) in the display windows 151 to 155 (C7).

Then, whether a winning combination is achieved or not, that is, whether a combination of symbols 180 stopped in the display windows 151 to 155 corresponds to a winning combination listed in the base game payout table 131 or not, is determined (C8). When it is determined that a winning combination is not achieved (C8: NO), the process proceeds to the step C10. On the other hand, when it is determined that a winning combination is achieved (C8: YES), a base game payout process is executed (C9). More specifically, the number of coins to be paid out which corresponds to the kind of the winning combination is calculated based on the base game payout table 131 shown in FIG. 8. When coins to be paid out are reserved, a credit value equivalent to the coins to be paid out is added to the credit value stored in the RAM 43. When the coins are paid out, a control signal is transmitted to the hopper 66 so that a predetermined number of coins are paid out to the coin tray 18. That is, a base payout is awarded in accordance with the winning combination.

Then, it is determined whether a jackpot game start signal which is transmitted in a later-mentioned center side jackpot game running process is received or not (C10). When the jackpot game start signal is not received (C10: NO), this process ends. On the other hand, when the jackpot game start signal is received (C10: YES), a later-mentioned terminal side jackpot game running process is executed (C11). Then, this process once ends.

[Operation of Slot Machine: Terminal Side Jackpot Game Running Process]

Figure 16:
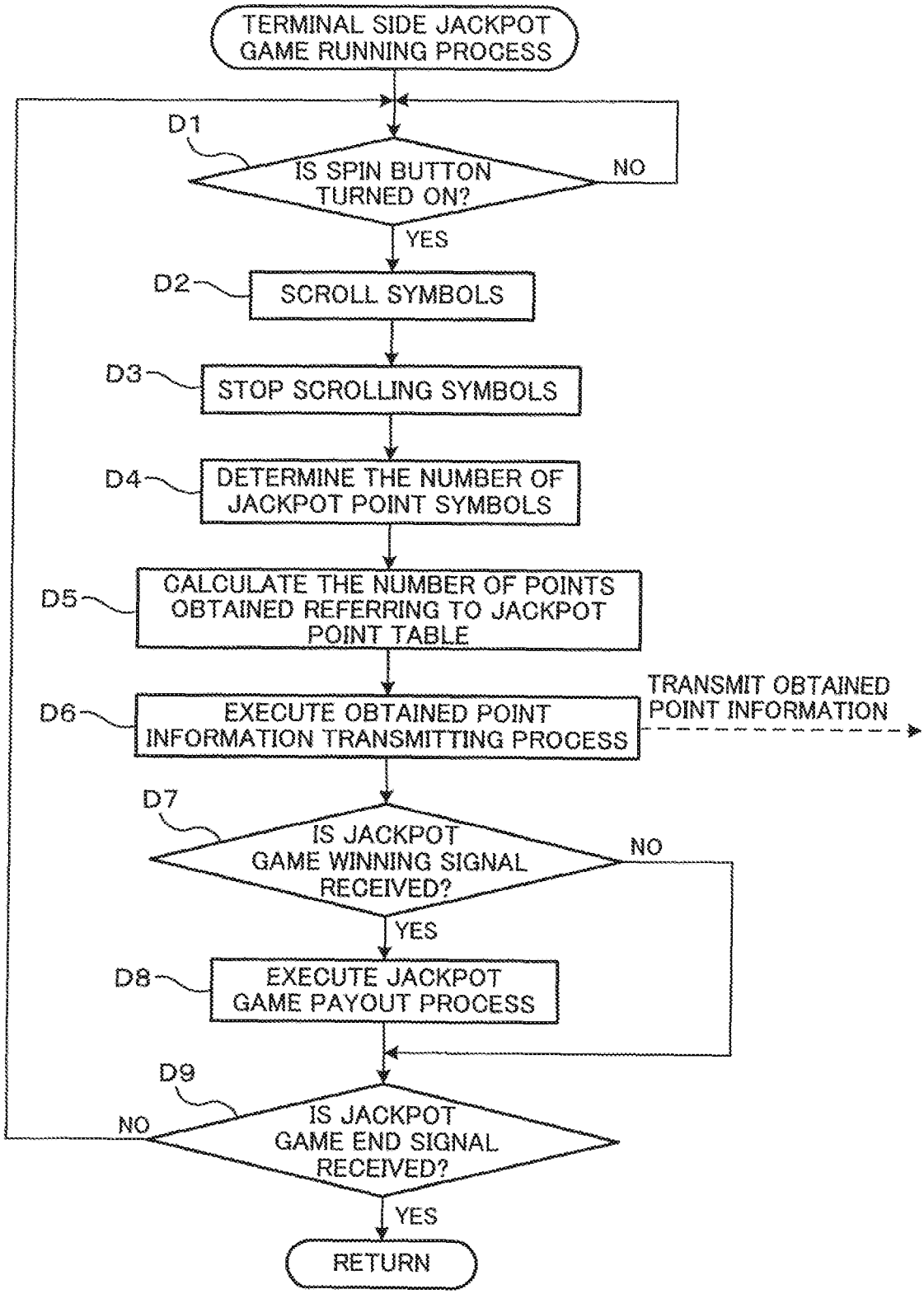
FIG. 16 is a flowchart of a terminal side jackpot game running process executed in the terminal device.

When the terminal side jackpot game running process is executed in the step C11 of FIG. 15, the main CPU 41 of the terminal device (3A to 3J) executes the terminal side jackpot game running process shown in FIG. 16. A terminal side jackpot game running processing program is stored in the RAM 43.

When the terminal side jackpot game running process is executed, first, whether the spin button 23 is turned on or not is determined (D1). When it is determined that the spin button 23 is not turned on (D1: NO), the process returns to D1.

On the other hand, when it is determined that the spin button 23 is turned on (D1: YES), symbols 180 are scroll-displayed in the display windows 151 to 155 (D2). When a predetermined period of time (base time) has elapsed after the scroll of the symbols 180 is started, symbols 180 are stopped (rearranged) in the display windows 151 to 155 (D3).

Then, it is determined how many symbols of "SUN" 181 each acting as a jackpot point symbol appear among the symbols 180 stopped in the display windows 151 to 155 (D4).

Then, the number of points obtained is calculated, based on the number of symbols of "SUN" 181 each acting as a jackpot point symbol, which number is determined in the step D4, as well as referring to the jackpot point table 132 (D5). After that, executed is an obtained point information transmitting process (D6). That is, the main CPU 41 transmits to the central control board 210 the number of points obtained which is calculated in the step D5, as obtained point information.

Then, whether a jackpot game winning signal is received or not is determined, which signal is transmitted in the later-mentioned center side jackpot game running process (D7) When the jackpot game winning signal is not received (D7: NO), the process proceeds to the step D9.

On the other hand, when the jackpot game winning signal is received (D7: YES), a jackpot game payout process is executed (D8). In other words, paid out are one or more coins equivalent to an accumulated value resulting from accumulative calculation of a percentage of an amount bet at each of the terminal devices 3A to 3J. For example, as shown in FIG. 3, "$12.34" is displayed on the shared display 201, and coins equivalent to this accumulated value of "$12.34" are to be paid out. When coins to be paid out are reserved, a credit value equivalent to the accumulated value is added to the credit value stored in the RAM 43. When the coins are paid out, a control signal is transmitted to the hopper 66 so that coins equivalent to the accumulated value are paid out to the coin tray 18.

Then, it is determined whether a jackpot game end signal is received or not, which signal is transmitted in the later-mentioned center side jackpot game running process (D9) When the jackpot game end signal is not received (D9: NO), the process returns to the step D1. On the other hand, when the jackpot game end signal is received (D9: YES), this process once ends.

[Operation of Slot Machine: Center Side Jackpot Game Running Process]

Figure 17:
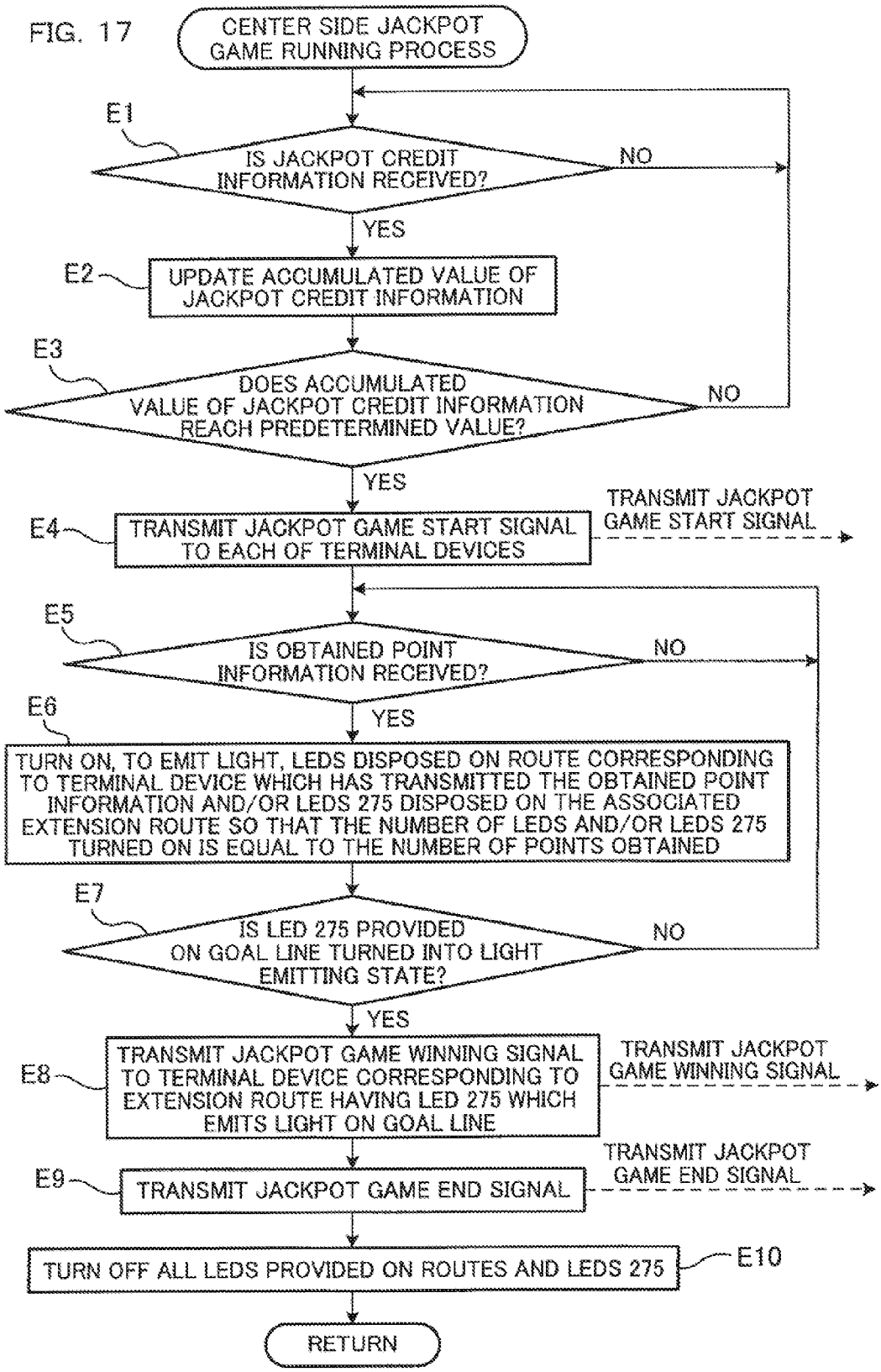
FIG. 17 is a flowchart of a center side jackpot game running process executed in the central control board.

After the center side initial setting routine shown in FIG. 14 ends, the main CPU 241 of the central control board 210 reads out and executes the game program and the game system program sequentially, thereby running the center side jackpot game running process shown in FIG. 17. This center side jackpot game running processing program is stored in the RAM 243.

When the center side jackpot game running process is executed, first, it is determined whether the jackpot credit information transmitted in the before-mentioned game running process is received or not (E1). When the jackpot credit information is not received (E1: NO), the step E1 is repeated. On the other hand, when the jackpot credit information is received (E1: YES), the accumulated value of the jackpot credit information is updated (E2). In other words, based on the jackpot credit information transmitted from each of the terminal devices 3A to 3J, the main CPU 241 adds a percentage (5% in this embodiment) of an amount bet at each of the terminal devices 3A to 3J to the accumulated value of jackpot credit information stored in the RAM 243, and stores the thus obtained value.

Next, the main CPU 241 determines whether the accumulated value of jackpot credit information stored in the RAM 243 reaches a predetermined value ("$12.34" in this embodiment) (E3). When the accumulated value does not reach the predetermined value (E3: NO), the process returns to the step E1. On the other hand, when the accumulated value reaches the predetermined value (E3: YES), a jackpot game start signal which triggers a jackpot game is transmitted to each of the terminal devices 3A to 3J (E4).

In this embodiment, a jackpot game is started when the accumulated value of jackpot credit information exceeds a predetermined value (e.g., a fixed value of "$12.34"), however, this embodiment is not limited thereto. For example, the slot machine 1 may have a structure that a threshold value, for triggering a jackpot game, of the accumulated value of jackpot credit information is randomly varied in each jackpot game within a predetermined range (e.g., $200 to $300).

Next, it is determined whether the obtained point information is received or not, which information is transmitted in the before-mentioned terminal side jackpot game running process (E5). When the obtained point information is not received (E5: NO), the step E5 is repeated. On the other hand, when the obtained point information is received (E5: YES) LEDs disposed on a route corresponding to a terminal device which has transmitted the obtained point information and/or LEDs 275 disposed on the associated extension route of the shared display 201 are caused to be turned on toward the goal line 209A or 209B so as to emit light, the number of the LEDs and/or LEDs 275 turned on being equal to the number of points obtained (E6).

Next, it is determined whether an LED 275 provided on the goal line 209A or 209B is turned into a light emitting state (E7). In other words, it is determined whether the number of points awarded in a jackpot game reaches a predetermined value (50 points). (That is, whether there is a player who has won the jackpot game is determined). When an LED 275 provided on the goal line 209A or 209B is not turned into a light emitting state (E7: NO), the process returns to the step E5. On the other hand, when an LED 275 provided on the goal line 209A or 209B is turned into a light emitting state (E7: YES), a jackpot game winning signal is transmitted to a terminal device corresponding to an extension route having the LED which emits light on the goal line 209A or 209B (E8).

In this embodiment, a fixed value (50 points) is set as the number of points required to receive, at the terminal device (3A to 3J), an award of the accumulated value of jackpot credit information (in this embodiment, a predetermined value of "$12.34" ). However, the required number of points may be set by selection. For example, the number of points required to receive an award of the accumulated value of jackpot credit information may be selected, by an input from outside, from several values (e.g., 50 points, 100 points, and 150 points). Next, a jackpot game end signal is transmitted to the terminal devices 3A to 3J (E9). Then, all the LEDs disposed on the routes 207A to 207J and all the LEDs 275 disposed on the shared display 201 are turned off (E1). Then, this process once ends.

[Operation of Slot Machine: Effect Operation]

When the above-described various processes are executed in the slot machine 1, results or contents corresponding to the processes are, in the form of commands or data, input to respective actuators. For example, when a jackpot game winning signal is received at the terminal device (3A to 3J), the main CPU 41 controls the lamp 30 so as to blink. When a jackpot game winning signal is transmitted, effect images are displayed on the upper image display panel 33 of each of the terminal devices 3A to 3J and the small shared displays 205A and 205B. Moreover, an effect is presented through audio output from the speaker 29, together with or independently of the above-described effects.

In addition, when an LED provided on the on and off light line 208A or 208B is turned into a light emitting state, an effect is presented such that an effect sound is output from the speaker 29 in response to turning on of the LED.

Note that the present invention is not limited to the above-described first embodiment. The below-described variation may also be possible. Hereinafter, described is a base game of a slot machine 1 according to a variation of the first embodiment of the present invention.

Figure 18:
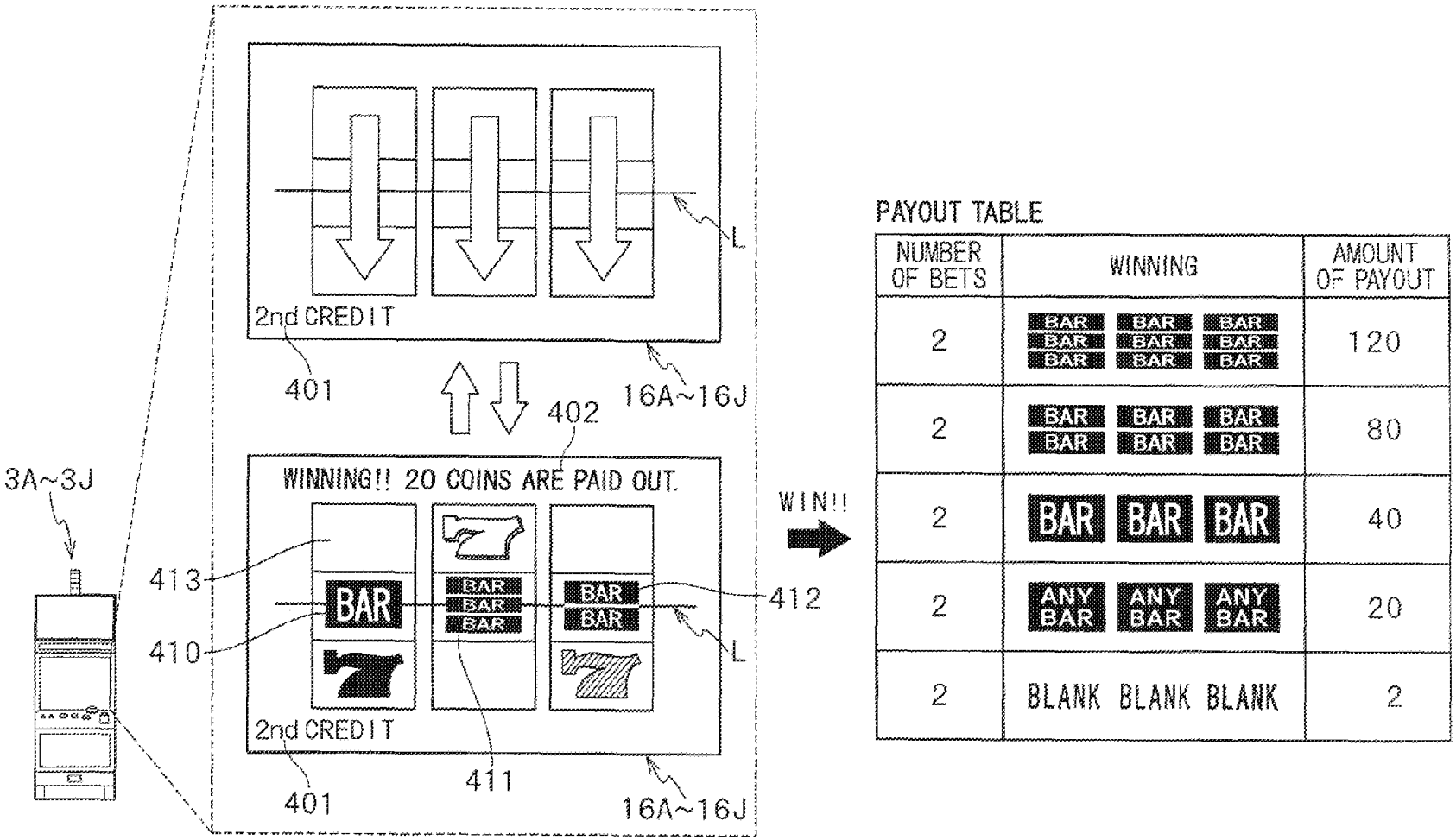
FIG. 18 is an explanatory view concerning a base game in a slot machine according to a variation of the first embodiment of the present invention.

As shown in FIG. 18, each of lower image display panels 16A to 16J according to this variation has arrangement regions in the form of matrix of three rows and three columns. The arrangement regions located in a middle row make up a payline L. When a predetermined winning is achieved by the relation between the symbols rearranged on the payline L, a payout is awarded according to the winning achieved. The lower image display panel (16A to 16J) displays thereon a credit-number 401 which indicates the amount of game value bet.

In the example shown in FIG. 18, the credit-number 401 indicates "2nd CREDIT", meaning that the amount of game value bet is equivalent of two coins. As a result of symbol rearrangement, symbols 410, 411, and 412 are rearranged as "1BAR", "3BAR", and "2BAR", respectively, on the payline L. These symbols make a winning of "ANY-BAR" "ANY-BAR" "ANY-BAR", which is a winning combination for credit-number 401 equivalent of two coins. As a payout for this winning, twenty coins are awarded.

FIG. 19 shows a second base game payout table. The second base game payout table is used when the main CPU 41 determines a winning in a base game, and when the main CPU 41 awards a payout according to the winning. The second base game payout table contains fields for the number of bets, winning, and the amount of payout. In the field for the number of bets, the number of coins bet is shown. In the field for winning, combinations of symbols rearranged on the payline L are shown, which are conditions necessary for achieving a winning. The field for the amount of payout shows the number of coins paid out when a winning is achieved. An example Shown in FIG. 19 will be described below. When the symbols "3BAR" "3BAR" "3BAR" are rearranged on the payline L, the amount of payout is 60 when the number of bets is 1, and 120 when the number of bets is 2. When the symbols "2BAR" "2BAR" "2BAR" are rearranged on the payline L, the amount of payout is 40 when the number of bets is 1, and 80 when the number of bets is 2. When the symbols "1BAR" "1BAR" "1BAR" are rearranged on the payline L, the amount of payout is 20 when the number of bets is 1, and 40 when the number of bets is 2. When the symbols "ANY-BAR" "ANY-BAR" "ANY-BAR" are rearranged on the payline L, the amount of payout is 10 when the number of bets is 1, and 20 when the number of bets is 2. When the symbols "BLANK" "BLANK" "BLANK" are rearranged on the payline L, the amount of payout is 1 when the number of bets is 1, and 2 when the number of bets is 2. When the symbols "Blue 7" "Blue 7" "Blue 7" are rearranged on the payline L, the amount of payout is 1800 when the number of bets is 3. When the symbols "Red 7" "Red 7" "Red 7" are rearranged on the payline L, the amount of payout is 100 when the number of bets is 3. When the symbols "ANY-7" "ANY-7" "ANY-7" are rearranged on the payline L, the amount of payout is 100 when the number of bets is 3. Like this, the amount of payout awarded at a time of achieving a winning increases as the number of bets is increased. This may increase the game value (number of bets) bet by a player.

The following describes a bonus game in a slot machine 1 according to the variation of the first embodiment of the present invention. In a bonus game according to this variation, points are awarded that reflect a predetermined winning. LEDs provided each of routes 207A to 207J and LEDs 275 disposed in an associated extension route of the shared display 201 are configured to be turned on, toward a goal line 209A or 209B, so as to emit light. The number of light-emitting LEDs and LEDs 275 corresponds to the accumulated number of points awarded.

Figure 20:
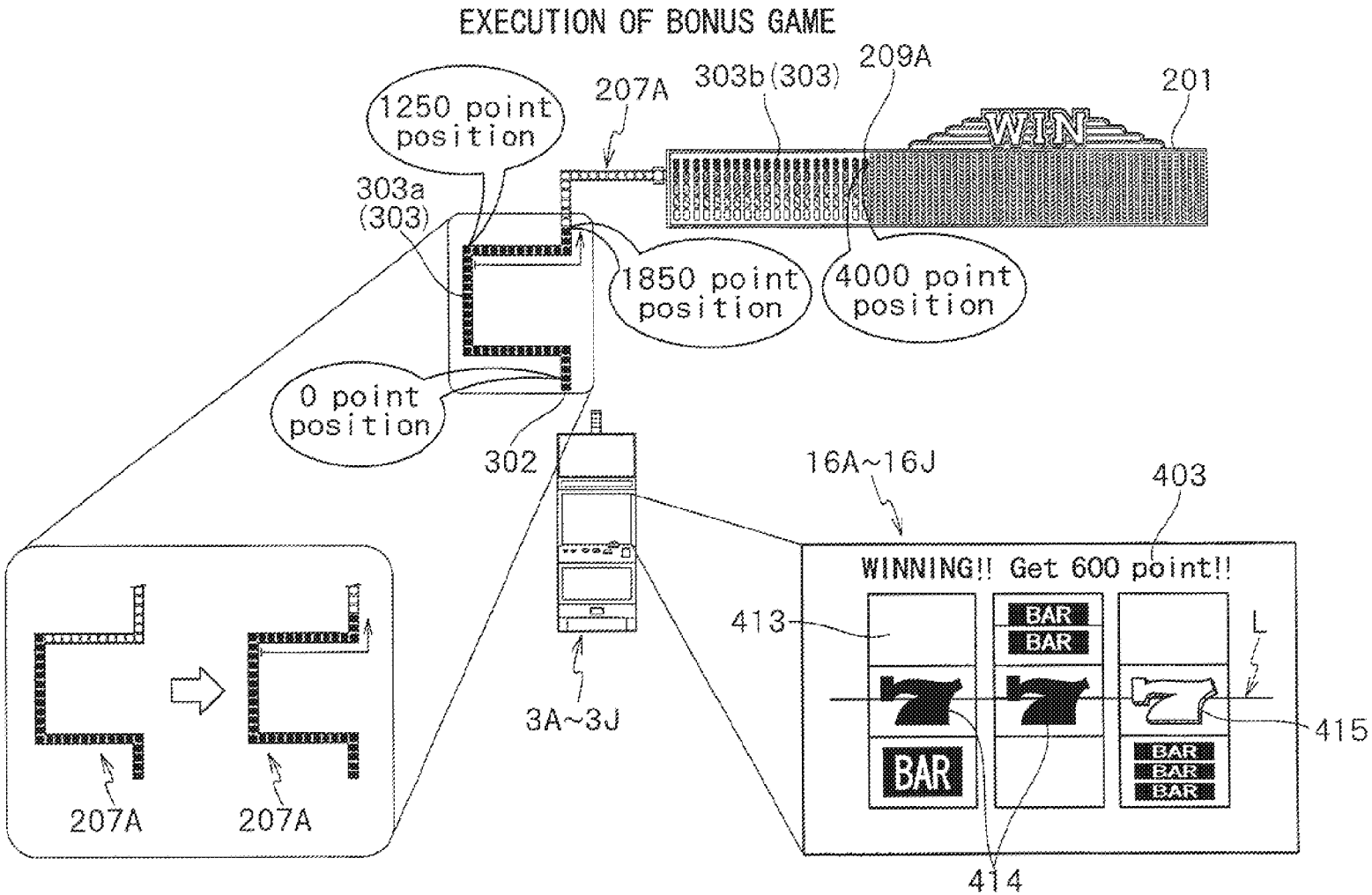
FIG. 20 is an explanatory view concerning a bonus game in the slot machine according to the variation of the first embodiment of the present invention.

An example shown in FIG. 20 is described below. The positions 302 respectively connected to the terminal devices 3A to 3J are 0 point positions, and the respective positions where the extension routes intersect with the goal line 209A or 209B are 4000 point positions. The number of points awarded and accumulated at the terminal device 3A is 1250 points and, on the route 207A, a leading one of the light-emitting LEDs reaches the position corresponding to 1250 points. Here, winnings are achieved by the rearrangement of symbol 414, symbol 414, and symbol 415 as "Red 7", "Red 7", and "Blue 7", respectively, on the pay line L. Three winnings are achieved. Rearrangement of the symbols 414 on the payline L makes two winnings, and rearrangement of the symbol 415 on the payline L makes one winning. The payout for the winning achieved by each symbol 414 is 150 points, and the payout for the winning achieved by the symbol 415 is 300 points. Accordingly, the three winnings make a total payout of 600 points. Awarding the above 600 points to the terminal device 3A makes the accumulated points of 1250+600=1850 points. Then, a leading one of the light-emitting LEDs reaches the position corresponding to 1850 points. Thus, during a bonus game, points are awarded according to a predetermined winning achieved, and a jackpot prize is awarded when the number of points awarded and accumulated reaches a predetermined value (4000 points).

FIG. 21 shows a bonus game payout table. The bonus game payout table is used when the main CPU 41 determines a winning in a bonus game, and when the main CPU 41 awards payout-points according to the winning. The bonus game payout table contains fields for winning and fields for payout-points. In the field for winning, combinations of symbols rearranged on the payline L are shown, which are conditions necessary for achieving a winning. The field for payout-points indicates the number of points paid out when a winning is achieved. An example shown in FIG. 21 is described below. When symbols "Blue 7" "Blue 7" "Blue 7" are rearranged on the payline L, 7000 points are paid out. When a symbol "Blue 7" is rearranged on the payline L, 300 points are paid out. When a symbol "Red 7" is rearranged on the payline L, 150 points are paid out. When a symbol "3BAR" is rearranged on the payline L, 30 points are paid out. When a symbol "2BAR" is rearranged on the payline L, 20 points are paid out. When a symbol "LBAR" is rearranged on the payline L, 10 points are paid out.

The foregoing described a slot machine (gaming machine 100) according to the variation of the first embodiment of the present invention. The slot machine 1 according to the variation of the first embodiment of the present invention has a structure that a bonus game is started when the accumulated value of jackpot credit information exceeds a predetermined value (e.g., a fixed value of "$12.34"). However, this variation is not limited thereto. For example, the slot machine 1 may have a structure that a threshold value, for triggering a bonus game, of the accumulated value of jackpot credit information is randomly varied in each bonus game within a predetermined range (e.g., $200 to $300).

In addition, in the variation of the first embodiment of the present invention, a fixed value (4000 points) is set as the number of points required to receive, at the terminal device (3A to 3J), an award of accumulated value of jackpot credit information (in this variation, "$12.34"). However, the required number of points may be set by selection. For example, the slot machine 1 (gaming machine) may have a structure that the accumulated value of jackpot credit information is awarded when the number of points award and accumulated reaches a value which is varied in each bonus game within a predetermined range (e.g., 3000 to 5000 points)

In addition, in this variation, a fixed value (4000 points) is set as the number of points required to receive, at the terminal device (3A to 3J), an award of accumulated value of jackpot credit information (in this variation, "$12.34"). However, the required number of points may be set by selection. For example, the number of points required to receive an award of the accumulated value of jackpot credit information may be selected, by an input from outside, from several values (e.g., 3000 points, 4000 points, and 5000 points).

In the detailed description provided above, characteristic parts have mainly been described in order that the present invention can be understood more Easily. However, the present invention is not limited to the embodiment shown in the detailed description provided above, and may be applied to other embodiments. The scope of application of the present invention should be construed as broadly as possible. Terms and phraseologies adopted in the present specification are for correctly illustrating the present invention, not for limiting. It would be easy for those skilled in the art to derive, from the spirit of the invention described in the present specification, other structures, systems, methods and the like which are included in the spirit of the invention. Accordingly, it should be considered that claims cover equivalent structures, too, without departing from the technical idea of the present invention. An object of the abstract is to enable an intellectual property office, general public institutions, persons belonging to the art but not familiar with patent, legal terms, or technical terms to quickly understand technical contents and essences of the present invention through a simple research. Therefore, the abstract is not intended to limit the scope of the invention that should be evaluated by the claims. In addition, it is desirable to sufficiently refer to already-disclosed documents and the like, in order to fully understand the objects and effects of the present invention.

The detailed description provided above includes a processing which is executed on a computer or a computer network. The descriptions and expressions provided above are given for the purpose of allowing those skilled in the art to understand the invention most effectively. In the specification, respective steps used to induce one result, or blocks having a predetermined processing function should be understood as a processing having no self-contradiction. In addition, in each step or block, an electrical or magnetic signal is transmitted/received, recorded, and the like. In a processing in each step or block, such a signal is embodied in the form of a bit, a value, a symbol, a character, a term, a number, and the like. However, it should be noted that they have been used simply because they are convenient for explanations. A processing in each step or block has sometimes been described using an expression which is common to a human behavior. However, in principle, the processing described in the specification is executed by various devices. In addition, other structures necessary for each step or block are apparent: from the above description.

(Second Embodiment)

With reference to FIGS. 22 to 50, the following describes a second embodiment of a gaming machine and a playing method thereof according to the present invention. The second embodiment includes embodiment 2-1 and embodiment 2-2. Note that reference numbers and symbols given to members and steps of flowcharts are only applicable to those described within the present embodiment, and do not represent the members or the steps of the other embodiments.

(Embodiment 2-1)

Figure 22:
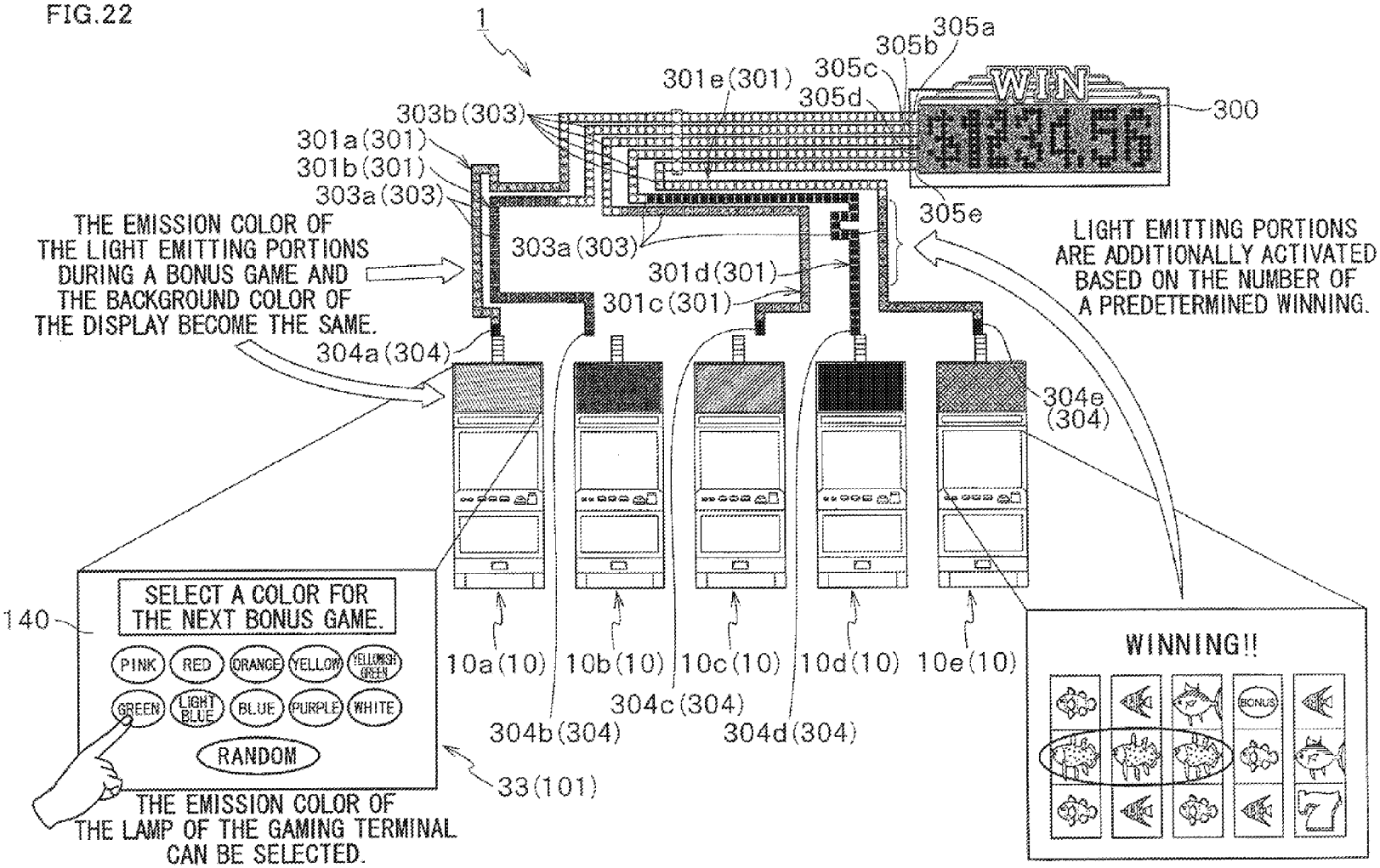
FIG. 22 is an explanatory diagram illustrating a gaming machine and a playing method thereof according to an embodiment 2-1.

As illustrated in FIG. 22, the playing method of the present invention is executed by a gaming machine 1 and includes the steps of: through a plurality of gaming terminals 10, running a base game that awards a payout according to a predetermined winning independently of another gaming terminal 10 and awarding a payout according to a predetermined winning; setting a color associated with each gaming terminal 10; displaying a background image based on the set color in a background display area 140 of a gaming terminal 10 according to a predetermined timing; running a bonus game configured to award a bonus payout greater than the payout awarded in the base game; displaying a bonus payout in a bonus payout display unit 300; in a plurality of path units 301, each corresponding to any of the plurality of gaming terminals 10, wherein the plurality of light-emitting portions 303 that emit light upon activation are arranged from the first end 304 to the second end 305, each time a winning is achieved in the gaming terminal 10, additionally activating light-emitting portions 303 based on the number of predetermined winnings in an light-emitting color according to the set color from the first end 304 to the second end 305 of the path unit 301 associated with the gaming terminal 1.0; and when the path unit 301 is activated up to a light-emitting portion 303 at the second end 305, awarding a bonus payout through the gaming terminal 10 associated with the path unit 301.

Figure 23:
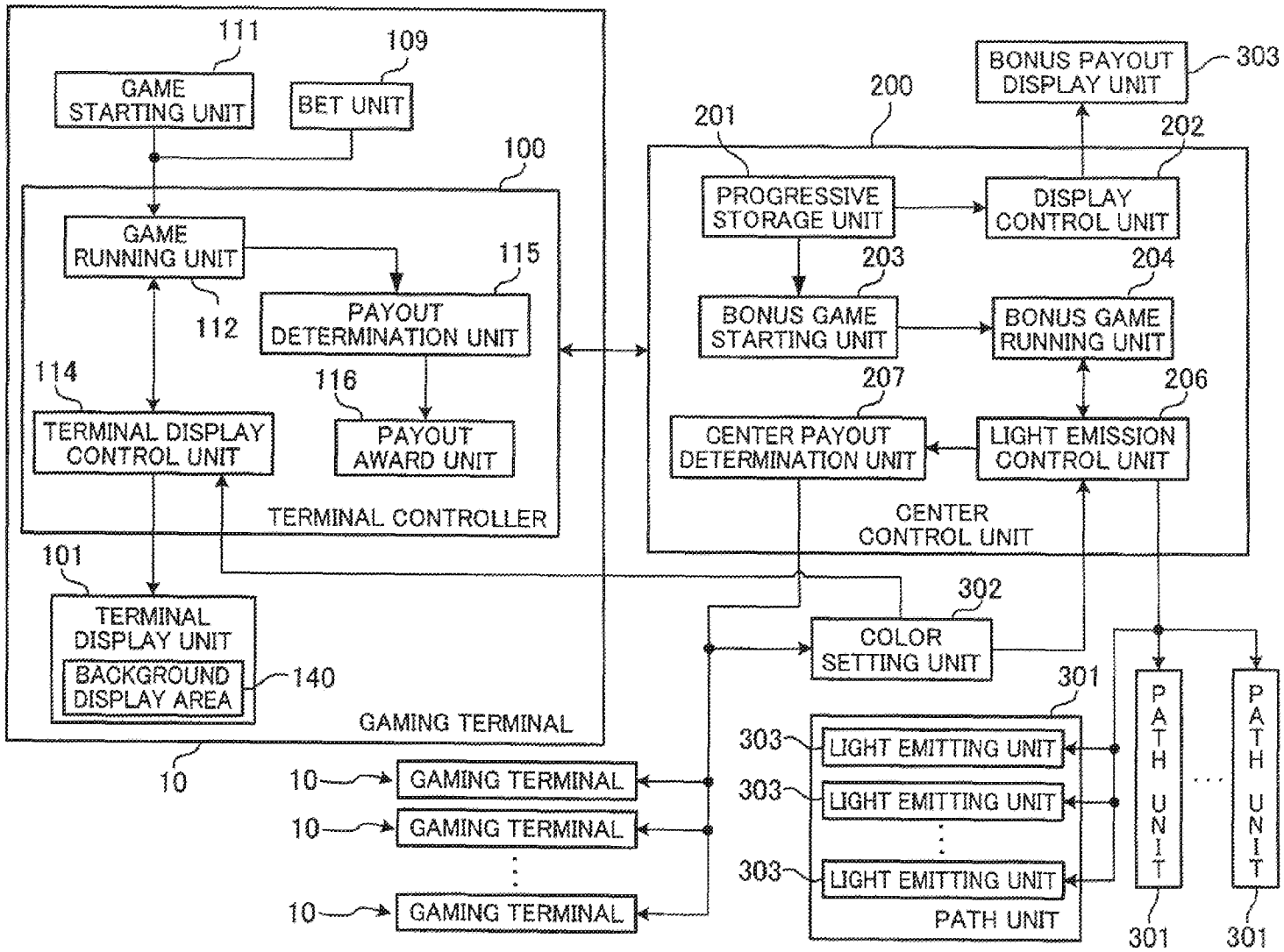
FIG. 23 is a block diagram of the gaming machine.

As illustrated in FIG. 23, the gaming machine 1 that executes the abovementioned playing method has a bonus payout display unit 300, a center controller 200, a plurality of gaming terminals 10, a plurality of path units 301, and a color-setting unit 302.

The color-setting unit 302 sets each color associated with a plurality of gaming terminals 10. The color-setting unit 302 outputs color information signals that include the color that is set for a terminal controller 100 and a center controller 200. The gaming machine 1 may have a structure that includes a color-setting unit 302 in each of the gaming terminals 10 and/or in the center controller 200.

The bonus payout display unit 300 has a function of displaying the amount of bonus payout to be awarded for the gaming terminal 10 that has won a jackpot in a bonus game. In the example illustrated in FIG. 24, the bonus payout display unit 300 indicates that the bonus payout is $1,234.56. The bonus payout display unit 300 has an arrangement of a plurality of LEDs as illuminants in the present embodiment; however, the bonus payout display unit 300 may be structured as one liquid crystal display. Note that an illuminant is not limited to an LED as long as the member emits light.

The path units 301 are respectively associated with the gaming terminals 10. As illustrated in FIG. 22, each path unit 301 has a first end 304 and a second end 305. The first end is situated closer to the plurality of gaming terminals 10. The second end is the other end opposite the first end in the path unit 301 and is situated closer to the bonus payout display unit 300. A plurality of light-emitting portions 303 is arranged from the first end 304 to the second end 305 to form each of the path units 301. That is, one path unit 301 has a plurality of light-emitting portions 303 aligned so as to form a path from the gaming terminal 10 to the bonus payout display unit 300.

Figure 24:
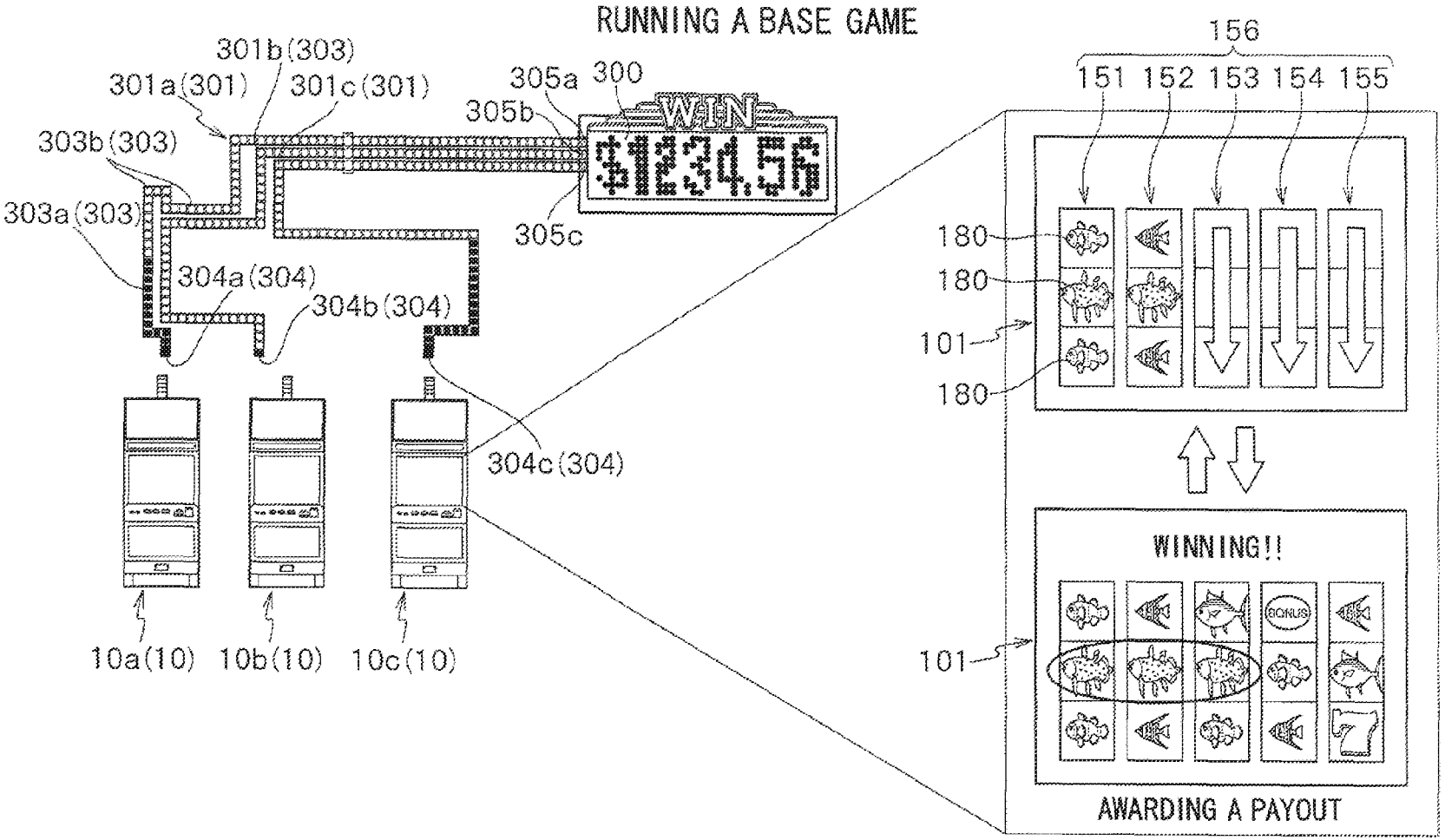
FIG. 24 is an explanatory diagram of a base game.

In the example shown in FIG. 24, a path unit 301*a* is formed as one path from the first end 304*a*, which is closer to the gaming terminal 10*a*, to the second end 305*a*, which is closer to the bonus payout display unit 300. Likewise, a path unit 301*b* is formed as one path from the first end 304*b*, which is closer to the gaming terminal 10*b*, to the second end 305*b*, which is closer to the bonus payout display unit 300. Other path units 301*c* to 301*j* are formed in the same manner. Thus, the path units 301 are respectively associated with the gaming terminals 10.

The light-emitting portion 303 is controlled so that it can emit a plurality of colors. The light-emitting portion 303 turns off when inactive and emits light when activated. The light-emitting portion 303 is activated to emit light in a color set by the color-setting unit 302. That is, each of the gaming terminals 10 displays a background image based on the respectively set color in the terminal display unit 101 based on control by the terminal display control unit 114. In FIG. 22, activated light-emitting portions 303 are shown as light-emitting portions 303*a* and inactive light-emitting portions 303 are shown as light-emitting portions 303*b*.

Each time a predetermined winning is achieved in the gaming terminal 10 associated with the path unit 301, based on the number of predetermined winnings, light-emitting portions 303 are additionally activated from the first end 304 to the second end 305. That is, when a predetermined winning is achieved in the gaming terminal 10, in one associated path unit 301, based on the number of predetermined winnings, inactive light-emitting portions 303*b* are activated and become activated light-emitting portions 303*a*.

The gaming terminal 10 includes a terminal display unit 101 and a terminal controller 100.

As illustrated in FIG. 22 and FIG. 23, the terminal display unit 101 includes a background display area 140 that displays a background image. The terminal display unit 101 is controlled by the terminal controller 100 to display a background image based on the color set by the color-setting unit 302.

(Terminal Controller 100)

The terminal controller 100 is configured to execute: a first process of running a base game independently of another gaming terminal 10 and awarding a payout according to a predetermined winning; a second process of displaying a background image based on a color set by a color-setting unit 302 in a background display area 140 of the gaming terminal 10; and a third process of awarding a bonus payout based on a command from the center controller 200. In other words, the terminal controller 100 has a first processing unit, a second processing unit, and a third processing unit.

The terminal controller 100 is connected to the center controller 200 and is in communication with the center controller 200.

As illustrated in FIG. 23, the terminal controller 100 is connected to a game starting unit 111. The game starting unit 111 has a function of outputting a game start signal in response to an operation by a player. The game start signal output is then input to a later-described game running unit 112.

Further, the terminal controller 100 is connected to a bet unit 109. The bet unit 109 has functions of receiving a bet entered through an operation by the player, and outputting a BET signal in response to the bet entered. The bet signal output is input to a later-described game running unit 112.

The terminal controller 100 has a game-running unit 112 and a terminal display control unit 114. The game-running unit 112 runs a base game triggered by a game start signal from a game start unit 111 and determines the winning as a running result. Here, the base game awards a payout set for each winning.

Further, the terminal controller 100 outputs a progressive signal, triggered by the game start signal. The progressive signal indicates a game value.

Further, the progressive signal indicate a part of a game value entered as a bet through a player's operation. The progressive signal is transmitted to a progressive storage unit 201 described below. The progressive signal is configured so as to be stored and accumulated in the progressive storage unit 201.

The terminal display control unit 114 controls the content to be displayed in the terminal display unit 101. The terminal display control unit 114 displays effect images or the like in the terminal display unit 101 based on the running of the base game by the game-running unit 112. Further, the terminal display control unit 114 displays a background image based on the color set by the color-setting unit 302 in the background display area 140 according to a predetermined timing. That is, each of the gaming terminals 10 is controlled by the terminal display control unit 114 to display a background image based on the respectively set color in the terminal display unit 101.

Further, the terminal controller 100 has a payout determination unit 115 and a payout-awarding unit 116. The payout determination unit 115 determines whether to award a payout on the basis of the winning determined by the game-running unit 112. The payout-awarding unit 116 awards a payout on the basis of the determination of the payout determination unit 115. In short, the payout determination unit 115 determines whether a predetermined winning is achieved. The payout-awarding unit 116 awards a payout on the basis of the determination of the payout determination unit 115. Further, the payout awarding unit 116 awards a payout based on a command from the center controller 200.

Meanwhile, each block of the terminal controller 100 may be realized with hardware or with software as needed.

(Operation of Terminal Controller 100)

The following describes an operation of the terminal controller 100 in the above structure. Firstly, a betting unit 109 accepts a bet via input from outside. The game-running unit 112 receives a game start signal output by the game start unit 111. The game-running unit 112 starts running a base game upon the reception of the game start signal. The game-running unit 112 determines the winning as a result of running the base game.

Further, the payout determination unit 115 determines whether a predetermined winning has been achieved. When the payout determination unit 115 determines that a predetermined winning has been achieved, the payout-awarding unit 116 awards a payout. Thus, the terminal controller 100, through a plurality of gaming terminals 10, executes the first process of running a base game that awards a payout according to a predetermined winning independently of another gaming terminal 10 and awarding a payout according to the predetermined winning.

Further, when a predetermined winning is resulted, the terminal controller 100 transmits, to the center controller 200, a winning signal indicating that a predetermined winning has been resulted, based on a predetermined condition that a bonus game as a shared game is being run, or the like.

Further, the terminal display control unit 114, based on a color information signal from the color-setting unit 302, performs control to display a background image according to the color information signal in the background display area 140 of the terminal display unit 101. Thus, the terminal controller 100 executes the second process of displaying a background image based on the color set by the color-setting unit 302 in the background display area 140 of the gaming terminal 10 according to a predetermined timing.

Further, the payout-awarding unit 116 awards a bonus payout when receiving a command from the center controller 200 to award a bonus payout. Thus, the terminal controller 100 executes the third process of awarding a bonus payout based on a command from the center controller 200.

(Center Controller 200)

The center controller 200 is configured to execute: a fourth process of running a bonus game based on a predetermined condition; a fifth process of additionally activating the light-emitting portions 303 based on the number of predetermined winnings in an emission color according to the color set by the color-setting unit 302 from the first end 304 to the second end 305 of the path unit 301 associated with the gaming terminal 10; and a sixth process of, when the path unit 301 is activated up to a light-emitting portion 303 at the second end 305, commanding the terminal controller 100 of the gaming terminal 10 associated with the path unit 301 to award a bonus payout. In other words, the center controller 200 includes a fourth process unit, a fifth process unit, and a sixth process unit.

As illustrated in FIG. 23, the center controller 200 is connected to the terminal controller 100 and is in communication with the terminal controller 100.

The center controller 200 has a progressive storage unit 201, a display control unit 202, a bonus game start unit 203, a bonus game-running unit 204, a light emission control unit 206, and a center payout determination unit 207.

The progressive storage unit 201 stores and accumulates a game value indicated by a progressive signal received from the terminal controller 100. As described above, the progressive storage unit 201 stores and accumulates game values, which are part of the bet amount indicated by the progressive signal. The bonus payout is paid from the progressive value. The bonus game starting unit 203 outputs a bonus game start signal, when the predetermined condition is met. The game start signal output is then input to a later-described bonus game running unit 204. For example, "when a predetermined condition has been met" means a situation in which a progressive value stored in the progressive storage unit 201 is a predetermined value or greater.

The bonus game-running unit 204 runs a bonus game in which a plurality of players compete against one another for a jackpot via a plurality of gaming terminals 10, triggered by a bonus game start signal received from the bonus game start unit 203.

The display control unit 202 displays a progressive value accumulated in the progressive storage unit 201 in the bonus payout display unit 300.

The light emission control unit 206 activates the light-emitting portions 303 in an emission color according to a color information signal output from the color-setting unit 302 based on a control signal from the bonus game-running unit 204.

The center payout determination unit 207 determines, for each of the path units 301, whether the light-emitting portions 303 are activated up to the bonus payout display unit 300. When the center payout determination unit 207 is activated up to the bonus payout display unit 300, the center payout determination unit 207 commands the terminal controller 100 of the game terminal 10 associated with the path unit 301 to award a bonus payout.

Meanwhile, each block of the center controller 200 may be realized with hardware or with software as needed.

(Operation of Center Controller 200)

The following describes an operation of the center controller 200 in the above structure. Firstly, the progressive storage unit 201 stores and accumulates a game value based on a progressive signal sent from the terminal controller 100. The bonus game start unit 203 starts a bonus game based on a predetermined condition. Thus, the center controller 200 executes the fourth process of running a bonus game to award a bonus payout greater than the payout awarded in the base game based on a predetermined condition.

The center controller 200 receives a winning signal from the terminal controller 100 each time a predetermined winning is resulted in a gaming terminal 10. When the bonus game-running unit 204 receives a winning signal, the bonus game-running unit 204 determines, based on a predetermined winning, the number of light-emitting portions 303 to be activated. Then, the light emission control unit 206 controls the determined number of inactive light-emitting portions 303*b* to be activated from the first end 304 to the second end 305.

Specifically, if there are no activated light-emitting portions 303*a*, the light emission control unit 206 activates the light-emitting portions 303 based on the number of winnings from the light-emitting portions 303 at the first end 304 to the second end 305. Further, if there are any activated light-emitting portions 303*a*, the light emission control unit 206 activates the light-emitting portions 303 based on the number of winnings from the inactive light-emitting portions 303*b* adjacent to the activated light-emitting portions 303*a* to the second end 305. In addition, the light emission control unit 206 activates the light-emitting portions 303 in an emission color according to the color set by the color-setting unit 302. Thus, each time a predetermined winning is achieved in the gaming terminal 10, the center controller 200 executes the fifth process of additionally activating light-emitting portions 303 based on the number of predetermined winnings in an emission color according to the color set by the color-setting unit 302 from the first end 304 to the second end 305 of the path unit 301 associated with the gaming terminal 10.

When a plurality of light-emitting portions 303 are activated up to the second end 305, the center payout determination unit 207 commands the terminal controller 100 of the gaming terminal 10 associated with the path unit 301 to award a bonus payout. Thus, the center controller 200 executes the sixth process of, when a path unit 301 is activated up to a light-emitting portion 303 at the second end 305, commanding the terminal controller 100 of the gaming terminal 10 associated with the path unit 301 to award a payout.

As is clear from the abovementioned operations, the gaming machine 1 realizes, through a plurality of gaming terminals 10, a playing method that includes the steps of: running a base game independently of another gaming terminal 10 and awarding a payout according to a predetermined winning; setting the color associated with each of the gaming terminals 10; running a bonus game configured to award a bonus payout greater than the payout awarded in the base game; displaying a bonus payout in the bonus payout display unit; in a plurality of path units 301, each corresponding to one of the plurality of gaming terminals 10, wherein a plurality of light-emitting portions 303 that emit light upon activation are arranged from the first end 304 to the second end 305, each time a winning is achieved in a gaming terminal 10, additionally activating light-emitting portions 303 based on he number of predetermined winnings with a light-emitting color according to the set color; and when the path unit 301 is activated up to a light-emitting portion 303 at the second end 305, awarding a bonus payout through the gaming terminal 10 associated with the path unit 301.

According to this playing method, a base game is run in a plurality of the gaming terminals 10 independently of another gaming terminal 10, and a payout according to a predetermined winning is awarded. According to a predetermined timing, a background image based on the color associated with each gaming terminal 10, which is set by the color-setting unit 302, is displayed in the background display area 140 of the terminal display unit 101 of the gaming terminal 10. Further, a bonus game is run based on a predetermined condition. Each time a predetermined winning is achieved in the gaming terminal 10, based on the number of predetermined winnings, the light-emitting portions 303 are additionally activated from the first end 304 to the second end 305 of the path unit 301 associated with the gaming terminal 10 in an emission color according to the color that is set by the color-setting unit 302. When the path unit 301 is activated up to the light-emitting portions 303 at the second end 305, a bonus payout is awarded through the gaming terminal 10 associated with the path unit 301.

This realizes the background image displayed on the terminal display unit 101 of the gaming terminal 10 and the path unit 301 associated with the gaming terminal 10 in a mode according to the color set by the color-setting unit 302. As a result, the gaming terminals 10 are respectively associated with the path units 301. This realizes a new entertainment characteristic.

Here, the color-setting unit 302 of the gaming machine 1 may be installed in each of the gaming terminals 10 and may comprise an input device capable of receiving input from outside. The progressive storage unit 201 of the gaming machine 1 may store and accumulate a progressive signal from the gaming terminal 10 as a contribution amount to a bonus payout and associate it with each of the gaming terminals 10 to which the signal was sent.

Further, the gaming machine 1 may execute a playing method that includes the steps of: determining the color associated with the gaming terminal 10 based on input through the input device; displaying a background image according to the determined color in the background display area 140 of the gaming terminal 10; commanding the terminal controller 100 of a plurality of gaming terminals 10 to allow the reception of input through the input device in a descending order of the contribution amount; and each time a predetermined winning is achieved in the gaming terminal 10, additionally activating the light-emitting portions 303 based on the number of predetermined winnings in an emission color according to the color determined by the gaming terminal 10 from the first end 304 to the second end 305 of the path unit 301 associated with the gaming terminal 10.

According to the structure above, a base game is run in a plurality of gaming terminals 10 independently of another gaming terminal 10 and a payout is awarded according to a predetermined winning. For a plurality of gaming terminals 10, reception through the input device capable of receiving input from outside is allowed in descending order of the contribution amount that is stored and accumulated in the contribution amount memory. The color associated with the gaming terminal 10 is determined based on input through the input device. A background image based on the determined color is displayed in the background display area 140 of the terminal display unit 101 of the gaming terminal 10 according to a predetermined timing. Further, a bonus game is run based on a predetermined condition. Each time a predetermined winning is achieved in the gaming terminal 10, the light-emitting portions 303 based on the number of predetermined winnings are additionally activated in an emission color according to the color determined by the gaming terminal 10 from the first end 304 to the second end 305 of the path unit 301 associated with the gaming terminal 10. When the path unit 301 is activated up to the light-emitting portions 303 at the second end, a bonus payout is awarded through the gaming terminal 10 associated with the path unit 301.

This realizes a background image displayed on the terminal display unit 101 of the gaming terminal 10 and a path unit 301 associated with the gaming terminal 10 in a mode according to the color determined based on input through the input device. As a result, the gaming terminals 10 are easily associated with path units 301 respectively. Further, the gaming terminal 10 is allowed to receive input through the input device based on the contribution amount. This realizes new entertainment characteristics.

Further, the color-setting unit 302 in the gaming machine 1 may be installed in the center controller 200. In addition, the center controller 200 may comprise an achievement level memory that associates and stores an achievement level determined based on the light-emitting portions 303, which are activated in the path unit 301, and the color according to the achievement level.

Further, the gaming machine 1 may execute a playing method that includes the steps of: determining an achievement level based on the number of light-emitting portions 303 that are activated as a result of additionally activating the light-emitting portions 303 in the path unit 301; emitting the light-emitting portions 303 in a color according to the achievement level; and displaying a background image in a color according to the achievement level in the background display area 140 of the gaming terminal 10.

According to the structure above, a base game is run in a plurality of gaming terminals 10 independently of another gaming terminal 10, and a payout is awarded according to a predetermined winning. Further, a bonus game is run based on a predetermined condition. Each time a predetermined winning is achieved in the gaming terminal 10, the number of light-emitting portions 303 to be additionally activated is determined on the basis of a predetermined winning and an achievement level is determined on the basis of the number of light-emitting portions 303 to be activated in the path unit 301 as a result of additional activation. The determined number of light-emitting portions 303 are additionally activated from the first end 304 to the second end 305 of the path unit 301 associated with the gaming terminal 10, and the color of the light-emitting portions 303 to be activated is changed to the color associated with the achievement level. A background image according to the color associated with the achievement level is displayed in the background display area 140 of the gaming terminal 10. When the path unit 301 is activated up to the light-emitting portions 303 at the second end, a bonus payout is awarded through the gaming terminal 10 associated with the path unit 301.

This realizes a background image displayed on the terminal display unit 101 of the gaming terminal 10 and a path unit 301 associated with the gaming terminal 10 in a mode according to the color associated with the achievement level, which is determined on the basis of the number of light-emitting portions 303 activated in the path unit 301. As a result, the gaming terminals 10 are easily associated with path units 301, and the achievement level can be easily recognized. This realizes new entertainment characteristics.

(Running Base Game)

The following specifically describes an example of a base game of the gaming machine and the playing method thereof. Note that the following example deals with a case in which the terminal display unit 101 arranges symbols according to the video reel method as illustrated in FIG. 24.

As illustrated in FIG. 24, a matrix 156 is in the center of the terminal display unit 101. The matrix 156 scroll-displays a symbol having a plurality of symbols 180. The display windows 151 to 155 are respectively divided into upper stages 151*a* to 155*a*, central stages 151*b* to 155*b*, and lower stages 151*c* to 155*c*. The symbols 180 are stopped (arranged) in the stages 151*a* to 155*a*, 151*b* to 155*b*, and 151*c* to 155*c*, respectively. The matrix 156 is a symbol matrix that includes five columns and three rows. However, the matrix 156 is not limited to five columns and three rows.

The terminal display unit 101 may have a mechanical structure that incorporates a reel device that rotates a reel for arranging the symbols 180, or it may have an electrical structure in which a video reel displayed as an image arranges symbols 180. Further, the terminal display unit 101 may be configured to have a combination of the mechanical structure (reel) and the electrical structure (video reel). Examples of the electrical structure include a liquid crystal display device, a CRT (cathode-ray tube), a plasma display device, or the like. A specific structure of the terminal display unit 101 will be detailed later.

The "arranging" in this specification means a state where the symbols 180 can be visually observed by a player. That is, FIG. 24 illustrates a state in which the symbols 180 are displayed in the matrix 156. Arranging the symbols 180 again after releasing the symbols 180 is referred to as "rearranging".

As illustrated in FIG. 24, the terminal display unit 101 variably displays a plurality of symbols 180 when a base game is run in the gaming terminal 10. When this variable-displaying of symbols 180 stops, symbols 180 are rearranged in the arrangement areas 150. A winning is resulted based on a relation among the symbols 180, and a payout according to the winning is awarded.

Note that part of a bet entered by a player is accumulated in the center controller 200 as a progressive value each time a bonus game is started. The progressive value that is being accumulated is displayed on the bonus payout display unit 300 as illustrated in FIG. 24.

(Running Bonus Game)

The following specifically describes an example of a bonus game of the gaming machine 1 and the playing method thereof.

When the accumulated progressive value exceeds a certain amount, a bonus game is started. A plurality of symbols 180 are rearranged in the matrix 156 in each of the gaming terminals 10 during the bonus game. When a winning is resulted in a gaming terminal 10 with the rearranged symbols 180, the number of light-emitting portions 303 of the associated path unit 301 corresponding to the winning are activated. These operations are repeated until the plurality of light-emitting portions 303 of any one of the path units 301 are activated up to the second end 305, which is closer to the bonus payout display unit 300.

Figure 25:
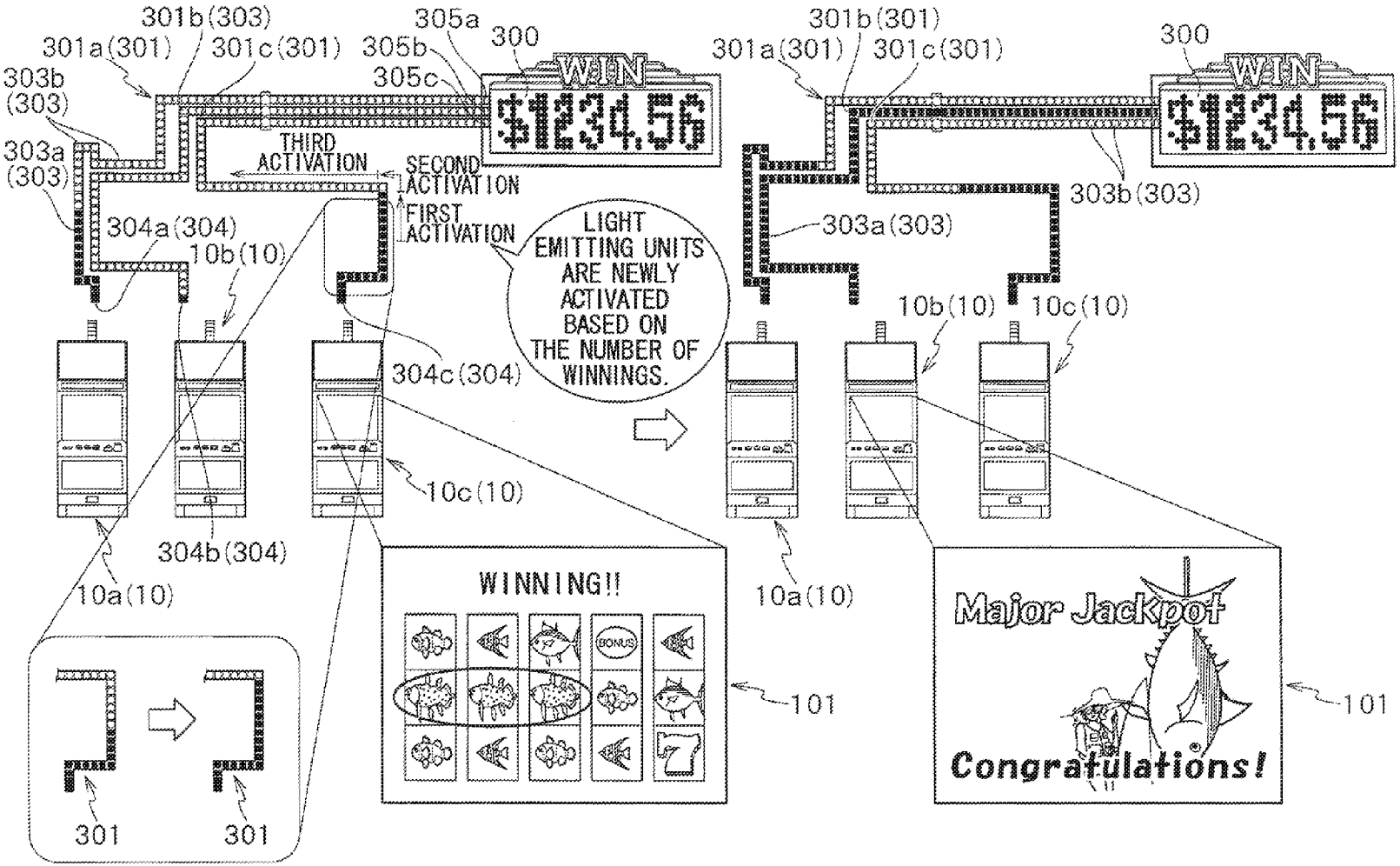
FIG. 25 is an explanatory diagram of a bonus game.

As illustrated in FIG. 25, for instance, when a predetermined winning is resulted in the gaming terminal 10*c*(10), six additional light-emitting portions 303 are activated. Then, when another winning is resulted in the same gaming terminal 10*c*(10), one additional light-emitting portion 303 is activated. Then, when yet another predetermined winning is resulted in the same gaming terminal 10*c*(10), eighteen additional light-emitting portions 303 are activated. Thus, the number of light-emitting portions 303 corresponding to a winning are activated towards the bonus payout display unit 300 each time a winning is resulted.

When a plurality of light-emitting portions 303 are activated up to the bonus payout display unit 300, a so-called "jackpot" is awarded through the gaming terminal 10 associated with the path unit 301. The progressive value is then awarded as a bonus payout. In the example illustrated in FIG. 25, a bonus payout is awarded through the gaming terminal 10*b* (10) associated with the path unit 301*b* (301), the light-emitting portions 303 of which are activated up to the bonus payout display unit 300 (all of the light-emitting portions 303 from the first end 304 to the second end 305 are activated).

(Symbol, Combination, or the Like)

The symbols 180 displayed in the matrix 156 of the terminal display unit 101 form symbol columns that each have 22 symbols 180 as illustrated in FIG. 28. The symbols 180 that constitute each of the symbol columns each have one of the code numbers 0 to 21.

Each symbol column has a combination of symbols of "Angelfish," "Clownfish," "7," "Tuna," "Coelacanth," and "Bonus."

Of the symbols in the symbol columns, the display windows 151 to 155 each display (arrange) three successive symbols. The symbols arranged in the upper stages 151*a* to 155*a*, the central stages 151*b* to 155*b*, and the lower stages 151*c* to 155*c* form a symbol matrix having five columns and three rows. When a BET button and a start button are sequentially pressed in order to start a game, the symbols 180 constituting the symbol matrix start scrolling. This scrolling of the symbols stops (rearrangement) after a predetermined period from the beginning of the scrolling.

Further, for each symbol 180, a predetermined scatter symbol is determined in advance. Scatter symbols are symbols for when a player is put in an advantageous position when a predetermined number or more of them are displayed in the matrix 156. For example, the advantages includes: a state where coins corresponding to the scatter symbols are paid out, a state where the number of coins to be paid out is added to a credit, a state where a bonus game is started.

To be more specific, when three or more "BONUS" symbols are rearranged in the matrix 156, the gaming state shifts from a base game to a free game. Further, when four or more "BONUS" symbols stop in the matrix 156, twenty coins (game medium) are paid out for each bet.

Here, a free game is a gaming state that provides a greater advantage than a base game. The free game is a game allowing a player to play a game a predetermined number of times without betting a coin. There is no particular limitation on the advantageous gaming state as long as it is a gaming state that is advantageous to the player; that, is, as long as it is more advantageous than the base game. For example, it may include a state in which more game media are obtainable than in the base game, a state in which game media are obtainable with a higher probability than in the base game, a state in which game media are consumed lower than in the base game, and the like. Specifically, a second game, a feature game, or the like may be mentioned as examples of the advantageous gaming state.

(Mechanical Structure of Gaming Machine 1)

Next, the following describes a specific example of mechanical and electrical structures of the gaming machine 1 thus structured.

A gaming machine 1 is placed in a gaming facility such as a casino. This gaming machine 1 runs a unit game which involves a game medium. The game medium is a coin, bill, or a value in the form of electronic information. However, the game medium in the present invention is not particularly limited. For example, a medal, token, electronic money, ticket or the like are also possible. Further, the ticket is not particularly limited and may be a later-described ticket with a barcode or the like ticket.

Figure 26:
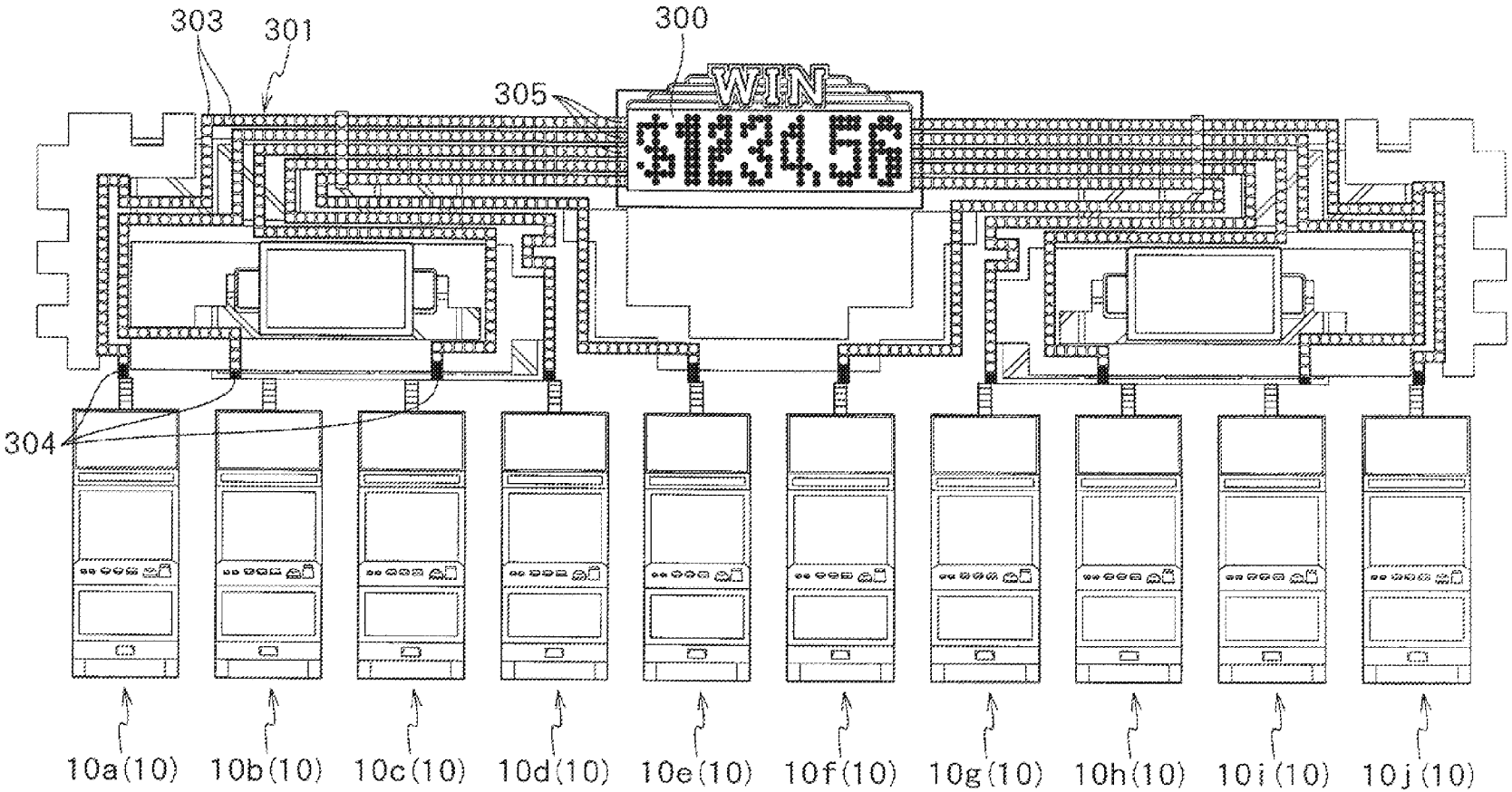
FIG. 26 is a front view illustrating an external appearance of the gaming machine.

As illustrated in FIG. 26, the gaming machine 1 has: gaming terminals 10 that run a base game independently of one another; a center controller 200 (see FIG. 34) that runs a bonus game is connected to the gaming terminals 10 and is in communication with the gaming terminals 10; a bonus payout display unit 300 that displays an amount of a bonus payout awarded in a bonus game; a plurality of path units 301 respectively associated with the gaming terminals 10, each path unit 301, having light-emitting portions 303 aligned to form a path from the first end 304, which is closer to the respectively associated gaming terminal of the plurality of gaming terminals 10, to the second end 305, which is closer to the bonus payout display unit 300.

In the present embodiment, the gaming machine 1 has ten gaming terminals 10. Further, the gaming machine 1 has ten path units 301 each associated with one of the ten gaming terminals 10, respectively. The ten path units 301 are configured by arranging a plurality of light-emitting portions 303 to form one path from each of the first ends 304 to the second ends 305.

In the present embodiment, the light-emitting portions 303 have a plurality of LEDs that are capable of emitting light in a plurality of colors. Specifically, the light-emitting portions 303 have three LEDs that emit light in "red", "green", and "blue" upon activation. Each of the LEDs is capable of emitting light in multiple tones of contrast. Therefore, for example, emitting only "red" and "green" LED light at the same tone brightness allows the light-emitting portion 303 to emit light in the color "orange". In the present embodiment, each of the LEDs is capable of emitting light in eight tones, but the LEDs are not limited to this.

The light-emitting portion 303 is not limited to a composition of a plurality of LEDs. For example, the light-emitting portion 303 may have only unicolor LEDs or may be displayed as a partial area of a liquid crystal display device. Further, in the present embodiment, the light-emitting portion 303 emits light upon activation; however, the operational mode is not limited to this configuration. For example, it may flash upon activation or emit light and flash in combination.

Figure 27:
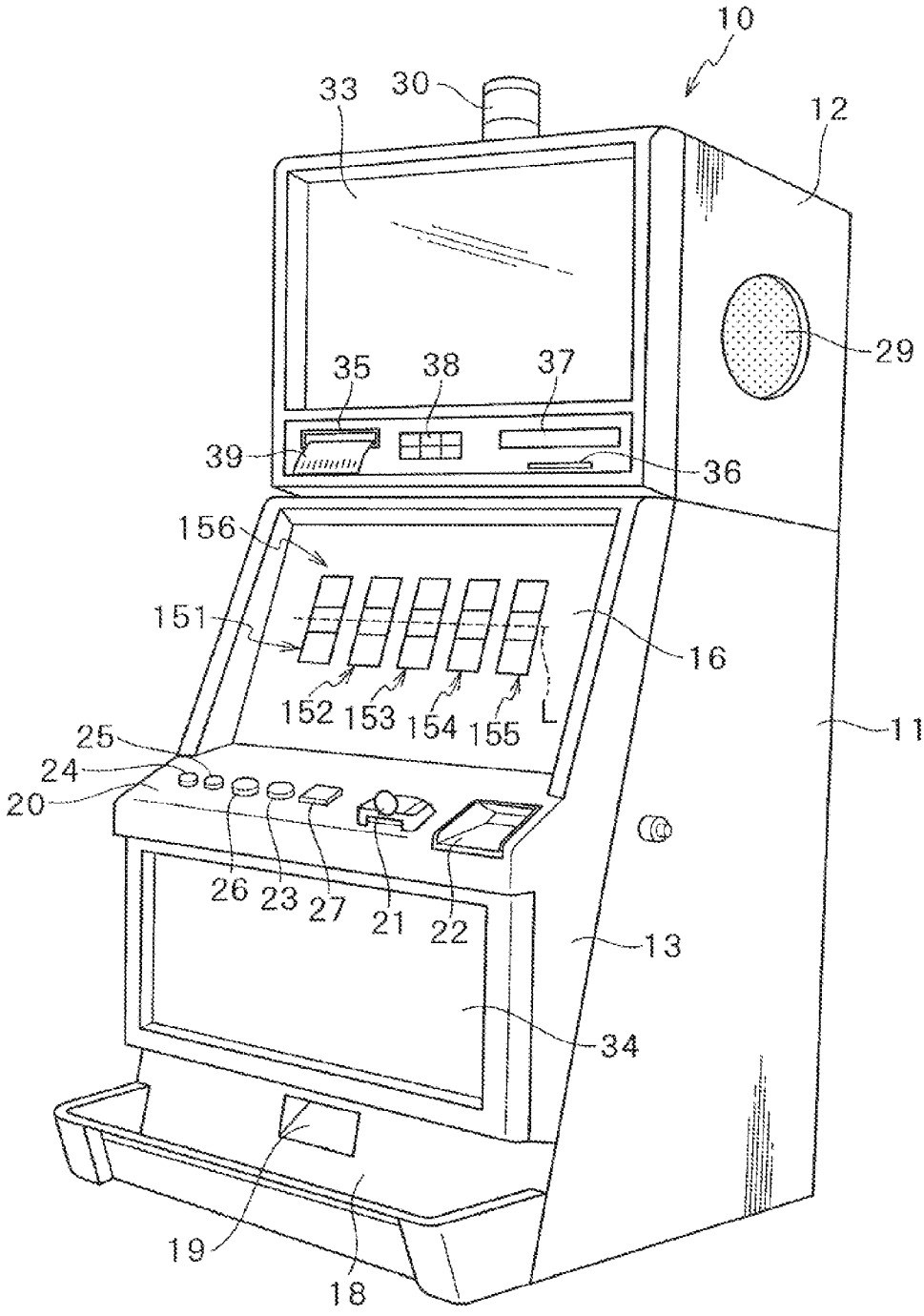
FIG. 27 is a perspective view illustrating an external appearance of a gaming terminal.

As illustrated in FIG. 27, the gaming terminal 10 has: a cabinet 11, a top box 12 provided above the cabinet 11, and a main door 13 provided on the front surface of the cabinet 11. The main door 13 has a lower image display panel 16. The lower image display panel 16 has a transparent liquid crystal panel for displaying various information. The lower image display panel 16 displays display windows 151 to 155 and a matrix 156 for arranging therein a plurality of symbols 180 and various information and effect images related to a game as needed.

The present embodiment deals with a case where the lower image display panel 16 electrically displays symbols 180 arranged in five rows/three columns. However, the present invention is not limited to this.

The lower image display panel 16 displays a single activated payline L. Note that the number of pay lines L may be two or more. When the number of pay lines L is two or more, the number of pay lines L to be activated may be determined according to a predetermined condition, such as the number of coins placed as a bet.

Note that the lower image display panel 16 may have a credit value indicator and a payout value indicator. The credit value indicator displays a total value (hereinafter also referred to as total credit value) which a gaming terminal 10 can pay out to a player. When symbols stopped along a pay line L form a winning combination, the payout value indicator displays the number of coins to be paid out.

Further, a scatter symbol may be used to pay out coins according to the number of scatter symbols displayed in the matrix 156. Note that the pay line L does not necessarily have to be displayed.

Below the lower image display panel 16 provided are a control panel 20, a coin insertion slot 21, and a bill validator 22. The control panel 20 is provided with various buttons 23 to 27. These buttons 23 to 27 allow a player to input instructions related to a game played by the player. Through the coin insertion slot 21, a coin is received in the cabinet 11.

The control panel 20 has: a spin button 23, a change button 24, a cashout button 25, a 1-bet button 26, and a maximum bet button 27. The spin button 23 is for inputting an instruction to start symbol scrolling. The change button 24 is used to ask a staff in the gaming facility for exchange of money. The cash out button 25 is for inputting an instruction to pay out coins corresponding to the total credit-value into the coin tray 18.

The 1-bet button 26 is used for betting one coin out of those corresponding to the total credit value. The maximum bet button 27 is used for betting, out of those corresponding to the total credit value, a maximum number of coins (e.g., fifty coins) which can be bet in one game.

After coins are bet in a game by operating the 1-BET button 26 or the maximum BET button 27 and then the spin button 23, the bet amount to be used in a bet is determined. Part of the determined bet amount is sent to the center controller 200 as a progressive signal to be stored and accumulated as a contribution amount for each gaming terminal 10.

The bill validator 22 validates whether a bill is genuine or not and receives the genuine bill into the cabinet 11. Note that the bill validator 22 is capable of reading a barcode attached to a later-mentioned ticket 39 having a barcode (hereinafter simply referred to as ticket 39) When the bill validator 22 reads the ticket 39, it outputs to the main CPU 41 a read signal representing information having read from the barcode.

On the lower front surface of the main door 13, that is, below the control panel 20, a belly glass 34 is provided. On the belly glass 34, a character of a gaming terminal 10 or the like is drawn. On the front surface of top box 12 is provided an upper image display panel 33. The upper image display panel 33 has a liquid crystal panel and displays an effect image, introduction to the game, rules of the game, or the like.

Further, the upper image display panel 33 functions as a terminal display unit 101. That is, the upper image display panel 33 has a background display area 140 that displays a background image according to the color determined for each of the gaming terminals 10. Here, the "color set for each of the gaming terminals 10" is referred to as a "set color". In the present embodiment, the set color is determined based on input via the input device.

The upper image panel 33 is an input device comprising a touch panel 69 capable of receiving input from outside. Although it is not illustrated in the figures, the touch panel 69 is installed so as to cover the front surface of the upper image display panel 33. The touch panel 69 has a function of outputting position data comprising a lateral axis and a vertical axis as input signals to the terminal controller 100 when pressure is applied. The terminal controller 100 is configured in advance to refer to color information associated with the position information. This enables the touch panel 69 to receive input from outside. Further, the terminal controller 100 is configured to determine the set color based on input through the touch panel 69.

Note that the input device is not limited to the touch panel 69. A button and a pointing device may be applied as an input device.

In the present embodiment, the background image color of the upper image display panel 33 of the gaming terminal 10 and the emission color of the light-emitting portion 303 of the path unit 301 are controlled so as to be the same as the set color.

Herein, the display mode of the upper image display panel 33 in the present embodiment is described with reference to FIG. 29 to FIG. 32.

Figure 29:
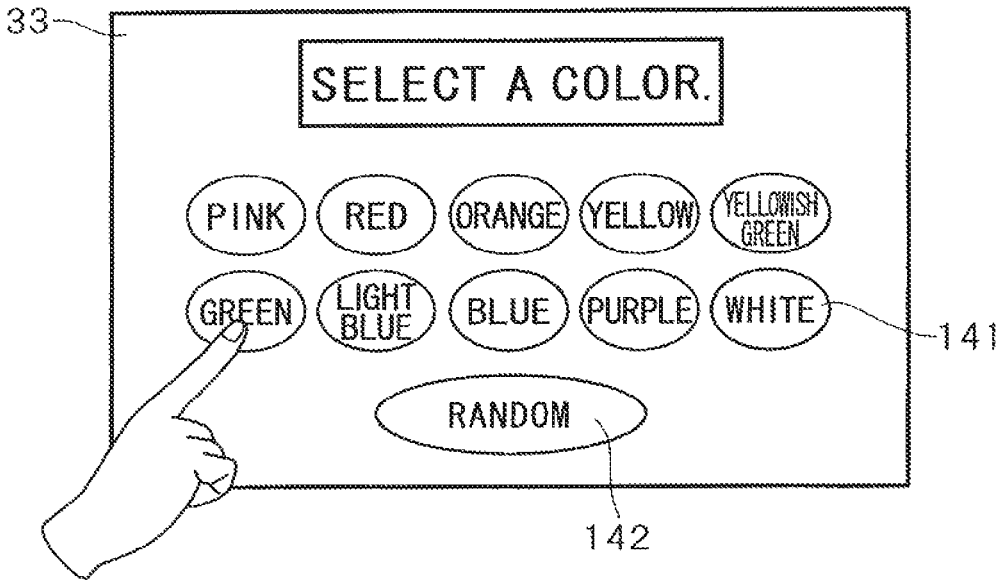
FIG. 29 is a front view illustrating a set color selection screen displayed on the upper image display panel 33 according to the embodiment 2-1.

FIG. 29 is a front view illustrating a set color selection screen displayed on the upper image display panel 33. The terminal controller 100 displays the set color selection screen according to a command from the center controller 200. The terminal controller 100 is configured to allow the reception of input through the touch panel 69 by displaying the set color selection screen. In the present embodiment, the set color selection screen is displayed after a bonus game is completed, but the set color selection screen is not limited to this configuration. For example, the set color selection screen may be one that is displayed when a bonus game is started.

As illustrated in FIG. 29, on the set color selection screen, the upper image display panel 33 displays a plurality of color selection button areas 141 and random button areas 142. The color selection button areas 141 are configured to indicate each of the selectable set colors. A player can select a set color by pressing the color selection button area 141.

Specifically, in the example of FIG. 29, ten color selection button areas 141 display text images variously indicating "pink", "red", "orange", "yellow", "yellowish green", "green", "light blue", "blue", "purple", and "white". When a player has pressed the color selection button area 141 that displays the text image indicating "green", the set color of the gaming terminal 10 of the player is set to green.

The random button area 142 is arranged lower than the color selection button area 141 and displays a text image that indicates "Random". When a player has pressed the random button area 142, the set color of the gaming terminal 10 of the player is set randomly from among the displayed colors.

Figure 30:
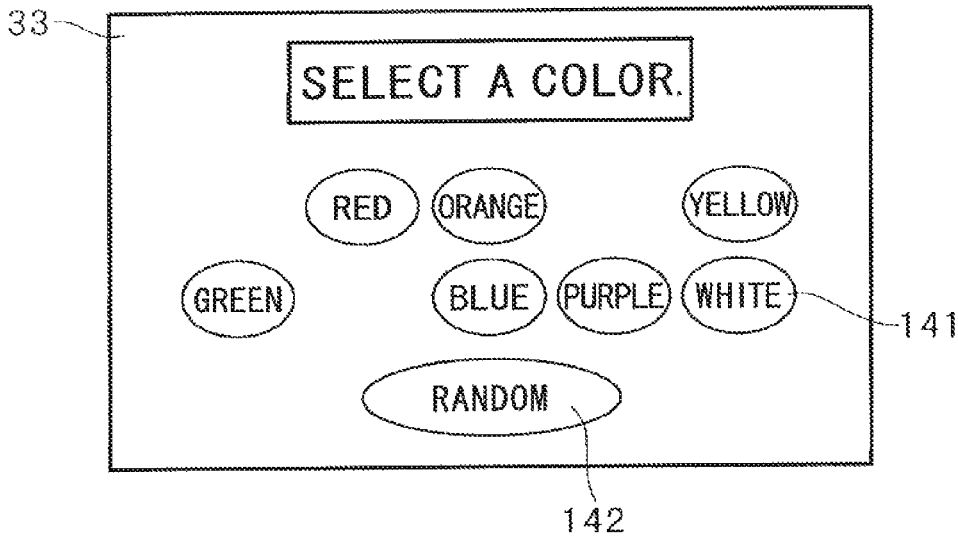
FIG. 30 is a front view illustrating a set color selection screen displayed on the upper image display panel 33 according to the embodiment 2-1.
Figure 31:
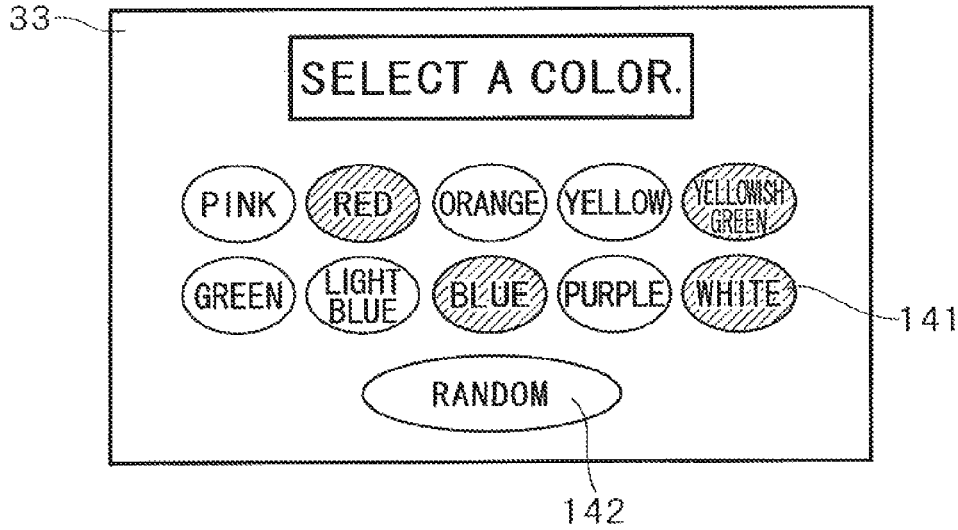
FIG. 31 is a front view illustrating a set color selection screen displayed on the upper image display panel 33 according to the embodiment 2-1.

Further, as illustrated in FIG. 30, a set color that has already been selected by another gaming terminal 10 cannot be selected. Specifically, the example of FIG. 30 indicates that the color selection button areas 141 corresponding to "pink", "yellow", and "light blue" are not displayed and thus are not selectable. Here, as illustrated in FIG. 31, a set color that has already been selected by another gaming terminal 10 may be displayed in the color selection button area 141 and may be indicated as unselectable by graying out the color selection button area 141.

Further, the order for displaying the set color selection screen in each of the gaming terminals 10 is determined based on the contribution amount stored for each gaming terminal 10. Specifically, the center controller 200 executes a command to display a set color selection screen on the gaming terminal 10 having the highest contribution amount that is stored and accumulated from among the gaming terminals 10 that have not yet executed a command to display a set color selection screen. The center controller 200 repeats this process to determine a set color for all of the gaming terminals 10.

Figure 32:
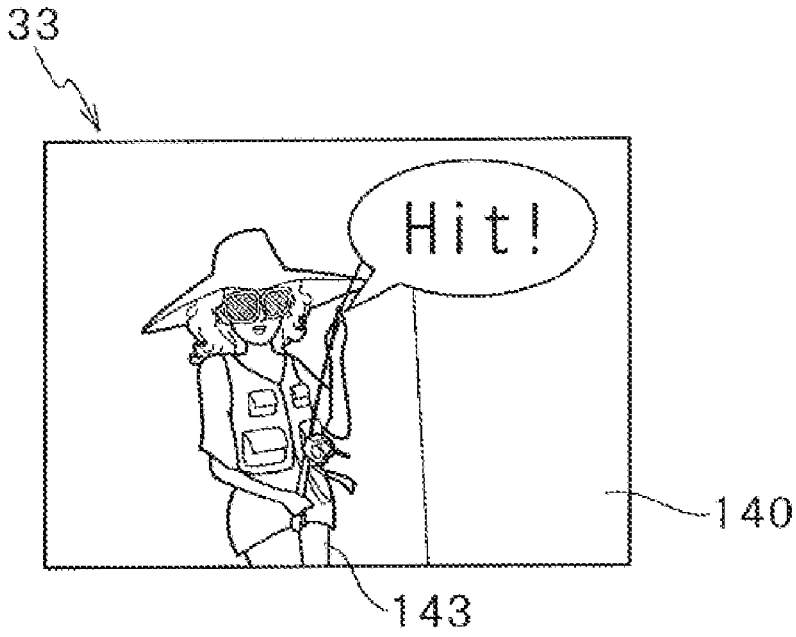
FIG. 32 is a front view illustrating an effect screen during a bonus game displayed on the upper image display panel 33 according to the embodiment 2-1.

FIG. 32 is a front view illustrating an effect screen during a bonus game displayed on the upper image display panel 33. As illustrated in FIG. 32, on the effect screen, the upper image display panel 33 displays an effect image 143 and a background display area 140. Although it is not illustrated in FIG. 32, the background display area 140 displays a background image in the same color as the set color determined in the set color selection screen. Here, the background image of the present embodiment is a unicolor "wallpaper" image, but the background image is not limited to this configuration. For example, it may be a geometric pattern comprising a set color with a higher ratio (for example, 80 percent or more).

Further, the top box 12 has a speaker 29 for performing an audio output. Below the upper image display panel 33 are provided a ticket printer 35, a card reader 36, a data displayer 37, and a keypad 38. The ticket printer 35 prints, on to a ticket, a barcode having encoded data containing credit-value, date and time, identification number of a gaming terminal 10 or the like, thereby issuing a ticket. 39 having a barcode attached thereto. A player can play a game in another gaming terminal 10 with the ticket 39 having the barcode, or exchange the ticket 39 having the barcode with bill or the like at a change booth or the like of the game arcade.

The card reader 36 reads/writes data from/into a smart card. The smart card is carried by a player, and stores therein data for identifying the player, data relating to a history of games played by the player, or the like.

The data displayer 37 includes a fluorescent display or the like, and displays the data read by the card reader 36 and the data input by the player through the keypad 38. The keypad 38 is for entering instructions or data relating to issuing of a ticket or the like.

(Electrical Structure of Gaming Machine 1)

Figure 33:
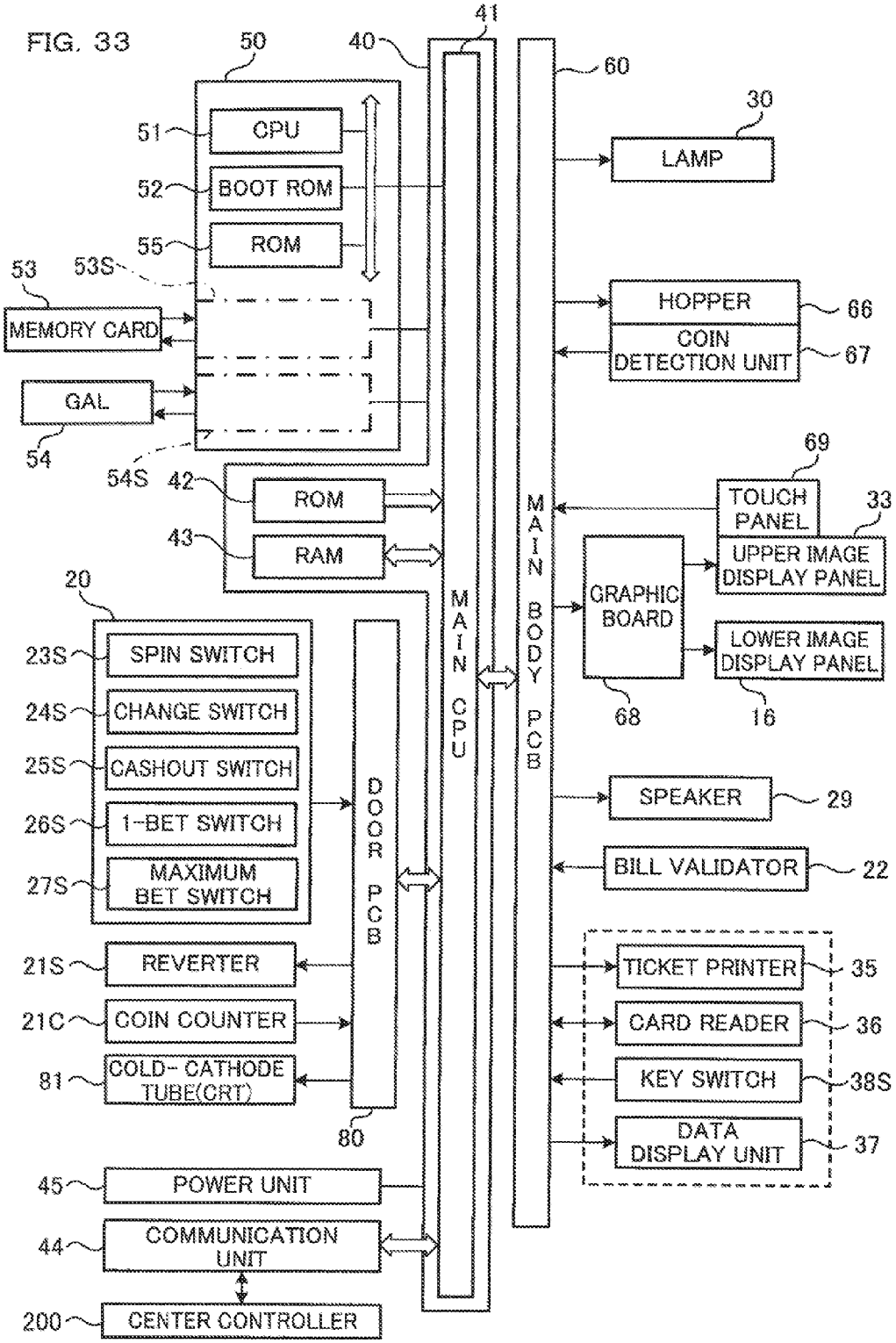
FIG. 33 is a block diagram illustrating the electrical structure of a gaming terminal.
Figure 34:
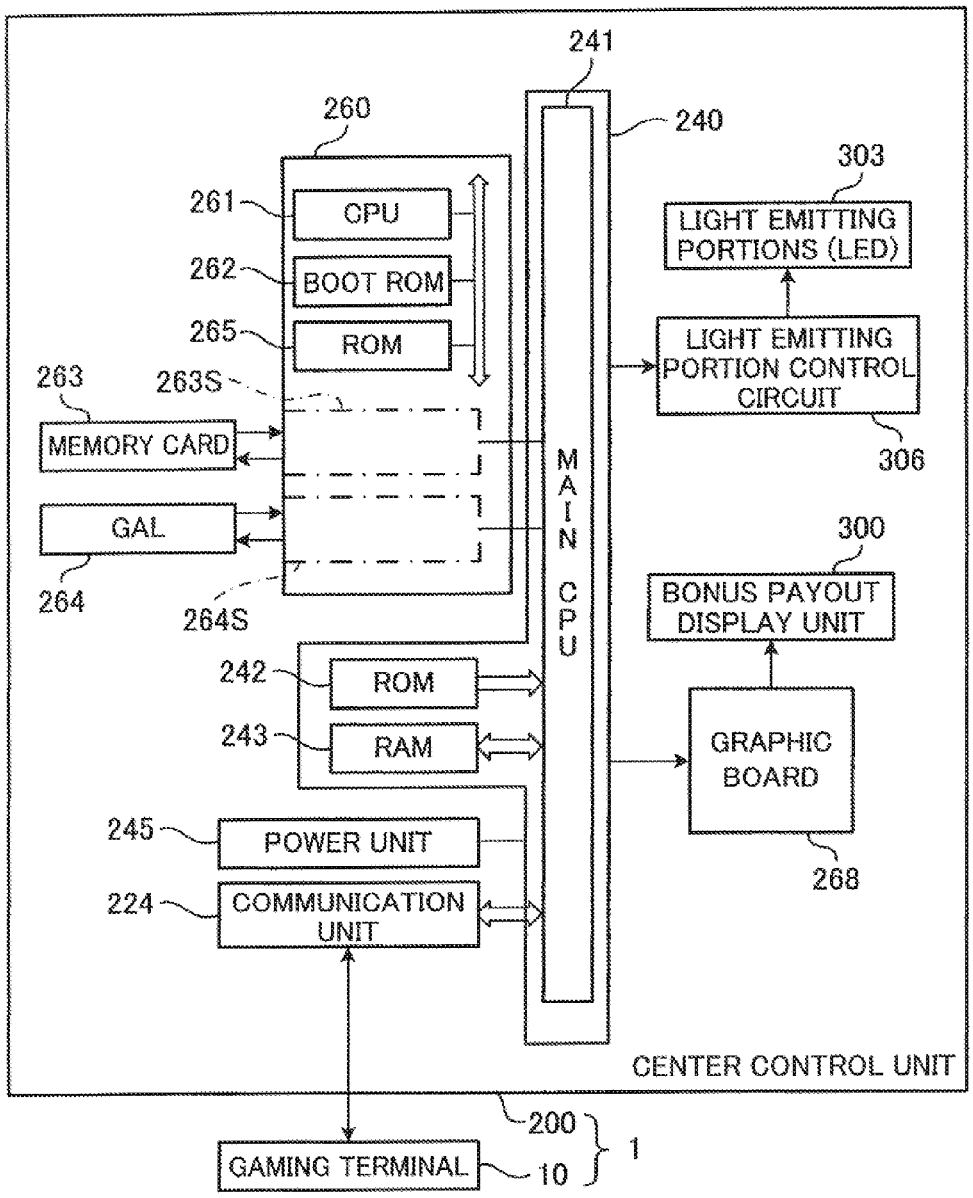
FIG. 34 is a block diagram illustrating the electrical structure of a center controller.

FIGS. 33 and 34 are block diagrams that each illustrate the electrical structure of the entire gaming machine 1.

(Electrical Structure of Gaming Terminal 10)

FIG. 33 is a block diagram illustrating the electrical structure of the gaming terminal 10. As illustrated in FIG. 33, the cabinet 11 includes a control unit having a terminal controller 100. As illustrated in FIG. 33, the control unit includes components such as a motherboard 40, a main body PCB (Printed Circuit Board) 60, a gaming board 50, a door PCB 80, and various switches, sensors, or the like.

The gaming board 50 is provided with a CPU (Central Processing Unit) 51, a ROM 55, a boot ROM 52, a card slot 53S corresponding to a memory card 53, and an IC socket 54S corresponding to a GAL (Generic Array Logic) 54. The CPU 51, the ROM 55, and the boot ROM 52 are connected to one another through an internal bus.

The memory card 53 stores therein a game program and a game system program. The game program contains a stop symbol determining program. The stop symbol determining program determines symbols (code number corresponding to the symbol) to be stopped in the arrangement areas 150. This stop symbol determining program contains sets of symbol weighting data respectively corresponding to various payout rates (e.g., 80%, 84%, 88%). Each set of the symbol weighting data indicates, for each of the display windows 151 to 155, a code number of each symbol and at least one random numerical value allotted to the code number. The numerical value is a value within a predetermined range of 0 to 256 for example.

The payout rate is determined based on payout rate setting data output from the GAL 54. Based on a set of the symbol weighting data corresponding to the payout rate determined, a symbol to be stopped is determined.

The memory card 53 stores therein various types of data for use in the game programs and the game system programs. For example, the memory card 53 stores a table listing combinations of a symbol 180 to be displayed on the display windows 151 to 155 of FIG. 22 and an associated range of random numerical values. This data is transferred to the RAM 43 of the motherboard 40, at the time of running a game program.

The card slot 53S is structured so as to allow the memory card 53 to be attached/detached to/from the card slot 53S. This card slot 53S is connected to the motherboard 40 through an IDE bus. Thus, the type and content of a game run by a gaming terminal 10 can be modified by detaching the memory card 53 from the card slot 53S, write a different game program and a different game system program into the memory card 53, and inserting the memory card 53 back into the card slot 53S.

Each of the game programs includes a program related to the progress of the game and/or a program for causing a transition to a bonus game. Each of the game programs includes image data and audio data output during the game.

The GAL 54 has input and output ports. When the GAL 54 receives data via input port, it outputs data corresponding to the input data from its output port. This data from the output port is the payout rate setting data described above.

IC socket 54S is structured go as to allow the GAL 54 to be attached/detached to/from the IC socket 54S. The IC socket 54S is connected to the motherboard 40, via a PCI bus. Thus, the payout rate setting data to be output from GAL 54 can be modified by: detaching the GAL 54 from the IC socket 54S, overwriting the program stored in the GAL 54, and attaching the GAL 54 back to the IC socket 54S.

The CPU 51, the ROM 55 and the boot ROM 52 connected through an internal bus are connected to the motherboard 40 through the PCI bus. The PCI bus communicates signals between the motherboard 40 and the gaming board 50 and supplies power from the motherboard 40 to the gaming board 50. The ROM 55 stores country identification information and an authentication program. The boot ROM 52 stores a preliminary authentication program and a program (boot code) for enabling the CPU 51 to run the preliminary authentication program.

The authentication program is a program (falsification check program) for authenticating the game program and the game system program. The authentication program is a program for confirming and verifying that the game program and the game system program are not falsified. In other words, the authentication program is described in accordance with a procedure for authenticating the game program and the game system program. The preliminary authentication program is a program for authenticating the authentication program. The preliminary authentication program is described in accordance with a procedure for verifying that the authentication program to be authenticated is not falsified. In short, the preliminary authentication program authenticates the authentication program.

The motherboard 40 is provided with a main CPU 41 (terminal controller 100), a ROM (Read Only Memory) 42, a RAM (Random Access Memory) 43, and a communication interface 44.

The main CPU 41 serves as a terminal controller 100 and has a function of controlling the entire gaming terminal 10. In particular, the main CPU 41 controls the following operations: an operation of outputting a signal instructing variable-displaying of symbols 180 to the graphic board 68, which is performed in response to pressing of the spin button 23 after betting of credit; an operation of determining symbols 180 to be stopped after the variable-displaying of symbols 180; and an operation of stopping the symbols 180 thus determined in the display window 151 to 155.

In other words, the main CPU 41 serves as an arrangement controller which arranges symbols to form a new symbol matrix through scrolling of symbols displayed on the lower image display panel 16. This main CPU 41 therefore determines symbols to be arranged in a symbol matrix by selecting symbols to be arranged from various kinds of symbols. Then, the main CPU 41 executes arrangement control to stop scrolling the symbols to present the symbols thus determined.

The ROM 42 stores a program such as BIOS (Basic Input/Output System) run by the main CPU 41, and permanently-used data. When the BIOS is run by the main CPU 41, each of peripheral devices is initialized and the game program and the game system program stored in the memory card 53 are read out through the gaming board 50. The RAM 43 stores data or a program used for the main CPU 41 to perform a process.

The communication interface 44 is provided to communicate with a host computer or the like equipped in the gaming facility, through the network (communication line). The communication interface 44 is also for communicating with the center controller 200 through a communication line. Further, a main body PCB (Printed Circuit Board) 60 and a door PCB 80 are connected to the motherboard 40, through USB (Universal Serial Bus). Further, the motherboard 40 is connected to a power unit 45. The power unit 45 supplies power to the motherboard 40 to boot the main CPU 41 thereof. Meanwhile, the power unit 45 supplies power to the gaming board 50 through the PCI bus to boot the CPU 51 thereof.

The main body PCB 60 and door PCB 80 are connected to various devices or units which generate signals to be input to the main CPU 41, and various devices or units whose operations are controlled by signals from the main CPU 41. Based on a signal input to the main CPU 41, the main CPU 41 runs the game program and the game system program stored in the RAM 43, to perform an arithmetic process. Then, the CPU 41 stores the result of the arithmetic process in the RAM 43, or transmits a control signal to the various devices and units to control them based on the result.

The main body PCB 60 is connected to a lamp 30, a hopper 66, a coin sensor 67, a graphic board 68, a speaker 29, a bill validator 22, a ticket printer 35, a card reader 36, a key switch 38S, and a data displayer 37.

The lamp 30 is turned on/off on the basis of a control signal from the main CPU 41. The lamp 30 is capable of lighting in multicolor. Specifically, the lamp 30 has red LEDs, green LEDs, and blue LEDs which respectively light in red, green, and blue upon a power supply. The lamp 30 is capable of lighting in any color by turning on and off LEDs under the control of the main PCB 60.

The hopper 66 is mounted in the cabinet 11 and pays out a predetermined number of coins from a coin outlet 19 to the coin tray 18, based on a control signal from the main CPU 41. The coin sensor 67 is provided inside the coin outlet 19, and outputs a signal to be input to the main CPU 41 upon sensing that a predetermined number of coins have been delivered from the coin outlet 19.

The graphic board 68 controls image displaying of the upper image display panel 33 and the lower image display panel 16, based on a control signal from the main CPU 41. Further, the graphic board 68 is provided with a VDP (Video Display Processor) for generating image data on the basis of a control signal from the main CPU 41, a video RAM for temporarily storing the image data generated by the VDP, or the like. Note that image data used at the time of generating the image data by the VDP is in a game program which is read out from the memory card 53 and stored in the RAM 43.

The bill validator 22 reads an image on a bill and takes only those recognized as genuine into the cabinet 11. When taking in a genuine bill, the bill validator 22 outputs input signal indicating the value of the bill to the main CPU 41. The main CPU 41 stores into the RAM 43 a credit-value corresponding to the value of the bill indicated by the signal.

The ticket printer 35 prints a barcode on to a ticket to issue a ticket 39 having the barcode. The barcode contains encoded data such as credit-value stored in the RAM 43, date and time, identification number of the gaming terminal 10, or the like, based on a control signal from the main CPU 41.

The card reader 36 reads out data from the smart card and transmits the data to the main CPU 41. Further, the card reader 36 writes data into the smart card based on the control signal output from the main CPU 41. The key switch 38S is mounted to the keypad 38, and outputs a signal to the main CPU 41 in response to an operation of the keypad 38 by the player. The data displayer 37 displays, based on a control signal from the main CPU 41, the data read by the card reader 36 or the data input by the player through the key pad 38.

The touch panel 69 sends position data comprising a lateral axis and a vertical axis of the location pressed by a player to the main CPU 41. The main CPU refers to a position information table stored in ROM 42 that will be described later and determines the set color associated with the position data. That is, the main CPU 41, ROM 42, and the touch panel 69 function as a color-setting unit 302.

The door PCB 80 is connected to the control panel 20, a reverter 21S, a coin counter 21C, and a cold cathode tube 81. The control panel 20 is provided with: a spin switch 23S associated with the spin button 23; a change switch 245 associated with the change button 24; a cashout switch 25S associated with the cashout button 25; a 1-bet switch 26S associated with the 1-bet button 26; and a maximum bet switch 27S associated with the maximum bet button 27. Each of the switches 23S to 27S outputs a signal to the main CPU 41, when a player presses the associated button.

The coin counter 21C is provided within the coin insertion slot 21, and identifies whether the coin inserted into the coin insertion slot 12 by the player is genuine. A coin except the genuine coin is discharged from the coin outlet 19. In addition, the coin counter 21C outputs input signal to the main CPU 41 upon detection of a genuine coin.

The reverter 21S is operated on the basis of the control signal output from the main CPU 41 and distributes a coin, which is recognized as a genuine coin by the coin counter 21C, to a not-shown cash box or hopper 66 mounted in the gaming terminal 10. In other words, when the hopper 66 is full of the coins, the genuine coin is distributed into the cash box by the reverter 21S. On the other hand, when the hopper 66 is not yet full of the coins, the genuine coin is distributed into the hopper 66. The cold cathode tube 81 functions as a backlight mounted to rear sides of the lower image display panel 16 and the upper image display panel 33. This cold cathode tube 81 turns on according to a control signal from the main CPU 41.

(Electrical Structure of Center Controller 200)

FIG. 34 is a block diagram illustrating the electrical structure of the center controller 200. The center controller 200 is provided therein with a control unit. As illustrated in FIG. 34, the control unit includes components such as a motherboard 240, a gaming board 260, an actuator, or the like.

The gaming board 260 has the same structure as that of the gaming board 50. The motherboard 240 has the same structure as that of the motherboard 40. The communication interface 244 communicates with the terminal controller 100 through a communication line.

Specifically, the motherboard 240 comprises the main CPU 241, the ROM 242, and the RAM 243. For example, the RAM 243 stores and accumulates a progressive signal sent from each gaming terminal 10 as a contribution amount for each gaming terminal 10. That is, the RAM 243 comprises the functions of the progressive storage unit 201 as a contribution amount memory. Here, the total of all contribution amounts becomes a progressive value.

The graphic board 268 has the same structure as that of the graphic board 68, except in that the graphic board 268 controls displaying of the bonus payout display unit 300 based on a control signal from the main CPU 241.

A light-emitting portion control circuit 306 controls the activation of an LED as a light-emitting portion 303, activating and deactivating the light-emitting portions 303 based on a control signal output from the main CPU 241.

(Position Information Table)

FIG. 35 illustrates a position information table. The position information table is stored in the ROM 42 of the gaming terminal 10. The position information table is referred to in order to determine a set color when the touch panel 69 is pressed in the set color selection screen as illustrated in FIG. 29. The position information table has a column for the lateral axis range, a column for the vertical axis range, and a column for set color. Specifically, when the main CPU 41 receives position data in the lateral axis and the vertical axis from the touch panel 69, the main CPU 41 selects a row in concordance with the position data from the columns for the lateral axis range and the vertical axis range to determine a set color. For example, in the example of FIG. 35, the position data in the lateral axis direction is "200". When the position data in the vertical axis direction is "400", the set color is "pink".

(Set Color Management Table)

FIG. 36 illustrates a set color management table. The set color management table is stored in the RAM 243 of the center controller 200. The set color management table is updated after a set color is determined. Further, the set color management table is referred to when determining an emission color of the light-emitting portion 303. The set color management table has a gaming terminal column for storing the gaming terminal ID that refers to each gaming terminal 10 and a set color column for storing the set color that is determined for each gaming terminal. For example, when the color "blue" is set in the gaming terminal 10, the set color information is sent to the center controller, and the color "blue" is stored as a set color for the gaming terminal ID corresponding to the set color management table.

(Path Unit Activation State Table)

FIG. 37 illustrates a path unit activation state table. The path unit activation state table is stored in the RAM 243. The path unit activation state table illustrates the number of activated light-emitting portions 303, and the number of inactive light-emitting portions 303, for each of the path units 301. For instance, there are ten activated light-emitting portions 303 and ninety inactivated light-emitting portions 303 on the path unit 301*a*.

(Contribution Amount Management Table)

FIG. 38 illustrates a contribution amount management table. The contribution amount management table is stored in the RAM 243.

The contribution amount management table indicates the accumulated contribution amount of each gaming terminal 10 in relation to the progressive value.

For example, the contribution level management table indicates that the contribution amount of the gaming terminal 10*a* is $130.

(Emission Color Control Table)

FIG. 39 illustrates an emission color control table. The emission color control table is stored in a RAM 243. The emission color control table is referred to when the main CPU 41 emits the light-emitting portion 303 in the same color as the set color. For example, when the set color of one gaming terminal 10 is "orange", the tone of each LED for the light-emitting portion 303 of the path unit 301 associated with the gaming terminal 10 is controlled according to the emission color control table. Specifically, when the light-emitting portion 303 emits the color "orange", the main CPU 41 renders the red LED of the light-emitting portion 303 to emit tone 4 and the green LED of the light-emitting portion 303 to emit tone 4.

(Operation of Gaming Machine 1: Boot Process)

The following describes a boot process routine which takes place in the gaming machine 1. Upon turning on the power of the gaming machine 1, the boot process routine illustrated in FIG. 40 begins in the motherboard 240 and the gaming board 260 in the center controller 200 and in the motherboard 40 and the gaming board 50 in the terminal controller 100. The memory cards 53 and 263 are assumed to be inserted into the card slots 53S and 263S of the gaming boards 50 and 260, respectively. Further, the GALs 54 and 264 are assumed to be attached to the IC sockets 54S and 264S, respectively.

First, turning on the power switch of (powering on) the power units 45 and 245 boots the motherboards 40 and 240, and the gaming boards 50 and 260. Booting the motherboards 40 and 240 and the gaming boards 50 and 260 starts separate processes in parallel. Specifically, the CPUs 51 and 261 read out preliminary authentication programs stored in the boot ROMs 52 and 262, respectively. Then, preliminary authentication is performed according to the read out programs so as to confirm and verify that no falsification is made to authentication programs, before reading them in the motherboards 40 and 240, respectively (S1). Meanwhile, the main CPUs 41 and 241 of the motherboards 40 and 240 run BIOS stored in the ROMs 42 and 242 to load into the RAMs 43 and 243 compressed data built in the BIOS, respectively (S2). Then, the main CPUs 41 and 241 run a procedure of the BIOS according to the data loaded into the RAMs 43 and 243 so as to diagnose and initialize various peripheral devices (S3).

The main CPUs 41 and 241, which are respectively connected to the ROMs 55 and 265 of the gaming boards 50 and 260 via PCI buses, read out authentication programs stored in the ROMs 55 and 265 and stores them in the RAMs 43 and 243 (S4). During this step, the main CPUs 41 and 241 each derives a checksum through ADDSUM method (a standard check function) which is adopted in a standard BIOS, and store the authentication programs into RAMs 43 and 243 while confirming if the operation of storing is carried out without an error.

Next, the main CPUs 41 and 241 each checks what connects to the IDE bus. Then, the main CPUs 41 and 241 access, via the IDE buses, to the memory cards 53 and 263 inserted into the card slots 53S and 263S, and read out game programs and game system programs from the memory cards 53 and 263, respectively. In this case, the CPUs 41 and 241 each reads out four bytes of data constituting the game program and the game system program at one time. Next, according to an authentication program stored in RAMs 43 and 243, the main CPUs 41 and 241 authenticate the game program and the game system program that have been read out to confirm and verify that these programs are not falsified (S5).

When the authentication properly ends, the main CPUs 41 and 241 write and store the authenticated game programs and game system programs in RAMs 43 and 243 (S6).

Next, the main CPUs 41 and 241 access, via the PCI buses, to the GALs 54 and 264 attached to the IC socket 54S 264S, and read out payout rate setting data from the GALs 54 and 264, respectively. The payout rate setting data read out is then written and stored in the RAMs 43 and 243 (S7).

Next, the main CPUs 41 and 241 read out, via the PCI buses, country identification information stored in the ROMs 55 and 265 of the gaming boards 50 and 265, respectively. The country identification information read out is then stored in the RAMs 43 and 243 (S8).

Figure 41:
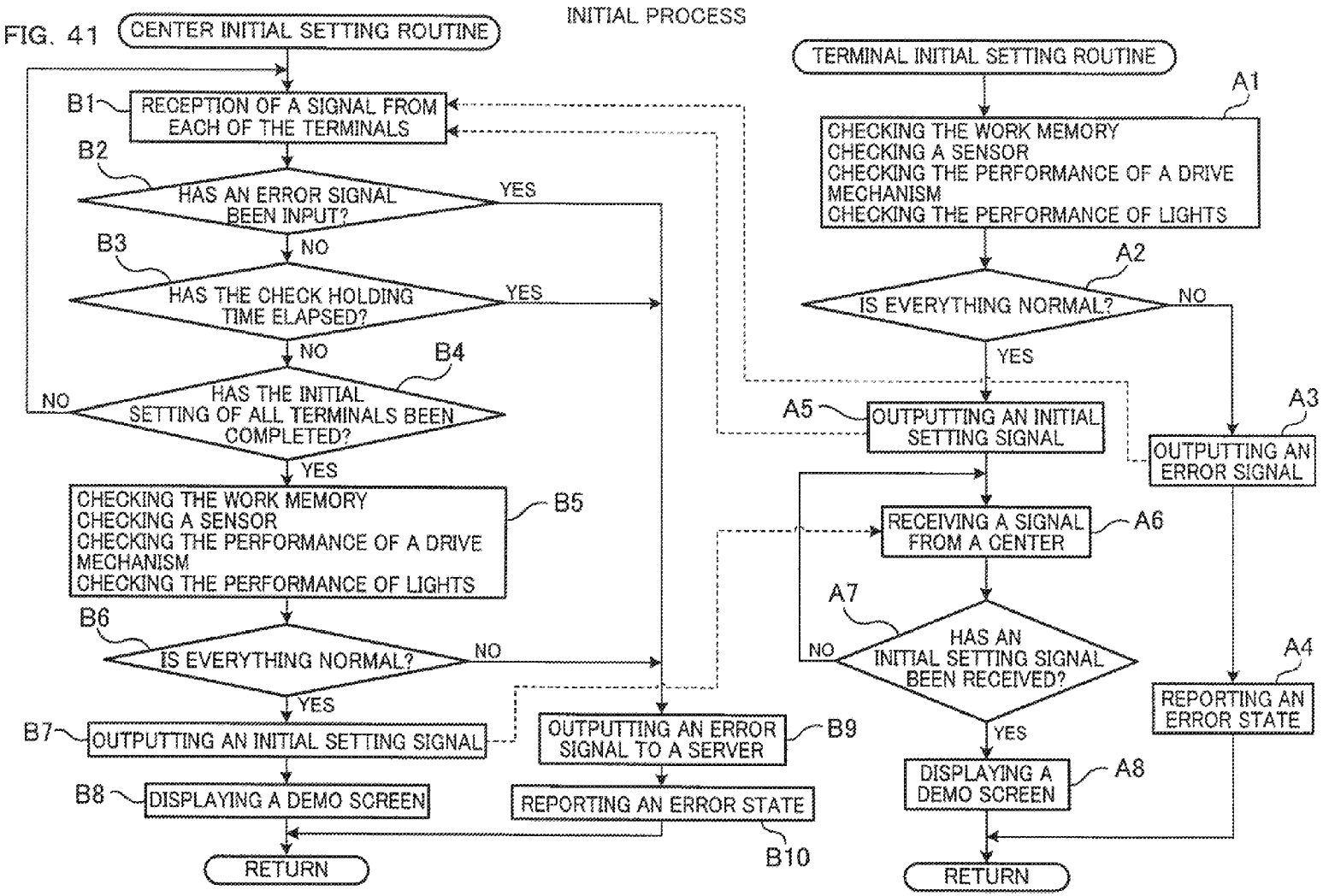
FIG. 41 is a flowchart illustrating an initial process executed in the gaming terminal and the center controller.

After performing the above process, the main CPUs 41 and 241 each perform the initial process of FIG. 41.

(Operation of Gaming Machine 1: Initial Process)

Figure 40:
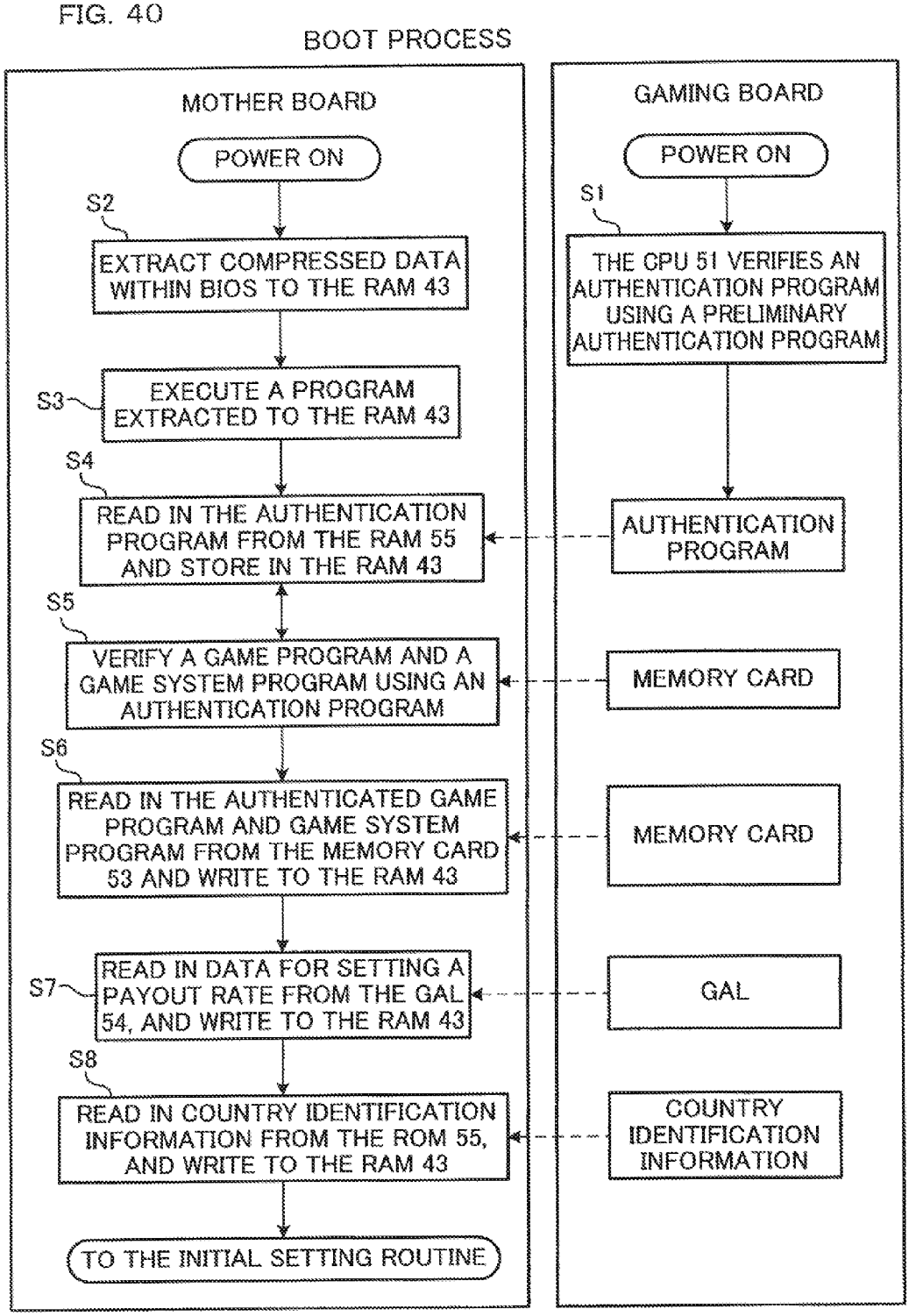
FIG. 40 is a flowchart illustrating a boot process executed in the gaming terminal and the center controller.

The following describes an initial process which takes place in the gaming machine 1. When the boot process of FIG. 40 is completed, the center controller 200 reads out, from the RAM 243, the center side initial setting routine illustrated in FIG. 41 and executes the routine. Meanwhile, when the boot process of FIG. 40 is completed, the gaming terminal 10 reads out, from the RAM 43, the terminal side initial setting routine illustrated in FIG. 41 and executes the routine. The center side and terminal side initial setting routines are executed in parallel.

First, the main CPU 41 of each of the gaming terminals 10 checks operations of work memories such as the RAM 43, various sensors, various driving mechanisms, and various decorative illuminations (A1). Then, the main CPU 41 determines if all the check results are normal (A2). If the main CPU 41 determines that the check results contains an error (A2: NO), the main CPU 41 outputs a signal notifying the error (hereinafter, error signal) to the center controller 200 (A3). Further, the main CPU 41 reports-the error in the form of illuminating the lamp 30 or the like (A4), and then ends the routine.

On the other hand in A2, if the main CPU 41 determines that all the check results are normal (A2: YES), an initial setting signal is output to the center controller 200 (A5). Then, an initial setting signal is waited from the center controller 200 (A6, A7: NO).

The main CPU 241 of the center controller 200 receives signals from each of the terminals (B1). Then, the main CPU 241 determines whether a signal received is an error signal (B2). If the main CPU 241 determines that the signal is an error signal (B2: YES), the main CPU 241 outputs the error signal to a server of a not-shown host computer or the like (B9) to report the error (B10), and ends the routine.

On the other hand in B2, if the main CPU 241 determines that the signal is not an error signal (B2:NO), the main CPU 241 determines whether a predetermined time (check time) has elapsed from the time of powering on (B3). If the main CPU 241 determines that the check time has elapsed (B3: YES), B9 is executed. On the other hand, if the main CPU 241 determines that the check time has not yet elapsed (B3:NO), it is determined whether an initial setting signal is received from each of the gaming terminals 3 (B94). If the main CPU 241 determines that an initial setting signal from any one of the gaming terminals 10 is not received (B4: NO), the process returns to B1. On the other hand, if it is determined that initial setting signals from all the gaming terminals 10 are received (B4: YES), the main CPU 241 checks operations of work memories such as RAM 243 or the like, various sensors, various driving mechanisms, and various decorative illuminations (B5). Then, the main CPU 241 determines whether all the check results are normal (B6). If the main CPU 241 determines the check results contain an error (B6: NO), the main CPU 241 executes B9.

On the other hand, in B6, if all of the check results are determined as normal (B6: YES), the main CPU 241 outputs an initial setting signal to all of the gaming terminals 10 (B7) and causes the shared display 102 to display a demo screen (B8) Then, the main CPU 241 ends the routine.

In the process of A7, the main CPU 41 of the gaming terminals 10 determines that an initial setting signal has been received from the center controller 200 (A7: YES) and causes the upper image display panel 33 to display a demo screen (A8) The main CPU 41 then ends the routine.

(Operation of Gaming Terminal 10: Terminal Process Routine)

Figure 42:
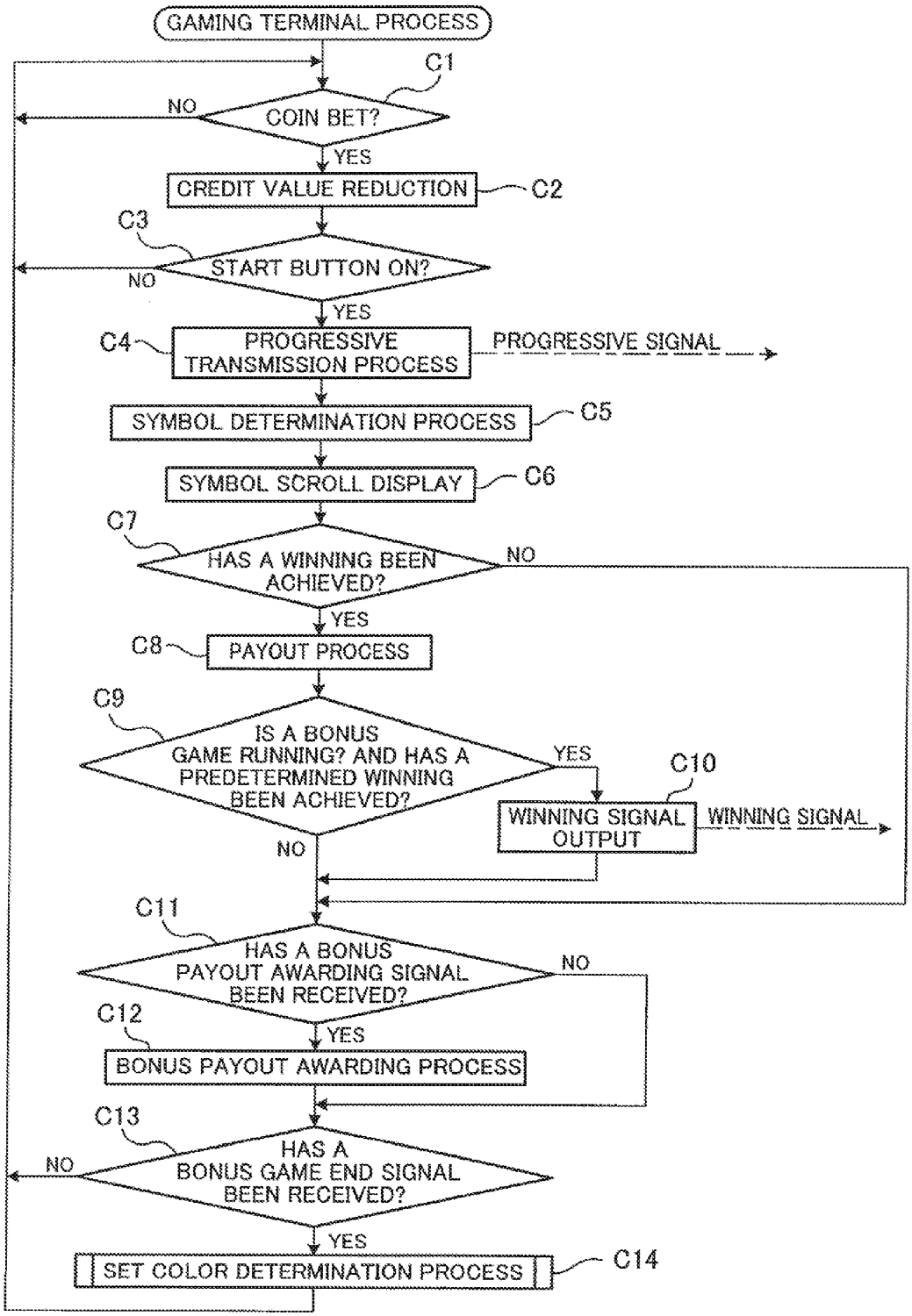
FIG. 42 is a flowchart illustrating a gaming terminal process routine executed in the gaming terminal according to the embodiment 2-1.

After the terminal side initial setting routine of FIG. 41, the main CPU 41 of the gaming terminal 10 performs the gaming terminal process routine of FIG. 42. Through this terminal process routine executed by the main CPU 41, a game is run.

As illustrated in FIG. 42, in the gaming terminal process routine, a determination is made as to whether a coin has been bet (C1). In this step, it is determined whether a signal from the 1-bet switch 26S entered by pressing of the 1-bet button 26 is received. Meanwhile, it is determined whether a signal from the maximum bet switch 27S entered by pressing of the maximum bet button 27 is received. If no coin is bet (C1: NO), C1 is repeated until a coin is bet.

On the other hand, if a coin is bet (C1: YES), the credit value stored in the RAM 43 is reduced according to the number of coins bet (C2). When the number of coins bet surpasses the number of coins equivalent to the credit value stored in the RAM 43, the process goes to later-described C3 without the reduction of the credit value. When the number of coins bet exceeds the maximum number of coins bettable for one game (50 pieces in this embodiment), the process goes to a later-described step C3 without the reduction of the credit value.

Then, it is determined whether a spin button 23 is pressed (C3). If the spin button 23 is not pressed (C3: NO), the process returns to C1. Here, if the spin button 23 is not pressed (for example, the spin button 23 is not pressed but a command to end the game is input), the reduction of the credit value in C2 is canceled.

On the other hand, when the spin button 23 is pressed (C3: YES), a progressive transmission process is executed (C4). In other words, a progressive signal indicating a part of the game value bet is transmitted to the center controller 200.

Next executed is a symbol determining process (C5). That is, the stop symbol determination program stored in the RAM 43 is run to determine the symbols 180 to be stopped in the matrix 156. Through this, a symbol combination to be formed along the payline L is determined.

Then, the scrolling process is executed to scroll-display the symbols 180 on the lower image display panel 16 (C6) The scrolling process is a process in which the symbols 180 determined in C5 are stopped (rearranged) in the matrix 156 after the symbols 180 are scrolled in the direction indicated by an arrow symbol.

Next, a determination is made as to whether a winning has been achieved based on the combination of symbols 180 rearranged in the matrix 156 (C7). When it is determined that a winning is resulted (C7: YES), a payout process is executed (C8). More specifically, when a winning is resulted, the number of coins according to the combination is calculated. On the other hand in C7, when it is determined that no winning is resulted (C7: NO), C11 is executed.

After a payout process in C8 is executed, the main CPU 41 determines whether a bonus game is running, and whether a predetermined winning is resulted (C9). When a bonus game start signal is received from the center controller 200, the CPU 41 determines that the bonus game is running. If a bonus game is running, and if it is determined that a predetermined winning is resulted (C9, YES), the main CPU 41 outputs a winning signal to the center controller 200 (C10), and the main CPU executes a process of C11. Meanwhile, if a bonus game is not running, or if it is determined that a predetermined winning is not resulted (C9, NO), a process of C11 is executed.

Next, the main CPU 41 determines whether a bonus award signal is received from the center controller 200 (C11). When it is determined that a bonus award signal is received (C11, YES), a payout is awarded based on the bonus award signal (C12). When it is determined that a bonus award signal is not received after C12 or in C11 (C11, NO), it is determined whether a bonus end signal is received (C13). When it is determined that a bonus end signal is not received (C13, NO), the process returns to C1.

Meanwhile, when it is determined that a bonus end signal has been received (C13: YES), a set color determination process is run (C14). The set color determination process will be described later in detail with reference to FIG. 43. Afterwards, the process returns to C1.

(Operation of Gaming Terminal 10: Set Color Determination Routine)

Figure 43:
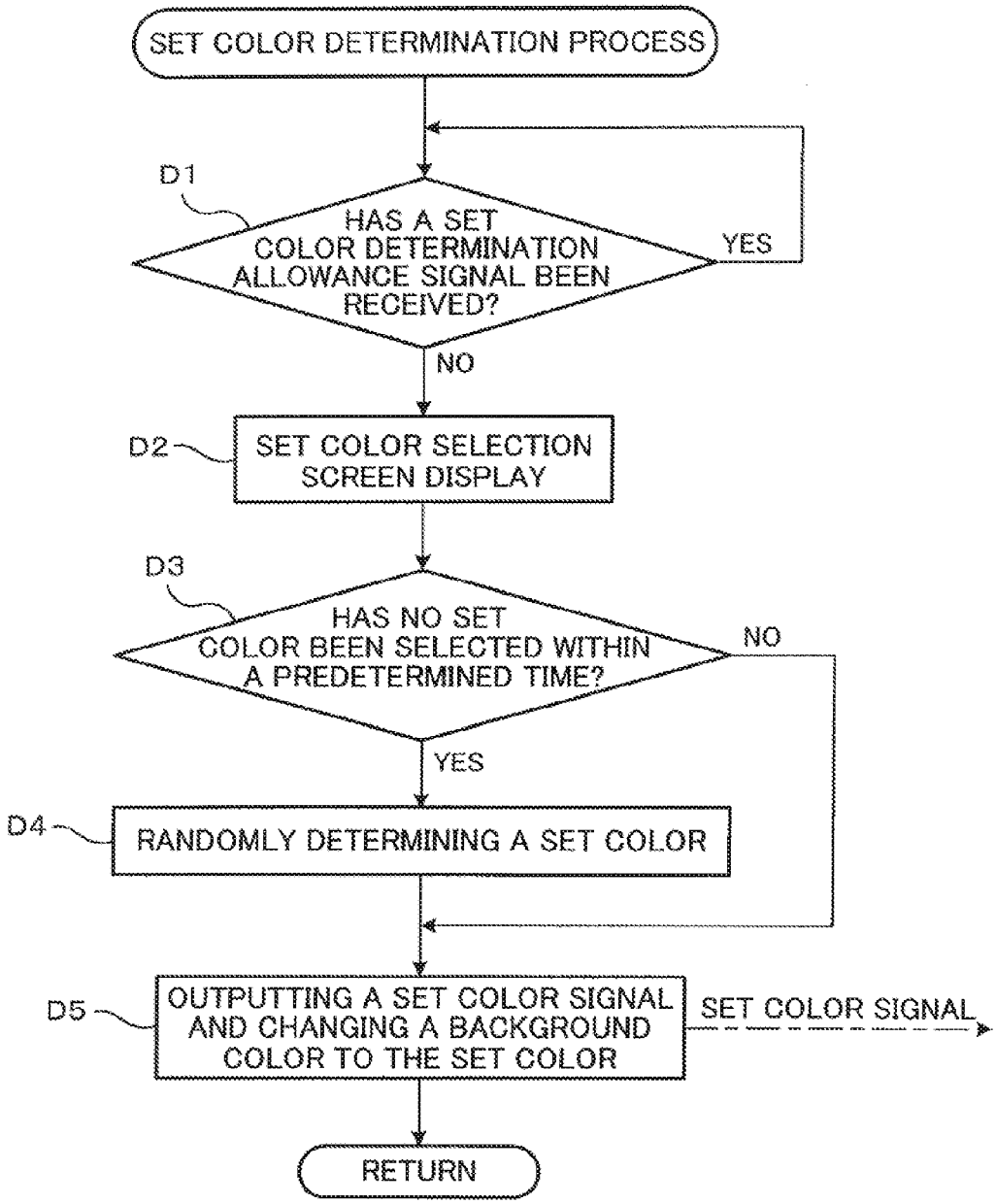
FIG. 43 is a flowchart illustrating a set color determination process routine executed in the gaming terminal according to the embodiment 2-1.

The following describes a set color determination process routine run by the main CPU 41 of the gaming terminal 10 with reference to FIG. 43. First, a determination is made as to whether a set color selection authorization signal has been received (D1). When the emission color selection signal has not been received (D1: NO), D1 is repeated. When the set color selection signal has been received (D1: YES), a set color selection screen as illustrated in FIG. 29 and FIG. 30 is displayed on the upper image display panel 33 (D2).

Here, the set color selection authorization signal includes set color information stored in the set color management table. That is, in the process of step D2, the main CPU does not display the set color that has already been selected in the color selection button area 141of the set color selection screen.

Then, a determination is made as to whether the set color has been selected within a predetermined period of time (D3). When it has not been selected within a predetermined period of time (D3: NO), an emission color is randomly determined (D4) Here, when the random button area 142 is pressed in the set color selection screen, similar to the case in which a set color has not been determined within a predetermined period of time, the process of step D4 is performed.

Further, in the step D3, whether a set color is selected is determined by whether position data has been sent using the touch panel 69 as an input device. The main CPU 41 refers to a set color associated with the position data range stored in the position information table of the ROM 42 to determine the selected set color. After the D4 process or when a set color is selected within a predetermined period of time (D3:YES), the main CPU 41 outputs a set color signal that includes the determined set color information and the gaming terminal ID to the center controller 200. Further, the main CPU 41 changes the color of the background display area 140 of the upper image display panel 33 to the determined set color and then ends the routine.

(Operation of Center Controller 200: Center Process Routine)

Figure 44:
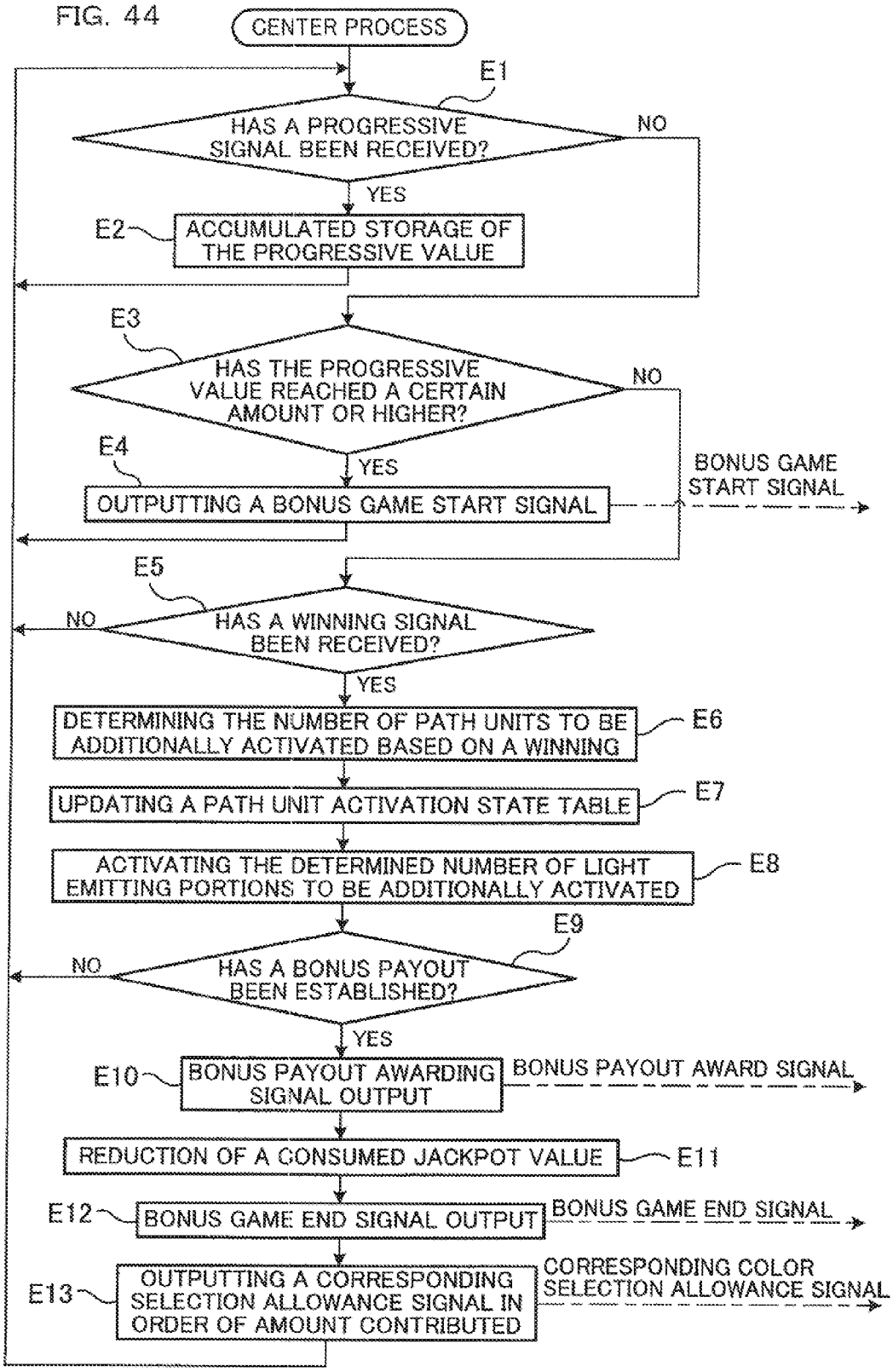
FIG. 44 is a flowchart illustrating a center process routine executed in the center controller according to the embodiment 2-1.

After the center side initial setting routine illustrated in FIG. 41, the main CPU 241 of the center controller 200 executes the center process routine of FIG. 44. The main CPU 241 executes the center process routine to run a bonus game.

As illustrated in FIG. 44, in the center process routine, the main CPU. 241 determines whether a progressive signal has been received from the gaming terminal 10 (E1). If it is determined that a progressive signal has been received (E1: YES), a game value indicated by the progressive signal is stored and accumulated for each gaming terminal 10 (E2). The process then returns to E1.

On the other hand, in the process of E1, if the main CPU 241 determines that no progressive signal has been received (E1: NO), the main CPU 241 determines whether the progressive value equals or exceeds a predetermined value (E3). When it is determined that the progressive value equals or exceeds the predetermined value (E3: YES), a bonus game start signal is output to each of the gaming terminals 10 (E4). Next, a process of E1 is executed.

Meanwhile, when it is determined that the progressive value is less than a predetermined value (E3: NO), the main CPU 241 determines whether a winning signal has been received from the terminal controller 100 (E5). If the main CPU 241 determines that no winning signal is received (E5: NO), the process returns to E1. On the other hand, when the main CPU 241 determines that a winning signal is received (E5, YES), the main CPU 241 determines the number of light-emitting portions 303 of a path unit 301 to be activated, based on a winning (E6). Then, the main CPU 241 updates the path unit activation state table based on the determined number of light-emitting portions 303 to be activated (E7). Then, the main CPU 241 activates the determined number of light-emitting portions 303 towards the bonus payout display unit 300 (E8). Specifically, the main CPU 241 refers to the set color management table and obtains the set color of the gaming terminal 10 that activates the path unit 301. The main CPU 241 then refers to the emission color control table and obtains the control information of each LED in the light-emitting portion 303 associated with the obtained set color. Furthermore, the main CPU 241 activates the light-emitting portion 303 based on the control information of each LED.

Next, it is determined whether a bonus payout is to be awarded, by determining whether the light-emitting portions 303 of any of the path units 301 have been lighted up to the bonus payout display unit 300 (E9). When it is determined that a bonus payout is not to be awarded (E9, NO), the process returns to E1. On the other hand, when it is determined that a bonus payout is to be awarded (E9, YES), a bonus award process is run to award a bonus payout, a bonus award signal is output to a gaming terminal 10 through which a bonus payout is awarded (E10). Then, the consumed progressive value is deducted from the RAM 243 (E11) and a bonus game end signal is output to each of the gaming terminals 10 (E12). Afterwards, a set color selection authorization signal is output to each of the gaming terminals in descending order of contribution amount (E13). Specifically, with reference to the contribution amount management table illustrated in FIG. 38, a set color selection authorization signal including the set color management table information illustrated in FIG. 36 is output to the gaming terminal 10 having the highest contribution amount stored and accumulated from among the gaming terminals 10 that have not yet executed a command to display a set color selection screen. When a set color signal is received from the gaming terminal 10 into which the set color selection authorization signal has been output, the set color management table is updated based on the received information. The same process is repeated for all of the gaming terminals 10 to determine the set color of each gaming terminal 10. Afterwards, the process returns to E1.

As mentioned above, a base game is run in a plurality of gaming terminals 10 independently of another gaming terminal 10, and a payout is awarded according to a predetermined winning. According to a predetermined timing, a background image according to the set color determined by the main CPU 41 is displayed in the background display area 140 of the upper image display panel 33 of the gaming terminal 10.

Further, a bonus game is run based on a predetermined condition. When a predetermined winning is achieved in the gaming terminal 10, based on the number of predetermined winnings, light-emitting portions 303 are additionally activated in an emission color based on the set color from the first end 304 to the second end 305 of the path unit 301 associated with the gaming terminal 10. When the path unit 301 is activated up to the light-emitting portions 303 at the second end 305, a bonus payout is awarded through the gaming terminal 10 associated with the path unit 301.

This realizes a background image displayed on the upper image display panel 33 of the gaming terminal 10 and a path unit 301 associated with the gaming terminal 10 in a mode based on the color set by a color-setting unit 302. As a result, the gaming terminals 10 are respectively associated with the path units 301. This realizes a new entertainment characteristic.

A base game is run in each of the gaming terminals 10 independently of another gaming terminal 10, and a payout is awarded according to a predetermined winning. For a plurality of gaming terminals 10, reception through an input device capable of receiving input from outside is allowed in descending order of the contribution amount stored and accumulated in the contribution amount memory. The set color is determined according to input through the input device. A background image according to the set color is displayed in the background display area 140 of the upper image display panel 33 of the gaming terminal 10 according to a predetermined timing. Further, a bonus game is run based on a predetermined condition. Each time a predetermined winning is achieved in the gaming terminal 10, based on the number of predetermined winnings, light-emitting portions 303 are additionally activated in an emission color according to the set color from the first end 304 to the second end 305 of the path unit 301 associated with the gaming terminal 10. When the path unit 301 is activated up to the light-emitting portions 303 at the second end 305, a bonus payout is awarded through the gaming terminal 10 associated with the path unit 301.

This realizes a background image displayed on the upper image display panel 33 of the gaming terminal 10 and a path unit 301 associated with the gaming terminal 10 in a mode according to the set color. As a result, the gaming terminals 10 are easily associated with path units 301, respectively. Further, the gaming terminal 10 is allowed to receive input through the input device based on the contribution amount. This realizes new entertainment characteristics.

(Embodiment 2-2)

In the following, the embodiment 2-1 of the slot machine and the playing method thereof according to the invention will be described with reference to FIG. 45 and FIG. 46. Identical members as those described in the embodiment 2-1 are indicated with the same reference numerals, so the descriptions thereof will be omitted.

As illustrated in FIG. 45, the gaming machine 1 comprises: gaming terminals 10 that run a base game independently of one another; a center controller 200 that runs a bonus game is connected to the gaming terminals 10 and is in communication with the gaming terminals 10; a bonus payout display unit 300 that displays an amount of a bonus payout awarded in a bonus game; path units 301 respectively associated with each of the gaming terminals 10, each path unit 301 having light-emitting portions 303 aligned to form a path from the first end 304, which is closer to the respectively associated gaming terminal of the plurality of gaming terminals 10, to the second end 305, which is closer to the bonus payout display unit 300. The gaming machine 1 according to the present embodiment is different from the one in the embodiment 2-1 in its method of determining a set color.

(Achievement Level Table)

FIG. 46 illustrates an achievement level mapping table. The achievement level mapping table is stored in the ROM 242 of the center controller 200. The achievement level mapping table is referred to when determining a set color associated with the achievement level of each gaming terminal 10. Herein, the achievement level refers to the lowness of the number of light-emitting portions 303 that are inactive in the path unit 301 (the number of inactive light-emitting portions left after activation). That is, the path unit 301 indicates a lower number of light-emitting portions remaining after activation for higher achievement levels. Specifically, as illustrated in FIG. 45, when the main CPU 41 determines a set color, the main CPU 31 refers to the path unit activation state table and determines the ranking of the achievement level. The main CPU 241 refers to an achievement level mapping table in which the ranking of the achievement level and the set color are associated in advance, and determines the set color associated with the gaming terminal 10. For example, the gaming terminal 10 with the highest achievement level has a set color of "red".

The achievement level is not limited to this configuration. For example, it may be determined on the basis of the number of light-emitting portions 303 to be activated or on the basis of the ratio of light-emitting portions 303 to be activated from among the light-emitting portions 303 of one entire path unit 301.

(Operation of Gaming Terminal 10: Terminal Process Routine)

When the main CPU 31 of the gaming terminal 10 completes the running of the terminal side initial setting routine illustrated in FIG. 41, the main CPU 41 runs the gaming terminal process routine illustrated in FIG. 43. This is similar to the embodiment 2-1 but is different in the aspect that the set color determination process of step C14 is not performed.

Furthermore, the main CPU 41 of the gaming terminal 10 is different from the gaming terminal in the embodiment 2-1 and is triggered by a set color signal that is sent from the center controller 200 to change the color of the background image in the background display area 140 to the color based on the set color signal. Specifically, the main CPU 41 changes the background image in the background display area 140 to the same color as the set color.

(Operation of Center Controller 200: Center Process Routine)

When the main CPU 241 of the center controller 200 completes the running of the center side initial setting routine illustrated in FIG. 41, the main CPU 241 runs the center process routine illustrated in FIG. 44. This is similar to the one in the embodiment 2-1 but is different in the aspect that it runs a process of determining a set color upon receiving a winning signal.

Specifically, the achievement level of each gaming terminal 10 is determined after activating the light-emitting portion based on the winning signal (E8). In particular, the main CPU 241 refers to the path unit activation state table updated in step E7 of the center process routine and determines the ranking of the gaming terminals 10 in a descending order of achievement level. The main CPU 241 then refers to the achievement level mapping table in which the ranking of the achievement levels is associated in advance with the set color, and determines the set color associated with the gaming terminal 10. Afterwards, it changes the color of the activated light-emitting portions 303 of each path unit 301 to the emission color, which is the same as the associated set color, and sends a set color signal that includes information on the set color determined for each of the gaming terminals 10.

Thus, a base game is run in a plurality of gaming terminals 10 independently of another gaming terminal 10, and a payout is awarded according to a predetermined winning. Further, a bonus game is run based on a predetermined condition. Each time a predetermined winning is achieved in the gaming terminal 10, the number of light-emitting portions 303 to be additionally activated is determined according to the predetermined winning, and an achievement level is determined according to the number of light-emitting portions 303 activated in the path unit 301 as a result of additional activation. The determined number of light-emitting portions 303 are additionally activated from the first end 304 to the second end 305 of the path unit 301 associated with the gaming terminal 10, and the color of the activated light-emitting portions 303 is changed to the color associated with the achievement level. A background image according to the color associated with the achievement level is displayed in the background display area 140 of the gaming terminal 10. When the path unit 301 is activated up to the light-emitting portions 303 at the second end 305, a bonus payout is awarded through the gaming terminal 10 associated with the path unit 301.

This realizes a background image displayed in the terminal display unit of the gaming terminal 10 and a path unit 301 associated with the gaming terminal 10 in a mode according to the color associated with the achievement level, which is determined based on the number of light-emitting portions 303 activated in the path unit 301. As a result, a plurality of gaming terminals 10 can be easily associated with each respective path unit 301, and the achievement level can be easily recognized. This realizes new entertainment characteristics.

Hereinabove, the embodiments 2-1 and 2-2 of the present invention have been described. The present invention is not limited to the above embodiments. The below-described variation may be applied to the present invention. The following describes a base game according to a variation of the second embodiment of the present invention.

Figure 47:
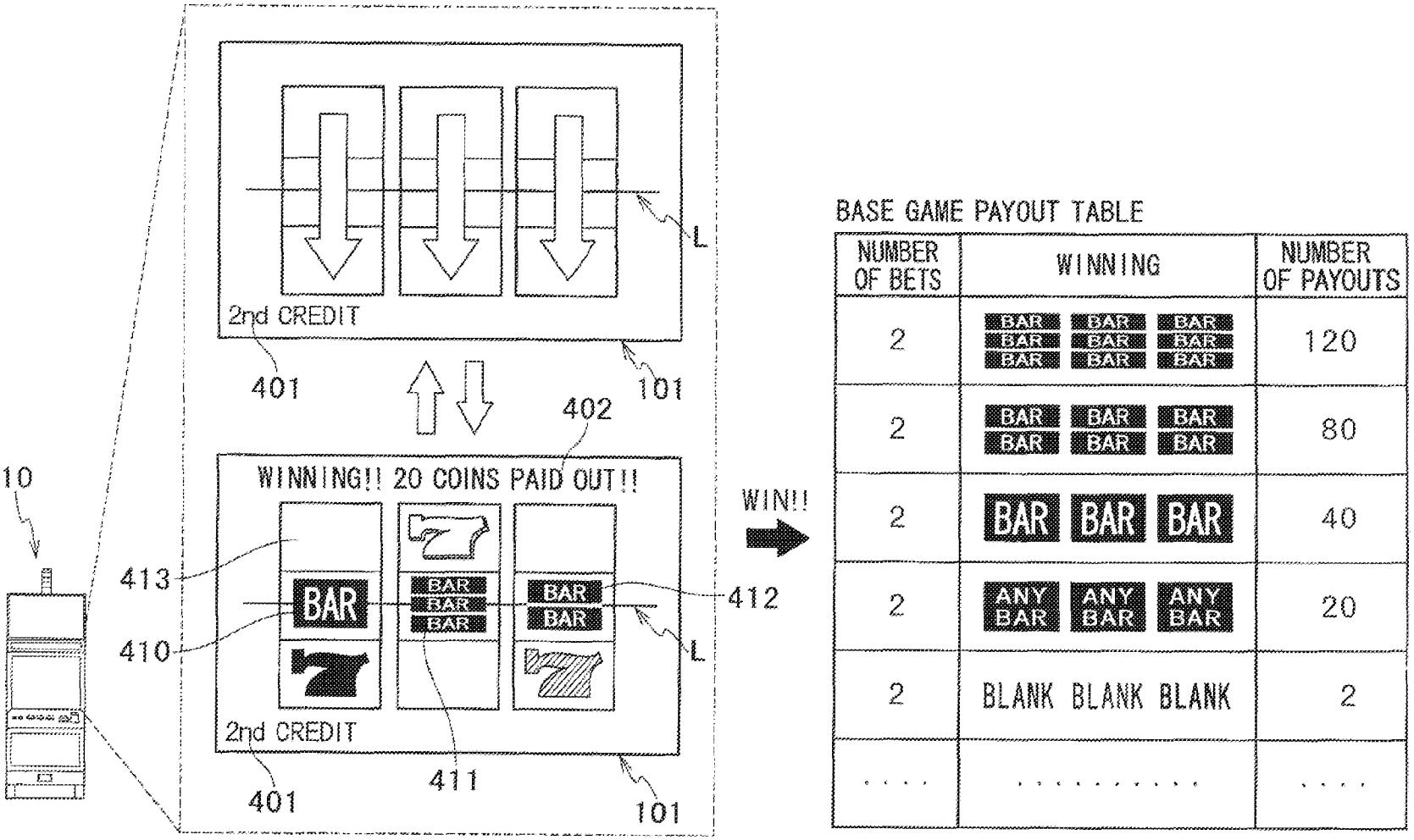
FIG. 47 is an explanatory diagram illustrating a base game of a gaming machine according to a variation of the second embodiment of the present invention.

As illustrated in FIG. 47, the terminal display unit 101 according to this variation has a plurality of arrangement areas forming a matrix with three rows and three columns. The arrangement areas of the middle row are set as a payline L. When the relation among the symbols rearranged on the payline L results in winning, a payout according to the resulted winning is awarded. Further, the terminal display unit 101 displays a credit 401 indicating the value of a bet game.

In the example shown in FIG. 47, the credit 401 shows "CREDIT: 2", and the value of the bet game is two coins. As a result of symbol rearrangement, a "1BAR" as a symbol 410, a "3BAR" as a symbol 411, and a "2BAR" as a symbol 412 are rearranged on the payline L. These symbols form a winning of "ANY-BAR" "ANY-BAR" "ANY-BAR," which is resulted when the credit 401 indicates two coins. Twenty coins are paid out as a payout for this winning.

FIG. 48 illustrates a base game payout table. The base game payout table is used when the main CPU 41 determines that a winning is resulted in a base game, and awards a payout according to the resulted winning. The base game payout table has a bet value column, a winning column, and a payout value column. The bet value column indicates the number of coins bet. The winning column indicates a combination of symbols to be rearranged on the payline L, which is a condition for a winning to be resulted. The payout value column indicates the number of coins to be paid out when a winning is resulted. The following describes the example illustrated in FIG. 48. When three symbols "3BAR" are rearranged on the payline L, and the bet value is 1 or 2, the payout amount is 60 or 120, respectively. When three symbols "2BAR" are rearranged on the payline L, and the bet value is 1 or 2, the payout amount is 40 or 80, respectively. When three symbols "1BAR" are rearranged on the payline L, and the bet value is 1 or 2, the payout amount is 20 or 40, respectively. When three symbols "ANY-BAR" are rearranged on the payline L, and the bet value is 1 or 2, the payout amount is 10 or 20, respectively. When three symbols "BLANK" are rearranged on the payline L, and the bet value is 1 or 2, the payout amount is 1 or 2, respectively. When three symbols "blue 7" are rearranged on the payline L, and the bet value is 3, the payout amount is 1800. When three symbols "red 7" are rearranged on the payline L, and the bet value is 3, the payout amount is 100. When three symbols "ANY-7" are rearranged on the payline L, and the bet value is 3, the payout amount is 100. Thus, the greater the bet value, the greater the payout amount for a resulted winning. Hence, a player may bet a greater amount of game value (bet value)

The following describes a bonus game of the gaming machine according to the variation of the second embodiment of the present invention. The bonus game according to this variation is configured to award a payout according to a predetermined winning. The number of light-emitting portions 303 according to accumulated points awarded are activated towards the bonus payout display unit 300.

Figure 49:
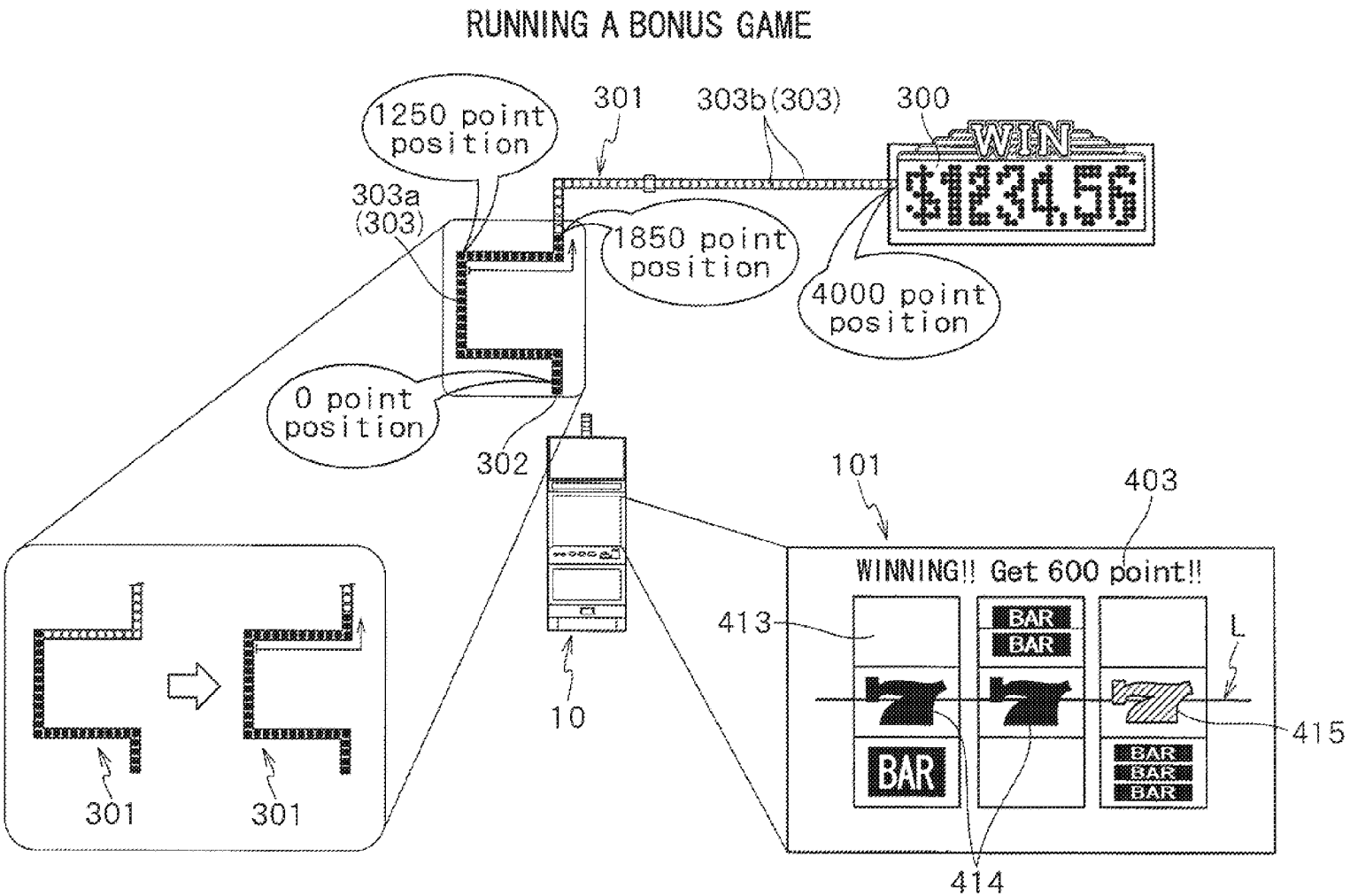
FIG. 49 is an explanatory diagram illustrating a bonus game of a gaming machine according to the variation of the second embodiment of the present invention.

The following describes the example illustrated in FIG. 49. The first end 304 of the gaming terminal 10 indicates a position equivalent to the zero point, and the second end 305 indicates a position equivalent to 4,000 points. Accumulated points awarded in the gaming terminal 10 is 1,250 points, so that the light-emitting portions 303 of the path unit 301 are lighted up to a position indicating 1,250 points. In this example, a winning is resulted with a "red 7" as a symbol 414, a symbol 414, and a "blue 7" as a symbol 415 rearranged. In this case, three winnings are resulted. Two winnings out of the three winnings are resulted by rearranging a symbol 414 on the payline L, and the other one winning is resulted by rearranging a symbol 415 on the payline L. The payout for a winning resulted with a symbol 414 is a hundred fifty (150) points, and the payout for a winning resulted with a symbol 415 is three hundred (300) points. Thus, the total points for the three winnings is six hundred (600) points. The six hundred points are paid out through the gaming terminal 10, so the accumulated points of the gaming terminal 10 is 1,250+600=1,850 points. The light-emitting portions 303 are activated up to the position indicating 1,850 points. Thus, a point according to a resulted predetermined winning is awarded during the bonus game. A jackpot is awarded when the accumulated points including a newly awarded point reach a predetermined amount (i.e., 4,000 points).

FIG. 50 illustrates a bonus game payout table. The bonus game payout table is used when the main CPU 41 determines that a winning is resulted in the bonus game, and awards a payout point according to the resulted winning. The bonus game payout table has a winning column and a payout point column. The winning column indicates a combination of symbols to be rearranged on the payline L, which is a condition for a winning to be resulted. The payout point column indicates an amount of points to be awarded for a resulted winning. The following describes the example illustrated in FIG. 50. When three symbols "blue 7" are rearranged on the payline L, the payout point is 7,000. When one symbol "blue 7" is rearranged on the payline L, the payout point is 300. When one symbol "red 7" is rearranged on the payline L, the payout point is 150. When one symbol "3 BAR" is rearranged on the payline L, the payout point is 30. When one symbol "2 BAR" is rearranged on the payline L, the payout point is 20. When one symbol "1BAR" is rearranged on the payline L, the payout point is 10.

Hereinabove, a gaming machine according to the variation of the second embodiment of the present invention is described. Although a gaming machine of the second embodiment of the present invention starts running a bonus game when the accumulated progressive value exceeds a certain amount (e.g., 200 dollars as a fixed value), it is not limited to this configuration. For example, the threshold progressive value where the gaming machine starts running the bonus game may be randomly changed within a predetermined range (e.g., two hundred to three hundred dollars).

Further, although the gaming machine of the second embodiment of the present invention awards a bonus payout when the accumulated points, which include newly awarded points, reach a predetermined amount, it is not limited to this configuration. The gaming machine may, for example, award a bonus payout when the accumulated points, which include newly awarded points, reach an amount that changes in each bonus game within a predetermined range (e.g., 3,000 to 5,000 points).

Further, for example, the gaming machine may be capable of selecting and setting a necessary amount of points for awarding a bonus payout through a gaming terminal. Specifically, the gaming machine may be capable of selecting any one of the values (e.g., 3,000 points, 4,000 points, and 5,000 points), through input from outside or the like, as points necessary for awarding a jackpot.

As yet another variation of the second embodiment of the present invention, each of the gaming terminals of the gaming machine may have the same level of difficulty (winning percentage of a bonus game) for all of the associated path units to be activated up to the bonus payout display unit. Further, the gaming terminal may set the level of difficulty (winning percentage of a bonus game) for each of the gaming terminals based on the contribution amount to the progressive value of the gaming terminal.

Further, for a gaming machine according to the second embodiment of the present invention, the set color associated with each of the gaming terminals may be determined by input through a touch panel or based on an achievement level, but it is not limited to this configuration. Any method may be applied for determination. For example, the set color may be determined in advance, and the already determined color may be changed by an input device or the like.

Further, a gaming machine according to the second embodiment of the present invention may be exemplified by a display that displays an effect image during a bonus game as a terminal display unit, but it is not limited to this configuration. For example, a display that displays a reel image of the base game described in the second embodiment of the present invention may be a terminal display unit. That is, for the gaming machine according to the second embodiment of the present invention, the background image in the base game running screen and the emission color of the light-emitting portion of the path unit may be based on the set color.

The detailed description of the present invention provided hereinabove mainly focused on characteristics thereof for the purpose of easier understanding; however, the scope of the present invention shall be construed as broadly as possible, encompassing various forms of other possible embodiments, and therefore the present invention shall not be limited to the above description. Further, the terms and phraseology used in the present specification are adopted solely to provide specific illustration of the present invention, and in no case should the scope of the present invention be limited by such terms and phraseology. Further, it will be obvious for those skilled in the art that the other structures, systems, methods or the like are possible, within the spirit of the invention described in the present specification. The description of claims therefore shall encompass structures equivalent to the present invention, unless otherwise such structures are regarded as to depart from the spirit and scope of the present invention. Further, the abstract is provided to allow, through a simple investigation, quick analysis of the technical features and essences of the present invention by an intellectual property office, a general public institution, or one skilled in the art who is not fully familiarized with patent and legal or professional terminology. It is therefore not an intention of the abstract to limit the scope of the present invention which shall be construed on the basis of the description of the claims. To fully understand the object and effects of the present invention, it is strongly encouraged to sufficiently refer to disclosures of documents already made available.

The detailed description of the present invention provided hereinabove includes a process executed on a computer or computer network. The above descriptions and expressions are provided to allow the one skilled in the art to most efficiently understand the present invention. A process performed in or by respective steps yielding one result or blocks with a predetermined processing function described in the present specification shall be understood as a process with no self-contradiction. Further, the electrical or magnetic signal is transmitted/received and written in the respective steps or blocks. It should be noted that such a signal is expressed in the form of bit, value, symbol, text, terms, number, or the like solely for the sake of convenience. Although the present specification occasionally personifies the processes performed in the steps or blocks, these processes are essentially executed by various devices. Further, the other structures necessary for the steps or blocks are obvious from the above descriptions.

(Third Embodiment)

With reference to FIGS. 51 to 78, the following describes a third embodiment of a gaming machine and a playing method thereof according to the present invention. The third embodiment includes embodiment 3-1 and embodiment 3-2. Note that reference numbers and symbols given to members and steps of flowcharts are only applicable to those described within the present embodiment, and do not represent the members or the steps of the other embodiments.

(Embodiment 3-1)

Figure 51:
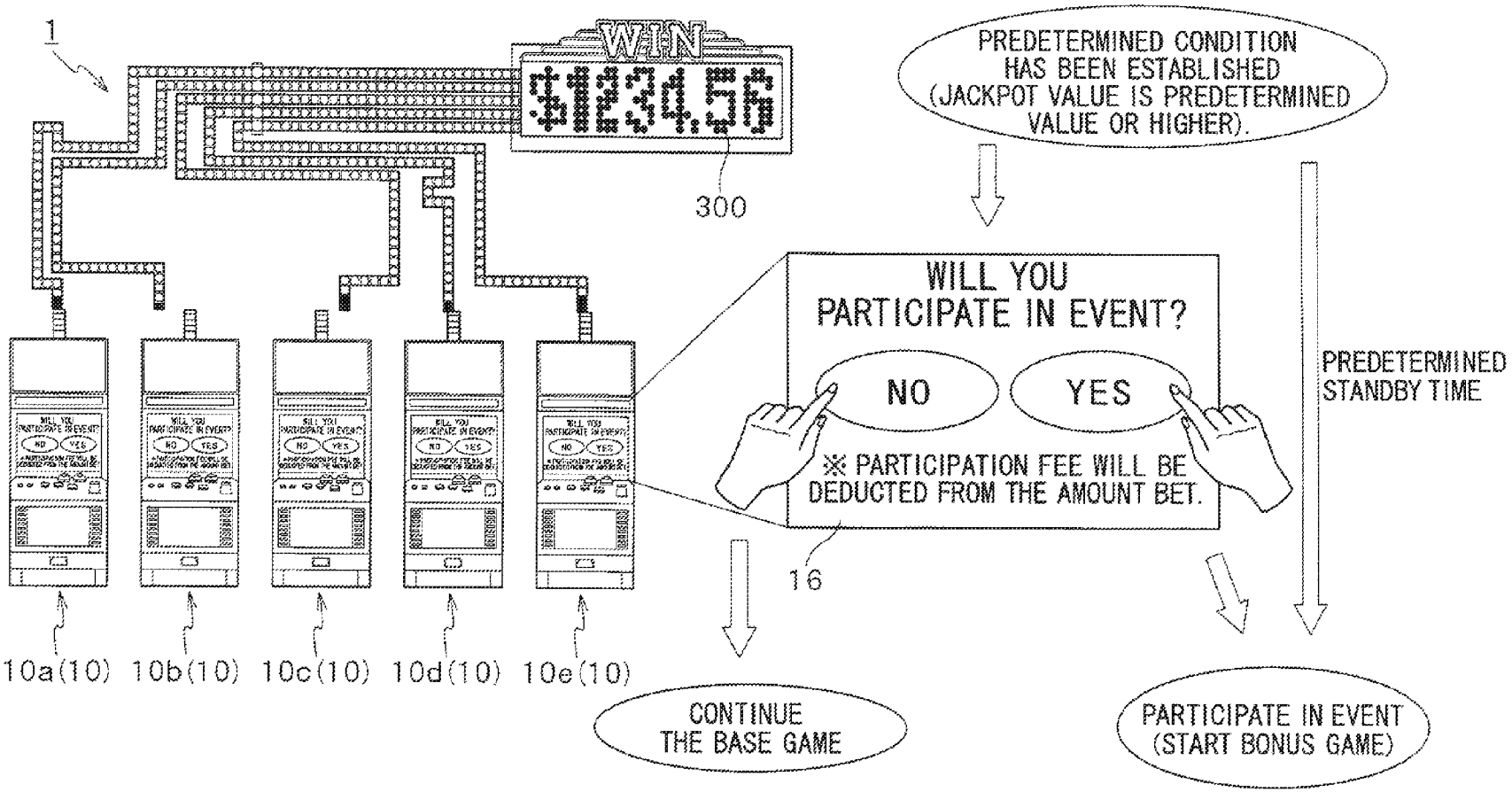
FIG. 51 is an explanatory diagram illustrating a gaming machine and a playing method thereof.

As illustrated in FIG. 51, a gaming machine 1 actualizes a playing method including the steps of: running a base game that repeats a unit game started in a plurality of gaming terminals 10 in response to a bet to consume a predetermined time independently of any other gaming terminals 10 and awarding a payout according to the predetermined results of the unit game; determining whether a predetermined start condition has been met for an event in which the plurality of gaming terminals 10 can participate; when a predetermined condition has been met, starting a count for a predetermined standby time that is longer than the predetermined time from the timing at which the predetermined condition has been met and prohibiting the starting of the unit game in a plurality of gaming terminals 10; and at the timing at which the count is finished, running the event in a plurality of gaming terminals 10.

Figure 52:
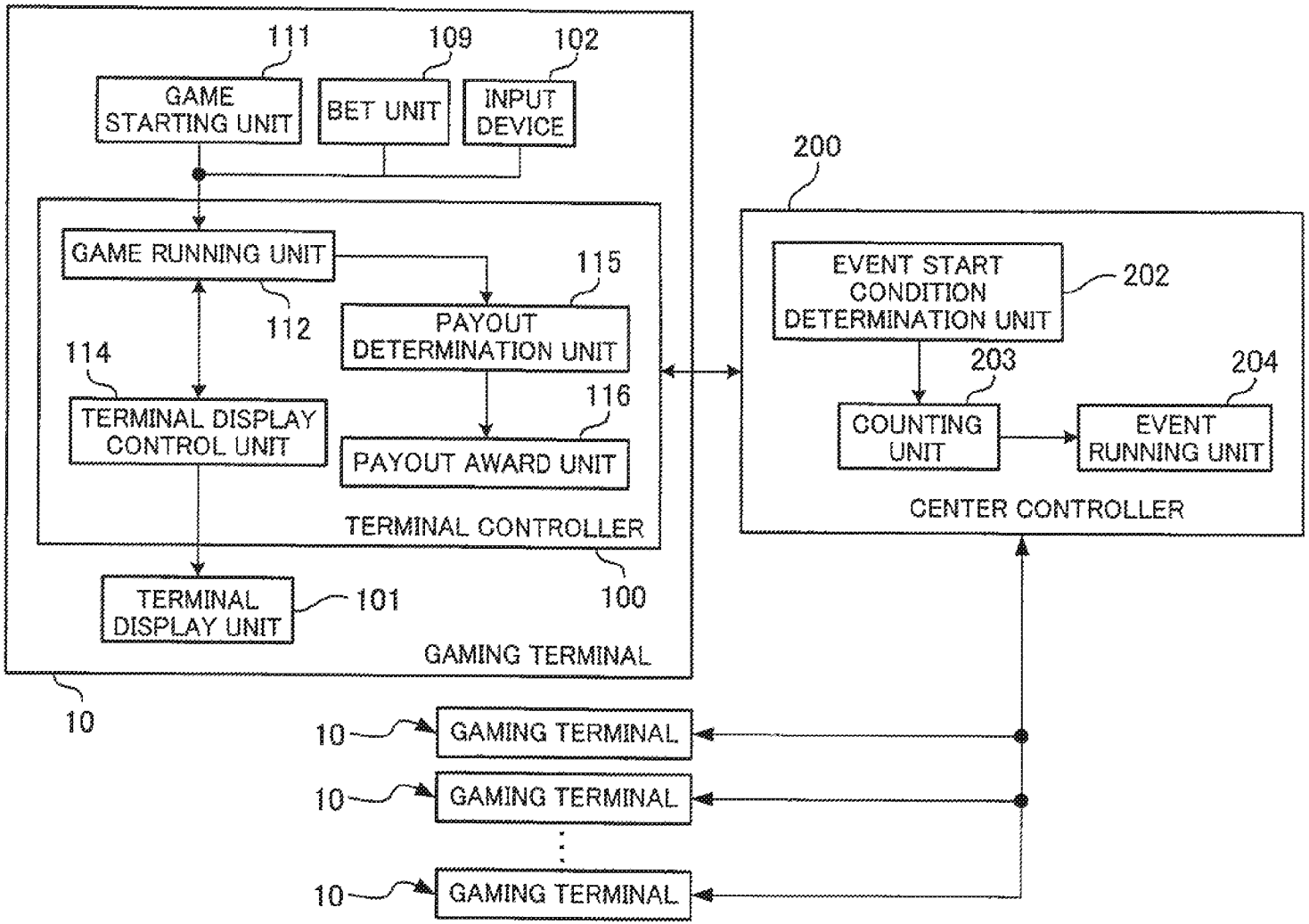
FIG. 52 is a block diagram illustrating a gaming machine according to an embodiment 3-1.

As illustrated in FIG. 52, the gaming machine 1 that executes the above playing method has a center controller 200 and a plurality of gaming terminals 10. The gaming terminal 10 has a game starting unit 111, a bet unit 109, an input device 102, a terminal display unit 101, and a terminal controller 100.

As illustrated in FIG. 52, the game starting unit 111, the bet unit 109, and the terminal display unit 101 are each connected to the terminal controller 100. The game starting unit 111 has a function of outputting a game start signal by an operation of the player. The game start signal output is then input to a later-described game running unit 112 of the terminal controller 100.

The bet unit 109 has functions of receiving a bet entered through an operation by the player and outputting a bet signal. The bet signal output is input to the game running unit 112.

The input device 102 has functions of receiving an input from outside and outputting an input signal to the terminal controller 100. The input signal output is input to the game running unit 112.

The terminal display unit 101 has a function of presenting options in which participation in an event can be selected through input to the input device based on a command from the terminal controller 100.

(Terminal Controller 100)

The terminal controller 100 is configured to execute: a first process of running a base game independently of any other gaming terminals 10 and awarding a payout according to the predetermined results of the unit game; a second process of prohibiting the starting of the unit game based on a unit game prohibition command from the center controller 200; and a third process of participating in an event based on an event start command from the center controller 200. In other words, the terminal controller 100 has a first processing unit, a second processing unit, and a third processing unit.

The terminal controller 100 is connected to the center controller 200 and is in communication with the center controller 200.

The terminal controller 100 has a game running unit 112 and a terminal display control unit 114. The game running unit 112 starts a unit game that consumes a predetermined time to output the results based on a bet signal from the bet unit 109, triggered by a game start signal from the game starting unit 111.

The terminal display control unit 114 instructs the terminal display unit 101 to present options in which participation in the event can be selected, in accordance with a command from the center controller 200. Further, the terminal display control unit 114 may instruct the terminal display unit 101 to display reporting information, effects, or the like according to the base game that is run by the game running unit 112.

Further, the terminal controller 100 has a payout determination unit 115 and a payout awarding unit 116. The payout determination unit 115 determines whether to award a payout according to the results of the unit game. The payout awarding unit 116 awards a payout on the basis of a determination of the payout determination unit 115. That is, the payout determination unit 115 determines whether the unit game results in awarding a payout. The payout awarding unit 116 awards a payout on the basis of a determination of the payout determination unit 115. Further, the payout awarding unit 116 may award a payout based on a command from the center controller 200 according to the results of running an event.

Here, the base game includes running of one or more unit games and awarding of a payout according to the results of running a unit game.

In the mean time, each block of the terminal controller 100 may be structured with a hardware or software, as required.

(Operation of Terminal Controller 100)

In the above structure, an operation of the terminal controller 100 will be described. First, the bet unit 109 accepts a bet entered through an operation by a player. Then, in response to the operation by the player, the game starting unit 111 outputs a game start signal to cause the game running unit 112 to start a unit game. The payout determination unit 115 determines whether running of the unit game resulted in awarding a payout. When it is determined that the running resulted in awarding a payout, the payout awarding unit 116 awards a payout. Thus, the terminal controller 100 executes the first process of running a base game independently of any other gaming terminals 10 and awarding a payout according to the predetermined results of the unit game.

The game running unit 112 then prohibits the starting of the unit game based on a later-described unit game prohibition command from the center controller 200. For example, when the unit game is running through the gaming terminal 10, the unit game is not started after the running unit game is finished. At this point, the terminal display control unit 114 may present options in which participation in the event can be selected on the terminal display unit 101. Thus, the terminal controller 100 executes the second process of prohibiting the starting of the unit game based on a unit game prohibition command from the center controller 200.

Thereafter, the gaming terminal 10 participates in an event based on an event start command from the center controller 200. When the terminal display control unit 114 presents options in which participation in the event can be selected on the terminal display unit 101, the terminal controller 100 may execute following processes. Specifically, the game running unit 112 determines whether the gaming terminal 10 participates in an event based on input from outside to the input device 102. When the gaming terminal 10 does not participate in an event, the game running unit 112 allows the starting of the unit game. That is, it allows for a bet unit 109 to receive a bet and for a game starting unit 111 to start a unit game. When the gaming terminal 10 participates in an event, the gaming terminal 10 participates in an event based on an event start command from the center controller 200. Thus, the terminal controller 100 executes the third process of participating in an event based on an event start command from the center controller 200.

(Center Controller 200)

The center controller 200 is configured to execute the fourth process of determining whether a predetermined condition has been met to start an event; the fifth process of, when a predetermined condition has been met, executing a unit game prohibition command in the terminal controller 100 of a plurality of gaming terminals 10 and starting a count for a predetermined standby time that is longer than the predetermined time from the timing at which the predetermined condition has been met; and the sixth process of executing an event start command in the terminal controller 100 of a plurality of gaming terminals 10 and running an event. In other words, the center controller 200 has a fourth processing unit, a fifth processing unit, and a sixth processing unit.

As illustrated in FIG. 52, the center controller 200 is connected to a plurality of terminal controllers 100 and is in communication with the center controller 200.

The center controller 200 has an event start condition determination unit 202, a count unit 203, and an event running unit 204.

The event start condition determination unit 202 determines whether a predetermined condition has been met to start an event. Further, when a predetermined condition has been met, the event start condition determination unit 202 outputs a unit game prohibition command signal to the terminal controller 100 of a plurality of gaming terminals 10 and outputs to the count unit 203 a condition establishment signal indicating information that a predetermined condition has been achieved.

The count unit 203 starts a count for a predetermined standby time in response to reception of a condition establishment signal from the event start condition determination unit 202. The predetermined standby time is longer than the predetermined time that is consumed by a unit game. Further, when a count for a predetermined standby time is finished, the count unit 203 outputs a count finish signal to the event running unit 204 indicating that a count is finished.

The event running unit 204 outputs an event start command signal to the terminal controller 100 of a plurality of gaming terminals in response to reception of a count finish signal from the count unit 203 and runs an event. When options in which participation in an event can be selected are presented in the gaming terminal 10, the event running unit 204 may output an event start command signal only to the gaming terminal 10 that participates in the event.

Meanwhile, each block of the center controller 200 may be realized with hardware or with software as needed.

(Operation of Center Controller 200)

The following describes an operation of the center controller 200 in the above structure. First, the event start condition determination unit 202 determines whether a predetermined condition has been met to start an event. Thus, the center controller 200 executes the fourth process of determining that a predetermined condition has been met.

A unit game prohibition command signal is then output from the event start condition determination unit 202 to the terminal controller 100 of a plurality of gaming terminals 10. Further, a condition establishment signal is sent from the event start condition determination unit 202 to the count unit 203. A count for a predetermined standby time is started by the count unit 203 in response to a receipt of a condition establishment signal. Thus, when a predetermined condition has been met, the center controller 200 executes the fifth process of running a unit game prohibition command in the terminal controller 100 of a plurality of gaming terminals 10 and starting a count for a predetermined standby time that is longer than the predetermined time from the timing at which a predetermined condition has been met.

Further, a count end signal is transmitted from the count unit 203 to the event running unit 204 when a count for a predetermined standby time is finished. An event start command signal is output from the event running unit 204 to the terminal controller 100 of a plurality of gaming terminals in response to a reception of a count end signal. An event is run by the event running unit 204. Thus, at the timing at which a count is finished, the event running unit 204 executes the sixth process of running an event start command in the terminal controller 100 of a plurality of gaming terminals 10 and running an event.

As is clear from the above operations, the gaming machine 1 realizes a playing method including the steps of: running a base game that repeats a unit game started in a plurality of gaming terminals 10 in response to a bet to consume a predetermined time independently of any other gaming terminals 10 and awarding a payout according to the predetermined results of the unit game; determining whether a predetermined start condition has been met for an event in which a plurality of gaming terminals 10 can participate; when a predetermined condition has been met, starting a count for a predetermined standby time that is longer than the predetermined time from the timing at which a predetermined condition has been met and prohibiting the starting of the unit game in a plurality of gaming terminals 10; and running an event in a plurality of gaming terminals 10 at the timing at which a count is finished.

According to this playing method, a base game is run that repeats a unit game started in a plurality of gaming terminals 10 in response to a bet to consume a predetermined time independently of any other gaming terminals 10, and a payout is awarded according to the predetermined results of the unit game. It is determined whether a predetermined condition has been met to start an event in which a plurality of gaming terminals 10 can participate. When a predetermined condition has been met, a count is started for a predetermined standby time that is longer than the predetermined time from the timing at which a predetermined condition has been met, and starting of the unit game is prohibited. An event is run at the timing at which a count is finished.

Accordingly, it allows for the gaming terminals 10 to participate in an event after a predetermined standby time that is longer than the unit game from the timing at which a predetermined condition is achieved, regardless of the run timing of the unit game of the base game that is implemented in each of the gaming terminals 10. This realizes a new entertainment characteristic.

Further, the gaming machine 1 may include, in the above playing method, a process of presenting options in which participation in an event can be selected, a process of determining whether the gaming terminal 10 participates in the event based on input into the input device 102, and a process of allowing the starting of the unit game when the determination is to not participate in the event.

According to this playing method, a base game that repeats a unit game started in a plurality of gaming terminals 10 in response to a bet to consume a predetermined time is run independently of any other gaming terminals 10, and a payout is awarded according to the predetermined results of the unit game. It is determined whether a predetermined condition has been met to start an event in which a plurality of gaming terminals 10 can participate. When a predetermined condition has been met, a count for a predetermined standby time that is longer than the predetermined time is started from the timing at which the predetermined condition has been met. The starting of the unit game is prohibited in each of the gaming terminals, and options are presented in which participation in an event can be selected. Whether to participate or not in an event is determined based on input into the input device 102 capable of receiving an input from outside. When the gaming terminal 10 does not participate in an event, starting of the unit game is allowed. When the gaming terminal 10 participates in an event, an event is run at the timing at which a count is finished.

This allows for gaming terminals to participate in an event altogether after a predetermined standby time that is longer than the unit game has elapsed since the timing at which a predetermined condition has been met, regardless of the run timing of the unit game of the base game that is implemented in each of the gaming terminals 10. Further, participation in an event can be selected. As a result, this realizes a new entertainment characteristic.

(Run Timing of Event)

Figure 53:
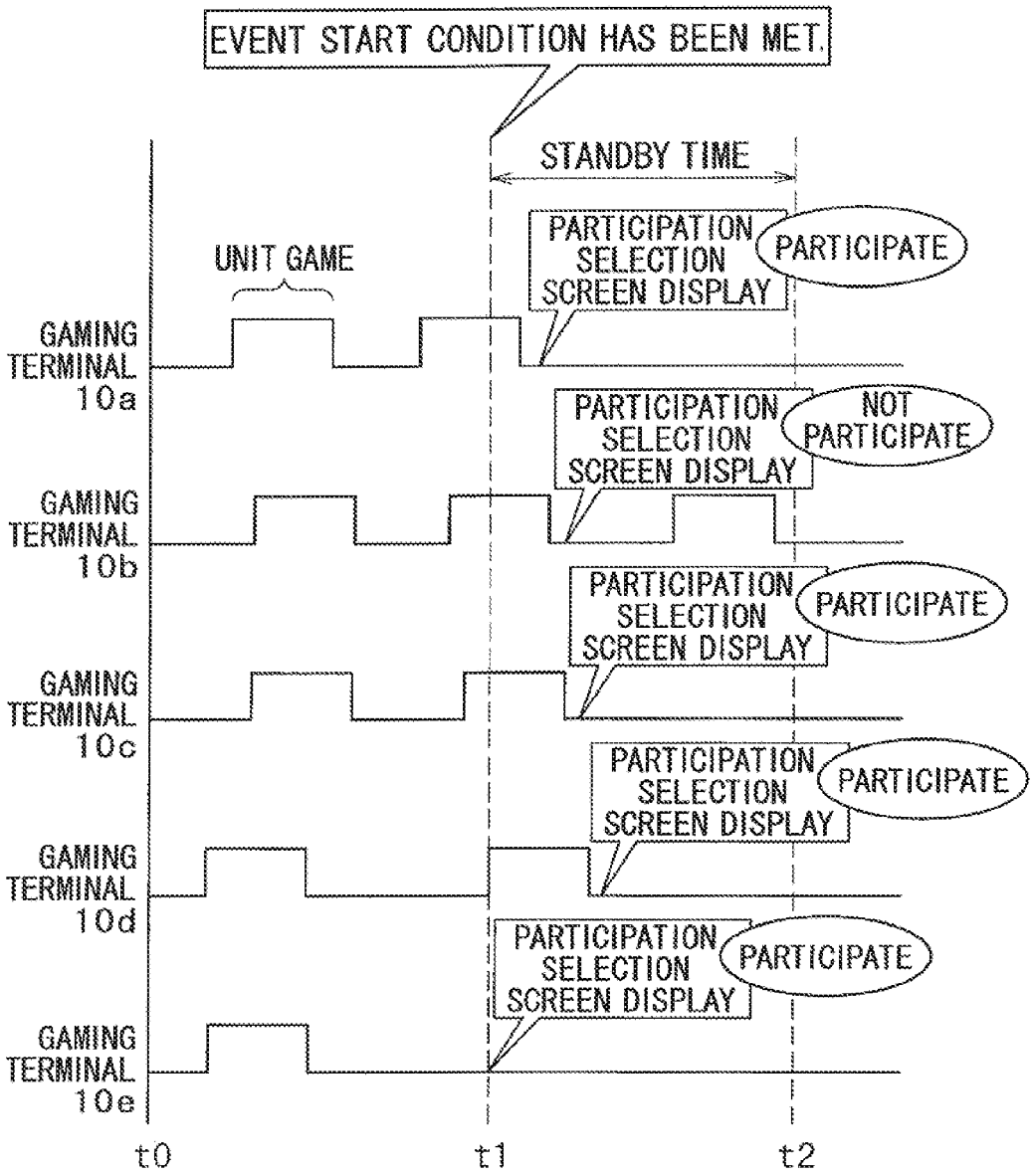
FIG. 53 is a time chart illustrating a run timing of a unit game and an event.

The following specifically describes an example of a run timing of an event in the abovementioned gaming machine 1 and a playing method thereof, with reference to FIG. 53.

FIG. 53 is a time chart indicating an example of run timing between respective unit games of each of the gaming terminals 10 and an event thereof. As illustrated in FIG. 53, five gaming terminals 10 (gaming terminal 10*a*, 10*b*, 10*c*, 10*d*, 10*e*) are used in the example.

In FIG. 53, a time axis is set in the lateral direction. t0 on the time axis refers to a certain point during running of the base game, t1 on the time axis refers to a point at which an event start condition has been met, and t2 refers to a point at which an event is started after a predetermined standby time has elapsed since the timing at which an event start condition has been met.

In each of the gaming terminals 10, a based game is conventionally run during a period of t0 to t1. In other words, in each of the gaming terminals 10 in a period of t0 to t1, a unit game that consumes a predetermined time can be started in response to a bet.

At the point of t1, the center controller 200 determines that a predetermined condition has been met and outputs a unit game prohibition command signal to each of the gaming terminals 10. Each of the gaming terminals 10 prohibits starting of the unit game based on a unit game prohibition command signal. Further, the center controller 200 starts a count from the point of t1 for a predetermined standby time (t1-t2) that is longer than the predetermined time consumed by the unit game.

For example, for the gaming terminal 10*a*, the unit game is running at the point of t1. When the unit game is running at the point of t1, starting of the unit game is prohibited after the running unit game is finished. Further, for the gaming terminal 10*d*, for example, the unit game is started at the same time as t1. Even when the unit game is started at the same time as t1, starting of the unit game is prohibited after the running unit game is finished. Further, for the gaming terminal 10*e*, for example, the unit game is not yet started at the point of t1. When the unit game is not yet started at the point of t1, running of the unit game is prohibited until a predetermined standby time has elapsed.

As such, by setting a predetermined standby time that is longer than the unit game and prohibiting the starting of the unit game during the period, it allows finishing of the unit game of the gaming terminals 10 that are participating in an event and having the gaming terminals participate in the event altogether.

In the examples above, the gaming machine 1 can start a unit game when an event start condition has been met, but it is not limited to this. For example, the gaming machine 1 may prohibit starting of the unit game when an event start condition has been met.

Further, in the standby period of t1 to t2, the gaming machine 1 displays a participation selection screen on a later-described lower image display panel 16 of the gaming machine 1 as a presentation of options in which participation in an event can be selected. The participation selection screen will be described later. When a unit game is run during a standby period, the participation selection screen is displayed after the unit game is finished. Further, when a unit game is not run during a standby period, the participation selection screen is displayed at the point of t1. The display timing of the participation selection screen is not limited to those described above. For example, it may be displayed altogether in each of the gaming terminals 10 during a standby period.

Further, when the participation selection screen is displayed and it is decided not to participate in an event through an input device such as a touch panel or the like, starting of the unit game during a standby period is allowed in the gaming terminal 10 that does not participate in the event. This enables a reduction in stress for a player who plays the gaming terminal 10 that does not participate in the event. For example, as illustrated in FIG. 53, for the gaming terminal 10*b*, as it is selected not to participate after the participation selection screen is displayed, a unit game is started during a standby period. Further, for any other gaming terminals 10 that is selected to participate in an event, starting of the unit game is prohibited during a standby period.

Thereafter, an event is started at the point of t2 at which a standby time has elapsed, and the gaming terminals 10 that have been selected to participate in the event are to participate in the event.

Figure 54:
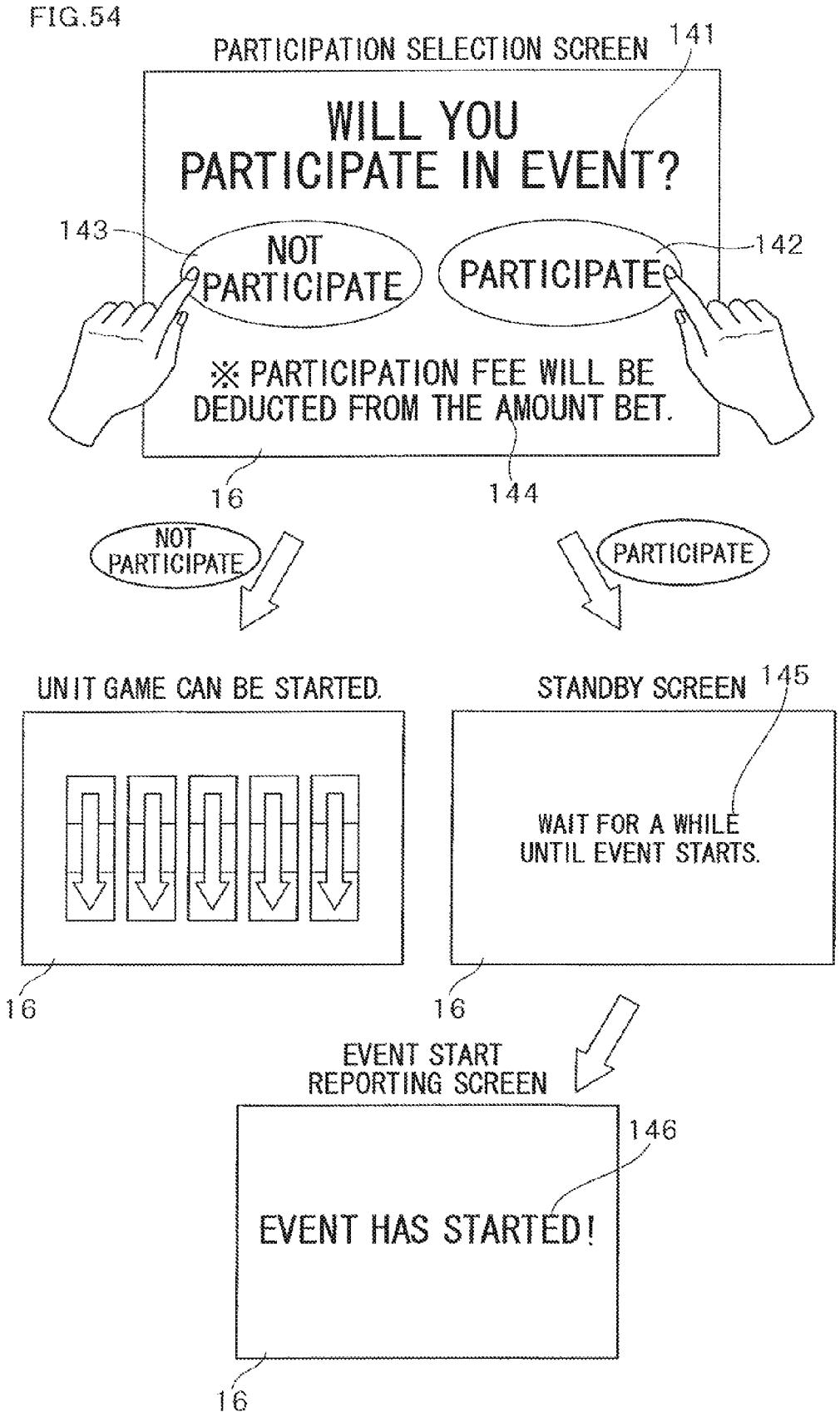
FIG. 54 is a front view illustrating a display mode of a lower image display panel.

With reference to FIG. 54, a participation selection screen will be described. The participation selection screen is displayed on the lower image display panel 16 of the gaming machine 1. The participation selection screen includes a selection reporting text image 141, a participation button image 142, a nonparticipation button image 143, and a caution text image 144.

The selection reporting text image 141 is a text image that displays the text "Will you participate in the event?", which is displayed on the upper part of the lower image display panel 16. When the selection reporting text image 141 is displayed, it is possible to enable the players to indicate their intention of participation/nonparticipation in the event.

A participation button image 142 and a nonparticipation button image 143 are displayed on the center part of the lower image display panel 16 as aligned in the horizontal direction. As described later, a touch panel 69 having the function of an input device 102 is provided so as to cover the lower image display panel 16. This allows for the selection of participation/nonparticipation in the event by pressing a participation button image 142 or a nonparticipation button image 143. That is, the touch panel 69 functions as an input device 102 capable of receiving an input from outside.

A caution text image 144 is a text image that indicates the text "*A participation fee will be deducted from the bet amount", which is displayed on the lower part of the lower image display panel 16. The bonus game as an event in the present embodiment is initiated by repeating a game similar to the unit game for each bet in the unit game, and a participation fee is deducted from the bet amount. The caution text image 144 is for reporting this. The display mode of the participation selection screen is not limited to those described above.

When the nonparticipation button image 143 is pressed in the participation selection screen—that is, when not participating in the event, as illustrated on the left side of the center part of FIG. 54—the unit game can be started.

Further, when the participation button image 142 is pressed on the participation selection screen—that is, when participating in the event, as illustrated on the right side of the center part of FIG. 54—a standby screen is displayed on the lower image display panel 16, and the standby reporting text image 145 is displayed on the center part of the lower image display panel 16. The standby reporting text image 145 is a text image that displays the text "Please wait for a while until the event is started". The display mode of the standby screen is not limited to this. For example, it may further display the time until the event is started. This allows for a reduction in the stress of players who are waiting ready.

At the point at which a standby period is finished—that is, at the point at which a predetermined standby time has elapsed since a predetermined condition has been met to start an event—an event start reporting screen illustrated on the lower part of FIG. 54 is displayed on the lower image display panel 16 of the gaming terminal 10 that participates in the event. As illustrated in FIG. 54, on the event start reporting screen, a start reporting text image 146 is displayed on the center of the lower image display panel 16. The start reporting text image 146 is a text image that indicates the text "Start an event!!" to report the starting of an event to players or the like. This allows the reporting of starting of the event altogether in the gaming terminals 10 that will participate in the event, which improves the entertainment characteristics.

(Mechanical Structure of Gaming Machine 1)

Next, the following describes a specific embodiment of mechanical and electrical structures of the gaming machine 1 thus structured.

A gaming machine 1 is placed in a gaming facility such as a casino. The gaming machine 1 runs a unit game by the use of a game medium. The game medium is a coin, bill, or a value in the form of electronic information. However, the game medium in the present invention is not particularly limited. For example, a medal, token, electronic money, ticket or the like are also possible. Further, the ticket is not particularly limited and may be a later-described ticket with a barcode or the like ticket.

Figure 55:
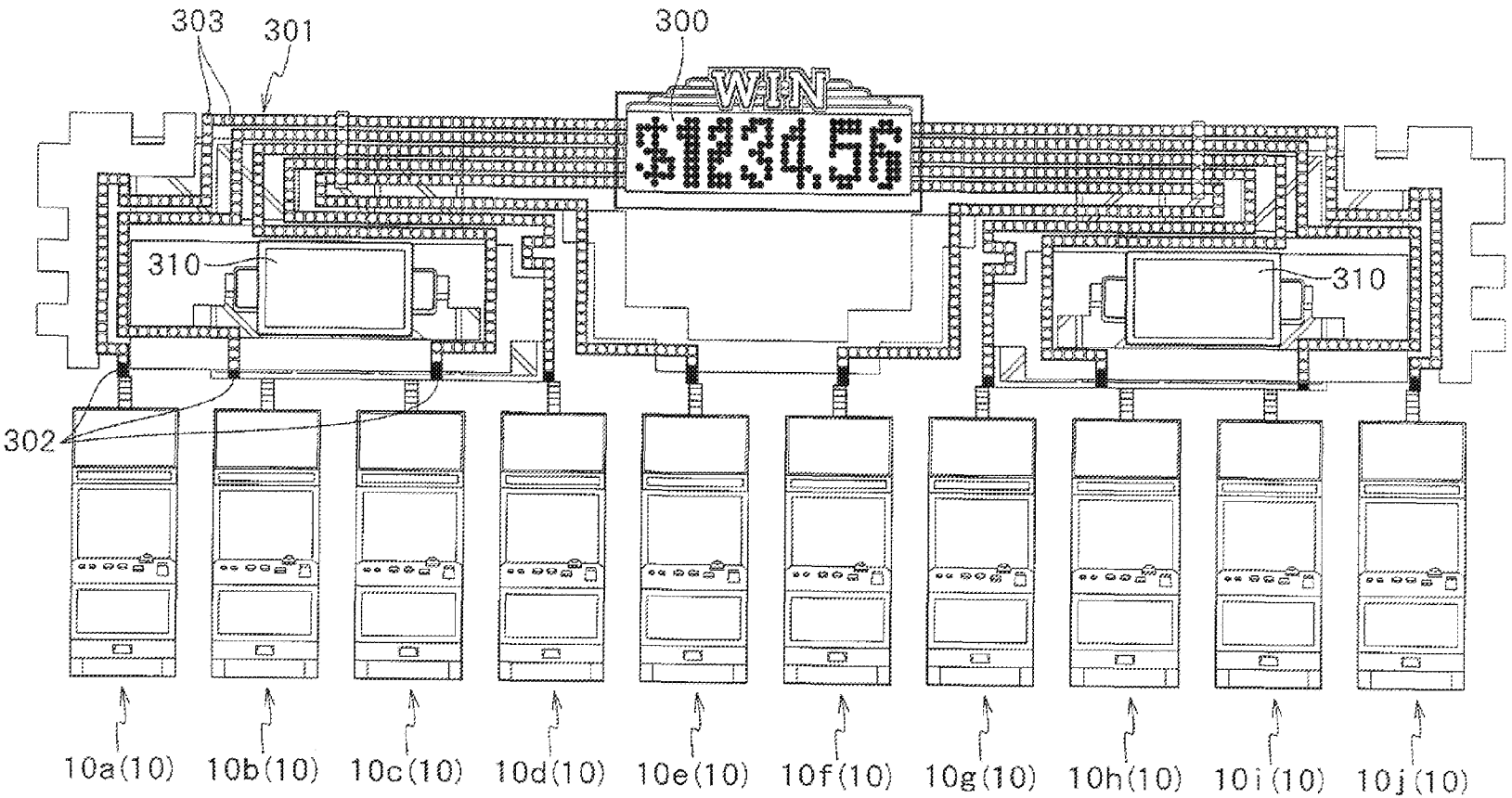
FIG. 55 is a front view illustrating an external appearance of the gaming machine.

As illustrated in FIG. 55, the gaming machine has a gaming terminal 10 that runs a base game independently, a center controller 200 that is connected to and is communicating with the gaming terminal 10 and runs a bonus game as an event, a bonus payout display unit 300 that displays the amount of bonus payout awarded in the bonus game, and two shared displays 310 that display an effect screen and a demo screen. Further, the gaming machine 1 has path units 301 that is formed by arranging a plurality of light-emitting portions 303 as one path from a position 302 corresponding to each of the gaming terminals 10 to the bonus payout display unit 300.

The bonus payout display unit 300 displays an amount of a bonus payout to be awarded in the bonus game. An example illustrated in FIG. 55 illustrates that an amount of a progressive jackpot is $1,234.56. The bonus payout display unit 300 has an arrangement of a plurality of LEDs as a plurality of illuminants in the present embodiment; however, it may be structured as one liquid crystal display. Note that an illuminant is not limited to an LED, as long as the member emits light. Two shared displays 310 are each structured as liquid crystal displays.

The path units 301 are respectively associated with any of the plurality of gaming terminals 10. Specifically, the path unit 301 is formed by arranging a plurality of light-emitting portions 303 such that one end is created nearby respectively associated gaming terminal of a plurality of gaming terminals 10, while the other end is created nearby the bonus payout display unit 300. That is, one path unit 301 has a plurality of light-emitting portions 303 aligned to form a path from the gaming terminal 10 to the bonus payout display unit 300.

Figure 57:
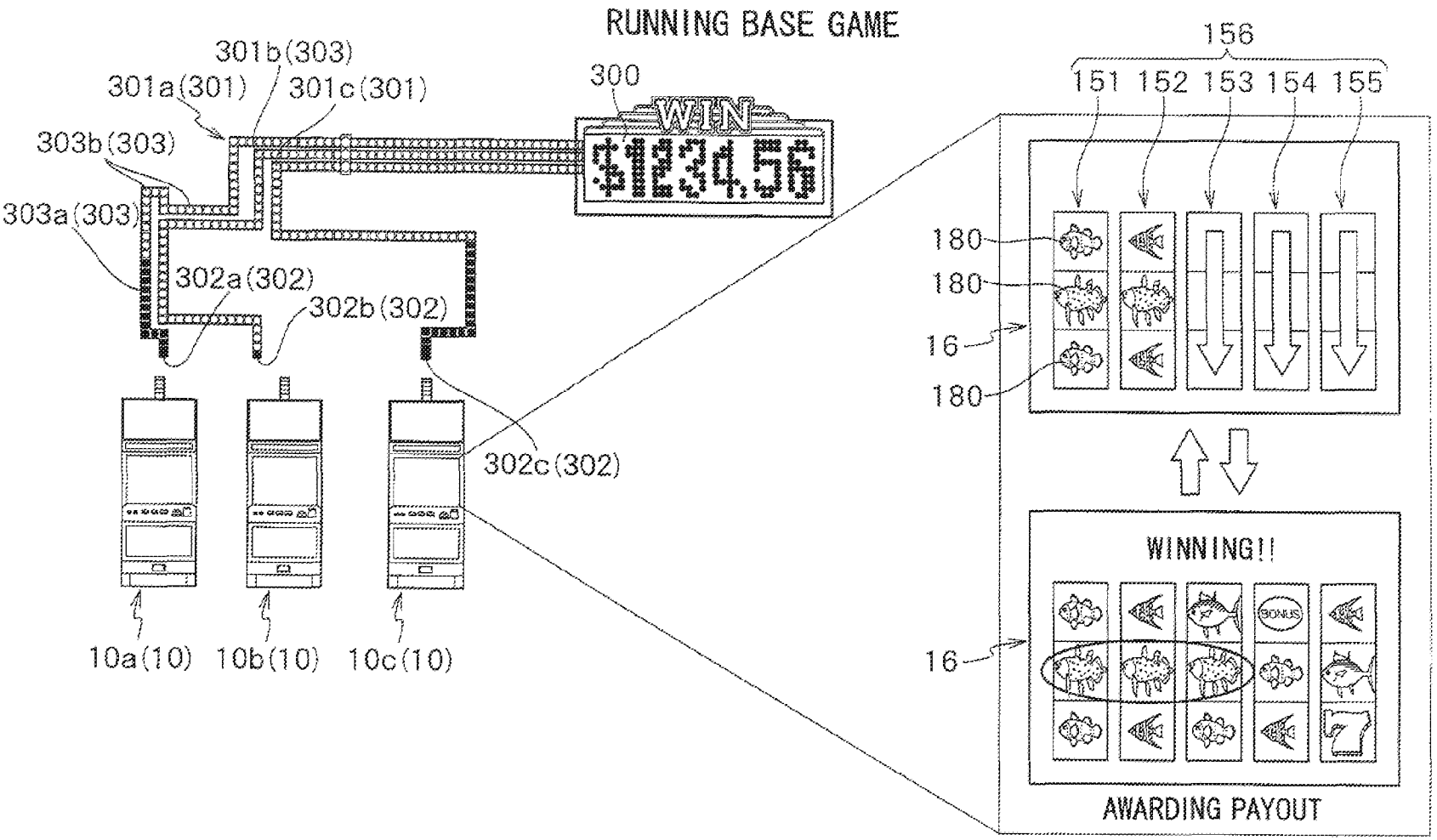
FIG. 57 is an explanatory diagram of a base game.

In an example illustrated in FIG. 57, a path unit 301*a* is formed as one path from a position 302*a* nearby a gaming terminal 10*a* to the bonus payout display unit 300. Likewise, a path unit 301*b* is formed as one path from a position 302*b* nearby a gaming terminal 10*b* to the bonus payout display unit 300. Other path units 301*c* to 301*j* are formed in the same manner. Thus, a plurality of path units 301 are respectively associated with a plurality of gaming terminals 10.

The light-emitting portion 303 is an LED (light-emitting diode) and controlled to light in plural colors. The light-emitting portion 303 turns off when inactivated and turns on when activated. In FIG. 57, activated light-emitting portions 303 are shown as light-emitting portions 303*a*, and inactivated light-emitting portions 303 as light-emitting portions 303*b*. Each of the light-emitting portions 303 is controlled to be sequentially activated in an arrangement order from the light-emitting portion 303 of one end of the path unit 301, which is closer to each of the gaming terminals 10, to the light-emitting portion 303 of the path unit 301, which is closer to the bonus payout display unit 300. That is, the path unit 301 is controlled so that the light-emitting portions 303 are additionally activated sequentially in an arrangement order from the gaming terminal 10 to the bonus payout display unit 300.

Note that a light-emitting portion 303 is not limited to an LED as long as the member emits light. Further, the activation state of a light-emitting portion 303 is not limited to a lighted state; it may be a blinking state or the like.

Figure 56:
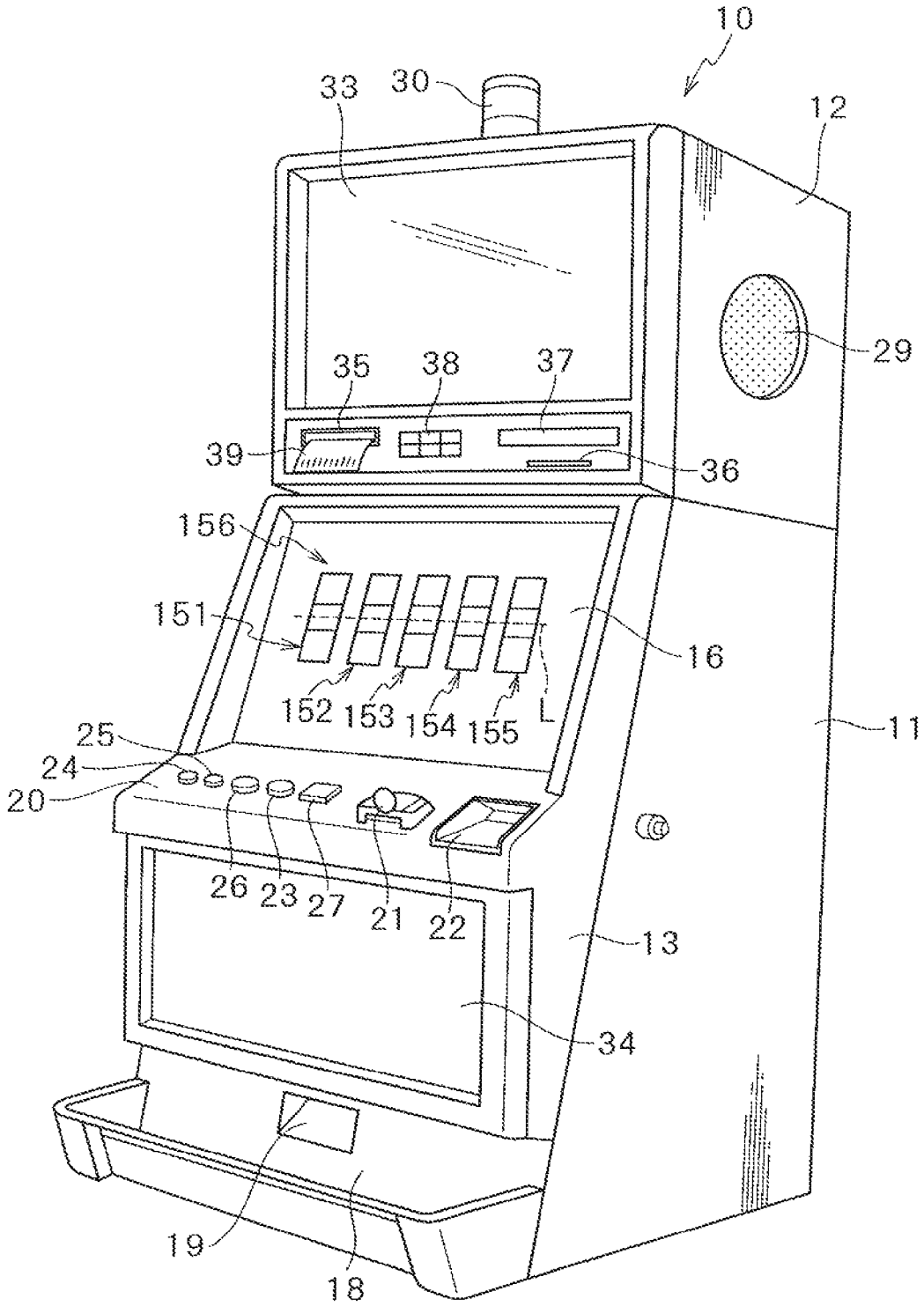
FIG. 56 is a perspective view illustrating an external appearance of a gaming terminal.

As illustrated in FIG. 56, the gaming terminal 10 has a cabinet 11, a top box 12 provided above the cabinet 11, and a main door 13 provided on the front surface of the cabinet 11. The main door 13 has a lower image display panel 16. The lower image display panel 16 has a transparent liquid crystal panel for displaying various information. The lower image display panel 16 displays display windows 151 to 155 and a matrix 156 for arranging therein a plurality of symbols 180. Further, the lower image display panel 16 displays as needed various information and effect images related to a game.

Further, as mentioned above, the lower image display panel 16 has a function of displaying a presentation of options in which participation in an event can be selected as a participation selection screen. The presentation of options in which participation in an event is not limited to this. For example, the presentation may be displayed on the upper image display panel 33 or in another display screen. For example, audio presentation may be possible through a speaker.

The present embodiment is exemplified by a case where the lower image display panel 16 electrically displays a plurality of symbols 180 arranged in five rows/three columns, but is not limited to this.

The lower image display panel 16 displays a single activated payline L. Note that the number of paylines L may be two or more. When the number of paylines L is two or more, the paylines L may be activated according to a predetermined condition, such as the number of bets of coins.

Note that the lower image display panel 16 may have a credit value display unit and a payout value display unit. The credit value display unit-displays a total value (hereinafter also referred to as total credit value) which a gaming terminal 10 can pay out to a player. When symbols stopped along a payline L form a winning combination, the payout value display unit displays the number of coins to be paid out.

Further, a scatter symbol may be adopted, and the number of coins to be paid out may be determined, according to the number of scatter symbols displayed on the matrix 156. Note that the payline L does not necessarily have to be displayed.

The lower image display panel 16 has a touch panel 69 as an input device 102 capable of receiving an input from outside. Although it is not illustrated in the figures, the touch panel 69 is mounted so as to cover the front of the upper image display panel 33. The touch panel 69 has a function of outputting, to the terminal controller 100 position, data including a lateral axis direction and a vertical axis direction as an input signal, in response to the reception of pressure. The terminal controller 100 is to refer to corresponding information associated with the position data in advance. This enables the touch panel 69 to receive the selection input of participation/nonparticipation in an event from outside.

Note that an input device 102 is not limited to the touch panel 69, and it may be a button or a pointing device.

Below the lower image display panel 16 provided are a control panel 20, a coin insertion slot 21, and a bill validator 22. The control panel 20 is provided with a plurality of buttons 23 to 27. These buttons 23 to 27 allow a player to input instructions related to a game played by the player. The coin insertion slot 21 is capable of receiving a coin in the cabinet 11.

The control panel 20 has a spin button 23, a change button 24, a cashout button 25, a 1-bet button 26, and a maximum bet button 27. The spin button 23 is for inputting an instruction to start symbol scrolling. The change button 24 is used to ask a staff in the gaming facility for exchange of money. The cash-out button 25 is used for inputting an instruction to pay out coins corresponding to the total credit-value into the coin tray 18.

The 1-bet button 26 is used for betting one coin out of those corresponding to the total credit value. The maximum bet button 27 is used for betting, out of those corresponding to the total credit value, a maximum number of coins (e.g., fifty coins) which can be bet in one game.

The bill validator 22 validates whether a bill is genuine or not and receives the genuine bill into the cabinet 11. Note that the bill validator 22 is capable of reading a later-mentioned ticket 39 having a barcode. When the bill validator 22 reads the ticket 39 having a barcode, it outputs to the main CPU 41 a read signal representing information having read from the barcode.

On the lower front surface of the main door 13, that is, below the control panel 20, a belly glass 34 is provided. On the belly glass 34, a character of a gaming terminal 10 or the like is drawn. On the front surface of top box 12 is provided an upper image display panel 33. The upper image display panel 33 has a liquid crystal panel and displays an effect image, introduction to the game, rules of the game, or the like.

Further, the top box 12 has a speaker 29 for an audio output. Below the upper image display panel 33 are provided a ticket printer 35, a card reader 36, a data displayer 37, and a keypad 38. The ticket printer 35 prints, on to a ticket, a barcode having encoded data containing credit-value, date and time, identification number of a gaming terminal 10 or the like, thereby issuing a ticket 39 having a barcode attached thereto. A player can play a game in any other gaming terminals 10 with the ticket 39 having the barcode, or exchange the ticket 39 having the barcode with bill or the like at a cashier or the like of the gaming facility.

The card reader 36 reads/writes data from/into a smart card. The smart card is carried by a player, and stores therein data for identifying the player, data relating to a history of games played by the player, or the like.

The data displayer 37 includes a fluorescent display or the like, and displays the data read by the card reader 36 and the data input by the player through the keypad 38. The keypad 38 is for entering instructions or data relating to issuing of a ticket or the like.

Although it is not illustrated in the figures, the gaming machine 1 has a rear board on which a bonus payout display unit 300 and a plurality of path units 301 are arranged, each of the gaming terminals 10, and a supporting board for supporting the rear board in the vertical direction. A center controller 200 is provided on the supporting board for data communication with each of the gaming terminals 10. Further, for the present embodiment, the center controller 200 is electrically connected to enable control of a bonus payout display unit 300 and a plurality of path units 301. For example, the center controller 200 may be connected to a control board specific for the bonus payout display unit 300 and a plurality of path units 301 that are provided on the rear board.

(Running Base Game)

The following specifically describes an example of a base game of the gaming machine 1 and the playing method thereof. As illustrated in FIG. 57, this explanation is based on a structure in which the lower image display panel 16 of the gaming machine 1 arranges symbols via a video reel method.

As illustrated in FIG. 57, the matrix 156 is arranged on the center of the lower image display panel 16. In the matrix 156, a symbol having a plurality of symbols 180 is scroll-displayed. In addition, the respective display windows 151 to 155 are divided into arrangement areas such as upper stage 151*a*, 152*a*, 153*a*, 154*a*, 155*a*, central stage 151*b*, 152*b*, 153*b*, 154*b*, 155*b* and lower stage 151*c*, 152*c*, 153*c*, 154*c*, 155*c*. The symbols 180 are respectively stopped (arranged) in the respective stages 151*a* to 155*a*, 151*b* to 155*b*, and 151*c* to 155*c*. The matrix 156 is a symbol matrix including five columns/three rows. The matrix 156 however is not limited to the one with five-columns/three-rows.

The "arranging" in this specification means a state where the symbols 180 can be visually observed by an outside player. That is, the lower right part of FIG. 57 shows a state in which the symbols 180 are displayed in the matrix 156. Arranging the symbols 180 again after releasing the symbols 180 is referred to as "rearranging".

As is illustrated in FIG. 57, the lower image display panel 16 variably displays a plurality of symbols 180 when a base game is started in the gaming terminal 10. Then, the variable-display of the plurality of symbols 180 is automatically stopped after a predetermined period has elapsed, and the plurality of symbols 180 are rearranged in the matrix 156. That is, a predetermined time consumed by a unit game refers to a time from the time of starting the variable-display of the plurality of symbols 180 to the time of rearrangement. Here, the predetermined time consumed by the unit game is not limited to this. Thereafter, a winning is achieved based on the relation among the plurality of the rearranged symbols 180, and a payout according to the winning is awarded.

Each time running of a base game is started in the gaming terminals 10 that are participating in an event, and part of the bet received from a player is accumulated as a jackpot value as an underlying asset of a bonus payout. The accumulated jackpot value is displayed on the bonus payout display unit 300, as illustrated in FIG. 57.

The lower image display panel 16 may be mechanically structured with a reel device for arranging the symbols 180 by rotation of a reel or electrically structured with a video reel on which an image is displayed for arranging the symbols 180. Further, the lower image display panel 16 may be a structure of combining a mechanical structure (reel) and an electrical structure (video reel). The electrical structure may include a liquid crystal device, a CRT (cathode-ray tube), a plasma display and the like. Further, any number of matrices 156 may be accepted.

(Running Event)

The following specifically describes an example of an event that is run in the gaming machine 1 above and the playing method thereof.

An event is started under the condition that the total number of unit games started in each of the gaming terminals 10 (the accumulated number of unit games) is a predetermined number or higher. That is, in the present embodiment, a predetermined condition for starting an event is that the total number of unit games started in each of the gaming terminals 10 is a predetermined number or higher. Here, the predetermined condition for starting an event is not limited to those described above.

An event is a bonus game that awards a bonus payout that is greater than the payout awarded in a base game. A bonus game progresses as a base game is run through the gaming terminal 10 that participates in an event. That is, a bonus game progresses according to the results of the unit game in the base game. Further, a jackpot value that is an accumulation of some of the bet value that has been bet in a unit game is awarded as a payout to any of the gaming terminals 10.

During the bonus game, a unit game is run and a plurality of symbols 180 are rearranged in the matrix 156 in each of the gaming terminals 10. When a predetermined winning is achieved with the rearranged symbols 180, light-emitting portions 303 are activated based on the number of winnings in the path unit 301 associated with the gaming terminal 10. These operations are repeated until a plurality of light-emitting portions 303 of any one of the path units 301 are activated up to the bonus payout display unit 300.

Figure 58:
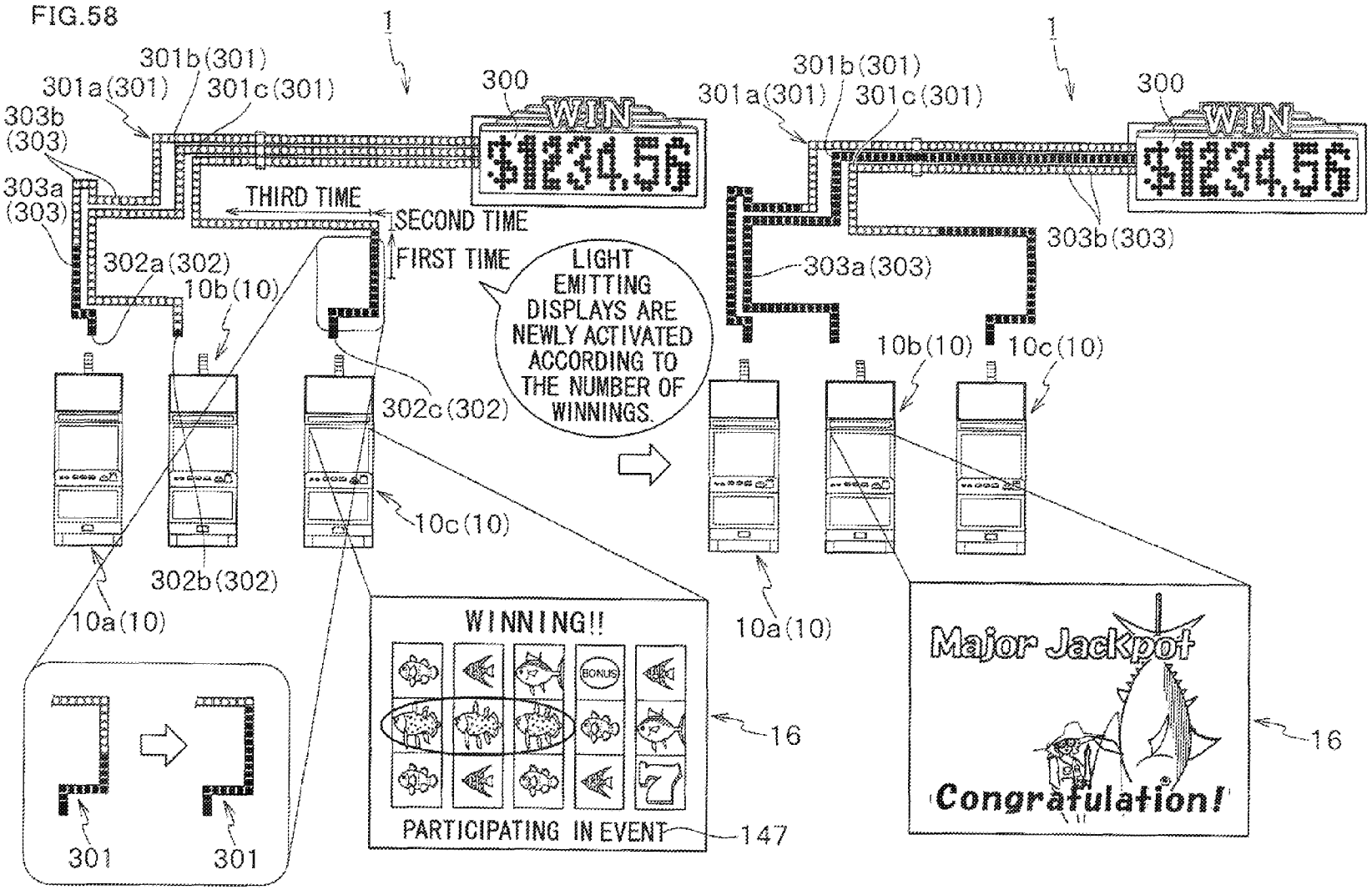
FIG. 58 is an explanatory diagram of an event.

As illustrated in FIG. 58, for instance, when a predetermined winning is achieved in the gaming terminal 10*c*(10), six additional light-emitting portions 303 are activated. Then, when a predetermined winning is achieved in the same gaming terminal 10*c*(10), one additional light-emitting portion 303 is activated. Then, when yet another predetermined winning is achieved in the same gaming terminal 10*c*(10), eighteen additional light-emitting portions 303 are activated. Thus, the number of light-emitting portions 303 corresponding to the number of winnings are activated towards the bonus payout display unit 300 each time a winning is achieved.

When a plurality of the light-emitting portions 303 are activated up to the bonus payout display unit 300, a jackpot as a bonus payout is awarded through the gaming terminal 10 associated with the path unit 301. In the example illustrated in FIG. 58, a jackpot is awarded through the gaming terminal 10*b*(10) associated with the path unit 301*b*(301) whose light-emitting portions 303 are activated up to the bonus payout display unit 300.

As illustrated in FIG. 58, in the base game that is participating in an event, the participation reporting text image 147 may be displayed on the lower part of the lower image display panel 16. The participation reporting text image 147 is a text image displaying the text "Participating in the event". Through the display of the participation reporting text image 147, players can verify that they are participating in the event.

(Symbol, Combination and the Like)

Symbols 180 displayed in a matrix 156 on the lower image display panel 16 form symbol columns each having twenty two symbols as illustrated in FIG. 59. The symbols constituting the respective symbol columns are given with one code number of zero to twenty-one.

Each symbol column has a combination of symbols of "Angelfish," "Clownfish," "7," "Tuna," "Coelacanth," and "Bonus."

The three successive symbols in the symbol columns are displayed (arranged) in the arrangement areas of upper stage 151*a*, 152*a*, 153*a*, 154*a*, 155*a*, the center stage 151*b*, 152*b*, 153*b*, 154*b*, 155*b* and the lower stage 151*c*, 152*c*, 153*c*, 154*c*, 155*c*, respectively, so that they constitute a symbol matrix of 5 columns/3 rows in the display windows 151 to 155. When a BET button is pushed and then a start button is pushed to start a game, the symbol columns constituting the symbol matrix are scrolled. When a predetermined time period has elapsed after the scroll has started, each scroll of the symbols is stopped (rearranged).

Further, for each symbol, a predetermined scatter symbol is determined in advance. Scatter symbols are such symbols that a player is put in an advantageous position when a predetermined number or more of them are displayed in the matrix 156. For example, the advantages includes: a state where coins corresponding to the scatter symbols are paid out, a state where the number of coins to be paid out is added to a credit, a state where a bonus game is started.

To be more specific, triggered by a state in which three or more symbols of "BONUS" are rearranged in a matrix 156, a gaming state shifts to an advantageous state. Further, when four or more symbols of "BONUS" are stopped in the matrix 156, twenty coins (game medium) are paid out for one bet.

No particular limitation is put on the advantageous state, and the examples may include a state in which more game media are obtainable than in the base game, a state in which a game medium is obtainable with higher probability than in the base game, a state in which a game medium is less consumed than in the base game, and the like. Specifically, a free game, a second game, a feature game, and the like may be mentioned as examples of the advantageous state. The free game is a game allowing a player to play a game for a predetermined number of times without betting a coin.

(Electrical Structure of Gaming Machine 1)

An electrical structure of the gaming machine 1 is described with reference to FIG. 60 and FIG. 61.

(Electrical Structure of Gaming Terminal 10)

Figure 60:
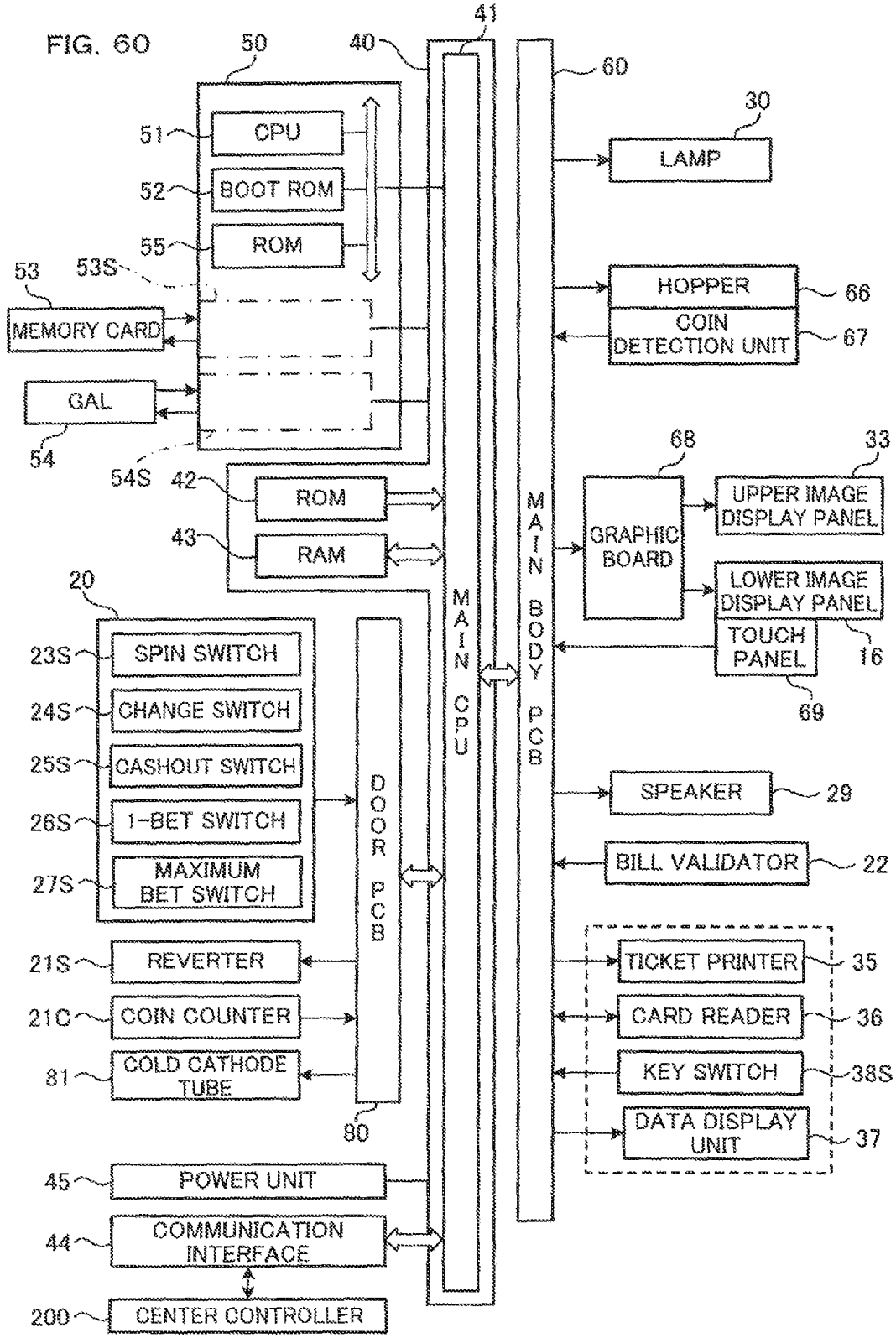
FIG. 60 is a block diagram illustrating an electrical structure of the gaming terminal.

FIG. 60 is a block diagram illustrating an electrical structure of the gaming terminal 10. As illustrated in FIG. 60, the cabinet 11 includes a control unit having a terminal controller 100. As illustrated in FIG. 61, the control unit includes components such as a motherboard 40, a main body PCB (Printed Circuit Board) 60, a gaming board 50, a door PCB 80, various switches, sensors, or the like.

The gaming board 50 is provided with a CPU (Central Processing Unit) 51, a ROM 55, a boot ROM 52, a card slot 53S corresponding to a memory card 53, and an IC socket 54S corresponding to a GAL (Generic Array Logic) 54. The CPU 51, the ROM 55, and the boot ROM 52 are connected to one another through an internal bus.

The memory card 53 stores therein a game program and a game system program. The game program contains a stop symbol determining program. The stop symbol determining program is a program for determining symbols (code number corresponding to the symbol) to be stopped in the arrangement areas 150. This stop symbol determining program contains sets of symbol weighting data respectively corresponding to various payout rates (e.g., 80%, 84%, 88%). Each set of the symbol weighting data indicates, for each of the display windows 151 to 155, a corresponding relationship between a code number of each symbol and one or more random numerical values within a predetermined range of 0 to 256.

The payout rate is determined based on payout rate setting data output from the GAL 54. Based on a set of the symbol weighting data corresponding to the payout rate, a stop symbol is determined.

The memory card 53 stores various types of data for use in the game programs and the game system programs. For example, the memory card 53 stores data indicating the relationship between symbols 180 displayed on the display windows 151 to 155 illustrated in FIG. 57 and a range of random numerical numbers in a table format. This data is transferred to the RAM 43 of the motherboard 40 at the time of running a game program.

The card slot 53S is structured so as to allow the memory card 53 to be inserted/detached and is connected to the motherboard 40 through an IDE bus. Thus, the type and content of a game run by a gaming terminal 10 can be modified by detaching the memory card 53 from the card slot 53S, writing a different game program and a different game system program into the memory card 53, and inserting the memory card 53 back into the card slot 53S.

Each of the game programs includes a program related to the progress of the game and/or a program for causing a transition to a bonus game. Each of the game programs includes image data and audio data output during the game.

The GAL 54 has a plurality of input and output ports. When the GAL 54 receives data via an input port, it outputs data corresponding to the input data from its output port. This data from the output port is the payout rate setting data described above.

The IC socket 54S is configured so that the GAL can be attached and detached. The IC socket 54S is connected to the motherboard 40 via a PCI bus. Thus, the payout rate setting 15 data to be output from GAL 54 can be modified by: detaching the GAL 54 from the IC socket 54S, overwriting the program stored in the GAL 54, and attaching the GAL 54 back to the IC socket 54S.

The CPU 51, the ROM 55 and the boot ROM 52 connected through an internal bus are connected to the motherboard 40 through the PCI bus. The PCI bus communicates signals between the motherboard 40 and the gaming board 50 and supplies power from the motherboard 40 to the gaming board 50. The ROM 55 stores country identification information and an authentication program. The boot ROM 52 stores a preliminary authentication program and a program (boot code) for enabling the CPU 51 to activate the preliminary authentication program.

The authentication program is a program (falsification check program) for authenticating the game program and the game system program. The authentication program is a program for confirming and verifying that the game program and the game system program are not falsified. In other words, the authentication program is described in accordance with a procedure for authenticating the game program and the game system program. The preliminary authentication program is a program for authenticating the authentication program. The preliminary authentication program is described in accordance with a procedure for verifying that the authentication program to be authenticated is not falsified. In short, the preliminary authentication program authenticates the authentication program.

The motherboard 40 is provided with a main CPU 41 (terminal controller 100), a ROM (Read Only Memory) 42, a RAM (Random Access Memory) 43, and a communication interface 44.

The main CPU 41 serves as a terminal controller 100 and has a function of controlling the entire gaming terminal 10. In particular, the main CPU 41 controls the following operations: an operation of outputting a command signal instructing variable-displaying of a plurality of symbols 180 to the graphic board 68, which is performed in response to pressing of the spin button 23 after betting of credit; an operation of determining symbols 180 to be stopped after the variable-displaying of the plurality of symbols 180; and an operation of stopping the symbols 180 thus determined in the display windows 151 to 155.

In other words, for rearranging a new symbol matrix after scrolling a plurality of symbols displayed on the lower image display panel 16, the main CPU 41 serves as an arrangement controller that selects and determines an arrangement symbol to be arranged in a symbol matrix from various types of symbols and executes arrangement control to stop scrolling in order to present the symbols determined thereby.

The ROM 42 stores a program such as BTOS (Basic Input/Output System) run by the main CPU 41 and permanently-used data. When the BIOS is run by the main CPU 41, each of peripheral devices is initialized and the game program and the game system program stored in the memory card 53 are read out through the gaming board 50. The RAM 43 stores data or a program used for the main CPU 41 to perform a process.

The communication interface 44 is provided to communicate with a host computer or the like equipped in the gaming facility through a communication line. The communication interface 44 is also for communicating with the center controller 200 through a communication line. Further, a main body PCB (Printed Circuit Board) 60 and a door PCB 80 are each connected to the motherboard 40 via USB (Universal Serial Bus). Further, the motherboard 40 is connected to a power unit 45. The power unit 45 supplies power to the motherboard 40 to boot the main CPU 41. Meanwhile, the power unit 45 supplies power to the gaming board 50 through the PCI bus to boot the CPU 51.

The main body PCB 60 and door PCB 80 are connected to various devices or units which generate input signals to be input to the main CPU 41, and various devices or units whose operations are controlled by control signals output from the main CPU 41. Based on a signal input to the main CPU 41, the main CPU 41 runs the game program and the game system program stored in the RAM 43 to perform an arithmetic process. Then, the CPU 41 stores the result of the arithmetic process in the RAM 43 or transmits a control signal to each of the various devices and units to control them.

The main body PCB 60 is connected with a lamp 30, a hopper 66, a coin sensor 67, a graphic board 68, a touch panel 69, a speaker 29, a bill validator 22, a ticket printer 35, a card reader 36, a key switch 38S, and a data displayer 37.

The lamp 30 is turned on/off on the basis of a control signal output from the main CPU 41. The lamp 30 is configured so as to be capable of lighting in multicolor. Specifically, the lamp 30 has a plurality of red LEDs, green LEDs, and blue LEDs which respectively light in red, green, and blue upon a power supply. The lamp 30 is configured so as to be capable of lighting in any color by turning each of the LEDs on and off via control by the main body PCB 60.

The hopper 66 is mounted in the cabinet 11 and pays out a predetermined number of coins from a coin outlet 19 to the coin tray 18, based on a control signal output from the main CPU 41. The coin sensor 67 is provided inside the coin outlet 19, and outputs an input signal to the main CPU 41 upon sensing that a predetermined number of coins have been delivered from the coin outlet 19.

The graphic board 68 controls image displaying of the upper image display panel 33 and the lower image display panel 16, based on a control signal output from the main CPU 41. Further, the graphic board 68 is provided with a VDP (Video Display Processor) for generating image data on the basis of a control signal output from the main CPU 41, a video RAM for temporarily storing the image data generated by the VDP, or the like. Note that image data used at the time of generating the image data by the VDP is in a game program which is read out from the memory card 53 and stored in the RAM 43.

The touch panel 69 sends position data to the main CPU 41. The position data includes a lateral axis direction and a vertical axis direction of the place that is press-operated by a player. The main CPU refers to corresponding information that is associated with the position data stored in the ROM 42.

The bill validator 22 reads an image on a bill and takes only genuine bills into the cabinet 11. When taking in a genuine bill, the bill validator 22 outputs an input signal to the main CPU 41 based on the value of the bill. The main CPU 41 stores into the RAM 43 a credit-value corresponding to the value of the bill transmitted by the input signal.

The ticket printer 35 prints a barcode on to a ticket to issue a ticket 39 having the barcode. The barcode contains encoded data such as credit-value stored in the RAM 43, date and time, identification number of the gaming terminal 10, or the like, based on a control signal from the main CPU 41.

The card reader 36 reads out data from the smart card, transmits the data to the main CPU 41, and writes data into the smart card based on the control signal from the main CPU 41. The key switch 38S is mounted to the keypad 38, and outputs an input signal to the main CPU 41 in response to an operation of the keypad 38 by the player. The data displayer 37 displays, based on a control signal output from the main CPU 41, the data read by the card reader 36 or the data input by the player through the keypad 38.

The door PCB 80 is connected to a control panel 20, a reverter 21S, a coin counter 21C, and a cold cathode tube 81. The control panel 20 is provided with a spin switch 23S associated with the spin button 23, a change switch 24S associated with the change button 24, a cashout switch 25S associated with the cashout button 25, a 1-bet switch 26S associated with the 1-bet button 26, and a maximum bet switch 27S associated with the maximum bet button 27. Each of the switches 23S to 27S outputs an input signal to the main CPU 41, when a player presses the associated buttons 23 to 27.

The coin counter 21C is provided within the coin insertion slot 21, and identifies whether the coin inserted into the coin insertion slot 21 by the player is genuine. A coin except the genuine coin is discharged from the coin outlet 19. In addition, the coin counter 21C outputs an input signal to the main CPU 41 upon detection of a genuine coin.

The reverter 21S is operated on the basis of the control signal output from the main CPU 41 and distributes a coin, which is recognized as a genuine coin by the coin counter 21C, to a cash box (not shown) or hopper 66 mounted in the gaming terminal 10. In other words, when the hopper 66 is full of the coins, the genuine coin is distributed into the cash box by the reverter 21S. On the other hand, when the hopper 66 is not yet full of the coins, the genuine coin is distributed into the hopper 66. The cold cathode tube 81 functions as a backlight mounted to rear sides of the lower image display panel 16 and the upper image display panel 33 and turns on according to a control signal from the main CPU 41.

(Electrical Structure of Center Controller 200)

Figure 61:
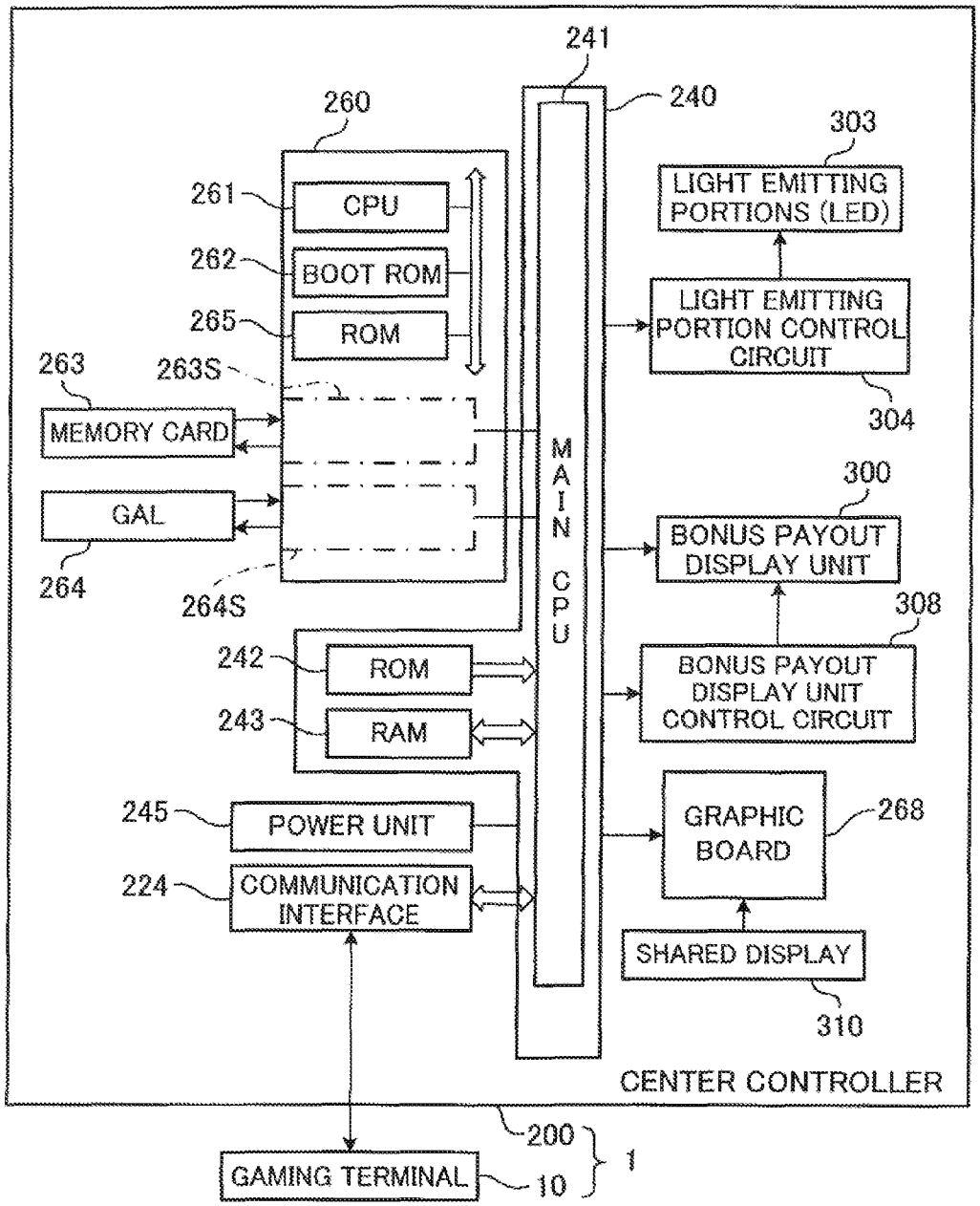
FIG. 61 is a block diagram illustrating an electrical structure of a center controller.

FIG. 61 is a block diagram illustrating an electrical structure of the center controller 200. The center controller 200 is provided therein with a control unit. As illustrated in FIG. 61, the control unit includes components such as a motherboard 240, a gaming board 260, a graphic board 268, a light-emitting portion control circuit 304, a bonus payout display unit control circuit 308, and an actuator, or the like.

The gaming board 260 has the same structure as that of the abovementioned gaming board 50. The motherboard 240 has the same structure as that of the abovementioned motherboard 40. The communication interface 244 communicates with the terminal controller 100 through a communication line.

The graphic board 268 has the same structure as that of the abovementioned graphic board 68, except in that the graphic board 268 controls image displaying of the shared displays 310 based on a control signal output from the main CPU 241.

A light-emitting portion control circuit 304 controls an activation of an LED as a light-emitting portion 303, activating and inactivating the light-emitting portions 303 based on a control signal output from the main CPU 241.

A bonus payout display unit control circuit 308 variously controls the plurality of LEDs of the bonus payout display unit 300 such that the bonus payout display unit 300 indicates the accumulated jackpot value. That is, the bonus payout display unit control circuit 308 switches activation/inactivation of each LED based on the jackpot value.

The light-emitting portions 303 are configured so as to be capable of lighting in multicolor like the lamp 30. Specifically, the light-emitting portions 303 have red LEDs, green LEDs, and blue LEDs which respectively light in red, green, and blue upon a power supply. The light-emitting portions 303 are capable of lighting in any color by turning each of the LEDs on and off via control of the light-emitting portion control circuit 304.

(Path Unit Activation State Table)

FIG. 62 is a diagram illustrating a path unit activation state table. The path unit activation state table is stored in the RAM 243. The path unit activation state table illustrates the number of activated light-emitting portions 303 and the number of inactivated light-emitting portions 303 for each of the path units 301. For instance, there are ten activated light-emitting portions 303 and ninety inactivated light-emitting portions 303 on the path unit 301*a*.

(Event Participation State Table)

FIG. 63 is a diagram illustrating an event participation state table. The event participation state table is stored in the RAM 243. The event participation state table indicates a state of participation/nonparticipation in an event for each of the gaming terminals 10. For instance, the gaming terminal 10*a* is "participating" in the event, while the gaming terminal 10*b* is "nonparticipating" in the event 10*b*.

(Process Operation of Gaming Machine 1: Boot Process)

Figure 64:
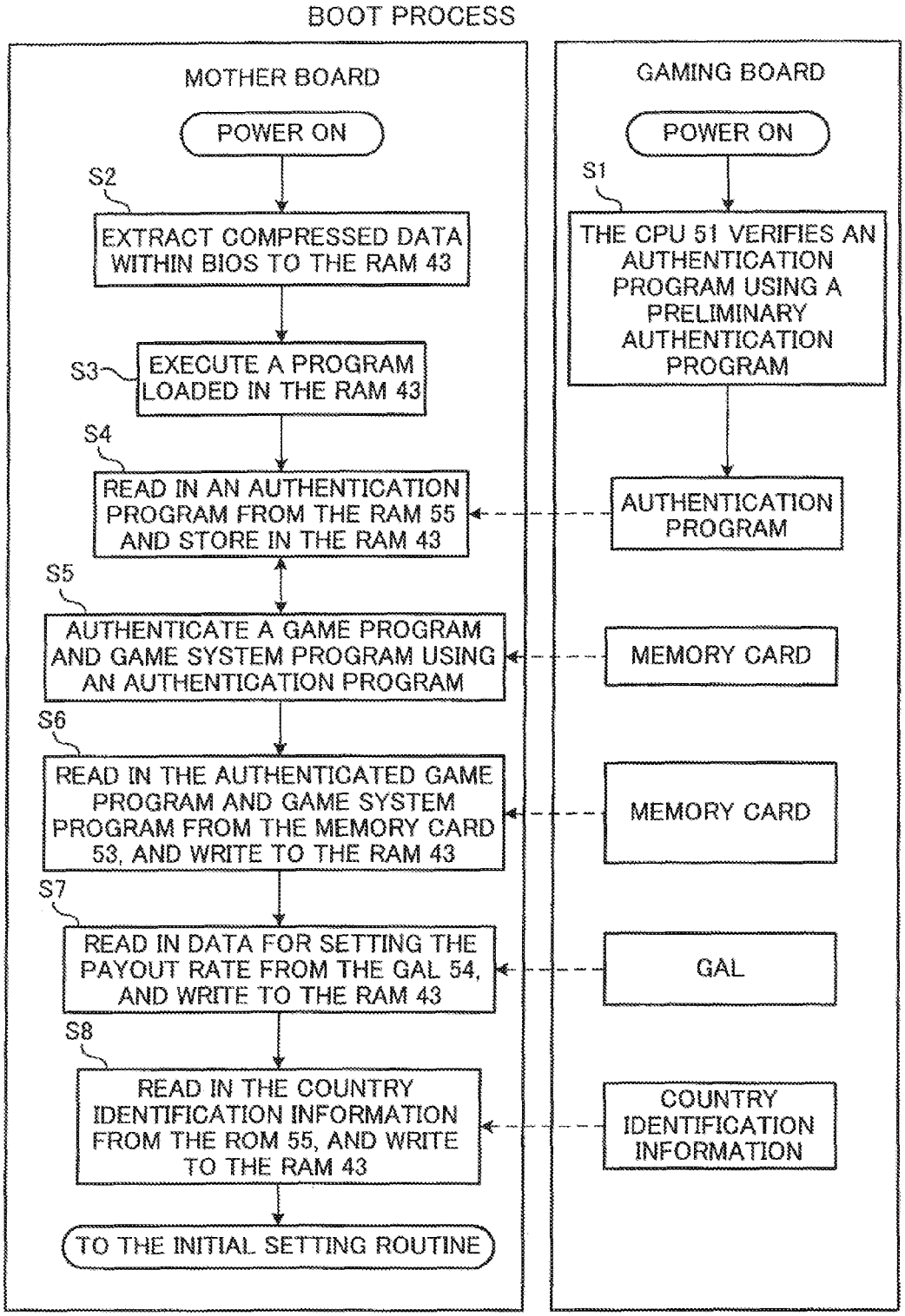
FIG. 64 is a flowchart illustrating a boot process executed in the gaming terminal and the center controller.

The following describes a boot process which takes place in the gaming machine 1. Upon powering on the gaming machine 1, a boot process routine illustrated in FIG. 64 is executed in the motherboard 240 and the gaming board 260 in the center controller 200 and in the motherboard 40 and the gaming board 50 in the terminal controller 100. The memory cards 53 and 263 are assumed to be inserted into the card slots 53S and 263S of the gaming boards 50 and 260 respectively. Further, the GALs 54 and 264 are assumed to be attached to the IC sockets 54S and 264S respectively.

First, turning on the power switch of (powering on) the power units 45 and 245 boots the motherboards 40 and 240, and the gaming boards 50 and 260. Booting the motherboards 40 and 240 and the gaming boards 50 and 260 starts separate processes in parallel. Specifically, the CPUs 51 and 261 read out preliminary authentication programs stored in the boot ROMs 52 and 262 respectively. Then, preliminary authentication is performed according to the read out preliminary authentication programs so as to confirm and verify that no falsification is made to authentication programs, before reading them in the motherboards 40 and 240 respectively (S1). Meanwhile, the main CPUs 41 and 241 of the motherboards 40 and 240 run BIOS stored in the ROMs 42 and 242 to load into the RAMs 43 and 243 compressed data built in the BIOS respectively (S2). Then, the main CPUs 41 and 241 run the BIOS loaded into the RAMs 43 and 243 so as to diagnose and initialize various peripheral devices (S3).

The main CPUs 41 and 241, which are respectively connected to the ROMs 55 and 265 of the gaming boards 50 and 260 via PCI buses, read out authentication programs stored in the ROMs 55 and 265 and stores them in the RAMs 43 and 243 (S4). During this step, the main CPUs 41 and 241 each derives a checksum through ADDSUM method (a standard check function) according to a function of a standard BIOS and store the authentication programs into RAMs 43 and 243 while confirming if the storing is carried out without an error.

Next, the main CPUs 41 and 241 each checks what connects to the IDE bus. Then, the main CPUs 41 and 241 access, via the IDE buses, to the memory cards 53 and 263 inserted into the card slots 53S and 263S, and read out game programs and game system programs from the memory cards 53 and 263 respectively. In this case, the CPUs 41 and 241 each reads out four bytes of data constituting the game program and the game system program at one time. Next, the main CPUs 41 and 241 authenticate the game program and the game system program read out according to the authentication program stored in the RAMs 43 and 243 to confirm and verify that these programs are not falsified (S5).

When the authentication properly ends, the main CPUs 41 and 241 write and store the authenticated game programs and game system programs in the RAMs 43 and 243 (S6).

Next, the main CPUs 41 and 241 access, via the PCI buses, to the GALs 54 and 264 attached to the IC socket 54S and 264S, read out payout rate setting data from the GALs 54 and 264 respectively, and write and store the data in the RAMs 43 and 243 (S7).

Next, the main CPUs 41 and 241 read out, via the PCI buses, country identification information stored in the ROMs 55 and 265 of the gaming boards 50 and 265 respectively and then store the information in the RAMs 43 and 243 (S8).

Figure 65:
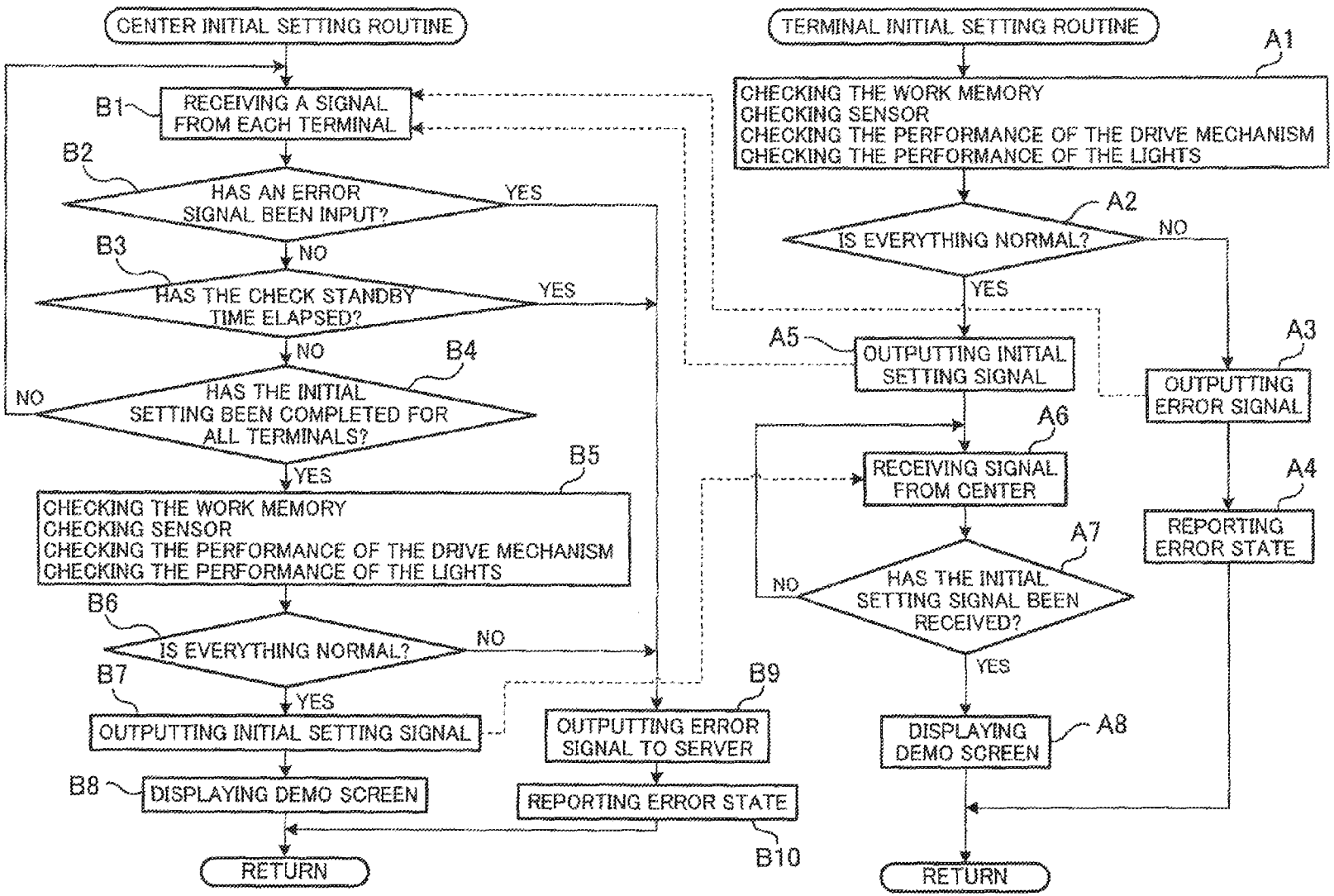
FIG. 65 is a flowchart illustrating an initial process executed in the gaming terminal and the center controller.

After the abovementioned process, the main CPUs 41 and 241 each performs an initial process of FIG. 65.

(Process Operation of Gaming Machine 1: Initial Process)

The following describes an initial process which takes place in the gaming machine 1. When the boot process of FIG. 64 is completed, the center controller 200 reads out from the RAM 243 a center side initial setting routine illustrated in FIG. 65 and executes the routine. When the boot process of FIG. 64 is completed, the gaming terminal 10 reads out from the RAM 43 a terminal side initial setting routine illustrated in FIG. 65 and executes the routine. The center side and terminal side initial setting routines are executed in parallel.

First, the main CPU 41 of each of the gaming terminals 10 checks the operations of each work memory such as the RAM 43, various sensors, various driving mechanisms, and various decorative illuminations (A1). Then, the main CPU 41 determines if all the check results are normal (A2). If the main CPU 41 determines that the check results contains an error (A2: NO), the main CPU 41 outputs an error signal to the center controller 200 (A3), reports the error in the form of illuminating the lamp 30 or the like (A4), and then ends the routine.

On the other hand in A2, if the main CPU 41 determines that all the check results are normal (A2: YES), an initial setting signal is output to the center controller 200 (A5). Then, an initial setting signal is waited from the center controller 200 (A6, A7: NO).

The main CPU 241 of the center controller 200 receives signals from each of the terminals (B1). Then, the main CPU 241 determines whether a signal received is an error signal (B2). If the main CPU 241 determines that the signal is an error signal (B2: YES), the main CPU 241 outputs the error signal to a server of a not-shown host computer or the like (B9) to report the error (B10), and ends the routine.

On the other hand in B2, if the main CPU 241 determines that the signal is not an error signal (B2:NO), the main CPU 241 determines whether a predetermined time (check time) has elapsed from the time of powering on (B3). If the main CPU 241 determines that the check time has elapsed (B3: YES), B9 is executed. On the other hand, if the main CPU 241 determines that the check time has not yet elapsed (B3: NO), it is determined whether an initial setting signal has been received from all of the gaming terminals 10 (B4). If it is determined that an initial setting signal from any one of the gaming terminals 10 has not been received (B4: NO), the process returns to B1. On the other hand, if it is determined that initial setting signals from all the gaming terminals 10 are received (B4: YES), the main CPU 241 checks operations of work memories such as RAM 243 or the like, various sensors, various driving mechanisms, and various decorative illuminations (B5). Then, the main CPU 241 determines whether all the check results are normal (B6). If the main CPU 241 determines the check results contain an error (B6: NO), the main CPU 241 executes B9.

On the other hand in B6, if it is determined that all the check results are normal (B6: YES), the main CPU 241 outputs an initial setting signal to all the gaming terminals 10 (B7), causes the shared displays 310 to display a demo-screen (B8), and then ends the routine.

In the process of A7, the main CPU 41 in the gaming terminal 10 determines that an initial setting signal has been received from the center controller 200 (A7: YES), causes the upper image display panel 33 and the lower image display panel 16 to display a demo-screen (A8), and then ends the routine.

(Process Operation of Gaming Terminal 10: Gaming Terminal Process Routine)

Figure 66:
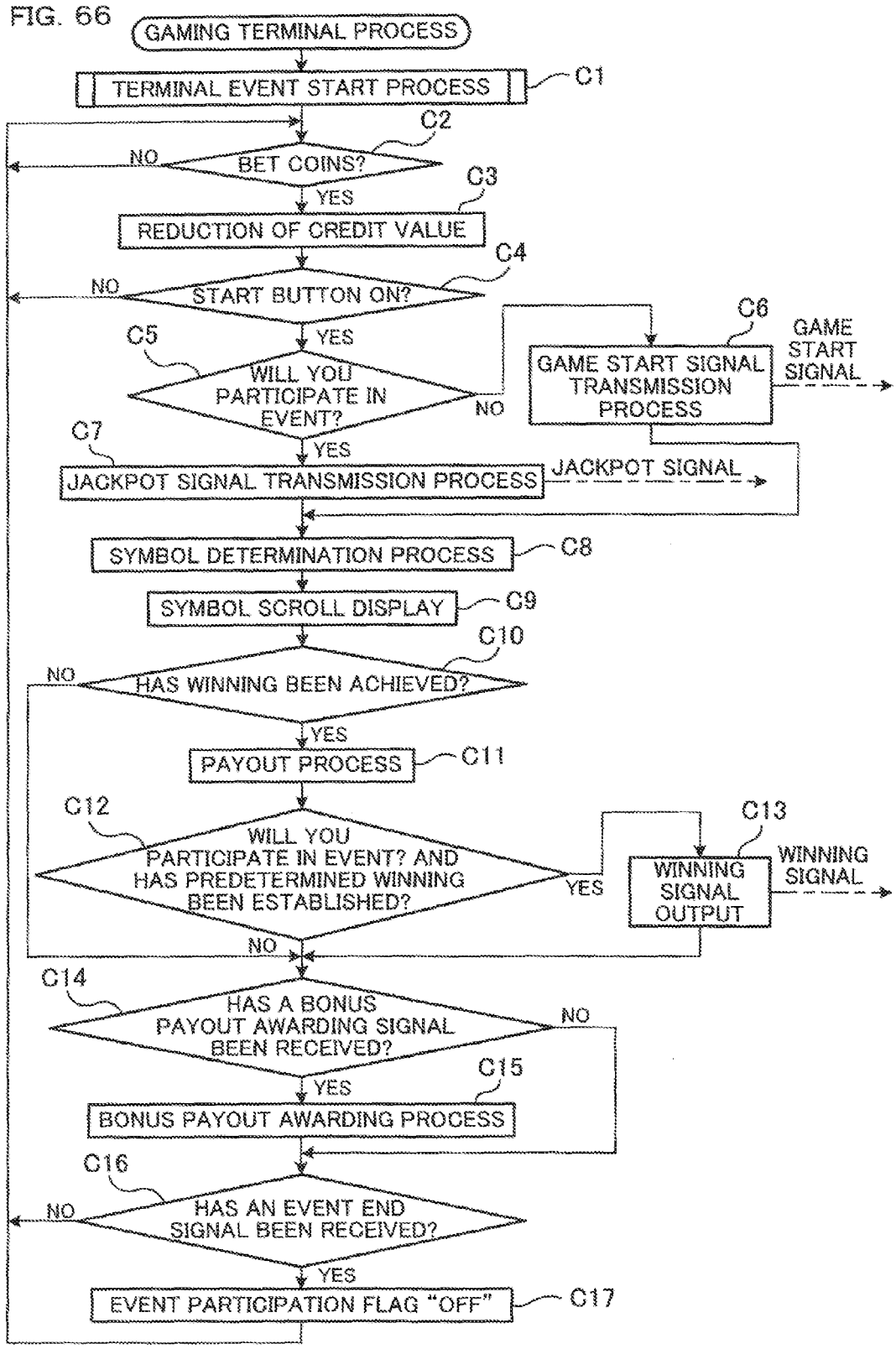
FIG. 66 is a flowchart illustrating a gaming terminal process routine executed in the gaming machine according to the embodiment 3-1.

After the terminal side initial setting routine of FIG. 65, the main CPU 41 of the gaming terminal 10 performs a gaming terminal process routine of FIG. 66. A game is run through this terminal process routine executed by the main CPU 41.

As illustrated in FIG. 66, a later-described terminal side event participation process is executed (C1) in the gaming terminal process routine. Next, it is determined whether a coin is bet (C2). In this process, it is determined whether an input signal from the 1-bet switch 26S entered by pressing of the 1-bet button 26 has been received, and it is also determined whether a signal from the maximum bet switch 27S entered by pressing of the maximum bet button 27 has been received. If no coin is bet (C2: NO), C2 is repeated until a coin is bet.

On the other hand, if a coin is bet (C2: YES), the credit value stored in the RAM 43 is reduced according to the number of coins bet (C3). When the number of coins bet surpasses the number of coins equivalent to the credit value stored in the RAM 43, the process goes to later-described C4 without the reduction of the credit value. When the number of coins bet exceeds the maximum number of coins bettable for one game (50 pieces in this embodiment), the process goes to a later-described step C4 without the reduction of the credit value.

Then, it is determined whether a spin button 23 is pressed (C4). If the spin button 23 is not pressed (C4: NO), the process returns to C2. Here, if the spin button 23 is not pressed (for example, the spin button 23 is not pressed but a command to end the game is input), the reduction of the credit value in C3 is canceled.

On the other hand, if the spin button 23 is pressed (C4: YES), it is determined whether the gaming terminal is participating in an event (C5). Specifically, it is determined whether an event participation flag stored in the RAM 43 is set to "ON". Although it will be described later, the event participation flag is set to "ON" when selecting "Participate" in the participation selection screen and "OFF" when the event ends.

When the gaming terminal is not participating in an event (C5: NO), the game start signal transmission process is executed (C6). Herein, the game start signal indicates that a game is started. The game start signal is transmitted to the center controller 200. As described later, each time the center controller 200 receives a game start signal from each of the gaming terminals 10, the accumulated number of unit games is incremented by one.

When the gaming terminal is participating in an event (C5: YES), a jackpot signal transmission process is executed (C7). In other words, a jackpot signal indicating a part of the game value bet is transmitted to the center controller 200. Thus, for a bet from the gaming terminal 10 that participates in an event, the value after deducting part of the bet game value comes to the bet amount.

Then, a symbol determining process is executed (C8) That is, the stop symbol determining program stored in the RAM 43 is run to determine symbols 180 to be stopped in the matrix 156. Through this, a symbol combination to be stopped on the payline L is determined.

Thereafter, the scrolling process is executed to scroll symbols 180 on the lower image display panel 16 (C9).

The scrolling process is a process in which the symbols 180 determined in the process of C5 are stopped (rearranged) in the matrix 156 after scrolling of symbols 180 in a direction indicated by an arrow symbol. (see FIG. 57)

Next, it is determined whether a winning is resulted with a combination of symbols 180 rearranged in the matrix 156 (C10). When it is determined that a winning is achieved (C10: YES), a payout process is executed (C11). More specifically, when a winning is resulted, the number of coins according to the combination is calculated. On the other hand in the process of C7, when it is determined that no winning is achieved (C10: NO), a later-described process of C14 is executed.

After the payout process in C11 is executed, the main CPU 41 determines whether the gaming terminal is participating in an event and whether a predetermined winning is achieved (C12) When the event participation flag is set to "ON", it is determined that the gaming terminal is participating in an event. When participating in an event, and if it is determined that a predetermined winning is achieved (C12: YES), a winning signal is output to the center controller 200 (C13), the process of C14 is executed. Meanwhile, when not participating in an event, or if it is determined that a predetermined winning is not achieved (C12: NO), the process of C14 is executed.

Next, the main CPU 41 determines whether a bonus payout award signal has been received from the center controller 200 (C14). When it is determined that a bonus payout award signal has been received (C14: YES), a payout is awarded based on the bonus award signal (C15). When it is determined that a bonus payout award signal has not been received after the process of C15 or in the process of C14 (C14: NO), it is determined whether an event end signal has been received (C16). When it is determined that an event end signal has not been received (C16: NO), the process returns to C1.

On the other hand, when it is determined that an event end signal has been received (C16: YES), the event participation flag is set to "OFF" (C17). Afterwards, the process returns to C1.

(Process Operation of Gaming Terminal 10: Terminal Side Event Participation Process Routine)

Figure 67:
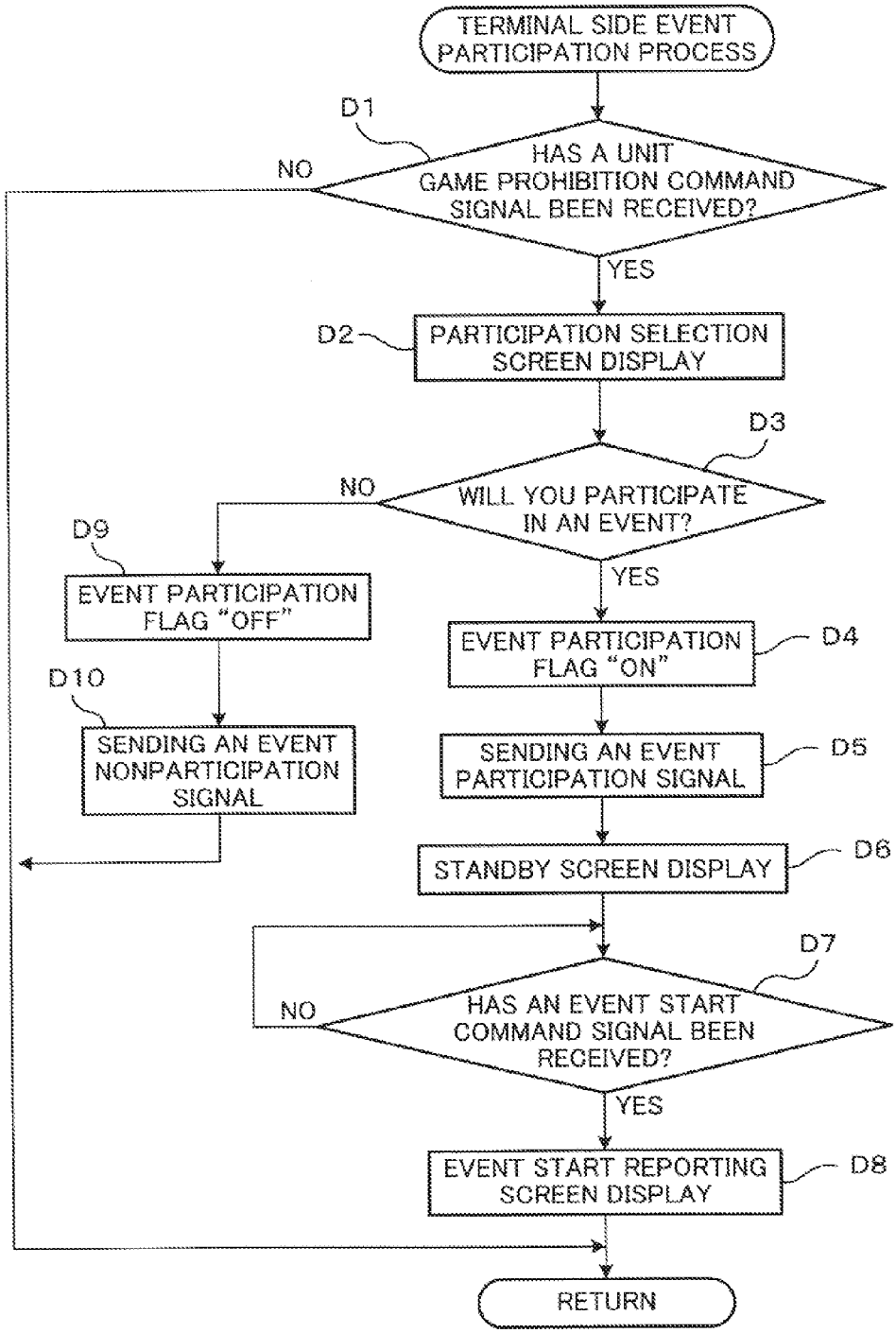
FIG. 67 is a flowchart illustrating a terminal side event participation process routine executed in the gaming machine according to the embodiment 3-1.

The following describes a terminal side event participation process routine run by the main CPU 41 of the gaming terminal 10 with reference to FIG. 67.

First, it is determined whether a unit game prohibition command signal has been received from the center controller 200 (D1). When the unit game prohibition command signal has not yet been received (D1: NO), the routine is ended. When the unit game prohibition command signal has been received (D1: YES), a participation selection screen as illustrated in FIG. 54 is displayed on the lower image display panel 16 (D2).

Afterwards, it will be determined whether to participate in an event (D3). Specifically, it is determined whether a participation button image 142 or a nonparticipation button image 143 displayed on the participation selection screen has been operated by pressing. When a pressing operation is not performed within a predetermined time, it is determined as not participating in an event. When participating in an event (D3: YES)—that is, when the participation button image 142 is operated by pressing—an event participation flag stored in the RAM 43 is set to "ON". Next, the event participation signal is output to the center controller 200 (D5). Herein, the event participation signal includes information that indicates participation in an event and gaming terminal 10 identification information. Then, as illustrated in FIG. 54, a standby screen is displayed (D6). It is determined whether an event start command signal has been received from the center controller 200 (D7). When an event start command signal has not been received (D7: NO), the process of D6 is repeated. As described below, the event start command signal is sent after a predetermined standby time has elapsed since a condition has been achieved to start an event. This switches a gaming terminal 10 that is participating in an event to a standby state until the event start time. When the event start command signal is received (D7: YES), as illustrated in FIG. 54, an event start reporting screen is displayed for a predetermined time (DE). When the event start command signal is output altogether from the center controller to each of the gaming terminals 10, the event start reporting screen is displayed altogether on each of the gaming terminals 10. This allows for each of the gaming terminals 10 to participate in an event altogether. Then, this routine is ended.

On the other hand, in the process of step D3, when not participating in an event (D3: NO)—that is, when a nonparticipation button image 143 is operated by pressing—an event participation flag stored in the RAM 43 is set to "OFF" (D9). Next, an event nonparticipation signal is output to the center controller 200 (D10). Herein, the event nonparticipation signal includes information that indicates nonparticipation in an event and gaming terminal 10 identification information. Then, this routine is ended.

Although it is not illustrated in the figures, operations of the gaming terminal 10 may include a process of displaying a participation reporting text image 147 as illustrated in FIG. 58 on the lower image display panel 16 for a period when an event participation flag is set to "ON".

(Process Operation of Center Controller 200: Center Process Routine)

Figure 68:
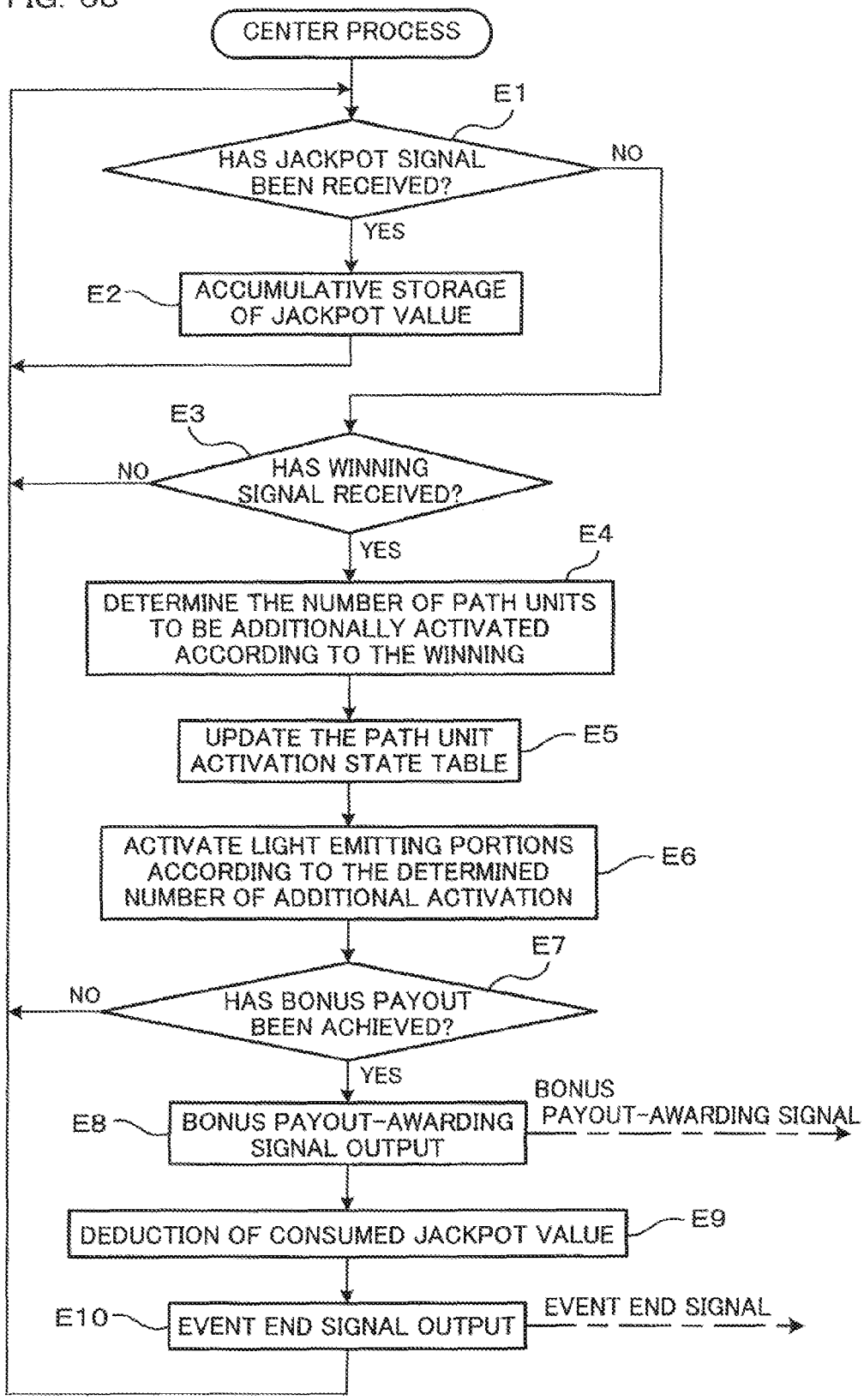
FIG. 68 is a flowchart illustrating a center process routine executed in the gaming machine according to the embodiment 3-1.

After the center side initial setting routine of FIG. 65, the main CPU 241 of the center controller 200 executes a center process routine of FIG. 68. The main CPU 241 performs the center process routine in order to initiate an event.

As illustrated in FIG. 68, in the center process routine, it is determined whether a jackpot signal has been received from the gaming terminal 10 (E1). When it is determined that a jackpot signal has been received (E1: YES), a game value indicated by the jackpot signal is accumulatively stored (E2) Then the process returns to E1.

On the other hand, in the process of E1, when it is determined that a jackpot signal has not yet been received (E1: NO), it is determined that a winning signal has been received from the terminal controller 100 (E3). If it is determined that no winning signal has been received (E3: NO), the process returns to E1. On the other hand, when it is determined that a winning signal has been received (E3: YES), the number of light-emitting portions 303 to be activated of a path unit 301 is determined based on the winning (E4). Then, the path unit activation state table is updated based on the determined number of light-emitting portions 303 to be activated (E5).

Then, the determined number of light-emitting portions 303 are activated towards the bonus payout display unit 300 (E6).

Next, it is determined whether awarding of a bonus payout has been achieved, by determining whether a plurality of light-emitting portions 303 of the path units 301 have been lighted up on the bonus payout display unit 300 (E7). When it is determined that awarding of a bonus payout has not been achieved (E7: NO), the process returns to E1. On the other hand, when it is determined that awarding of a bonus payout has been achieved (E7: YES), a bonus award process is run to award a bonus payout, a bonus award signal is output to a gaming terminal 10 through which a bonus payout is awarded (E8). Then, the consumed jackpot value is deducted from the RAM 243 (E9), and an event end signal is output to each of the gaming terminals 10 (E10). Thereafter, the process returns to step E1.

(Operation of Center Controller 200: Center Side Event Start Process Routine)

Figure 69:
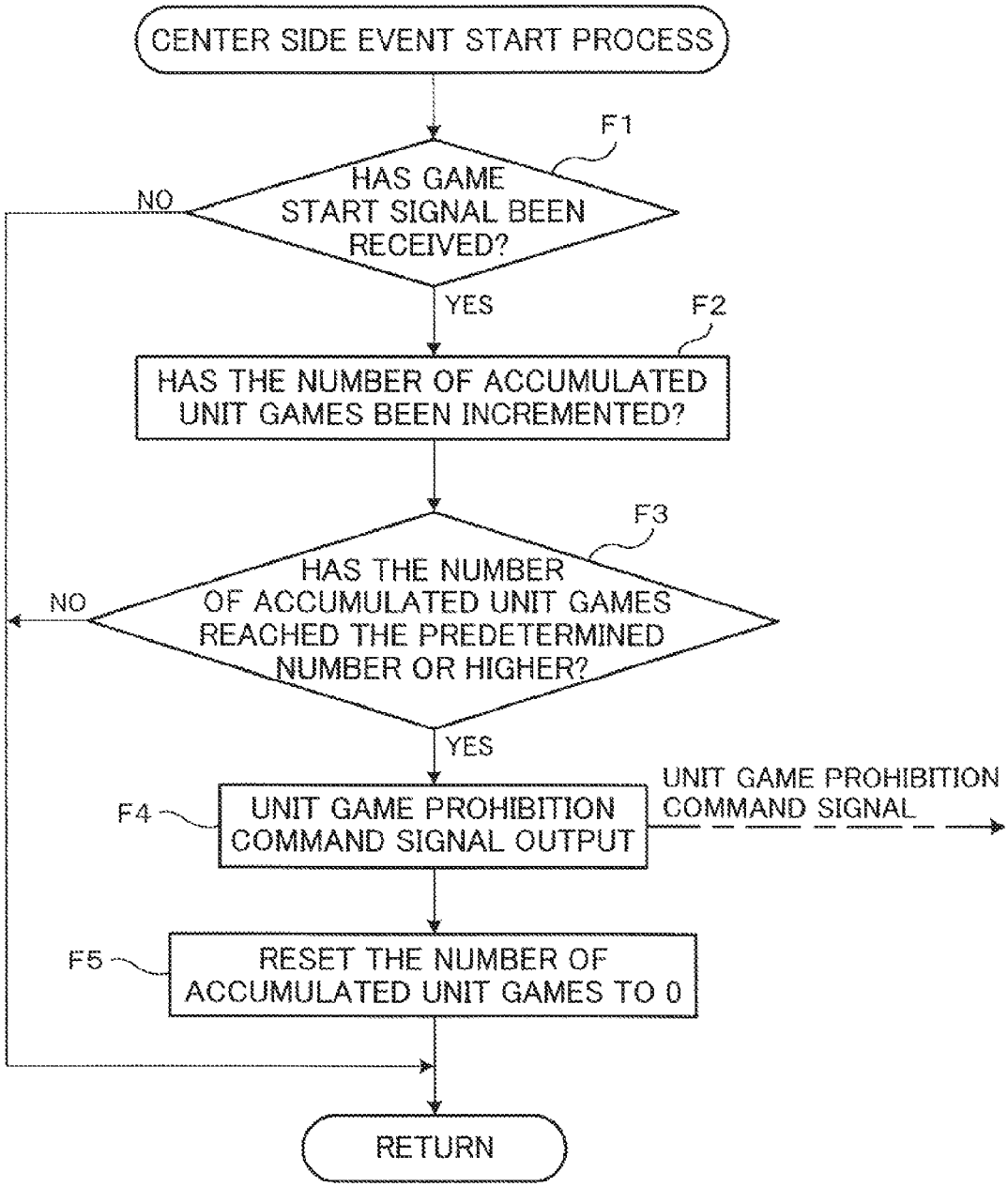
FIG. 69 is a flowchart illustrating a center side event start process routine executed in the gaming machine according to the embodiment 3-1.

Next, with reference to FIG. 69, the following describes a center side event start process routine that is executed by the main CPU 241 in the center controller 200.

First, it is determined whether the gaming terminal 10 has received a game start signal (F1). When a game start signal has not been received (F1: NO), the routine is ended. That is, the event started by the routine is started under the condition of receiving a game start signal from the gaming terminal 10. When a game start signal has been received (F1: YES), the accumulated number of unit games stored in the RAM 243 is incremented by one (F2). Then, it is determined whether the accumulated number of unit games is a predetermined number or higher (F3). When the accumulated number of unit games is less than the predetermined number (F3: NO), the routine is ended. When the accumulated number of unit games is a predetermined number or higher (F3: YES), a unit game prohibition command signal is output to all of the gaming terminals 10 connected to the center controller 200 (F4). Thereafter, the accumulated number of unit games is reset to 0 (F5), and the routine is ended.

(Process Operation of Center Controller 200: Center Side Event Start Process Routine)

Figure 70:
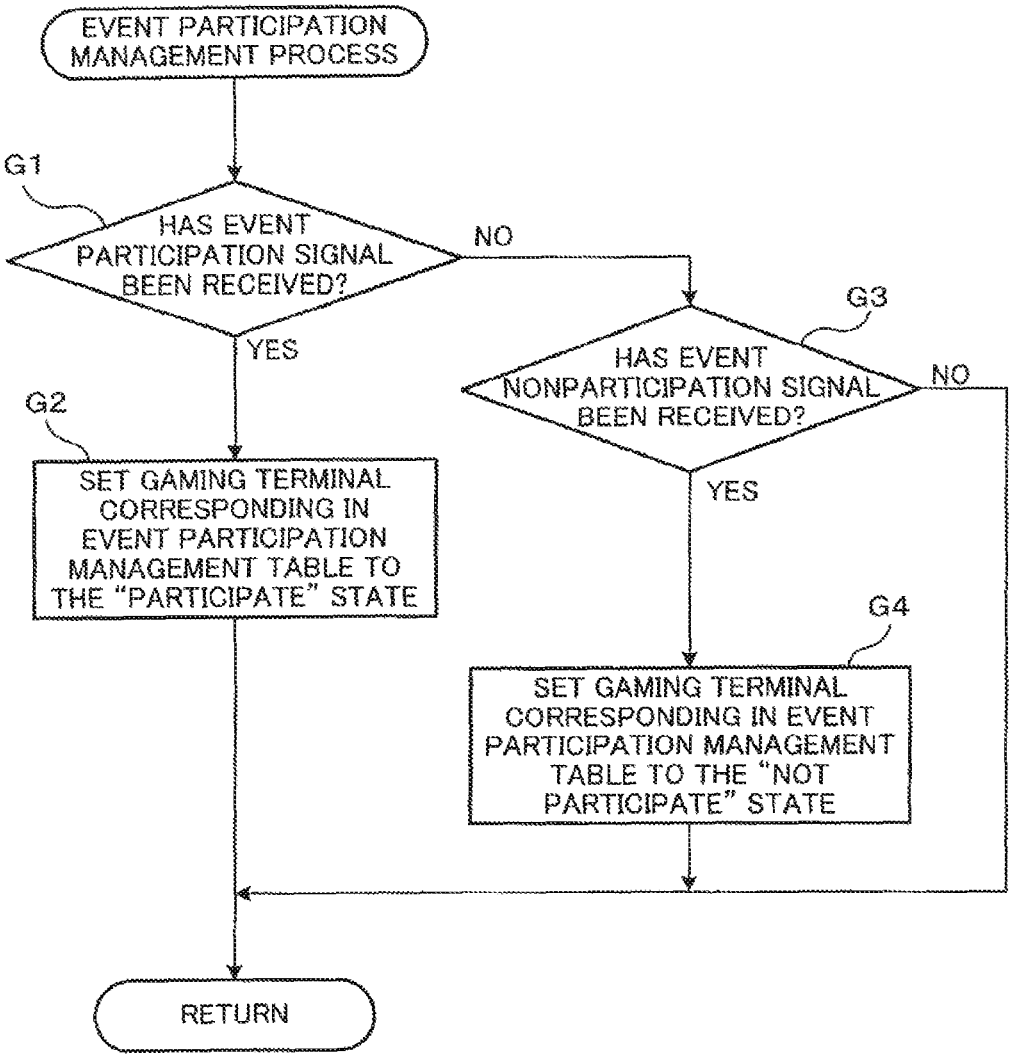
FIG. 70 is a flowchart illustrating an event participation management process routine executed in the gaming machine according to the embodiment 3-1.

Next, with reference to FIG. 70, the following describes a center side event participation management process routine that is executed by the main CPU 241 in the center controller 200.

First, it is determined whether an event participation signal has been received (G1). When an event participation signal is received (G1: YES), an event participation state table illustrated in FIG. 63 is updated based on the gaming terminal identification information that is included in an event participation signal (G2). Specifically, the state of the gaming terminal corresponding to the event participation management table is set to "Participate". Then, this routine is ended.

On the other hand, when an event participation signal is not received (G1: NO), it is determined whether an event nonparticipation signal has been received (G3). When an event nonparticipation signal is received (G3: YES), an event participation state table illustrated in FIG. 63 is updated based on the gaming terminal identification information that is included in the event nonparticipation signal (G2). Specifically, the state of the gaming terminal corresponding in the event participation management table is set to "Not Participate". Then, this routine is ended. Further, in step G3, when an event nonparticipation signal is not received, the routine is ended.

As described above, a base game-that is started in response to a bet in a plurality of gaming terminals 10 to consume a predetermined time-is run independently of any other gaming terminals 10, and a payout is awarded according to the predetermined results of the unit game. It is determined whether a predetermined condition has been met to start an event in which a plurality of gaming terminals 10 can participate. When a predetermined condition has been met, a count for a predetermined standby time that is longer than the predetermined time from the timing at which the predetermined condition has been met, and starting of the unit game is prohibited. An event is executed at the timing at which the count is ended.

This enables the gaming terminals 10 to participate in the event altogether after a predetermined standby time that is longer than the unit game after a predetermined standby time that is longer than the unit game has elapsed, regardless of the run timing of the unit game of the base game that is implemented in each of the gaming terminals 10. This realizes a new entertainment characteristic.

As described above, a base game that is started in response to a bet in a plurality of gaming terminals 10 to consume a predetermined time is run independently of any other gaming terminals 10, and a payout is awarded according to the predetermined results of the unit game. It is determined whether a predetermined condition has been met to start an event in which a plurality of gaming terminals 10 can participate. When a predetermined condition has been met, a count is started for a predetermined standby time that is longer than the predetermined time from the timing at which the predetermined condition has been met. The starting of the unit game is prohibited in each of the gaming terminals 10, and a participation selection screen in which participation in an event can be selected is presented. Whether to participate or not in an event is determined based on input into a touch panel 69 capable of receiving input from outside. When the gaming terminal 10 will not participate in an event, starting of the unit game is enabled. When the gaming terminal 10 will participate in an event, the event is executed at the timing at which a count is finished.

This allows for the gaming terminals 10 to participate in an event altogether, regardless of the run timing of the unit game of the base game that is implemented in each of the gaming terminals 10. Further, participation in an event can be selected. This realizes a new entertainment characteristic.

(Embodiment 3-2)

The following describes the embodiment 3-2 of a gaming machine and a playing method thereof according to the present invention. In the mean time, the members same as in the embodiment 3-1 are indicated with the same reference numerals.

In the present embodiment, similar to the embodiment 3-1, the gaming machine 501 realizes a playing method including the steps of: running a base game that repeats a unit game started in a plurality of gaming terminals 10 in response to a bet to consume a predetermined time independently of any other gaming terminals 10 and awarding a payout according to the predetermined results of the unit game; determining whether a predetermined start condition has been met for an event in which a plurality of gaming terminals 10 can participate; when a predetermined condition has been met, starting a count for a predetermined standby time that is longer than the predetermined time from the timing at which a predetermined condition has been met and prohibiting the starting of the unit game in a plurality of gaming terminals 10; and running an event in a plurality of gaming terminals 10 at the timing at which a count is finished.

Figure 71:
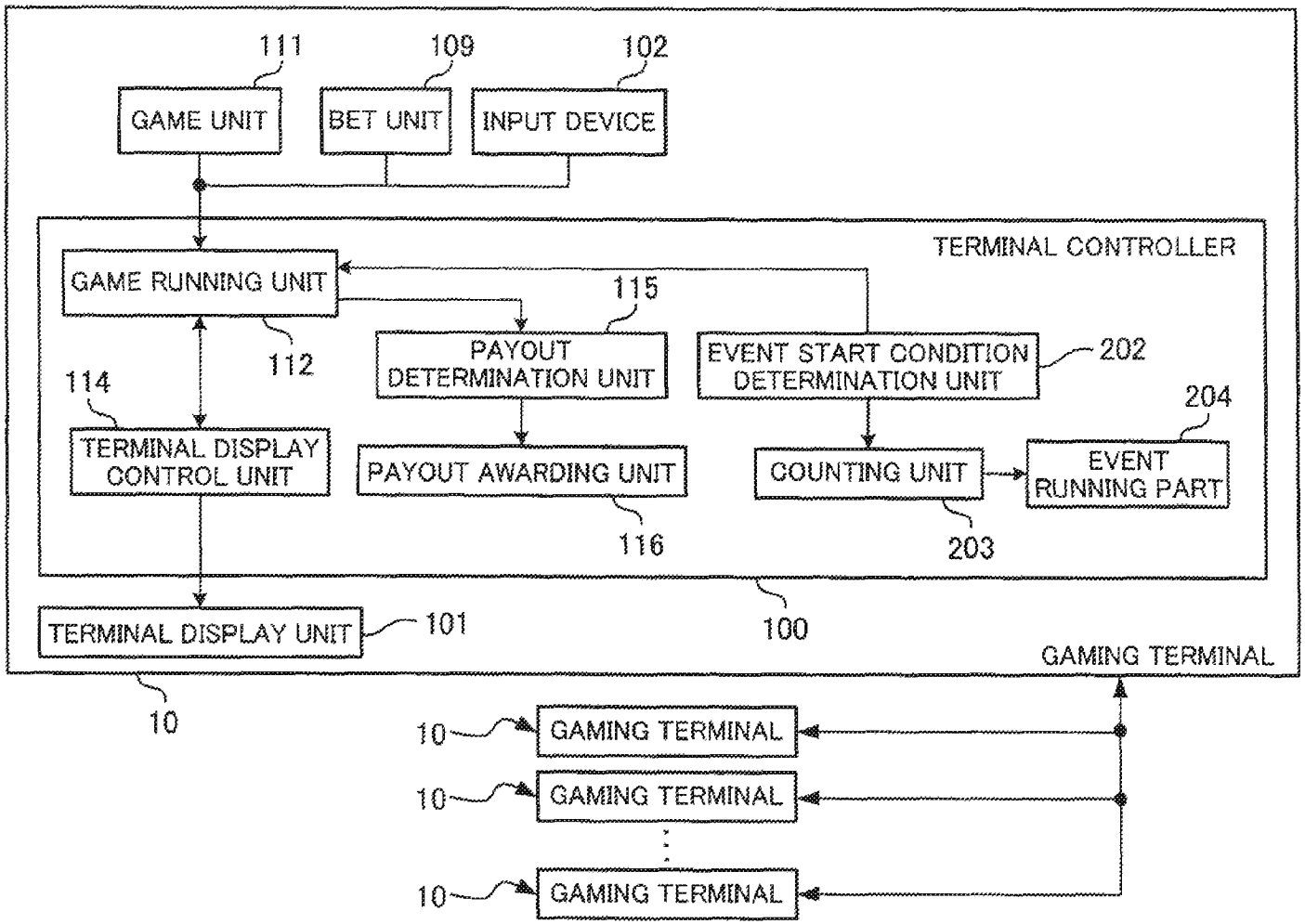
FIG. 71 is a block diagram illustrating the gaming machine according to an embodiment 3-2.

The gaming machine 501 that executes the abovementioned playing method has a plurality of gaming terminals 10 as illustrated in FIG. 71. The gaming terminal 10 has a game starting unit 111, a bet unit 109, an input device 102, a terminal display unit 101, and a terminal controller 100.

(Terminal Controller 100)

The terminal controller 100 is configured to carry out: a first process of running a base game independently of any other gaming terminals 10 and awarding a payout according to the predetermined results of the unit game; a second process of prohibiting the starting of the unit game in accordance with a unit game prohibition command from any terminal controller 100 of a plurality of gaming terminals 10; a third process of participating in an event in accordance with an event start command from the terminal controller 100; a 4-1 process of determining whether a predetermined condition has been met; a 4-2 process of executing the unit game prohibition command in the terminal controller 100 of a plurality of gaming terminals 10 when the predetermined condition has been met, and starting a count for a predetermined standby time that is longer than the predetermined time from the timing at which the predetermined condition has been met; and a 4-3 process of executing an event start command in the terminal controller of a plurality of gaming terminals 10 and running an event. In other words, the terminal controller 100 comprises a first processing unit, a second processing unit, a third processing unit, a 4-1 processing unit, a 4-2 processing unit, and a 4-3 processing unit.

The terminal controller 100 is connected to the terminal controller 100 of another gaming terminal 10 and is in communication with each another. The terminal controller 100 has an event start condition determination unit 202 in the center controller 200 according to the embodiment 3-1, a count unit 203, and an event running unit 204.

In the meantime, each block of the terminal controller 100 may be structured with hardware or software, as needed.

(Operation of Terminal Controller 100)

In the structure above, an operation of the terminal controller 100 will be described. Here, the first process is the same as in the embodiment 3-1, so the description thereof has been omitted. Further, the following "plurality of gaming terminals 10" includes its own.

The starting of the unit game is prohibited by the game running unit 112 based on a unit game prohibition command from the terminal controller 100. For example, when a unit game is run in the gaming terminal 10, the unit game is not started after the running unit game is finished. In this case, the terminal display control unit 114 may present options in which participation in an event can be selected in the terminal display unit 101. Thus, the terminal controller 100 performs the second process of prohibiting starting of the unit game based on the unit game prohibition command from the terminal controller 100 of a plurality of gaming terminals 10.

Then, the gaming terminal 10 participates in an event based on the event start command from the terminal controller 100. When the terminal display control unit 114 presents options in which participation in an event can be selected in the terminal display unit 101, the following processes may be executed. Specifically, the game running unit 112 determines whether the gaming terminal 10 will participate in an event based on input from outside to the input device 102. When the gaming terminal 10 will not participate in an event, the game running unit 112 allows starting of the unit game. That is, it allows the bet unit 109 to receive a bet and the game starting unit 111 to start a unit game. When the gaming terminal 10 will participate in an event, the gaming terminal 10 participates in an event based on an event start command from the terminal controller 100. Thus, the terminal controller 100 executes the third process of participating in an event in accordance with an event start command from the terminal controller 100 of a plurality of gaming terminals 10.

Further, the terminal controller 100 has a function of running an event in which a plurality of gaming terminals 10 participate as follows.

First, the event start condition determination unit 202 determines whether a predetermined condition has been met to start an event. Thus, the terminal controller 100 executes the fourth process to determine whether a predetermined condition has been met.

Then, a unit game prohibition command signal is output from the event start condition determination unit 202 to the terminal controller 100 of a plurality of gaming terminals 10. Further, a condition establishment signal is transmitted from the event start condition determination unit 202 to the count unit 203. The count unit 203 starts a count for a predetermined standby time upon receiving a condition establishment signal. Thus, when a predetermined condition is met, the terminal controller 100 performs the fifth process of executing a unit game prohibition command in the terminal controller 100 of a plurality of gaming terminals 10, and starting a count for a predetermined standby time that is longer than the predetermined time from the timing at which a predetermined condition has been met.

Further, a count end signal is transmitted from the count unit 203 to the event running unit 204 when a count for a predetermined standby time is ended. An event start command signal is output from the event running unit 204 to the terminal controller 100 of a plurality of gaming terminals based on the reception of a count end signal. An event is executed by the event running unit 204. Thus, the sixth process is executed by carrying out an event start command in the terminal controller 100 of a plurality of gaming terminals 10 and running an event.

As is clear from the abovementioned operations, the gaming machine 1 realizes a playing method including the steps of: running a base game that repeats a unit game started in a plurality of gaming terminals 10 in response to a bet to consume a predetermined time independently of any other gaming terminals 10 and awarding a payout according to the predetermined results of the unit game; determining whether a predetermined start condition has been met for an event in which a plurality of gaming terminals 10 can participate; when a predetermined condition has been met, starting a count for a predetermined standby time that is longer than the predetermined time from the timing at which a predetermined condition has been met and prohibiting the starting of the unit game in a plurality of gaming terminals 10; and running an event in a plurality of gaming terminals 10 at the timing at which a count is finished.

According to this playing method, a base game that repeats a unit game started in a plurality of gaming terminals 10 in response to a bet to consume a predetermined time is run independently of any other gaming terminals 10, and a payout is awarded according to the predetermined results of the unit game. It is determined whether a predetermined condition has been met to start an event in which a plurality of gaming terminals 10 can participate. When a predetermined condition has been met, a count is started for a predetermined standby time that is longer than the predetermined time from the timing at which a predetermined condition has been met, and the starting of the unit game is prohibited. An event is run at the timing at which the count is finished.

Thus, this enables the gaming terminals 10 to participate in an event altogether after a predetermined standby time that is longer than the unit game has elapsed since the predetermined condition has been met, regardless of the run timing of the unit game of the base game that is implemented in each of the gaming terminals 10. This realizes a new entertainment characteristic.

Further, the gaming machine 1 may have the processes of: in the above playing method, presenting options in which participation in an event can be selected; determining whether the gaming terminal 10 will participate in an event based on input into the input device 102; and allowing starting of the unit game when the determination is to not participate in the event.

According to this playing method, a base game repeats a unit game started in a plurality of gaming terminals 10 in response to a bet to consume a predetermined time, and a payout is awarded according to the predetermined results of the unit game. It is determined whether a predetermined condition has been met to start an event in which a plurality of gaming terminals 10 can participate. When a predetermined condition has been met, a count for a predetermined standby time that is longer than the predetermined time is started from the timing at which the predetermined condition has been met. The starting of the unit game is prohibited in each of the gaming terminals 10, and options in which participation in an event can be selected are presented. Whether to participate or not in an event is determined based on input into the input device 102 capable of receiving input from outside. When the gaming terminal 10 will not participate in an event, starting of the unit game is allowed. When the gaming terminal 10 will participate in an event, the event is run at the timing at which the count is finished.

Thus, this enables the gaming terminals 10 to participate in an event altogether after a predetermined standby time that is longer than the unit game has elapsed since the predetermined condition has been met, regardless of the run timing of the unit game of the base game that is implemented in each of the gaming terminals 10. Further, participation in an event can be selected. This realizes a new entertainment characteristic.

(Structure of Gaming Machine 501)

The run timing of an event, display mode, mechanical structure, and electrical structure of the gaming machine 501 are similar to those in the embodiment 3-1, so the descriptions thereof have been omitted. A plurality of gaming terminals 10 are mutually interconnected via a communication interface 44, communication circuits, or the like. Further, in this embodiment, the event participation state table in the embodiment 3-1 is configured so as to be stored in the RAM 43 of the gaming terminal 10 that runs an event. A bonus payout display unit 300, path units 301, and shared displays 310 are controlled by the center controller 200 based on a command from the gaming terminals 10 that runs an event.

(Process Operation of Gaming Machine 501)

The boot process routine and initial process routine in the present embodiment are the same as those in the embodiment 3-1, so the descriptions thereof have been omitted. Further, the gaming terminal 10 of the present embodiment performs the same processes as those in the gaming terminal process routine that is described with reference to FIG. 66 in the embodiment 3-1, so the descriptions thereof have been omitted.

Figure 72:
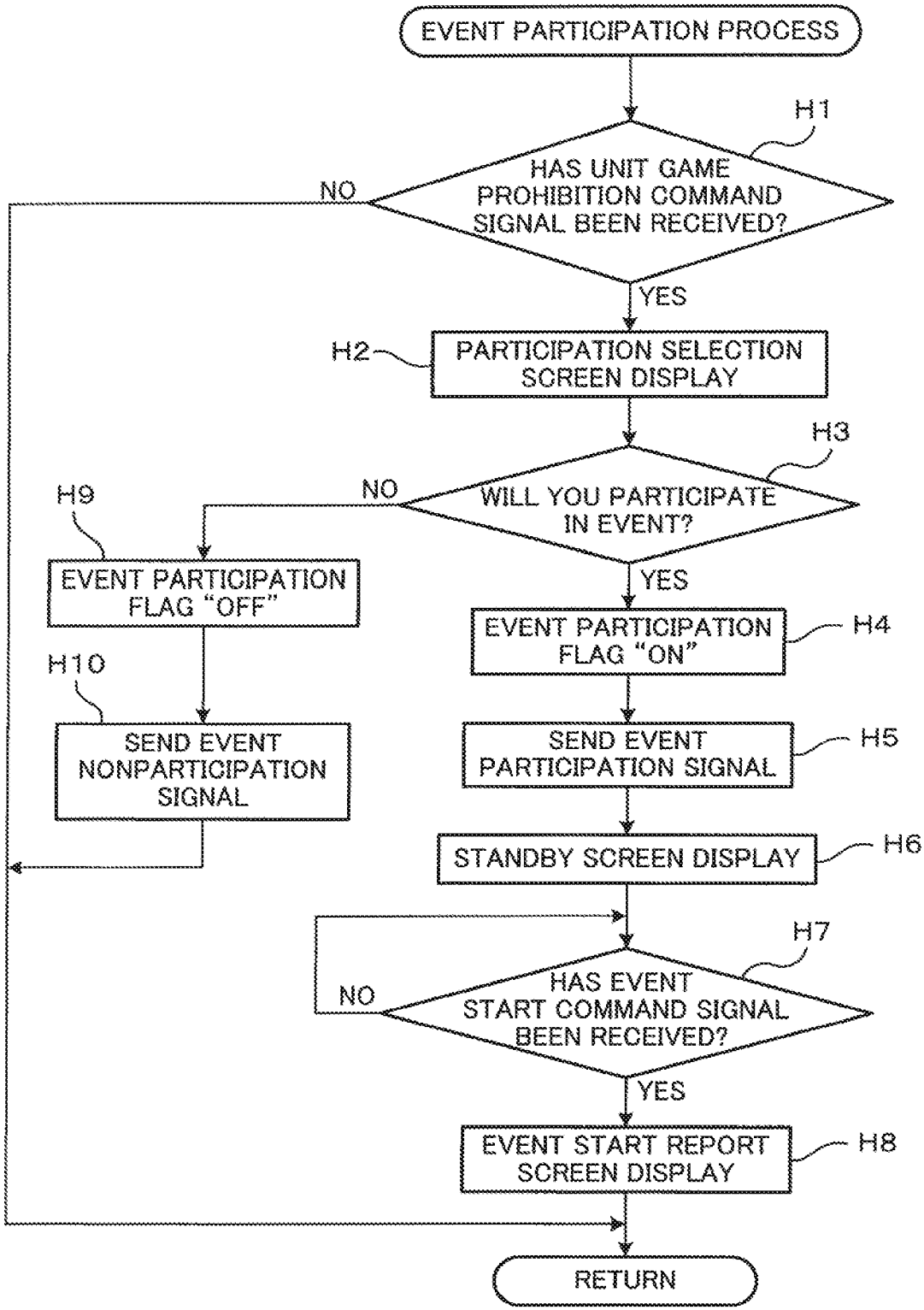
FIG. 72 is a flowchart illustrating an event participation process routine executed in the gaming machine according to the embodiment 3-2.

In the gaming terminal process routine of the present embodiment, a jackpot signal to be transmitted to the center controller 200 and a winning signal are output to the gaming terminal 10 that runs an event. Further, in the gaming terminal process routine of the present embodiment, a bonus payout awarding signal to be received and an event end signal are output from the gaming terminal 10 that runs an event. Instead of performing the terminal side event start process of step C1 as illustrated in FIG. 66, a later-described event participation process illustrated in FIG. 72 is executed. Further, instead of running the game start signal transmission process of step C6 as illustrated in FIG. 66, a process is executed in which the number of start unit games to be stored in the RAM 43 is incremented by one. When an event end signal is received, it clears the event running gaming terminal information that runs an event to be stored in the RAM 43 (a state indicating no information).

(Process Operation of Gaming Terminal 10: Event Participation Process Routine)

The following describes an event participation process routine run by the main CPU 41 of the gaming terminal 10 with reference to FIG. 72.

First, it is determined whether a unit game prohibition command signal transmitted from the gaming terminal 10 that runs an event has been received (H1). When the unit game prohibition command signal is not received (H1: NO), the routine is ended. When the unit game prohibition command signal is received (H1: YES), the participation selection screen as illustrated FIG. 54 is displayed on the lower image display panel 16 (H2). The unit game prohibition command signal includes event running gaming terminal information indicating the gaming terminal 10 that runs an event. The information is stored in the RAM 43. Further, although it is not illustrated in the figures, when the unit game prohibition command signal is received, a process is executed to reset the number of start unit games to be stored in the RAM 43 to 0.

Thereafter, participation in an event is determined (H3) Specifically, it is determined whether the participation button image 142 displayed in the participation selection screen or the nonparticipation button image 143 has been operated by pressing. When it is not operated by pressing within a predetermined time, it is determined to not participate in an event. When participating in an event (H3: YES)—that is, when the participation button image 142 is operated by pressing—the event participation flag stored in the RAM 43 is set to "ON". Next, an event participation signal is output to the gaming terminal 10 that runs an event (H5). Then, as illustrated in FIG. 54, a standby screen is displayed (H6). It is determined whether an event start command signal has been received from the gaming terminal 10 that runs an event (H7). When an event start command signal is not received (H7: NO), the process of H6 is repeated. The later-described event start command signal is transmitted after a predetermined standby time has elapsed since a condition has been met to start an event. This changes the gaming terminal 10 that is participating in an event to a standby state until an event start time. When an event start command signal is received (H7: YES), it is reported that the gaming terminal will participates in an event by an event start reporting screen as illustrated in FIG. 54 being displayed for a predetermined time (H8). Then, this routine is ended.

On the other hand, in the process of step H3, when the gaming terminal will not participate in an event (H3: NO)—that is, when a nonparticipation button image 143 is operated by pressing—an event participation flag stored in the RAM 43 is set to "OFF" (H9). Next, the event nonparticipation signal is output to the gaming terminal 10 that runs an event (H10), and the routine is ended.

(Process Operation of Gaming Machine 501: Event Running Process Routine)

Figure 73:
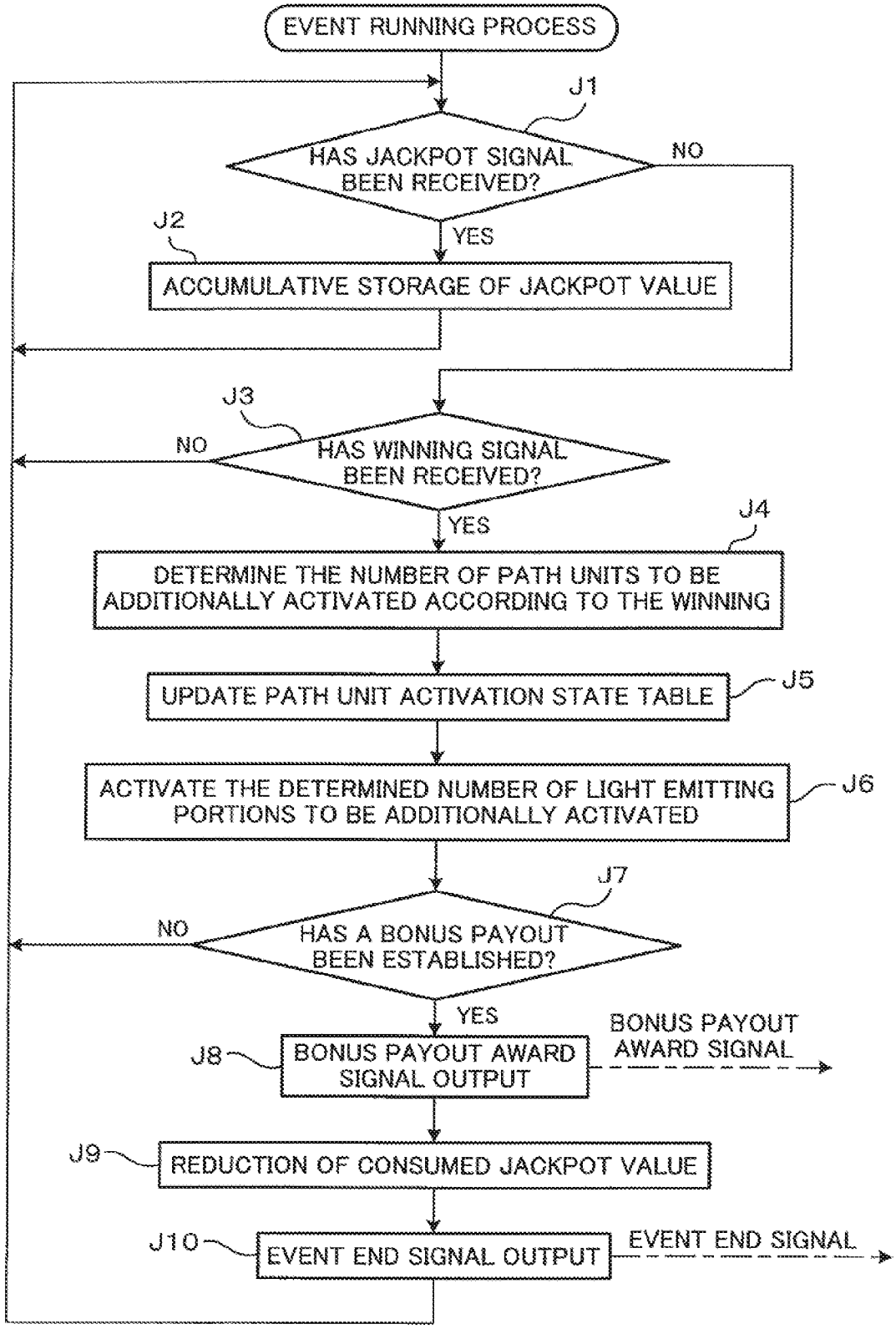
FIG. 73 is a flowchart illustrating an event running process routine executed in the gaming machine according to the embodiment 3-2.

The following describes an event running process routine run by the main CPU 41 of the gaming terminal 10 with reference to FIG. 73. In the present embodiment, an event is started under the condition that a predetermined number of unit games has been run in the gaming terminal 10.

As illustrated in FIG. 73, it is determined whether a jackpot signal has been received from the gaming terminal 10 in the event running process routine (J1). When it is determined that a jackpot signal has been received (J1: YES), the game value indicated by the jackpot signal is accumulatively stored (J2). Herein, a command signal is output to the center controller 200 in order to change the mode of the bonus payout display unit 300. Afterwards, the process returns to the process of J1.

On the other hand, if it is determined that a jackpot signal has not been received in the process of J1 (J1: NO), it is determined that a winning signal has been received from the terminal controller 100 (J3). If it is determined that no winning signal has been received (J3: NO), the process returns to H1. On the other hand, when it is determined that a winning signal has been received (J3: YES), the number of light-emitting portions 303 of a path unit 301 to be activated is determined based on the winning (J4). Next, the path unit activation state table is updated based on the determined number of light-emitting portions 303 to be activated (J5). Then, a command signal is output to the center controller 200 to activate the determined number of light-emitting portions 303 to be activated for the bonus payout display unit 300 (J6).

Next, it is determined whether awarding of a bonus payout is achieved by determining whether a plurality of light-emitting portions 303 of the path unit 301 has been lighted up to the bonus payout display unit 300 (J7). When it is determined that awarding of a bonus payout has not been achieved (J7: NO), the process returns to H1. On the other hand, when it is determined that awarding of a bonus payout has been achieved (J7: YES), a bonus award process is run to award a bonus payout, and a bonus award signal is output to a gaming terminal 10 through which a bonus payout is awarded (J8). Next, the consumed jackpot value is deducted from the RAM 243 (J9), and an event end signal is output to each gaming terminal 10 (J10). Thereafter, the process returns to step J1.

(Operation of Gaming Terminal 10: Event Start Process Routine)

Figure 74:
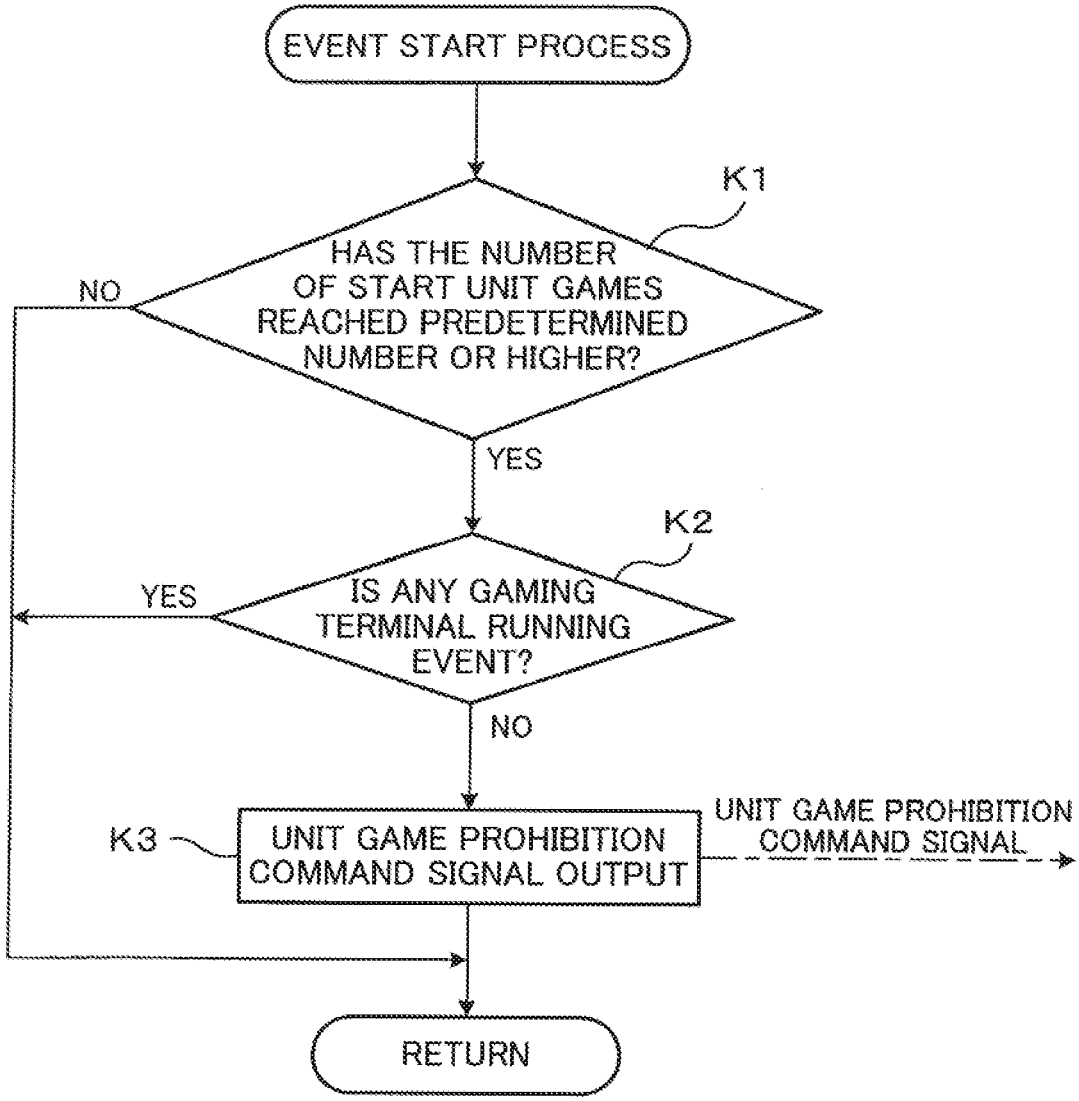
FIG. 74 is a flowchart illustrating an event start process routine executed in the gaming machine according to the embodiment 3-2.

The following describes an event start process routine run by the main CPU 41 of the gaming terminal 10 with reference to FIG. 74.

First, it is determined whether the number of start unit games stored in the RAM 43 is a predetermined number or higher (K1). The number of start unit games is accumulatively stored in each of the gaming terminals 10. When the number of start unit games is less than the predetermined number (K1: NO), the routine is ended. That is, an event started by the routine is started under the condition that the number of start unit games is a predetermined number or higher. When the number of start unit games is a predetermined number or higher (K1: YES), it is determined whether any gaming terminal 10 is running an event (K2). Specifically, when event running gaming terminal information stored in the RAM 43 shows any gaming terminals 10, it is determined that a gaming terminal 10 is running an event. Further, when the event running gaming terminal information does not show any gaming terminals (indicating no information), it is determined that no gaming terminals 10 are running an event.

When a gaming terminal 10 is running an event (K2: YES), it is determined that an event has already started, and the routine is ended. The gaming machine may be capable of running an event, regardless of the running of an event by any other gaming terminals. In this case, the gaming machine is capable of running a plurality of events simultaneously.

On the other hand, when no gaming terminal 10 is running an event (K2: NO), a unit game prohibition command signal is output to a plurality of gaming terminals 10 connected to the gaming terminal 10 that runs an event, and the routine is ended.

(Process Operation of Gaming Terminal 10: Event Participation Management Process Routine)

The event participation management process routine run by the main CPU 41 of the gaming terminal 10 in the present embodiment is the same as the event participation management process run by the main CPU 241 of the center controller 200 that is described with reference to FIG. 70 in the embodiment 3-1, so the descriptions thereof have been omitted.

As mentioned above, a base game that repeats a unit game started in a plurality of gaming terminals 10 in response to a bet to consume a predetermined time is run independently of any other gaming terminals 10, and a payout is awarded according to the predetermined results of the unit game. It is determined whether a predetermined condition has been met to start an event in which a plurality of gaming terminals 10 can participate. When a predetermined condition has been met, a count for a predetermined standby time that is longer than the predetermined time from the timing at which the predetermined condition has been met, and starting of the unit game is prohibited. An event is run at the timing at which a count is finished.

This enables the gaming terminals 10 to participate in an event altogether after a predetermined standby time that is longer than the unit game has elapsed, regardless of the run timing of the unit game of the base game that is implemented in each of the gaming terminals 10. This realizes a new entertainment characteristic.

As mentioned above, a base game that repeats a unit game started in a plurality of gaming terminals 10 in response to a bet to consume a predetermined time is run independently of any other gaming terminals 10, and a payout is awarded according to the predetermined results of the unit game. It is determined whether a predetermined condition has been met to start an event in which a plurality of gaming terminals 10 can participate. When a predetermined condition has been met, a count for a predetermined standby time that is longer than the predetermined time from the timing at which the predetermined condition has been met, and starting of the unit game is prohibited. Starting of the unit game is prohibited in each of the gaming terminals 10, and a participation selection screen is presented in which participation in an event can be selected. Whether to participate or not in an event is determined based on input into a touch panel 69 capable of receiving input from outside. When the gaming terminal 10 does not participate in an event, starting of the unit game is enabled. When the gaming terminal 10 participates in an event, an event is run at the timing at which a count is finished.

This enables the gaming terminals 10 to participate in an event altogether, regardless of the run timing of the unit game of the base game that is run through each of the gaming terminals 10. Further, participation in an event can be selected. This realizes a new entertainment characteristic.

Hereinabove, the third embodiment of the present invention has been described. The present invention is not limited to the above embodiment. The below-described variation of the third embodiment may be applied to the present invention. The following describes a base game according to a variation of the third embodiment of the present invention.

Figure 75:
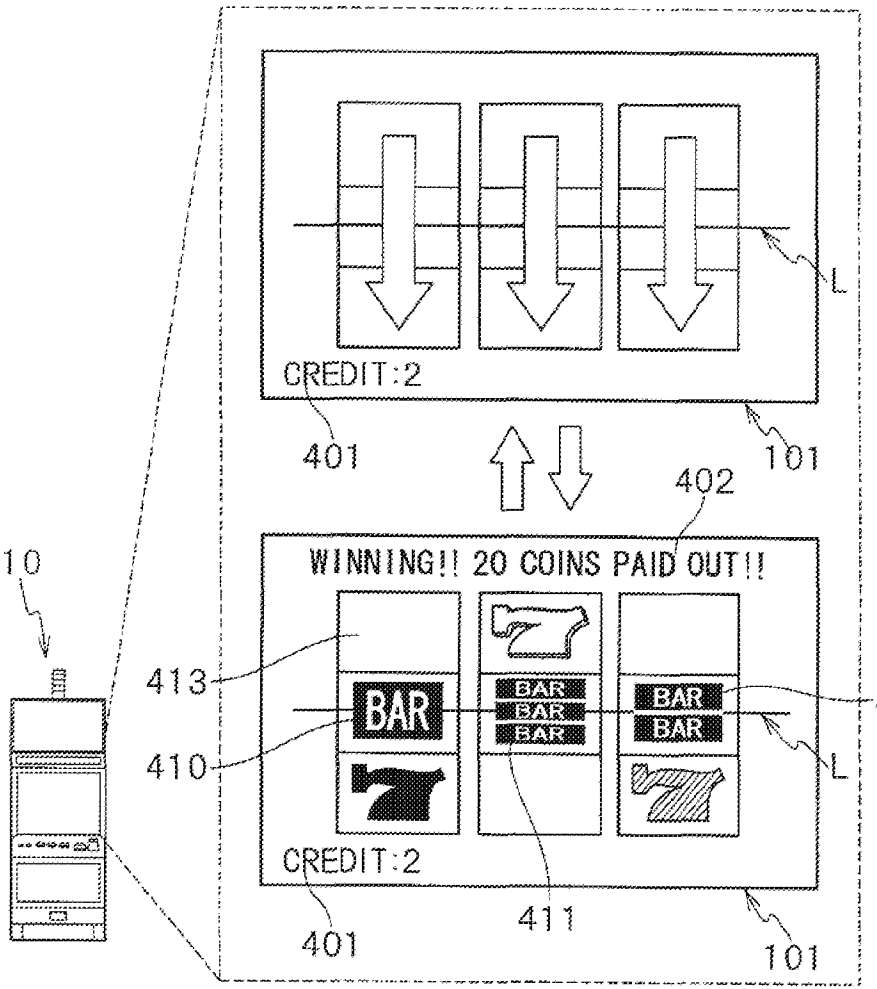
FIG. 75 is an explanatory diagram illustrating a base game according to a variation of the third embodiment of the present invention.

As illustrated in FIG. 75, the terminal display unit 101 according to the variation of the third embodiment has a plurality of arrangement areas forming a matrix of three rows/three columns. The arrangement areas of the middle row are set as a payline L. When the relation among the symbols rearranged on the payline L results in winning, a payout according to the resulted winning is awarded. Further, the terminal display unit 101 displays a credit 401 indicating an amount of a bet game value.

In the example illustrated in FIG. 75, the credit 401 is "CREDIT: 2" indicating that the bet amount of a game value is two coins. As a result of symbol rearrangement, a "1BAR" as a symbol 410, a "3BAR" as a symbol 411, and a "2BAR" as a symbol 412 are rearranged on the payline L. These symbols form a winning of "ANY-BAR" "ANY-BAR" "ANY-BAR," which is resulted when the credit 401 indicates two coins. Twenty coins are awarded as a payout for this winning.

FIG. 76 illustrates a base game payout table. The base game payout table is used when the main CPU 41 determines that a winning has been achieved in a base game and awards a payout according to the achieved winning. The base game payout table has a bet value column, a winning column, and a payout value column. The bet value column indicates the number of coins bet. The winning column indicates a combination of symbols to be rearranged on the payline L, which is a condition for a winning to be achieved. The payout value column indicates the number of coins to be paid out when a winning is resulted. The following describes the example illustrated in FIG. 76. When three symbols of "3BAR" are rearranged on the payline L, and the bet value is 1 or 2, the payout amount is 60 or 120 respectively. When three symbols of "2BAR" are rearranged on the payline L, and the bet value is 1 or 2, the payout amount is 40 or 80 respectively. When three symbols of "LBAR" are rearranged on the payline L, and the bet value is 1 or 2, the payout amount is 20 or 40 respectively. When three symbols of "ANY-BAR" are rearranged on the payline L, and the bet value is 1 or 2, the payout amount is 10 or 20 respectively. When three symbols of "BLANK" are rearranged on the payline L, and the bet value is 1 or 2, the payout amount is 1 or 2 respectively. When three symbols of "blue 7" are rearranged on the payline L, and the bet value is 3, the payout amount is 1,800. When three symbols of "red 7" are rearranged on the payline L, and the bet value is 3, the payout amount is 100. When three symbols of "ANY-7" are rearranged on the payline L, and the bet value is 3, the payout amount is 100. Thus, the greater the bet value, the greater the payout amount for a resulted winning. Hence, a player may bet a greater amount of game value (bet value).

The following describes an example of an event according to the variation of the third embodiment of the present invention. In this example, an event is a bonus game having a potential of awarding a bonus payout that is greater than the payout awarded in the base game. The bonus game according to this embodiment is configured to award a payout according to a predetermined winning. The number of the light-emitting portions 303 according to accumulated points awarded are activated towards the bonus payout display unit 300.

Figure 77:
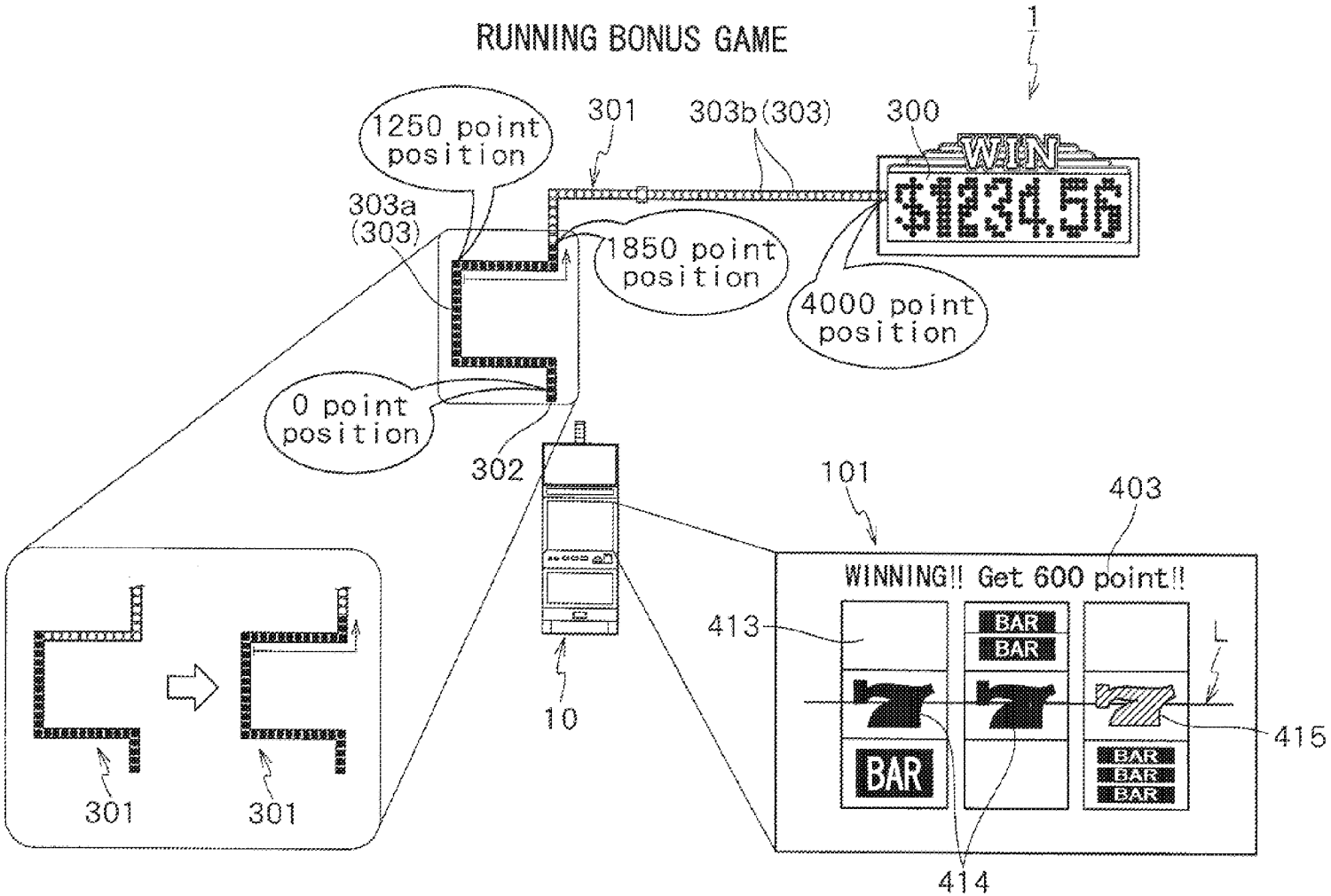
FIG. 77 is an explanatory diagram illustrating a bonus game of the gaming machine according to the variation of the third embodiment.

The following describes an example illustrated in FIG. 77. The position 302 corresponding to the gaming terminal 10 indicates a position equivalent to a zero point, and the position of the bonus payout display unit 300 indicates a position equivalent to 4,000 points. Accumulated points awarded in the gaming terminal 10 is 1,250 points, so that a plurality of light-emitting portions 303 of the path unit 301 are activated up to a position equivalent to 1,250 points. In this example, a winning is achieved with a "red 7" as a symbol 414, a symbol 414, and a "blue 7" as a symbol 415 rearranged on the payline L. In this case, three winnings are achieved. Two winnings out of the three winnings are achieved by rearranging a symbol 414 on the payline L, and the other one winning is achieved by rearranging a symbol 415 on the payline L. The payout for a winning achieved with a symbol 414 is 150 points, and the payout for a winning resulted with a symbol 415 is 300 points. Thus, the total points for the three winnings is 600 points. These six hundred points are awarded through the gaming terminal 10, so the accumulated points of the gaming terminal 10 is 1,250+600=1,850 points. The light-emitting portions 303 are activated up to the position indicating 1,850 points. Thus, a point according to a achieved predetermined winning is awarded during the bonus game. A jackpot is awarded when the accumulated points including a newly awarded point reach a predetermined amount (4,000 points).

FIG. 78 is a diagram illustrating a bonus game payout table. The bonus game payout table is used when the main CPU 41 determines that a winning is achieved in the bonus game and awards a payout point according to the achieved winning. The bonus game payout table has a winning column and a payout point column. The winning column indicates a combination of symbols to be rearranged on the payline L, which is a condition for a winning to be achieved. The payout point column indicates an amount of points to be awarded for a resulted winning. The following describes an example illustrated in FIG. 78. When three symbols of "blue 7" are rearranged on the payline L, the payout point is 7,000. When one symbol of "blue 7" is rearranged on the payline L, the payout point is 300. When one symbol of "red 7" is rearranged on the payline L, the payout point is 150. When one symbol of "3BAR" is rearranged on the payline L, the payout point is 30. When one symbol of "2BAR" is rearranged on the payline L, the payout point is 20. When one symbol of "1BAR" is rearranged on the payline L, the payout point is 10.

Hereinabove, a gaming machine according to the variation of the third embodiment of the present invention is described. It is described that the gaming machine in the third embodiment of the present invention starts an event when the total number of unit games run by the gaming terminals of the gaming machine surpasses a predetermined amount, or when the number of unit games run by any of the gaming terminals surpasses a predetermined number, but it is not limited to this. For example, the gaming machine may start an event when a jackpot value accumulated from each of the gaming terminals surpasses a certain amount (e.g., 200 dollars as a fixed value). For example, the gaming machine may randomly change the threshold of the progressive value in which an event is started within a predetermined range for each bonus game (e.g., 200 to 300 dollars).

Further, although the gaming machine of the third embodiment of the present invention awards a jackpot when the accumulated points including a newly awarded point reach a predetermined amount, it is not limited to this. The gaming machine may, for example, award a jackpot when the accumulated points including a newly awarded point reach an amount which changes in each bonus game within a predetermined range (e.g., 3,000 to 5,000 points).

Further, the gaming machine may be capable of selecting and setting a necessary amount of points for awarding a jackpot through a gaming terminal. Specifically, the gaming machine may be capable of selecting any one of the values (e.g., 3,000 points, 4,000 points, and 5,000 points), through an input from outside or the like, as points necessary for awarding a jackpot.

As yet another variation of the third embodiment of the present invention, each of the gaming terminals of the gaming machine may have the same difficulty (winning percentage in a bonus game) for all the path units to be activated up to the bonus payout display unit. Further, the gaming terminal may set the difficulty (winning percentage in a bonus game) for each of the gaming terminals based on the contribution amount to the jackpot of each of the gaming terminals.

Further, the gaming machine in the third embodiment of the present invention realizes the concurrent starting of an event by instructing to display an event start reporting screen through each of the game terminals altogether, but it is not limited to this. For example, the gaming machine may realize the concurrent starting of an event by starting unit games or the like altogether after a predetermined standby time has elapsed since an event start condition has been achieved.

The detailed description of the present invention provided hereinabove mainly focused on characteristics thereof for the purpose of easier understanding; however, the scope of the present invention shall be construed as broadly as possible, encompassing various forms of other possible embodiments, and therefore the present invention shall not be limited to the above description. Further, the terms and phraseology used in the present specification are adopted solely to provide specific illustration of the present invention, and in no case should the scope of the present invention be limited by such terms and phraseology. Further, it will be obvious for those skilled in the art that the other structures, systems, methods or the like are possible, within the spirit of the invention described in the present specification. The description of claims therefore shall encompass structures equivalent to the present invention, unless otherwise such structures are regarded as to depart from the spirit and scope of the present invention. Further, the abstract is provided to allow, through a simple investigation, quick analysis of the technical features and essences of the present invention by an intellectual property office, a general public institution, or one skilled in the art who is not fully familiarized with patent and legal or professional terminology. It is therefore not an intention of the abstract to limit the scope of the present invention which shall be construed on the basis of the description of the claims. To fully understand the object and effects of the present invention, it is strongly encouraged to sufficiently refer to disclosures of documents already made available.

The detailed description of the present invention provided hereinabove includes a process executed on a computer or computer network. The above descriptions and expressions are provided to allow the one skilled in the art to most efficiently understand the present invention. In the specification, the respective steps used to induce one result or blocks having a predetermined processing function should be understood as a process having no self-contradiction. Further, the electrical or magnetic signal is transmitted/received and written in the respective steps or blocks. It should be noted that such a signal is expressed in the form of bit, value, symbol, text, terms, number, or the like solely for the sake of convenience. Although the present specification occasionally personifies the processes performed in the steps or blocks, these processes are essentially executed by various devices. Further, the other structures necessary for the steps or blocks are obvious from the above descriptions.

Fourth Embodiment

With reference to FIGS. 79 to 111, the following describes a fourth embodiment of a gaming machine and a playing method thereof according to the present invention. The fourth embodiment includes embodiments 4-1, 4-2, 4-3, and 4-4. Note that reference numbers and symbols given to members and steps of flowcharts are only applicable to those described within the present embodiment, and do not represent the members or the steps of the other embodiments.

Embodiment 4-1

Figure 79:
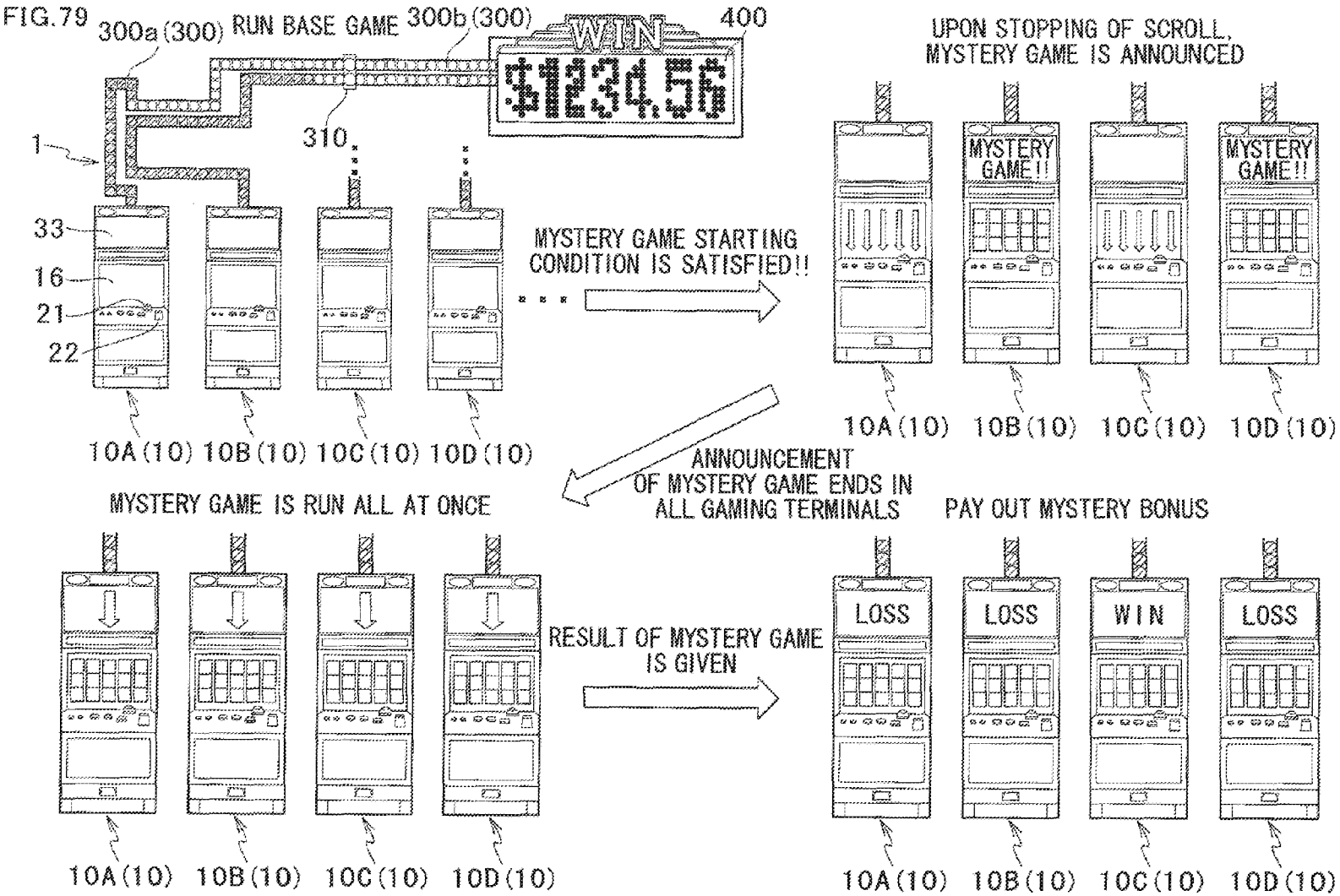
FIG. 79 is an explanatory diagram illustrating a gaming machine and a playing method thereof, according to an embodiment 4-1 of the present invention.

As shown in FIG. 79, a gaming machine 1 of the present invention includes a plurality of gaming terminals 10 (10A, 10B, . . . ). Each of the gaming terminals 10 includes a terminal display 101 (an upper image display panel 33, a lower image display panel 16) which displays an image, and runs a base game to award a payout corresponding to a predetermined winning and a mystery game to award a mystery bonus which is a payout greater than the payout of the base game. The gaming machine 1 performs a playing method including the steps of: in each one of the gaming terminals 10, running the base game and awarding a payout corresponding to a predetermined winning, independently of another gaming terminal 10; determining whether the base game has ended or not, when a predetermined condition is satisfied (e.g., when a total progressive value exceeds a mystery game start value); displaying on the terminal display 101 a mystery game image concerning the mystery game (e.g., a mystery game announcement image), when it is determined that the base game has ended; running the mystery game, when the mystery game image is displayed on the terminal displays 101 of all the gaming terminals 10; and awarding the mystery bonus in accordance with a result of the mystery game, after running the mystery game.

The present embodiment deals with a case where the gaming terminal 10 runs a slot game. The "mystery game" means a game which is run without a player knowing it, when a predetermined condition is satisfied. In this embodiment, during the mystery game, a "LOSS" image and a "WIN" image are alternately displayed on an upper image display panel 33 of each gaming terminal 10. When the "WIN" image is stopped, the game is won and a mystery bonus is awarded. In this embodiment, in addition, the "predetermined condition" for running the mystery game is a condition that a total progressive value reaches a predetermined value (hereinafter referred to as a mystery game start value). The total progressive value is a collection of values obtained from the respective gaming terminals 10 at the time of the base game. The total progressive value will be described later. In the present invention, the predetermined condition for running the mystery game is not limited to the above-mentioned one. For example, it may be possible that the mystery game is run when a predetermined zero hour comes. Alternatively, the "predetermined condition" may be a condition that a center controller 200 which supervises the gaming terminals 10 selects a win as a result of a random number lottery.

In each of the gaming terminals 10 of the gaming machine 1 of this embodiment, a player plays a base game, as shown in FIG. 79, for example. In playing the base game, the player inserts game media through a coin receiving slot 21 or a bill validator 22 which are provided to the gaming terminal 10. A part of the game media inserted in each of the gaming terminals 10 becomes a progressive value. When a total of progressive values (hereinafter referred to as a total progressive value) exceeds a mystery game start value, a mystery game is run (see an upper left view of FIG. 79).

Then, when a mystery game starting condition is satisfied, whether the base game run in each gaming terminal 10 has ended or not is determined. That is, whether symbols 180 scrolled on a lower image display panel 16 of the gaming terminal 10 are stopped or not is determined. In the gaming terminals 10, a mystery game announcement image is displayed on the upper image display panel 33, sequentially from the gaming terminal 10 having determined that the base game has ended. Here, the mystery game announcement image means an announcement image informing that a mystery game will start soon. Referring to FIG. 79, in the gaming terminals 10B and 10D, scroll of symbols 180 is stopped, and the mystery game announcement image is displayed on the upper image display panel 33 (see an upper right view of FIG.

79). In this embodiment, various images concerning the mystery game, such as the "mystery game announcement image", the "LOSS" image, and the "WIN" image, are displayed on the upper image display panel 33. However, this is not limitative, and they may be displayed on the lower image display panel 16 for example. In such a case as well, the various images concerning the mystery game are displayed, after symbols 180 scrolling on the lower image display panel 16 are stopped. Accordingly, an image of the base game (e.g., scroll of symbols 180) and an image of the mystery game (e.g., the mystery game announcement image or the like) are not displayed together.

Then, when the mystery game announcement image is displayed on the upper image display panels 33 of all the gaming terminals 10, a mystery game starts all at once (see a lower left view of FIG. 79). According to the above description, a mystery game announcement image is displayed sequentially from such a gaming terminal 10 that an end of the base game is determined. However, it may be possible that a mystery game is immediately started sequentially from such a gaming terminal 10 that an end of the base game is determined.

On running the mystery game, the "LOSS" image and the "WIN" image are alternately displayed on the upper image display panel 33 of each gaming terminal 10. When the "WIN" image is stopped, a mystery bonus is awarded. Referring to FIG. 79, the "WIN" image is displayed on the upper image display panel 33 of the gaming terminal 10C, while the "LOSS" image is displayed on the upper image display panels 33 of the other gaming terminals 10. In this case, a mystery bonus is awarded to the gaming terminal 10C alone (see a lower right view of FIG. 79).

Next, a base game and a JP game of this embodiment will be described with reference to FIGS. 80 to 82.

First, the "base game" refers to a game which is run during an ordinary state. In the base game, symbols 180 are rearranged in later-mentioned symbol arrangement areas 150. When the symbols 180 arranged have a relation that meets a winning, a payout is awarded. During the base game, the above-described mystery game is suddenly run.

The "JP game" is a special free game which is run by a later-detailed center controller 200, and played commonly among all the gaming terminals 10 which are communicably connected to the center controller 200. In this embodiment, the JP game is such that symbols 180 are rearranged in symbol arrangement areas 150 as is done in the base game, and that a JP winning is resulted according to a relation among the symbols 180 arranged. Note that, every time a JP winning is resulted, one or more race-use light emitting portions 2 existing in a race line unit 300 associated with the gaming terminal 10 having achieved the winning turn active. Then, a JP payout is awarded through a gaming terminal 10, when the race-use light emitting portions 2 forming the associated one of the race line unit 300 turn active along the line unit 300 all the way to a JP payout indicator 400. Note further that an "event time" appearing in this specification refers to a time during which the JP game is running. This event time occurs and the JP game is run, when the total progressive value, which is a total of progressive values collected from more than one gaming terminals 10, exceeds the JP game start value. In a case of a mystery bonus, the race-use light emitting portions 2 turn active along the race line unit 300 from the JP payout indicator 400 toward the gaming terminal 10 to which the mystery game is awarded.

The "JP payout" is a payout based on the total progressive value collected from the gaming terminals 10. A situation where this JP payout is awarded is referred to as "Jackpot".

The "winning" is achieved when a specific symbol combination is formed in the base game. When the winning is achieved, a payout is awarded. In the present embodiment, the winning is achieved when a predetermined number (e.g. 5) or more of specific symbols 180 are arranged in a matrix 156 which will be described later.

The "JP winning" is achieved when a specific symbol combination is formed in the JP game. When the JP winning is achieved, a predetermined number of the race-use light emitting portions 2 according to the combination formed turn active. In the present embodiment, the JP winning is achieved when a predetermined number (e.g. 5) or more of specific symbols 180 are arranged in the matrix 156, as is the case with the base game.

The "progressive value" is a game value based on game medium such as a coin or bill input by a player through the coin receiving slot 21 or the bill validator 22 of the gaming terminal 10. This progressive value is collected by the center controller 200 from each of the gaming terminals 10, and is used as a resource for a JP payout in the JP game.

Figure 81:
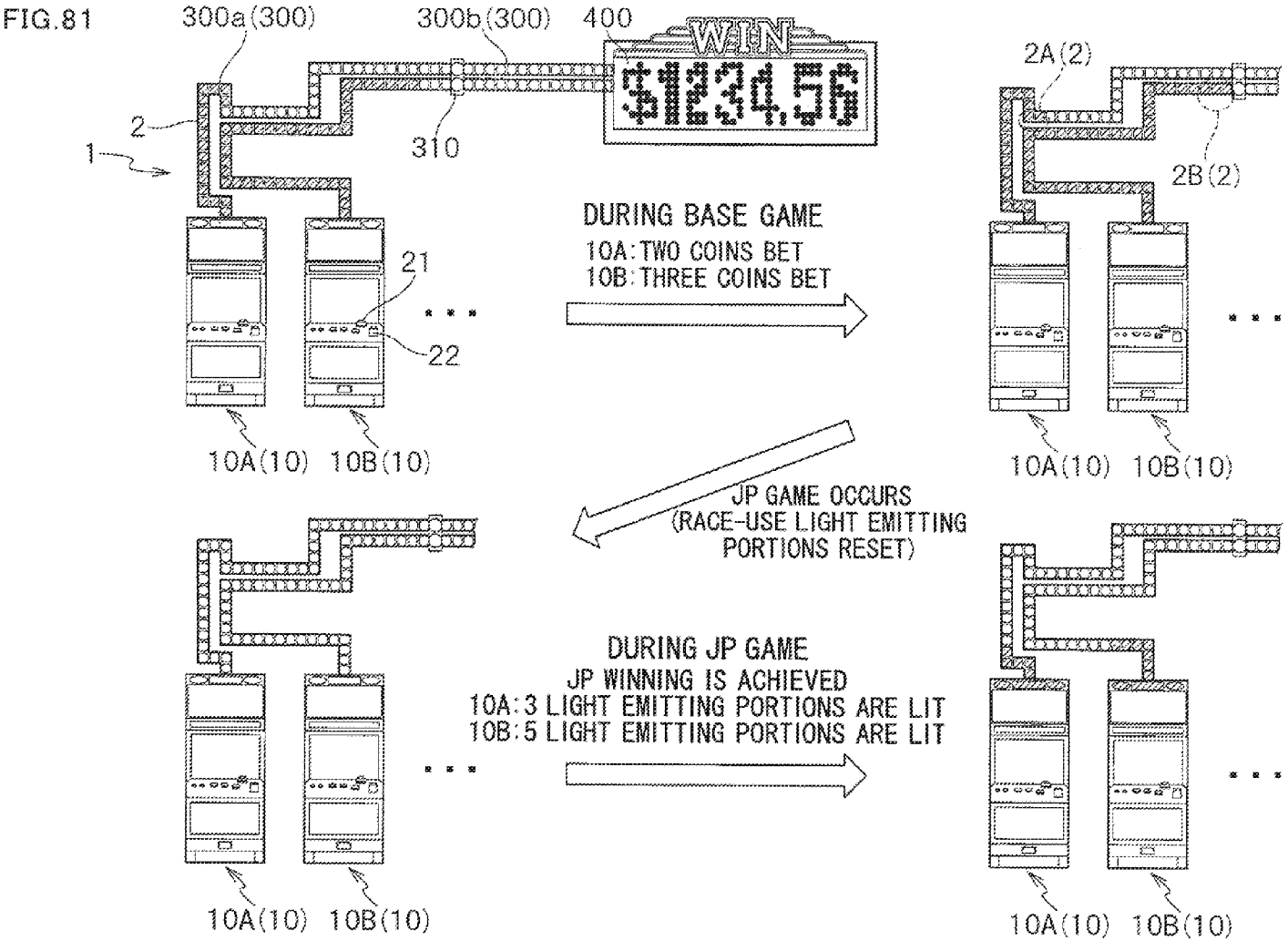
FIG. 81 illustrates a transition from a base game to a JP game.

As illustrated in FIG. 81, the gaming machine 1 of the, present embodiment is connected to and in communication with more than one gaming terminals 10 (10A, 10B, . . . ). Further, race line units 300 are formed from the gaming terminals 10 by arranging the race-use light emitting portions 2, respectively. One end of each race line unit 300 leads to associated one of the gaming terminals 10, and the other end thereof leads to the JP payout indicator 400. Further, the race line unit 300 includes: a curve 300*a* and a straight part 300*b*. At the boundary between the curve 300*a* and the straight part 300*b* is provided a relaying part 310. In short, the curve 300*a* extends from the gaming terminal 10 to the relaying part 310, and the straight part 300*b* extends from the relaying part 310 to the JP payout indicator 400. As is obvious from the above, each of the gaming terminals 10 is communicated with the JP payout indicator 400 via the race line unit 300 associated therewith.

The race-use light emitting portions 2 are LEDs (light-emitting diodes) in the present embodiment, and are capable of lighting in different colors. During the base game, the race-use light emitting portions 2 turn active when a player inserts a game medium into the gaming terminal 10 through the coin receiving 21 or the bill validator 22 thereof, and when a bet of the game medium is made. The number of the race-use light emitting portions 2 to be activated is determined, according to the amount (bet amount) of the game medium placed as a bet. As is already mentioned, a progressive value based on the game medium input during the base game is used as a resource for a JP payout in the JP game. As such, a larger the bet amount results in a higher contribution to the collection of the recourse for the JP payout. That is, the higher the contribution during the base game to the collection of the progressive value for use as the resource for the JP payout is, the more race-use light emitting portions 2 will be activated.

On the other hand, during the JP game, the light emitting portions 2 turn active upon meeting a JP winning. The number of the race-use light emitting portions 2 activated during the time is based on the JP winning achieved. Note that the race-use light emitting portions 2 are all reset (turned off) when the event time occurs thus causing a transition from the base game to the JP game.

The JP payout indicator 400 displays the amount of JP payout to be awarded upon achieving a Jackpot in the JP game. In the gaming machine 1 of the present embodiment, progressive values respectively based on the game media having been bet in the gaming terminals 10 are accumulatively added, and the resulting total (total progressive value) is displayed as a JP payout. The example illustrated in FIG. 81 shows that the JP payout is $1234.56. In this embodiment, the JP payout indicator 400 is structured to include LEDs serving as light emitters. However, the JP payout indicator 400 may be structured as a single liquid crystal display. The light emitters are not limited to LEDs (light-emitting diodes) so long as light is emitted.

Figure 80:
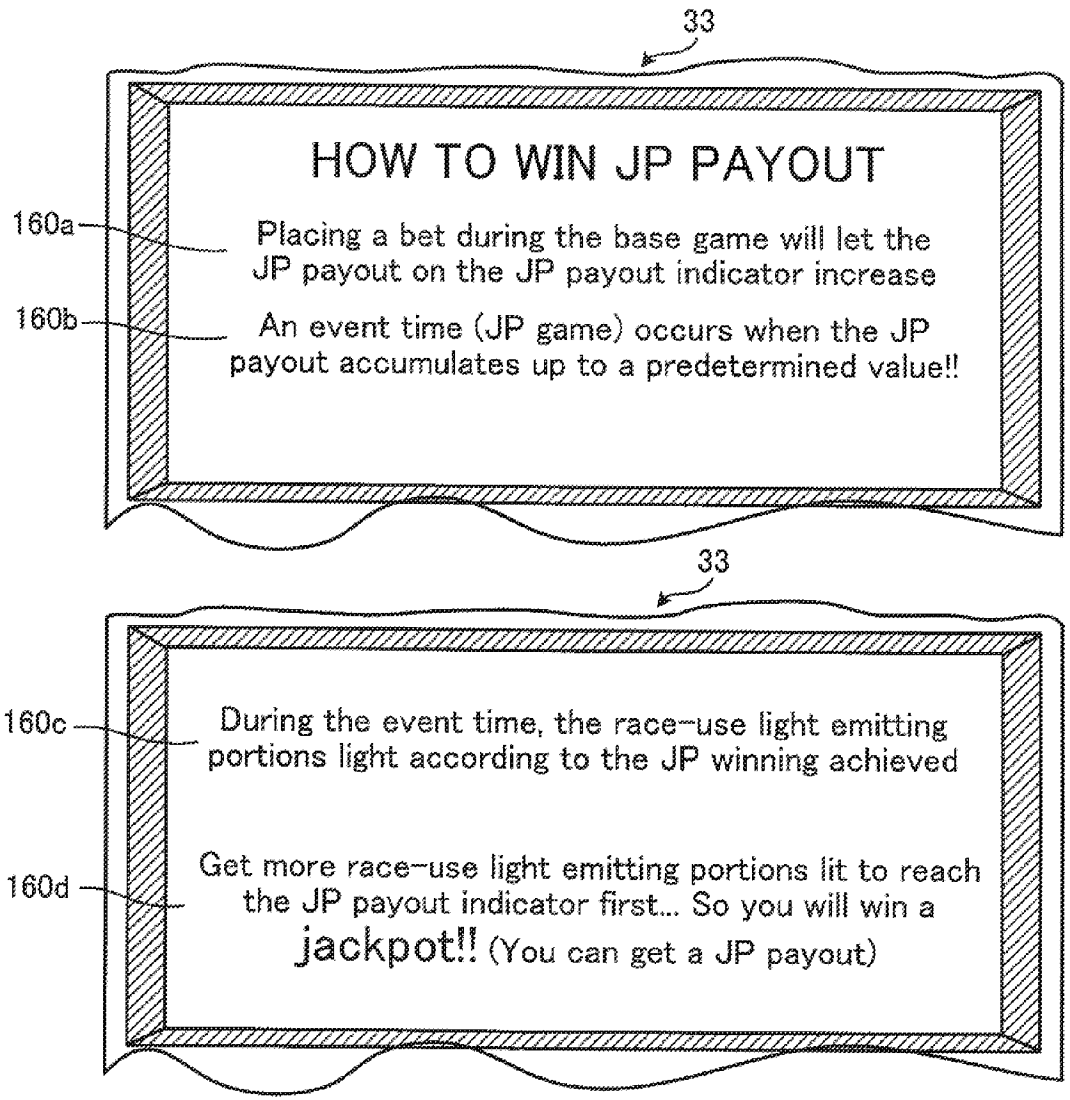
FIG. 80 illustrates an exemplary image displayed on an upper image display panel of a gaming terminal constituting a gaming machine according to the embodiment 4-1 of the present invention.

The following describes, with reference to FIG. 80, a method of determining a jackpot-winning gaming terminal 10 through which a JP payout is awarded. FIG. 80 illustrates an exemplary image displayed on an upper image display panel 33 provided to the gaming terminal 10. The upper image display panel 33 displays thereon text strings 160*a* to 160*d* indicating instructions to win the JP payout.

The text string 160*a* indicates that, when a bet is made in a gaming terminal 10 during the base game, a progressive value based on the game medium having been bet is accumulated and displayed on the JP payout indicator 400 as the JP payout.

The text string 160*b* indicates that an event time occurs and the JP game starts, when the JP payout accumulatively displayed on the JP payout indicator 400 reaches a JP game start value.

The text string 160*c* indicates that, during the event time (JP game), a predetermined number of the race-use light emitting portions 2 associated with a gaming terminal 10 having achieved the JP winning turn active, according to the JP winning combination resulted in the gaming terminal 10.

The text string 160*d* indicates that the JP payout is awarded to a gaming terminal 10 whose race-use light emitting portions 2 in the associated race line unit 300 are all activated.

Next described with reference to FIG. 81 is how a transition from the base game to the JP game occurs. In the example illustrated in FIG. 81, two coins are bet in the gaming terminal 10A and three coins are bet in the gaming terminal 10B, during the base game. In this case, two more race-use light emitting portions 2A associated with the gaming terminal 10A turn active, and three more race-use light emitting portions 2B associated with the gaming terminal 10B turn active (see an upper right view of the figure). As is obvious from the above example, the larger the amount bet in the base game, the more associated race-use light emitting portions 2 will be activated.

Further, when the event time occurs thus causing a transition from the base game to the JP game, the race-use light emitting portions 2 are all reset (turned off) once (see a lower left view of the figure).

Every time a JP winning is achieved during the JP game, a predetermined number of race-use light emitting portions 2 according to the JP winning achieved are activated. For example, as shown in FIG. 81, upon achieving the JP winning, three of the race-use light emitting portions 2A associated with the gaming terminal 10A are activated while five of the race-use light emitting portions 2B associated with the gaming terminal 10B are activated (see a lower right view of the figure).

Figure 82:
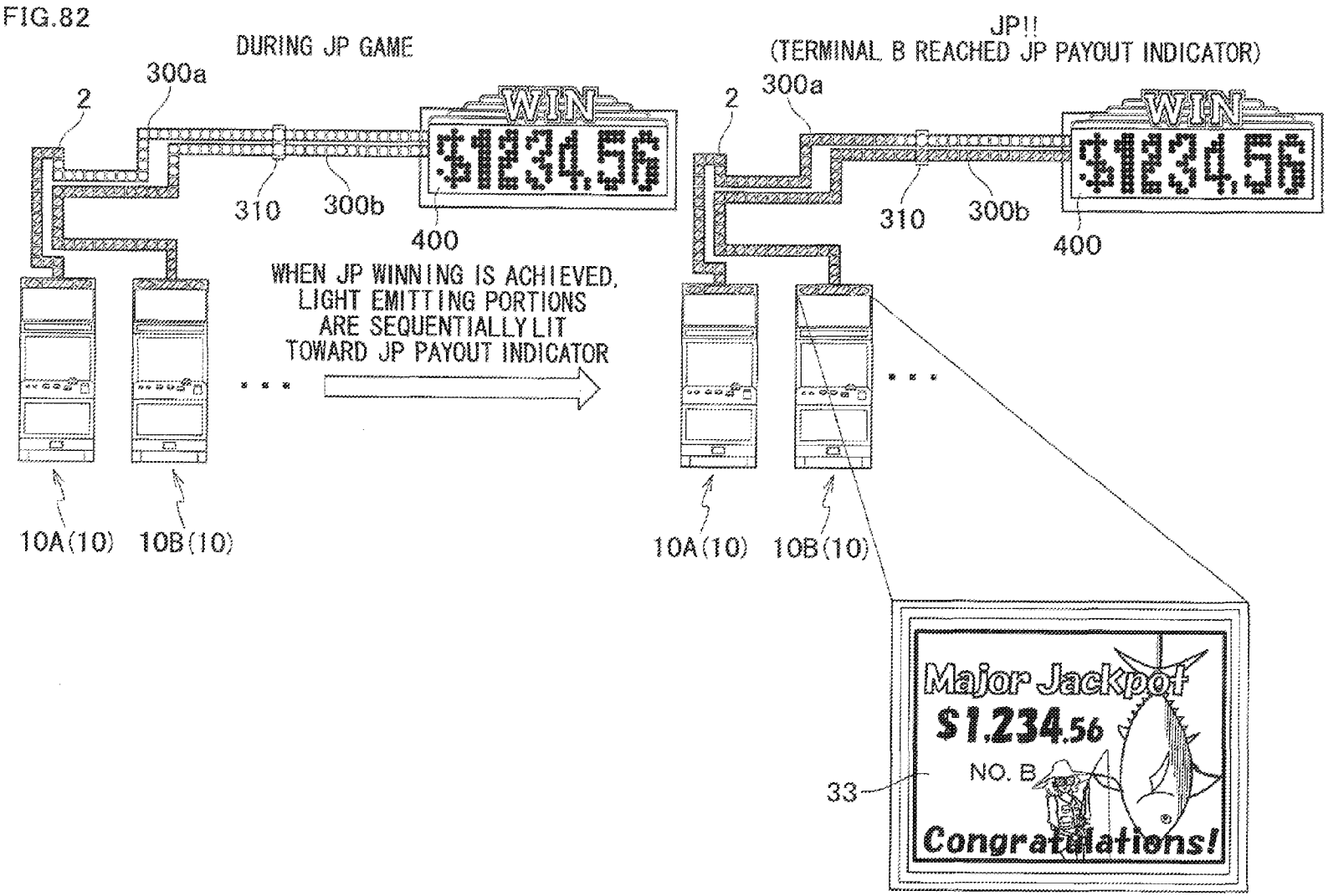
FIG. 82 is an explanatory diagram illustrating how race-use light emitting portions turn active during a JP game.

FIG. 82 illustrates how the race-use light emitting portions 2 turn active during the JP game. As is already mentioned, every time a JP winning is achieved during the JP game, a predetermined number of race-use light emitting portions 2 according to the JP winning achieved are activated. Repeating this will increase the number of the race-use light emitting portions 2 being activated. When the race-use light emitting portions 2 are activated all the way up to the JP payout indicator 400 along the race line unit 300, the jackpot is achieved.

Further, in the example illustrated in FIG. 82, the gaming terminal 10B has all the associated race-use light emitting portions 2 activated up to the JP payout indicator 400 earlier than the gaming terminal 10A. This means that the gaming terminal 10B achieves the jackpot, and wins the JP payout. Note that, when the gaming terminal 10B wins a jackpot, the upper image display panel 33B of the gaming terminal 10B displays a video indicating that the gaming terminal 10B has won the Jackpot.

Figure 83:
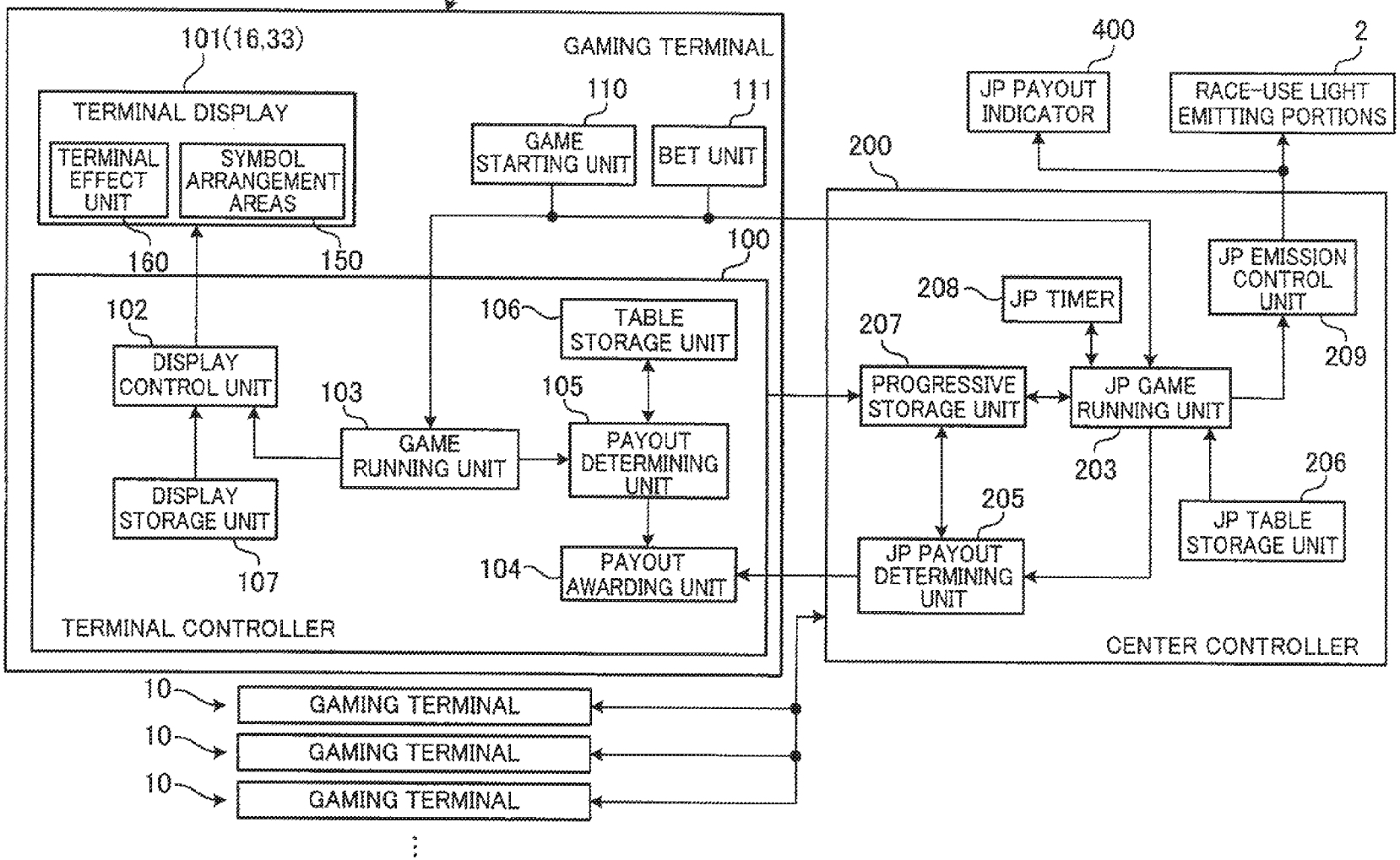
FIG. 83 is a block diagram showing the gaming machine.

As illustrated in FIG. 83, the gaming machine 1 which executes the above-described playing method has the JP payout indicator 400, the center controller 200, the gaming terminals 10, and the light emitting portions 2. Each of the gaming terminals 10 includes a terminal display 101 and a terminal controller 100.

As illustrated in FIG. 83, the terminal display 101 has a plurality of symbol arrangement areas 150, and symbols 180 are arranged in the symbol arrangement areas 150.

The "arranging" in this specification means a state where the symbols 180 can be visually observed by a player. That is, the wording means a state where the symbols 180 are displayed in the symbol arrangement areas 150, in FIG. 83. Arranging the symbols 180 again after dismissing the symbols 180 is referred to as "rearranging".

The terminal display 101 may have a mechanical structure adopting a reel device which rotates a reel to arrange the symbols 180. Alternatively, the terminal display 101 may have an electrical structure in which a video reel is displayed as an image and symbols 180 on a video reel are arranged in the form of an image. Further, the terminal display 101 may adopt a combination of the mechanical structure (reel) and the electrical structure (video reel). Examples of the electrical structure include a liquid crystal display device, a CRT (cathode-ray tube), a plasma display device, or the like. Further, the number of symbol arrangement areas 150 is not limited. A specific structure of the terminal display 101 will be detailed later.

Further, the terminal display 101 has a terminal effect unit 160. The terminal effect unit 160 provides a visual effect to the base game or the JP game. An example of such an effect is an indication of winning the jackpot on the upper image display panel 33 as is the case of FIG. 82. Further, the terminal effect unit 160 displays text strings 160*a* to 160*d* indicating the instructions to win the JP payout as shown in FIG. 80. Further, the terminal effect unit 160 displays various images concerning a mystery game as shown in FIG. 79.

The JP payout indicator 400 displays the amount of the JP payout which is the total of progressive values collected from the gaming terminals 10.

Each of the race-use light emitting portions 2 lights upon activation. The race-use light emitting portions 2 are controlled to be activated one after another, from the position of each gaming terminal 10 to the JP payout indicator 400. In addition, at the time of payout of a mystery bonus, the race-use light emitting portions 2 are controlled to be activated one after another, from the JP payout indicator 400 to the gaming terminal 10 having won the mystery bonus.

[Terminal Controller 100]

The terminal controller 100 performs: a first process of running the base game and awarding a payout corresponding to a predetermined winning, independently of another gaming terminal 10; a second process of determining whether the base game has ended or not, based on a mystery game start signal from the center controller 200; a third process of displaying on the terminal display 101 an mystery game announcement image concerning the mystery game, when it is determined that the base game has ended; a fourth process of running the mystery game based on a mystery bonus signal from the center controller 200; and a fifth process of awarding a mystery bonus in accordance with a result of the mystery game, after running the mystery game. In other words, the terminal controller 100 has first to fifth processing units.

The terminal controller 100 is connected to the center controller 200 and is in communication with the center controller 200.

As illustrated in FIG. 83, the terminal controller 100 is connected to a game starting unit 110. The game starting unit 110 has a function of outputting a game start signal, in response to an operation by the player. The game start signal output is then input to a later-described game running unit 103.

Further, the terminal controller 100 is connected to a BET unit 111. The BET unit 111 has functions of receiving a bet entered through an operation by the player, and outputting a BET signal in response to the bet entered. The BET signal output is input to a later-described game running unit 103.

The terminal controller 100 includes a table storage unit 106, a game running unit 103, a display storage unit 107, and a display control unit 102.

The table storage unit 106 stores a later-described winning combination table of FIG. 91, a base game payout table of FIG. 92, and the like.

The game running unit 103 runs a base game, triggered by a game start signal from the game starting unit 110. In the base game, symbols 180 are rearranged in the symbol arrangement areas 150 of the terminal display 101. Further, the terminal controller 100 outputs a progressive signal., triggered by the game start signal. The progressive signal is a signal indicating a progressive value.

Further, the game running unit 103 runs, when receiving a JP game start signal from the center controller 200, the JP game which rearranges symbols 180 in the symbol arrangement areas 150 of the terminal display 101. At this point, the game running unit 103 rearranges the symbols 180 in the symbol arrangement areas 150, based on the winning combination table of FIG. 91 which is stored in the table storage unit 106.

Further, the game running unit 103 outputs a JP winning signal to the center controller 200, when the payout determining unit 105 determines that a JP winning is achieved. Further, the game running unit 103 ends the JP game, when receiving a JP game end signal from the center controller 200.

Further, when receiving a mystery game start signal from the center controller 200, the game running unit 103 determines whether symbols 180 scrolling in the symbol arrangement areas 150 are stopped or not, that is, whether the base game has ended or not. When it is determined that the base game has ended, the game running unit 103 controls a later-described display control unit 102 to display a mystery game announcement image on a terminal effect unit 160. Then, the game running unit 103 outputs an announcement image display signal to the center controller 200.

Further, the game running unit 103 runs a mystery game, when receiving a mystery bonus signal from the center controller 200. In a case where the mystery bonus signal thus received includes information of winning a mystery bonus, the game running unit 103 controls the display control unit 102 to display the "WIN" image on the terminal effect unit 160, and makes a later-described payout awarding unit 104 award a mystery bonus.

The display storage unit 107 stores images of the symbols 180, and various images concerning the mystery game such as the mystery game announcement image, the "WIN" image, and the "LOSS" image.

The display control unit 102, under the control of the game running unit 103, reads out symbols 180 in the display storage unit 107, and displays the symbols 180 in the symbol arrangement areas 150 of the terminal display 101. A detailed display state will be detailed later. Further, the display control unit 102 outputs an image to the terminal effect unit 160 of the terminal display 101, based on the control performed by the game running unit 103.

Further, the terminal controller 100 has a payout determining unit 105 and a payout awarding unit 104. The payout determining unit 105 determines whether to award a payout, based on a relation among the symbols 180 rearranged in the symbol arrangement areas 150 of the terminal display 101. That is, the payout determining unit 105 determines whether a predetermined winning is achieved during the base game, and determines whether a predetermined JP winning is achieved during the JP game. At this time, the payout determining unit 105 determines a payout amount, based on the base game payout table of FIG. 92 which is stored in the table storage unit 106. The payout awarding unit 104, during the base game, awards a payout based on the determination of the payout determining unit 105. Further, the payout awarding unit 104 awards a JP payout, based on the JP payout signal from the center controller 200. Further, the payout awarding unit 104 awards a mystery bonus, based on control made by the game running unit 103.

Meanwhile, each block of the terminal controller 100 may be realized with hardware, or with software as needed.

[Operation of Terminal Controller 100]

The following describes an operation of the terminal controller 100 in the above structure. First, the BET unit 11.1 accepts a BET entered through an operation by a player. Then, in response to the operation, the game starting unit 110 outputs a game start signal to cause the game running unit 103 to start a base game. When the base game is run, symbols 180 are arranged in the symbol arrangement areas 150 by the display control unit 102, based on the control of the game running unit 103.

The payout determining unit 105 determines whether a predetermined winning has been achieved, based on a relation among the symbols.180 rearranged in the symbol arrangement areas 150. When it is determined that a predetermined winning has been achieved, the payout awarding unit 104 awards a payout. Like this, the terminal controller 100 performs the first process of running the base game and awarding a payout corresponding to a predetermined winning, independently of another gaming terminal 10.

When receiving a mystery game start signal from the center controller 200, the game running unit 103 determines whether symbols 180 scrolling in the symbol arrangement areas 150 are stopped or not. Like this, the terminal controller 100 performs the second process of determining whether the base game has ended or not, based on the mystery game start signal from the center controller 200.

When it is determined that the base game has ended, the game running unit 103 controls the display control unit 102 to display a mystery game announcement image on the terminal effect unit 160. Like this, the terminal controller 100 performs the third process of displaying on the terminal display 101 the mystery game announcement image concerning the mystery game, when it is determined that the base game has ended.

When receiving a mystery bonus signal from the center controller 200, the game running unit 103 runs a mystery game. Like this, the terminal controller 100 performs the fourth process of running the mystery game based on the mystery bonus signal from the center controller 200.

In a case where the mystery bonus signal thus received from the center controller 200 includes information of winning a mystery bonus, the game running unit 103 controls the display control unit 102 to display the "WIN" image on the terminal effect unit 160, and makes the payout awarding unit 104 award a mystery bonus. Like this, the terminal controller 100 performs the fifth process of awarding a mystery bonus in accordance with a result of the mystery game, after running the mystery game.

[Center Controller 200]

The center controller 200 performs: a sixth process of outputting a mystery game start signal to all of the gaming terminals 10, when the total progressive value reaches a mystery game start value; and a seventh process of outputting a mystery bonus signal to all of the gaming terminals 10, when the mystery game announcement image is displayed on the terminal effect unit 160 of every gaming terminal 10. In other words, the center controller 200 has sixth and seventh processing units.

As illustrated in FIG. 83, the center controller 200 is connected to the terminal controller 100 and is in communication with the terminal controller 100.

The center controller 200 has a progressive storage unit 207, a JP table storage unit 206, and a JP timer 208.

The progressive storage unit 207 accumulatively stores a progressive value indicated by the progressive signal from the terminal controller 100, in a progressive value table not shown. The progressive value table has an "individual progressive value" field for storing a progressive value given by a gaming terminal 10, in association with that gaming terminal 10. The table further includes a "total progressive value" field which stores a total of all the progressive values obtained from the gaming terminals 10.

The JP table storage unit 206 stores the race-use light emitting portion activation table illustrated in FIG. 93 which will be described later. The JP timer 208 measures a time, based on a later-described JP game running unit 203.

Further, the center controller 200 has a JP game running unit 203, a JP emission control unit 209, and a JP payout determining unit 205.

The JP game running unit 203 stores a progressive value indicated by a progressive signal given by a terminal controller 100 to the progressive storage unit 207, in association with that gaming terminal 10, in the "individual progressive value" field of the progressive value table which is stored in the progressive storage unit 207. Further, the JP game running unit 203 sums up all the progressive values from the gaming terminals 10, which values are stored in the "individual progressive value" field, and stores the resulting total progressive value in the "total progressive value" field of the progressive value table. Further, every time a progressive value is stored in an "individual progressive value" field, the JP game running unit 203 causes the later-mentioned JP emission control unit 209 to activate the race-use light emitting portions 2 forming a race line unit 300 of the associated gaming terminal 10 so that a predetermined number of the race-use light emitting portions 2 light sequentially from the one closest to the associated gaming terminal 10, according to the amount of progressive values having been stored.

Further, the JP game running unit 203 outputs a JP game start signal to the terminal controllers 100, when the total progressive value exceeds the JP game start value, thereby causing the respective gaming terminals 10 to run the JP game instead of the base game. Further, the JP game running unit 203 causes the JP emission control unit 209 to reset (turn off) all the race-use light emitting portions 2, when outputting the JP game start signal.

Further, the JP game running unit 203 causes the JP timer 208 to start measuring time upon outputting the JP game start signal, and then outputs a JP game end signal to the terminal controllers 100 upon elapse of a predetermined time. Note that the JP game running unit 203 causes the JP timer 208 to stop measuring time, when the JP game running unit 203 causes a later-mentioned JP payout determining unit 205 to output a JP payout signal to the terminal controllers 100.

Further, the JP game running unit 203 determines, when receiving a JP winning signal from the terminal controller 100, the number of race-use light emitting portions 2 to turn active based on the JP winning signal. Then, the JP game running unit 203 causes the JP emission control unit 209 to activate the race-use light emitting portions 2 of the race line unit 300 associated with an intended gaming terminal 10, in such a manner that the number of light emitting portions 2 thus determined turn active sequentially from the one closest to the gaming terminal 10.

Further, the JP game running unit 203 determines whether the race-use light emitting portions 2 in any of the race line units 300 have turned active all the way to the JP payout indicator 400. When the JP game running unit 203 determines that the race-use light emitting portions 2 in any one of the race line units 300 have turned active all the way to the JP payout indicator 400, the JP game running unit 203 causes the JP payout determining unit 205 to output a JP payout signal to the terminal controller 100 of the associated gaming terminal 10.

When the total progressive value exceeds the mystery game start value, the JP game running unit 203 outputs a mystery game start signal to the terminal controller 100, so that whether the base game has ended or not is determined.

Further, when the announcement image display signals are received from the terminal controllers 100 of all the gaming terminals 10, the JP game running unit 203 outputs a mystery bonus signal to the terminal controllers 100 of all the gaming terminals 10. This mystery bonus signal includes information about a gaming terminal 10 to which a mystery bonus is awarded. The gaming terminal 10 to which a mystery bonus is awarded is determined every time at random by the JP game running unit 203.

When a mystery bonus is awarded, the JP emission control unit 209 causes the JP payout indicator 400 to display a value to be awarded. Also, when a mystery bonus is awarded, the JP emission control unit 209 activates, under the control of the JP game running unit 203, the race-use light emitting portions 2 of the race line unit 300 associated with an intended gaming terminal 10, in such a manner that the race-use light emitting portions 2 turn active sequentially from the one closest to the JP payout indicator.

The JP payout determining unit 205, under the control of the JP game running unit 203, outputs a JP payout signal to the terminal controller 100 of an intended gaming terminal 10.

Note that each block of the center controller 200 may be realized with hardware, or with software as needed.

[Operations of Center Controller 200]

The following describes an operation of the center controller 200 in the above structure. First, when the total progressive value exceeds the mystery game start value, the JP game running unit 203 outputs a mystery game start signal to the terminal controllers 100. Like this, the center controller 200 performs the sixth process of outputting a mystery game start signal to all of the gaming terminals 10, when the total progressive value reaches the mystery game start value.

Then, when the announcement image display signals are received from the terminal controllers 100 of all the gaming terminals 10, the JP game running unit 203 outputs a mystery bonus signal to the terminal controllers 100 of all the gaming terminals 10. Like this, the center controller 200 performs the seventh process of outputting a mystery bonus signal to all of the gaming terminals 10, when the mystery game announcement image is displayed on the terminal effect unit 160 of every gaming terminal 10.

As is obvious from the above-described operations, the gaming machine 1 includes the gaming terminals 10 (10A, 10B, . . . ) each of which includes a terminal display 101 (the upper image display panel 33, the lower image display panel 16) which displays an image and each of which runs the base game to award a payout corresponding to a predetermined winning and a mystery game to award a mystery bonus which is greater than the payout of the base game. The gaming machine 1 performs the playing method including the steps of: in each one of the gaming terminals 10, running the base game and awarding a payout corresponding to a predetermined winning, independently of another gaming terminal 10; determining whether the base game has ended or not, when the total progressive value exceeds the mystery game start value; displaying on the terminal effect unit 160 of the terminal display 101 a mystery game announcement image concerning the mystery game, when it is determined that the base game has ended; running the mystery game, when the mystery game announcement image is displayed on the terminal displays 101 of all the gaming terminals 10; and awarding a mystery bonus in accordance with a result of the mystery game, after running the mystery game.

In the playing method, the base game is run in each of the gaming terminals 10. When the total progressive value exceeds the mystery game start value, whether the base game being run has ended or not is determined in each gaming terminal 10. Then, the gaming terminals 10, sequentially from the one having determined that the base game has ended, have the mystery game announcement image displayed on their terminal displays 101. When the mystery game announcement image is displayed on the terminal displays 101 of all the gaming terminals 10, the mystery game is run all at once in all the gaming terminals 10. When the mystery game is run all at once, a mystery bonus is awarded to each gaming terminal 10 in accordance with a result of the mystery game. Thus, in all the gaming terminals 10, the mystery game is run all at once after the base game ends. Accordingly, a player can share his/her expectation for the mystery bonus with other players. In addition, the gaming terminals 10, sequentially from the one having ended the base game, have the mystery game announcement image displayed on the terminal displays 101. This can give a player expectation for the mystery game starting soon, even before the other gaming terminals 10 end the base game. Like this, a player may enjoy the mystery game with sympathy with players playing on the other gaming terminals 10, as compared with when the mystery game is individually run in one gaming terminal 10 independently of in another gaming terminal 10.

[Base Game]

The following specifically describes an example of a base game in the gaming machine 1 and the playing method. Note that the following example deals with a case where the terminal display 101 adopts a video reel and arranges symbols 180 on a video reel, as illustrated in FIG. 84.

Figure 84:
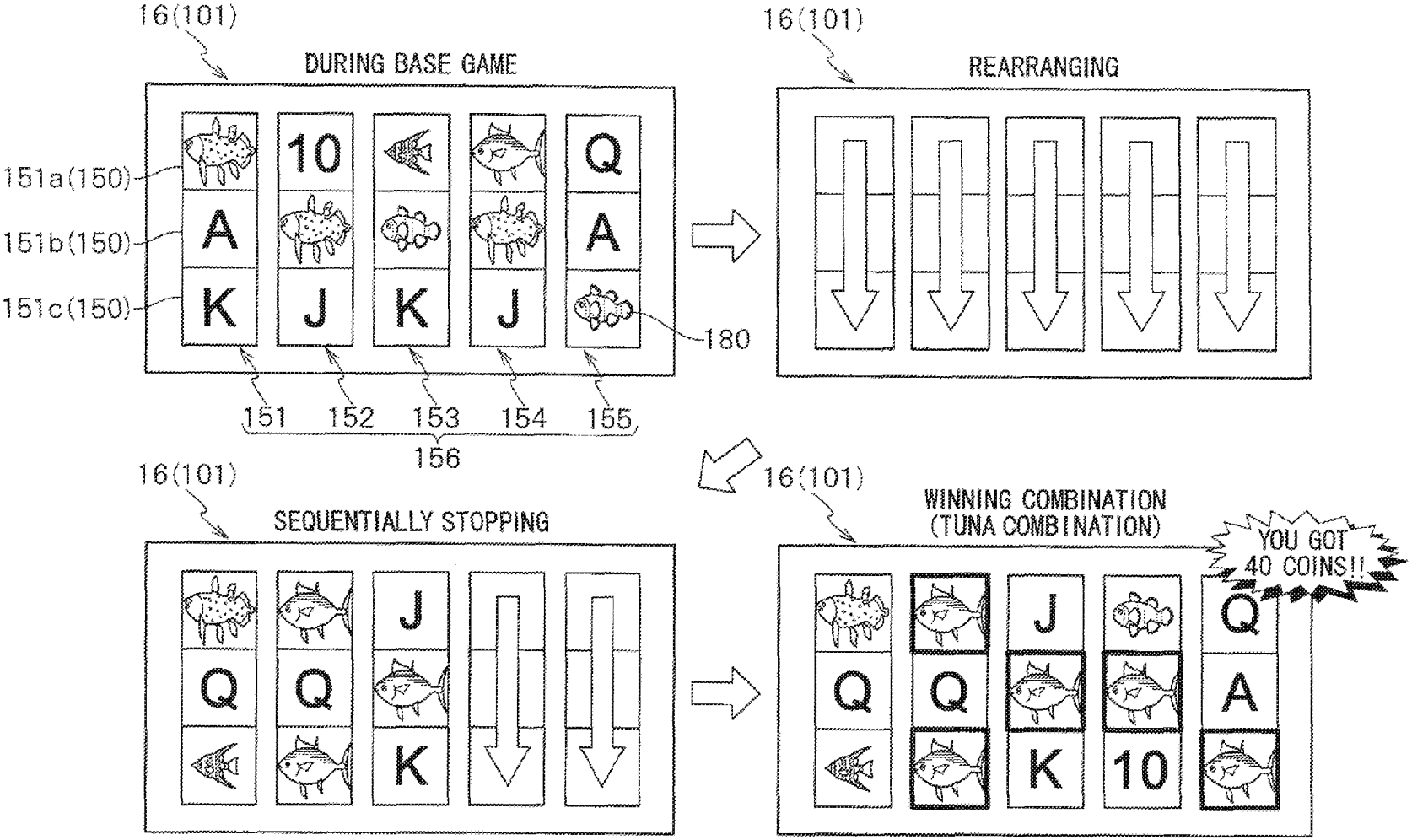
FIG. 84 is an explanatory diagram concerning the base game.

As illustrated in FIG. 84, a matrix 156 is in the middle of the terminal display 101. The matrix 156 includes symbols 180, which are scroll displayed. Further, display windows 151 to 155 are each divided into an upper stage 151*a*, a central stage 151*b*, and a lower stage 151*c*. The symbols 180 are stopped (arranged) in the stages 151*a* to 155*c*, respectively. The matrix 156 is a symbol matrix including five columns/three rows. The matrix 156 however is not limited to the one with the five-columns/three-rows.

As illustrated in FIG. 84, the terminal display 101 variably displays symbols 180 when a base game is started in the gaming terminal 10. When this variable-displaying of symbols 180 stops, symbols 180 are rearranged in the symbol arrangement areas 150. Then, when a winning is achieved according to a relation among the rearranged symbols 180, a payout according to this winning is awarded.

In the example illustrated in FIG. 84, a winning with a combination "Tuna" is achieved, and forty coins are awarded to the player as such (see a lower right view of the figure)

[JP Game]

The following specifically describes an example of a JP game in the gaming machine 1 and the playing method.

The JP game is run when the accumulated total of progressive values exceeds a predetermined amount (the JP game start value). In the JP game, the symbols 180 are rearranged in the matrix 156 in each gaming terminal 10, as is the case of the base game. When a predetermined JP winning is achieved by the rearrangement of the symbols 180, one or more race-use light emitting portions 2 turn active in the race line unit 300 associated with the gaming terminal 10 having achieved the winning.

Here, each race line unit 300 includes a curve 300*a* and a straight part 300*b*. The number of the race-use light emitting portions 2 to turn active is controlled so that, even the same JP winning occurs, the numbers of race-use light emitting portions 2 to turn active differs between the curve 300*a* and the straight part 300*b*. While the race-use light emitting portions 2 in the curve 300*a* are to turn active, the number of the race-use light emitting portions 2 to turn active is determined depending on which one of later-mentioned groups the associated gaming terminal 10 belongs to, whereas, while the race-use light emitting portions 2 in the straight part 300*b* are to turn active, the number of the race-use light emitting portions 2 to turn active is determined irrespective of which group the associated gaming terminal belongs to.

As is already mentioned, the activation of the race-use light emitting portions 2 in the curve 300*a* is controlled so that the numbers of the race-use light emitting portions 2 to turn active differ, depending on the groups, between the gaming terminals 10 in which the same JP winning has occurred. This is because each curve 300*a* is formed so as to avoid a later-mentioned shared display 510, race cabinets 520, a game signboard 540, and the like. More specifically, the gaming terminals 10 in the present embodiment are grouped into the following three groups: a group (Gr. 3) of gaming terminals 10 whose respective curved ling parts 300*a* are short; a group (Gr. 1) of gaming terminals 10 whose respective curves 300*a* are long; and a group (Gr. 2) of other gaming terminals 10. Even if the same JP winning occurs in more than one of these gaming terminals 10, the number of the race-use light emitting portions 2 to turn active is set to be small for the gaming terminal 10 of Gr. 3 whose curve 300*a* is short, whereas the number is set to be large for the gaming terminal 10 of Gr. 1 whose curve 300*a* is long.

Figure 85:
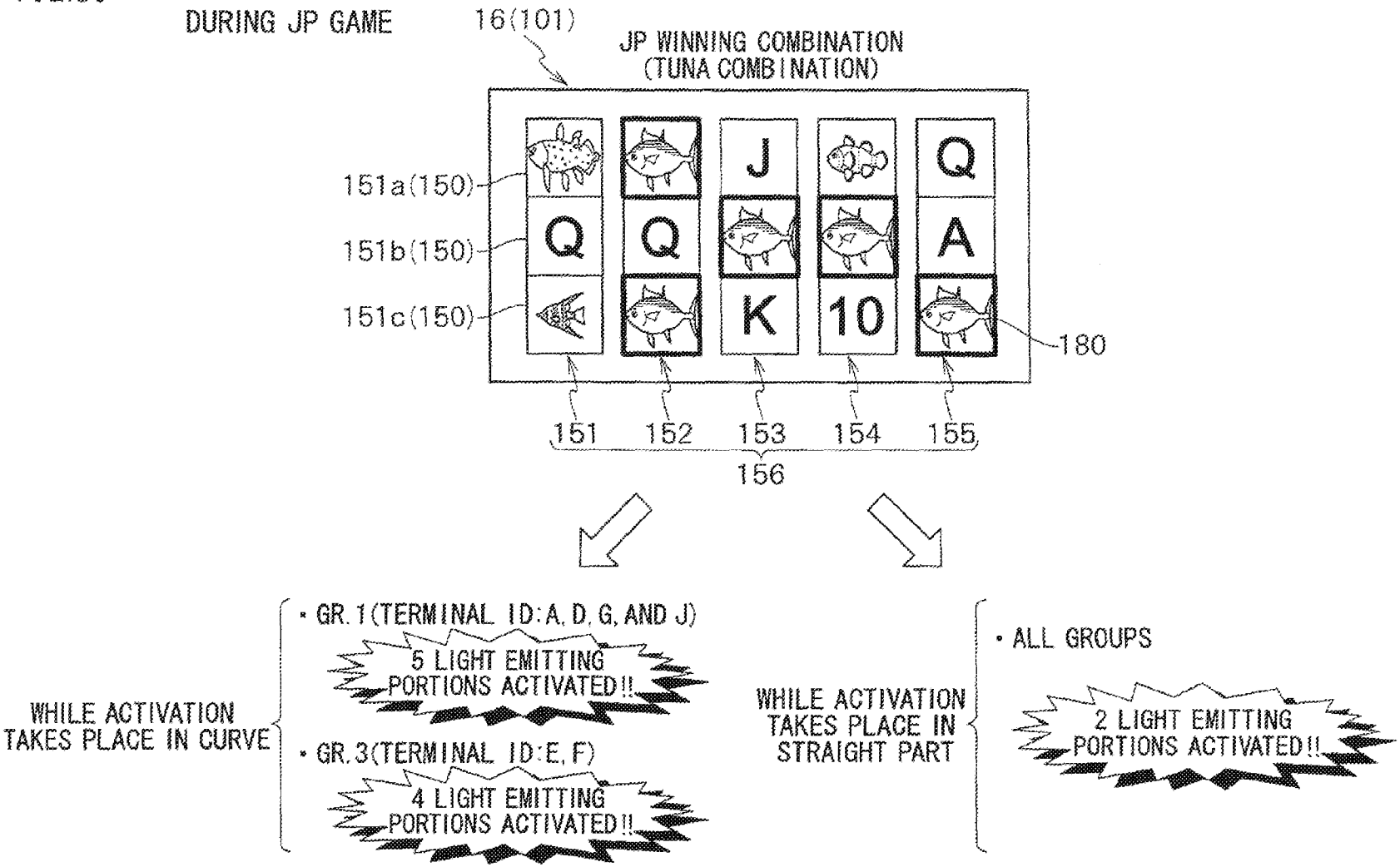
FIG. 85 is an explanatory diagram concerning the JP game.

In the example illustrated in FIG. 85 in which the same JP winning based on the combination of "Tuna" has occurred in more than one gaming terminals 10, five race-use light emitting portions 2 are turned active for the gaming terminal 10 of Gr. 1, whereas four race-use light emitting portions 2 are turned active for the gaming terminal 10 of Gr. 3 (see lower left of the figure). To be fair to the players of all the gaming terminals 10, the number of times the same JP winning has to be achieved to have the race-use light emitting portions 2 in the curve 300*a* turned active up to the relaying part 310 is uniformly set for each gaming terminal 10.

On the other hand, when the same JP winning based on the combination of "Tuna" occurs in more than one gaming terminals 10 while the activation of the race-use light emitting portions 2 takes place in the straight part 300*b*, each gaming terminal 10 has two of the associated race-use light emitting portions 2 turn active (see lower right of figure).

[Symbol, Combination, or the Like]

The terminal display 101 has the matrix 156 including symbol columns each having twenty two symbols 180 as illustrated in FIG. 86. To each of the symbols constituting the symbol columns is given one of code numbers 0 to 21. Each symbol column is made from a combination of "Coelacanth", "Tuna", "Clownfish", "Angelfish", "A", "K", "Q", and "J".

Of the symbols in the symbol columns, the display windows 151 to 155 each displays (arranges) three successive symbols. The symbols arranged in the upper stages 151*a* to 155*a*, the central stages 151*b* to 155*b*, and the lower stages 151*c* to 155*c* form a symbol matrix having five-columns/three-rows. When a BET button and a start button are sequentially pressed in this order to start a game, symbols constituting the symbol matrix start to scroll. This scrolling of the symbols stops (rearrangement) after a predetermined period from the beginning of the scrolling.

Further, for each symbol, a predetermined scatter symbol is determined in advance. Scatter symbols are such symbols that a player is put in an advantageous position when a predetermined number or more of them are displayed in the matrix 156. For example, the advantages includes: a state where coins corresponding to the scatter symbols are paid out, a state where the number of coins to be paid out is added to a credit, or the like.

[Mechanical Structure of Gaming Machine 1]

Next, the following describes a specific example of mechanical and electrical structures of the gaming machine 1 thus structured.

A gaming machine 1 is placed in a game arcade such as a casino. This gaming machine 1 runs a unit game which involves a game medium. The game medium is a coin, a bill, or a value equivalent thereto in the form of electronic information. However, the game medium in the present invention is not particularly limited. For example, a medal, token, electronic money, ticket or the like may also be possible. Further, the ticket is not particularly limited and may be a later-described barcoded ticket or the like ticket.

Figure 87:
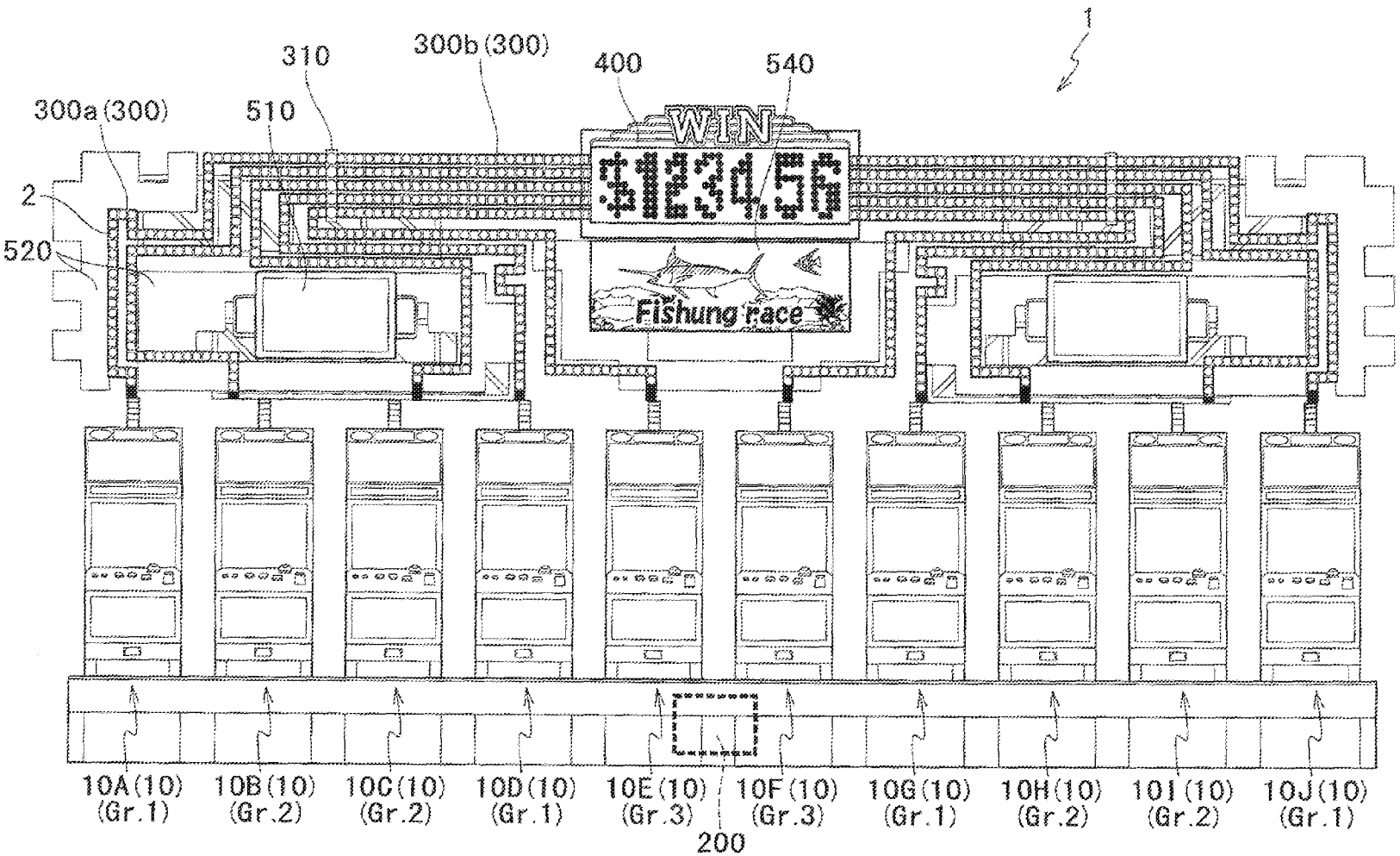
FIG. 87 is a front view showing an external appearance of the gaming machine.

As illustrated in FIG. 87, the gaming machine 1 includes: the gaming terminals 10 each of which runs a base game independently of another gaming terminal 10; the center controller 200 which is connected and is in communication with the gaming terminals 10, and which runs a JP game; the JP payout indicator 400 which displays the amount of the JP payout to be awarded in the JP game; and the race line units 300 formed by arranging the race-use light emitting portions 2, which respectively extend from the gaming terminals 10 to the JP, payout indicator 400. Each of the race line units 300 includes the curve 300*a* and the straight part 300*b*. At the boundary between the curve 300*a* and the straight part 300*b* is provided a relaying part 310. Further, the gaming terminals 10 are grouped by the size of the associated curves 300*a*. The gaming terminals 10 associated with long curves 300*a* are in Gr. 1 and are respectively terminals "A", "D", "G" and "J". The gaming terminals 10 associated with short curves 300*a* are in Gr. 3 and are respectively terminals "E" and "F". The other gaming terminals 10 are in Gr. 2 and are respectively terminals "B", "C", "H", and "I".

Further, the gaming machine 1 includes a shared display 510, a race cabinet 520, and a game signboard 540. The shared display 510 displays a video which provides an effect to the JP game. Each of the race cabinets 520 is a cabinet to support the gaming machine 1. The game signboard 540 is a signboard indicating a title of the game run in the gaming machine 1. As is already mentioned, each curve 300*a* is formed so as to avoid these members. Note that the present embodiment deals with a case where respective lengths of the curves 300*a* are different from one another depending on the gaming terminals 10; however, the curves 300*a* may all have the same lengths. In such a case, grouping of the gaming terminals 10 is not necessary. In either case, to activate the race-use light emitting portions 2 of the curve 300*a* up to the relaying part 310, the number of times one type of JP winning has to be achieved is the same in each of the curves 300*a*.

[Mechanical Structure of Gaming Terminal 10]

Figure 88:
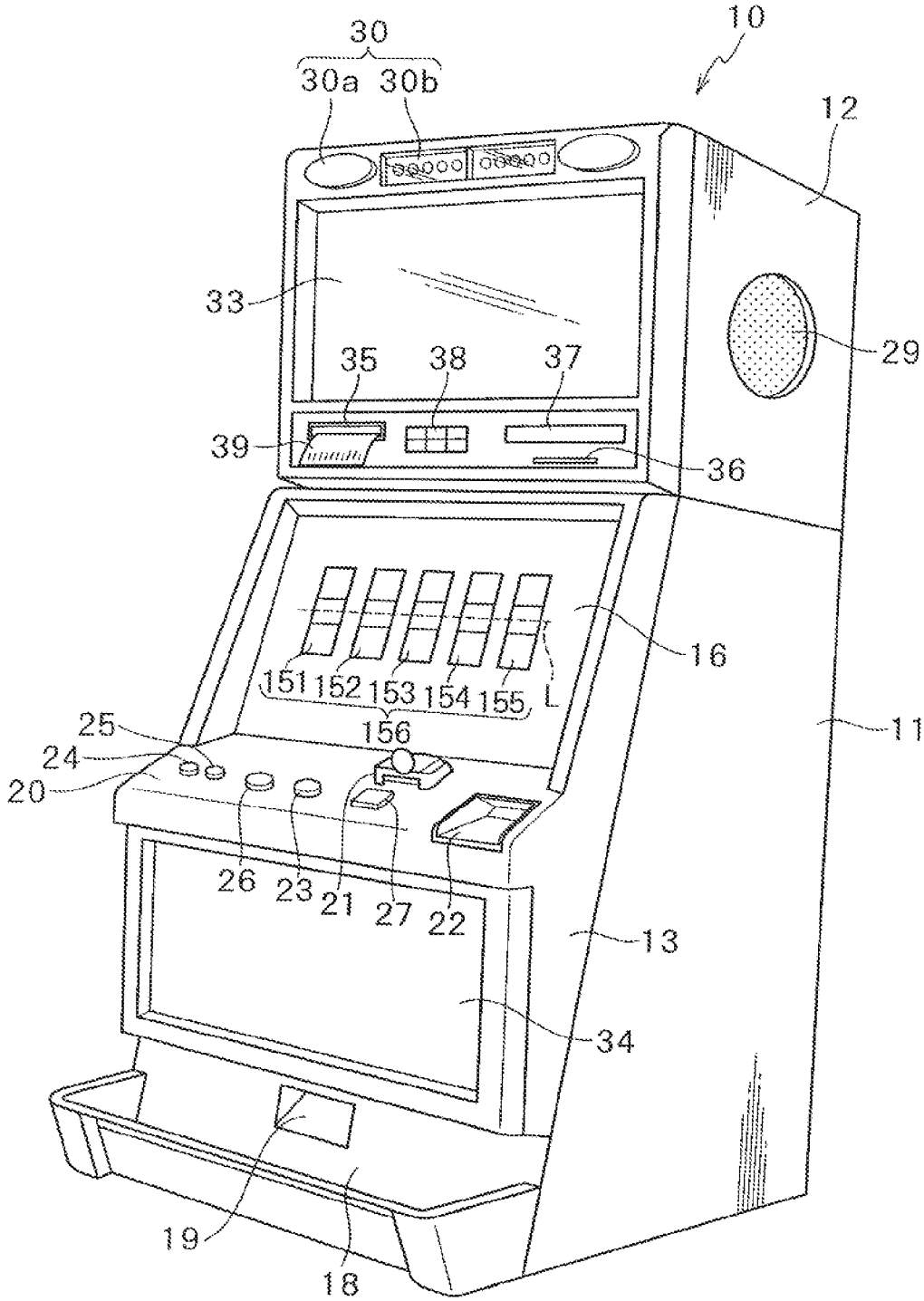
FIG. 88 is a perspective view illustrating an external appearance of the gaming terminal.

As illustrated in FIG. 88, the gaming terminal 10 includes: a cabinet 11, a top box 12 provided above the cabinet 11, and a main door 13 provided on a front surface of the cabinet 11. The main door 13 has a lower image display panel 16. The lower image display panel 16 has a transparent liquid crystal panel for displaying various information. The lower image display panel 16 displays display windows 151 to 155 (matrix 156) for arranging therein symbols 180. Further, the lower image display panel 16 displays as needed various information and effect images related to a game.

The present embodiment deals with a case where the lower image display panel 16 electrically displays symbols 180 arranged in five-columns/three-rows. However, the present invention is not limited to this.

The lower image display panel 16 displays a single activated payline L. Note that the number of paylines L may be two or more. When the number of paylines L is two or more, the number of paylines L activated may be determined according to a predetermined condition, such as the number of coins placed as a BET.

Note that the lower image display panel 16 may have a credit value indicator and a payout value indicator. The credit value indicator displays a total value (hereinafter also referred to as total credit value) which a gaming terminal 10 can pay out to a player. When symbols stopped along a payline L form a winning combination, the payout value indicator displays the number of coins to be paid out.

Further, scatter symbols may be adopted, and the number of coins to be paid out may be determined, according to the number of scatter symbols displayed on the matrix 156. Note that the payline L does not necessarily have to be displayed.

Below the lower image display panel 16 provided are a control panel 20, a coin receiving slot 21, and a bill validator 22. The control panel 20 is provided with various buttons 23 to 27. These buttons 23 to 27 allow a player to input instructions related to a game played by the player. Through the coin receiving slot 21, a coin is received in the cabinet 11.

The control panel 20 includes: a spin button 23, a change button 24, a cashout button 25, a 1-BET button 26, and a maximum BET button 27. The spin button 23 is for inputting an instruction to start symbol scrolling. The change button 24 is used to ask a staff person in the game arcade for exchange of money. The cashout button 25 is for inputting an instruction to pay out coins corresponding to the total credit value to the coin tray 18 via the coin outlet 19.

The 1-BET button 26 is used for betting one coin out of those corresponding to the total credit value. The maximum BET button 27 is used for betting, out of those corresponding to the total credit value, a maximum number of coins (e.g., fifty coins) which can be bet in one game.

The bill validator 22 validates whether a bill is genuine or not and receives the genuine bill into the cabinet 11. Note that the bill validator 22 is capable of reading a barcode attached to a later-mentioned barcoded ticket 39. When the bill validator 22 reads the ticket 39, it outputs to the main CPU 41 a read signal representing information having read from the barcode.

On a lower front surface of the main door 13, that is, below the control panel 20, a belly glass 34 is provided. On the belly glass 34, a character of a gaming terminal 10 or the like is drawn. On a front surface of top box 12 is provided an upper image display panel 33. The upper image display panel 33 has a liquid crystal panel and displays an effect image, introduction to the game, rules of the game, or the like. Also, in this embodiment, the upper image display panel 33 displays various images concerning a mystery game, such as the mystery game announcement image, the "LOSS" image, the "WIN" image, and the like.

The top box 12 has a speaker 29 for performing an audio output. Below the upper image display panel 33 are provided a ticket printer 35, a card reader 36, a data displayer 37, and a keypad 38. The ticket printer 35 prints, onto a ticket, a barcode having encoded data containing credit value, date and time, identification number of a gaming terminal 10 or the like, thereby issuing a barcoded ticket 39. A player can play a game in another gaming terminal 10 with the barcoded ticket 39, or exchange the barcoded ticket 39 with bill or the like at a change booth or the like of the game arcade.

The card reader 36 reads/writes data from/into a smart card. The smart card is carried by a player, and stores therein data for identifying the player, data relating to a history of games played by the player, or the like.

The data displayer 37 includes a fluorescent display or the like, and displays the data read by the card reader 36 and the data input by the player through the keypad 38, for example. The keypad 38 is for entering instructions or data relating to issuing of a ticket or the like.

Further, above the upper image display panel 33 are provided two cabinet light emitting portions 30 (circular light emitting portion 30*a*, strip light emitting portion 30*b*). The cabinet light emitting portions 30 are realized by LEDs (light-emitting diodes), and are capable of emitting light in different colors.

[Electrical Structure of Gaming Machine 1]

Figure 89:
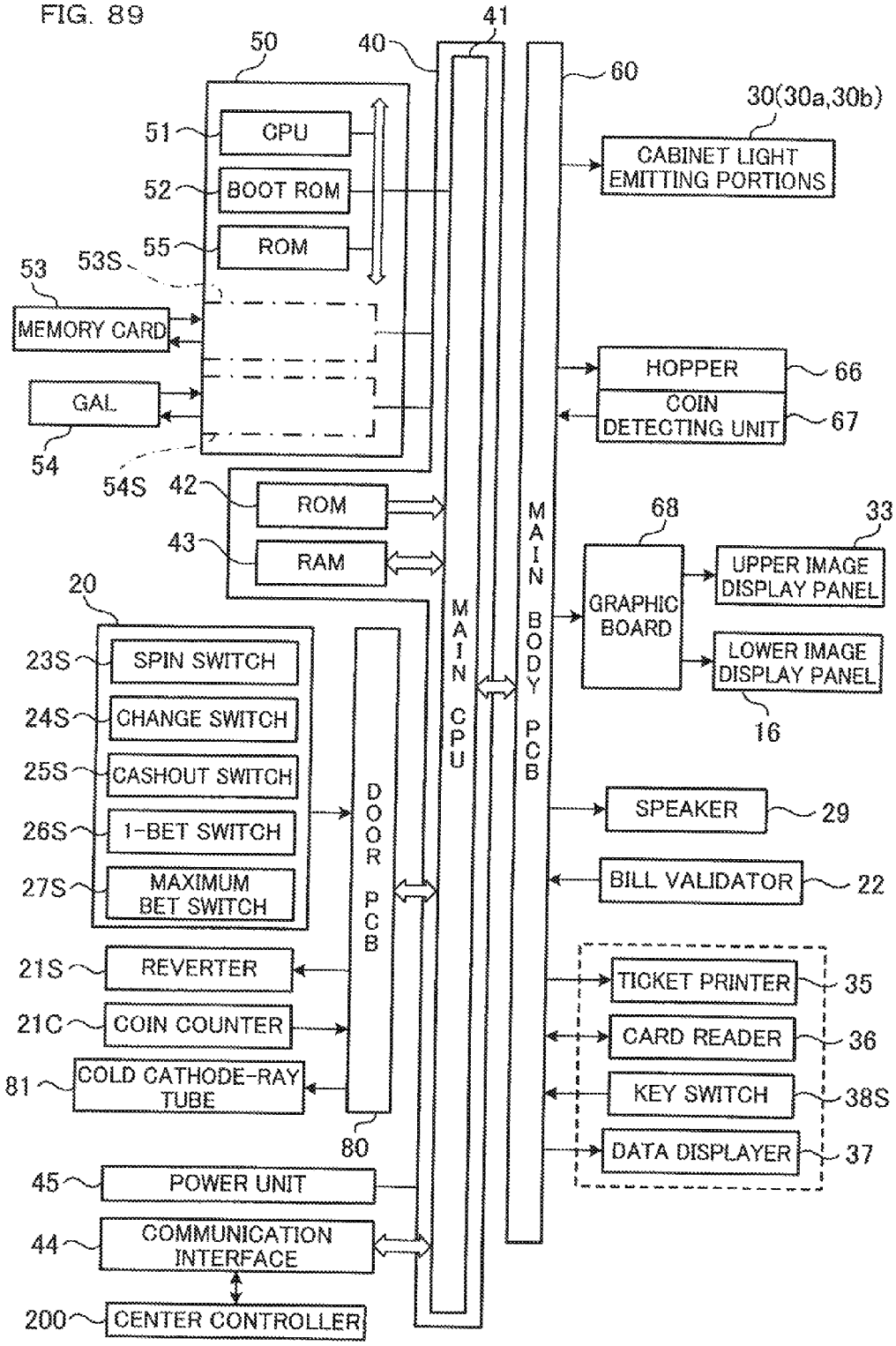
FIG. 89 is a block diagram illustrating an electrical structure of the gaming terminal.
Figure 90:
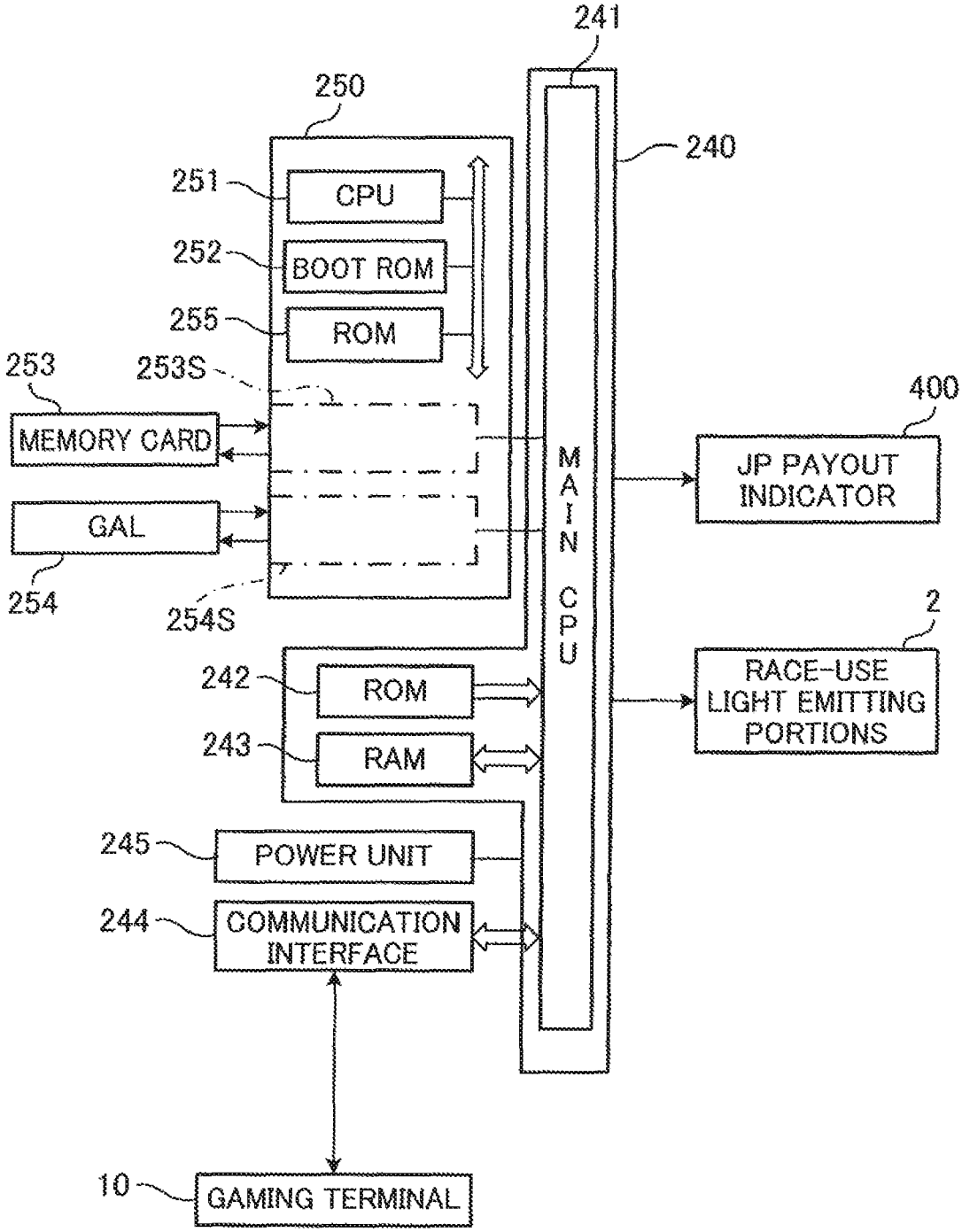
FIG. 90 is a block diagram illustrating an electrical structure of a center controller.

FIGS. 89 and 90 are block diagrams each illustrating an electrical structure of the entire gaming machine 1.

[Electrical Structure of Gaming Terminal 10]

FIG. 89 is a block diagram showing an electrical structure of the gaming terminal 10. As illustrated in FIG. 89, the cabinet 11 is provided therein with a control unit having a terminal controller 100. As illustrated in FIG. 89, the control unit includes a motherboard 40, a main body PCB (Printed Circuit Board) 60, a gaming board 50, a door PCB 80, various switches, sensors, and the like.

The gaming board 50 is provided with a CPU (Central Processing Unit) 51, a ROM 55, a boot ROM 52, a card slot 53S corresponding to a memory card 53, and an IC socket 54S corresponding to a GAL (Generic Array Logic) 54. The CPU 51, the ROM 55, and the boot ROM 52 are connected to one another through an internal bus.

The memory card 53 stores therein a game program and a game system program. The game program contains a stop symbol determining program. The stop symbol determining program determines symbols (code number corresponding to the symbol) to be stopped in the symbol arrangement areas 150. This stop symbol determining program contains sets of symbol weighting data respectively corresponding to various payout rates (e.g., 80%, 84%, 88%). Each set of the symbol weighting data indicates, for each of the display windows 151 to 155, a code number of each symbol and at least one random number allotted to the code number. The at least one random number is a value within a predetermined range of 0 to 256 for example.

The payout rate is determined based on payout rate setting data output from the GAL 54. Based on a set of the symbol weighting data corresponding to the payout rate determined, a symbol to be stopped is determined.

The memory card 53 stores therein various types of data for use in the game programs and the game system programs. For example, the memory card 53 stores a table listing combinations of a symbol 180 to be displayed on the display windows 151 to 155 of FIG. 84 and an associated range of random numerical values. This data is transferred to the RAM 43 of the motherboard 40, at the time of running the game programs.

The card slot 53S is structured so as to allow the memory card 53 to be attached/detached to/from the card slot 53S. This card slot 53S is connected to the motherboard 40 through an IDE bus. Thus, the type and content of a game run by a gaming terminal 10 can be modified by detaching the memory card 53 from the card slot 53S, writing a different game program and a different game system program into the memory card 53, and inserting the memory card 53 back into the card slot 53S.

Each of the game programs includes a program related to the progress of the game and/or a program for causing a transition to a JP game and a mystery game. Each of the game programs includes image data and audio data output during the game.

The GAL 54 has input and output ports. When the GAL 54 receives data via the input port, it outputs data corresponding to the input data from its output port. This data from the output port is the payout rate setting data described above.

The IC socket 54S is structured so as to allow the GAL 54 to be attached/detached to/from the IC socket 54S. The IC socket 54S is connected to the motherboard 40, via a PCI bus. Thus, the payout rate setting data to be output from GAL 54 can be modified by: detaching the GAL 54 from the IC socket 54S, overwriting the program stored in the GAL 54, and attaching the GAL 54 back to the IC socket 54S.

The CPU 51, the ROM 55 and the boot ROM 52 connected through an internal bus are connected to the motherboard 40 through a PCI bus. The PCI bus communicates signals between the motherboard 40 and the gaming board 50 and supplies power from the motherboard 40 to the gaming board 50. The ROM 55 stores country identification information and an authentication program. The boot ROM 52 stores a preliminary authentication program and a program (boot code) for enabling the CPU 51 to run the preliminary authentication program.

The authentication program is a program (falsification check program) for authenticating the game program and the game system program. The authentication program is a program for confirming and verifying that the game program and the game system program are not falsified. In other words, the authentication program is described in accordance with a procedure for authenticating the game program and the game system program. The preliminary authentication program is a program for authenticating the authentication program. The preliminary authentication program is described in accordance with a procedure for verifying that the authentication program to be authenticated is not falsified. In short, the preliminary authentication program authenticates the authentication program.

The motherboard 40 is provided with a main CPU 41 (terminal controller 100), a ROM (Read Only Memory) 42, a RAM (Random Access Memory) 43, and a communication interface 44.

The main CPU 41 serves as a terminal controller 100 and has a function of controlling the entire gaming terminal 10. In particular, the main CPU 41 controls the following operations: an operation of outputting a signal instructing variable-displaying of symbols 180 to the graphic board 68, which is performed in response to pressing of the spin button 23 after betting of credit; an operation of determining symbols 180 to be stopped after the variable-displaying of symbols 180; and an operation of stopping the symbols 180 thus determined in the display window 151 to 155.

In other words, the main CPU 41 serves as an arrangement controller which rearranges symbols to form a new symbol matrix through scrolling of symbols displayed on the lower image display panel 16. This main CPU 41 therefore determines symbols to be arranged in a symbol matrix by selecting symbols to be arranged from various kinds of symbols. Then, the main CPU 41 executes arrangement control to stop scrolling the symbols to present the symbols thus determined.

Note that the main CPU 41 includes: a game running unit 103 of FIG. 83, a display control unit 102, a payout determining unit 105, and a payout awarding unit 104.

The ROM 42 stores a program such as BIOS (Basic Input/Output System) run by the main CPU 41, and permanently-used data. When the BIOS is run by the main CPU 41, each of peripheral devices is initialized and the game program and the game system program stored in the memory card 53 are read out through the gaming board 50.

The RAM 43 stores data or a program used for the main CPU 41 to perform a process. For example, the RAM 43 includes, in the form of data area, a display storage unit 107, a table storage unit 106, which are shown in FIG. 83, and the like. Further, the data area serving as the table storage unit 106 stores the winning combination table of FIG. 91, and the base game payout table of FIG. 92.

The communication interface 44 is provided to communicate with a host computer and the like equipped in the game arcade, through a communication line. The communication interface 44 is also for communicating with the center controller 200 through a communication line. Further, a main body PCB (Printed Circuit Board) 60 and a door PCB 80 are connected to the motherboard 40, respectively through USBs (Universal Serial Bus). Further, the motherboard 40 is connected to a power unit 45. The power unit 45 supplies power to the motherboard 40 to boot the main CPU 41 thereof. Meanwhile, the power unit 45 supplies power to the gaming board 50 through the PCI bus to boot the CPU 51 thereof.

The main body PCB 60 and door PCB 80 are connected to various devices or units which generate control signals to be input to the main CPU 41, and various devices or units whose operations are controlled by signals from the main CPU 41. Based on a signal input to the main CPU 41, the main CPU 41 runs the game program and the game system program stored in the RAM 43, to perform an arithmetic process. Then, the CPU 41 stores a result of the arithmetic process in the RAM 43, or transmits a control signal to the various devices and units to control them based on the result.

The main body PCB 60 is connected with the cabinet light emitting portions 30, a hopper 66, a coin sensor 67, a graphic board 68, the speaker 29, a bill validator 22, a ticket printer 35, a card reader 36, a key switch 38S, and a data displayer 37.

The cabinet light emitting portions 30 is turned on/off on the basis of a control signal from the main CPU 41. The hopper 66 is mounted in the cabinet 11 and pays out a predetermined number of coins from a coin outlet 19 to the coin tray 18, based on a control signal from the main CPU 41. The coin sensor 67 is provided inside the coin outlet 19, and outputs a signal to be input to the main CPU 41 upon sensing that a predetermined number of coins have been delivered from the coin outlet 19.

The graphic board 68 controls image displaying of upper image display panel 33 and the lower image display panel 16, based on a control signal from the main CPU 41. Further, the graphic board 68 is provided with a VDP (Video Display Processor) for generating image data on the basis of a control signal from the main CPU 41, a video RAM for temporarily storing the image data generated by the VDP, and the like. Note that image data used at the time of generating the image data by the VDP is in a game program which is read out from the memory card 53 and stored in the RAM 43.

The bill validator 22 reads an image on the bill and takes only those recognized as genuine into the cabinet 11. When taking in a genuine bill, the bill validator 22 outputs an input signal indicating the value of the bill to the main CPU 41. The main CPU 41 stores into the RAM 43 a credit value corresponding to the value of the bill indicated by the signal input.

Based on a control signal from the main CPU 41, the ticket printer 35 prints a barcode onto a ticket to issue a barcoded ticket 39. The barcode contains encoded data of the credit value, date and time, the identification number of the gaming terminal 10, which are stored in the RAM 43, and the like.

The card reader 36 reads out data from the smart card and transmits the data to the main CPU 41. Further, the card reader 36 writes data into the smart card based on the control signal output from the main CPU 41. The key switch 38S is mounted to the keypad 38, and outputs a signal to the main CPU 41 in response to an operation of the keypad 38 by the player. The data displayer 37 displays, based on a control signal from the main CPU 41, the data read by the card reader 36 or the data input by the player through the keypad 38.

The door PCB 80 is connected to a control panel 20, a reverter 21S, a coin counter 21C, and a cold cathode tube 81. The control panel 20 is provided with: a spin switch 23S associated with the spin button 23; a change switch 24S associated with the change button 24; a cashout switch 25S associated with the cashout button 25; a 1-BET switch 26S associated with the 1-BET button 26; and a maximum BET switch 27S associated with the maximum BET button 27. Each of the switches 23S to 27S outputs a signal to the main CPU 41, when a player presses the associated button.

The coin counter 21C is provided within the coin receiving slot 21, and identifies whether the coin inserted into the coin receiving slot 12 by the player is genuine. A coin except the genuine coin is discharged from the coin outlet 19. In addition, the coin counter 21C outputs an input signal to the main CPU 41 upon detection of a genuine coin.

The reverter 21S is operated on the basis of the control signal output from the main CPU 41 and distributes a coin, which is recognized as a genuine coin by the coin counter 21C, to a not-shown cash box or hopper 66 mounted in the gaming terminal 10. In other words, when the hopper 66 is full of coins, the genuine coin is distributed into the cash box by the reverter 21S. On the other hand, when the hopper 66 is not yet full of coins, the genuine coin is distributed into the hopper 66. The cold cathode tube 81 functions as a backlight mounted to rear sides of the lower image display panel 16 and the upper image display panel 33. This cold cathode tube 81 turns on according to a control signal from the main CPU 41.

[Electrical Structure of Center Controller 200]

FIG. 90 is a block diagram illustrating an electrical structure of the center controller 200. A control unit is installed inside the center controller 200. As illustrated in FIG. 90, the control unit includes a motherboard 240, a gaming board 250, an actuator, and the like.

The gaming board 250 has the same structure as that of the gaming board 50. The motherboard 240 has the same structure as that of the motherboard 40.

The motherboard 240 has a main CPU 241, a ROM 242, and a RAM 243.

The main CPU 241 includes a JP game running unit 203, a JP timer 208, a JP emission control unit 209, and a JP payout determining unit 205 shown in FIG. 83.

The ROM 242 stores a program to be run by the main CPU 241, and permanently-used data.

The RAM 243 stores data or a program used for the main CPU 241 to perform a process. For example, in the RAM 243 are provided, in the form of data areas, a progressive storage unit 207, a JP table storage unit 206, and the like, which are shown in FIG. 83. Further, in the data area serving as the progressive storage unit 207 is stored the progressive value table not shown. In the data area serving as the JP table storage unit 206 is stored the race-use light emitting portion activation table shown in FIG. 93.

Further, the center controller 200 includes, as a main actuator, the JP payout indicator. 400 and the race-use light emitting portions 2.

The JP payout indicator 400 displays, in response to a control signal output from the main CPU 241, the JP payout based on the progressive values collected from the gaming terminals 10.

The race-use light emitting portions 2 light or blink based on a control signal output from the main CPU 241.

Further, the center controller 200 has a power unit 245 and a communication interface 244.

The power unit 245 has a function of supplying power to the motherboard 240. The communication interface 244 communicates with the terminal controller 100 of each gaming terminal 10 through a communication line.

[Winning Combination Table]

FIG. 91 shows a winning combination table. The winning combination table is stored in the RAM 43 of each gaming terminal 10, and has a "winning combination" field and a "random number" field. The "winning combination" field stores a list of combinations for achieving a winning in the base game, and the "random number" field stores a list of random numbers corresponding to various winning combinations. For example, a symbol 180 most unlikely to make a winning is "Coelacanth". Random numbers allotted thereto range from 0 to 49. Note that, in the present invention, the winning combinations and the range of the random numbers respectively allotted thereto are not limited to those in the winning combination table shown in FIG. 91. Further, in this embodiment, the similar table is used for, in the JP game, JP winning combinations and ranges of random numbers respectively allotted to the JP winning combinations. However, in the present invention, it may be possible to use different types of tables for the base game and JP game, respectively.

[Base Game Payout Table]

FIG. 92 shows a base game payout table. The base game payout table is stored in the RAM 43 of each gaming terminal 10, and has a "winning combination" field and a "payout" field. The "winning combination" field stores a list of combinations for achieving a winning in the base game, and the "payout" field stores a list of payout amounts corresponding to the respective winning combinations. For example, the winning combination of "Coelacanth" yields the highest payout, and 50 coins are awarded to the player every time this combination is formed. Further, the combination of "Loss" awards zero coins (i.e. no payout) to the player. Note that, in the present invention, the payouts are not limited to those listed in the base game payout table shown in FIG. 92, and they may appropriately be set.

[Race-Use Light Emitting Portion Activation Table]

FIG. 93 illustrates a race-use light emitting portion activation table for the JP game. This table is stored in the RAM 243 of the center controller 200, and has a "JP winning combination" field and a "race-use light emitting portion activation count" field. Further, the "race-use light emitting portion activation count" field includes a "curve" field and "straight part" field. Further, the "curve" field is divided into three groups: "Gr. 1", "Gr. 2", and "Gr. 3". The "straight part" field has a "common" field. The "JP winning combination" field stores a list of combinations for achieving a JP winning in the JP game, and the "race-use light emitting portion activation count" field stores a list of the numbers of the race-use light emitting portions 2 to be lighted, which numbers respectively correspond to various JP winnings. This table is referred to when activating the race-use light emitting portions 2 during the JP game. The number of the race-use light emitting portions 2 to be activated in the curves 300*a* is set different among the groups. For example, when a JP winning combination of "Coelacanth" is formed, the number of the race-use light emitting portions 2 to turn active is five for Gr. 1 and Gr. 2, and four for Gr. 3. Further, when the JP winning combination of "Angelfish" is formed, the number of the race-use light emitting portions 2 to turn active is four for Gr. 1, and three for Gr. 2 and Gr. 3. As is obvious from the above, even when the same JP winning is achieved, the number of race-use light emitting portions 2 to turn active differs depending on the groups which are classified in accordance with a length of the curve 300*a*. Here, in the present invention, if all the curves 300*a* have the same length, the grouping is not necessary. Therefore, it is not necessary that the number of the race-use light emitting portions 2 to turn active is set different among the groups.

The setting related to the "straight part" field is the same in all the gaming terminal 10 irrespective of which group each gaming terminal 10 belongs to. For example, when a JP winning of "Coelacanth" is achieved, three race-use light emitting portions 2 turn active for each of the gaming terminals 10.

[Timing Chart of Mystery Game]

Figure 94:
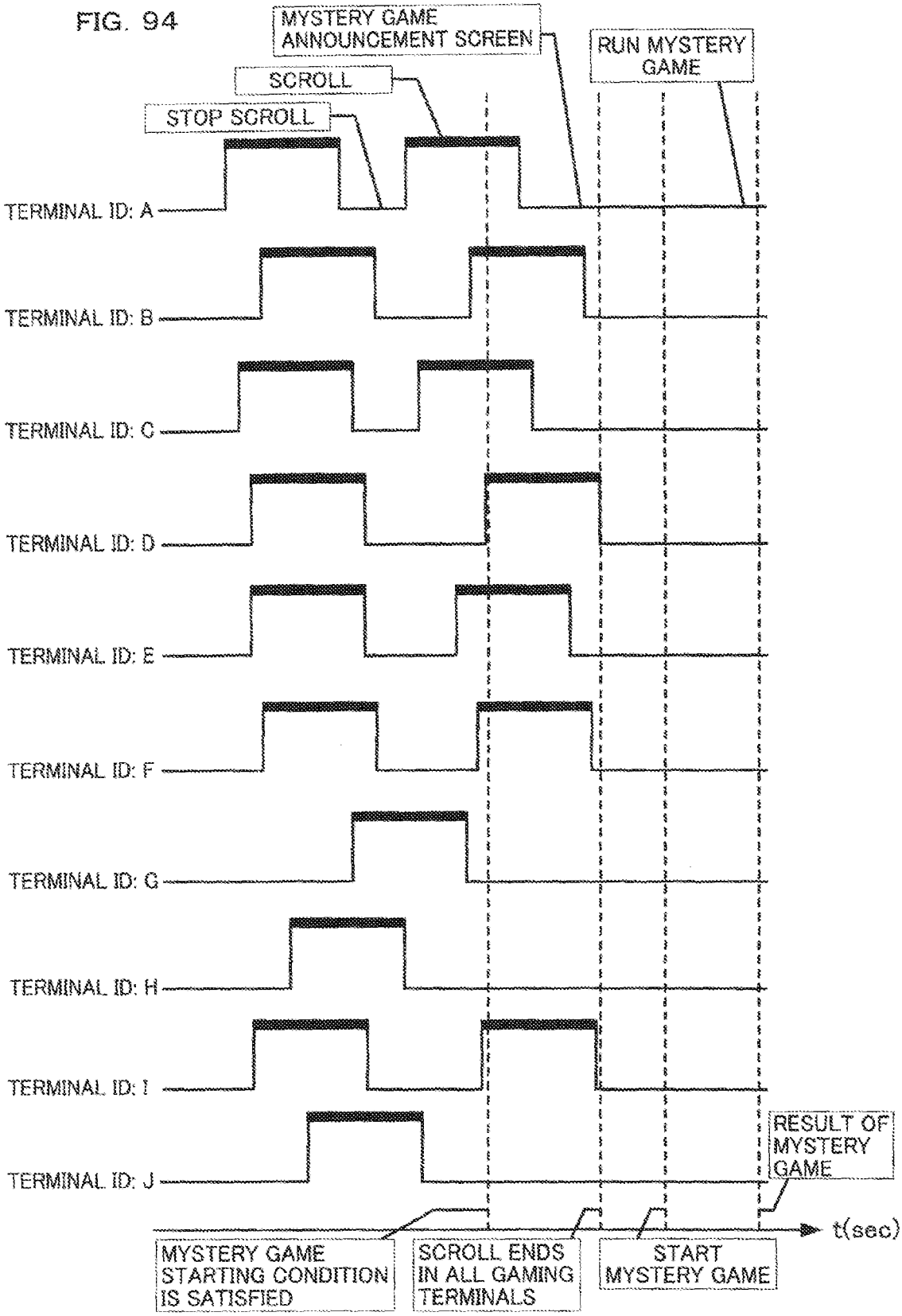
FIG. 94 is a diagram illustrating a timing chart in action of a mystery game.

FIG. 94 is a diagram illustrating a timing chart in action of a mystery game. As shown in FIG. 94, in each of ten gaming terminals 10 (having terminal codes A to J), symbols 180 are repeatedly scrolled and stopped during the base game. When the mystery game starting condition is satisfied, that is, when the total progressive value exceeds the mystery game start value, the mystery game announcement image is displayed on the terminal displays 101 (upper image display panels 33) of the gaming terminals 10, sequentially from the gaming terminal 10 in which scroll of the symbols 180 is stopped. In a case of FIG. 94, at the time when the mystery game starting condition is satisfied, the gaming terminals 10 with terminal codes G, H, and J do not yet start scrolling symbols. Therefore, in these gaming terminals 10, the mystery game announcement image is displayed on the terminal displays 101 (upper image display panels 33), without scrolling symbols thereafter.

Then, in all the gaming terminals 10, scroll of the symbols 180 is stopped (in the case of FIG. 94, the gaming terminal 10 with the terminal code D is the last to stop the scroll), and the mystery game announcement image is displayed on the terminal displays 101 (upper image display panels 33). In this case, after a predetermined period of time elapses since then, a mystery game is started all at once in all the gaming terminals 10. Then, after a predetermined period of time elapses since the mystery game is started, a result of the mystery game is displayed in all the gaming terminals 10. In each gaming terminal 10, a mystery bonus is awarded in accordance with the result of the mystery game.

Like this, in all the gaming terminals 10, the mystery game is run all at once after the base game ends. Accordingly, a player can share his/her expectation for the mystery bonus with other players. In addition, the gaming terminals 10, sequentially from the one having ended the base game, have the mystery game announcement image displayed on the terminal displays 101 (upper image display panels 33). This can give a player expectation for the mystery game starting soon, even before the other gaming terminals 10 end the base game. Like this, a player may enjoy the mystery game with sympathy with players playing on the other gaming terminals 10, as compared with when the mystery game is individually run in one gaming terminal 10 independently of in another gaming terminal 10.

[Operation of Gaming Machine 1: Boot Process]

The following describes a boot process which takes place in the gaming machine 1. Upon powering on the gaming machine 1, a boot process routine shown in FIG. 95 starts in the motherboard 240 and the gaming board 250 in the center controller 200, and in the motherboard 40 and the gaming board 50 in the terminal controller 100. The memory cards 53 and 253 are assumed to be inserted into the card slots 53S and 253S of the gaming boards 50 and 250, respectively. Further, the GALs 54 and 254 are assumed to be attached to the IC sockets 54S and 254S, respectively.

First, turning on power switches of (powering on) the power units 45 and 245 boots the motherboards 40 and 240, and the gaming boards 50 and 250. Booting the motherboards 40 and 240 and the gaming boards 50 and 250 starts separate processes in parallel. Specifically, in the gaming board 50 and 250, the CPUs 51 and 251 read out preliminary authentication programs stored in the boot ROMs 52 and 252, respectively. Then, preliminary authentication is performed according to the read out programs so as to confirm and authenticate that no modification is made to authentication programs, before reading them in the motherboards 40 and 240, respectively (S1). Meanwhile, the main CPUs 41 and 241 of the motherboards 40 and 240 run BIOS stored in the ROMs 42 and 242 to load into the RAMs 43 and 243 compressed data built in the BIOS, respectively (S2). Then, the main CPUs 41 and 241 run a procedure of the BIOS according to the data loaded into the RAMs 43 and 243 so as to diagnose and initialize various peripheral devices (S3).

The main CPUs 41 and 241, which are respectively connected to the ROMs 55 and 255 of the gaming boards 50 and 250 via PCI buses, read out authentication programs stored in the ROMs 55 and 255 and store them in the RAMs 43 and 243 (S4). During this step, the main CPUs 41 and 241 each derives a checksum through ADDSUM method (a standard check function) which is adopted in a standard BIOS, and store the authentication programs into RAMs 43 and 243 while confirming if storing is carried out without an error.

Next, the main CPUs 41 and 241 each checks what connects to the IDE bus. Then, the main CPUs 41 and 241 access, via the IDE buses, to the memory cards 53 and 253 inserted into the card slots 53S and 253S, and read out game programs and game system programs from the memory cards 53 and 253, respectively. In this case, the CPUs 41 and 241 each reads out four bytes of data constituting the game program and the game system program at one time. Next, according to the authentication programs stored in the RAMs 43 and 243, the main CPUs 41 and 241 authenticate the game program and the game system program read out to confirm and prove that these programs are not modified (S5).

When the authentication properly ends, the main CPUs 41 and 241 write and store the authenticated game programs and game system programs in RAMs 43 and 243 (S6).

Next, the main CPUs 41 and 241 access, via the PCI buses, to the GALs 54 and 254 attached to the IC sockets 54S and 254S, and read out payout rate setting data from the GALs 54 and 254, respectively. The payout rate setting data read out are then written and stored in the RAMs 43 and 243 (S7).

Next, the main CPUs 41 and 241 read out, via the PCI buses, country identification information stored in the ROMs 55 and 255 of the gaming boards 50 and 250, respectively. The country identification information read out is then stored in the RAMs 43 and 243 (S8).

Figure 96:
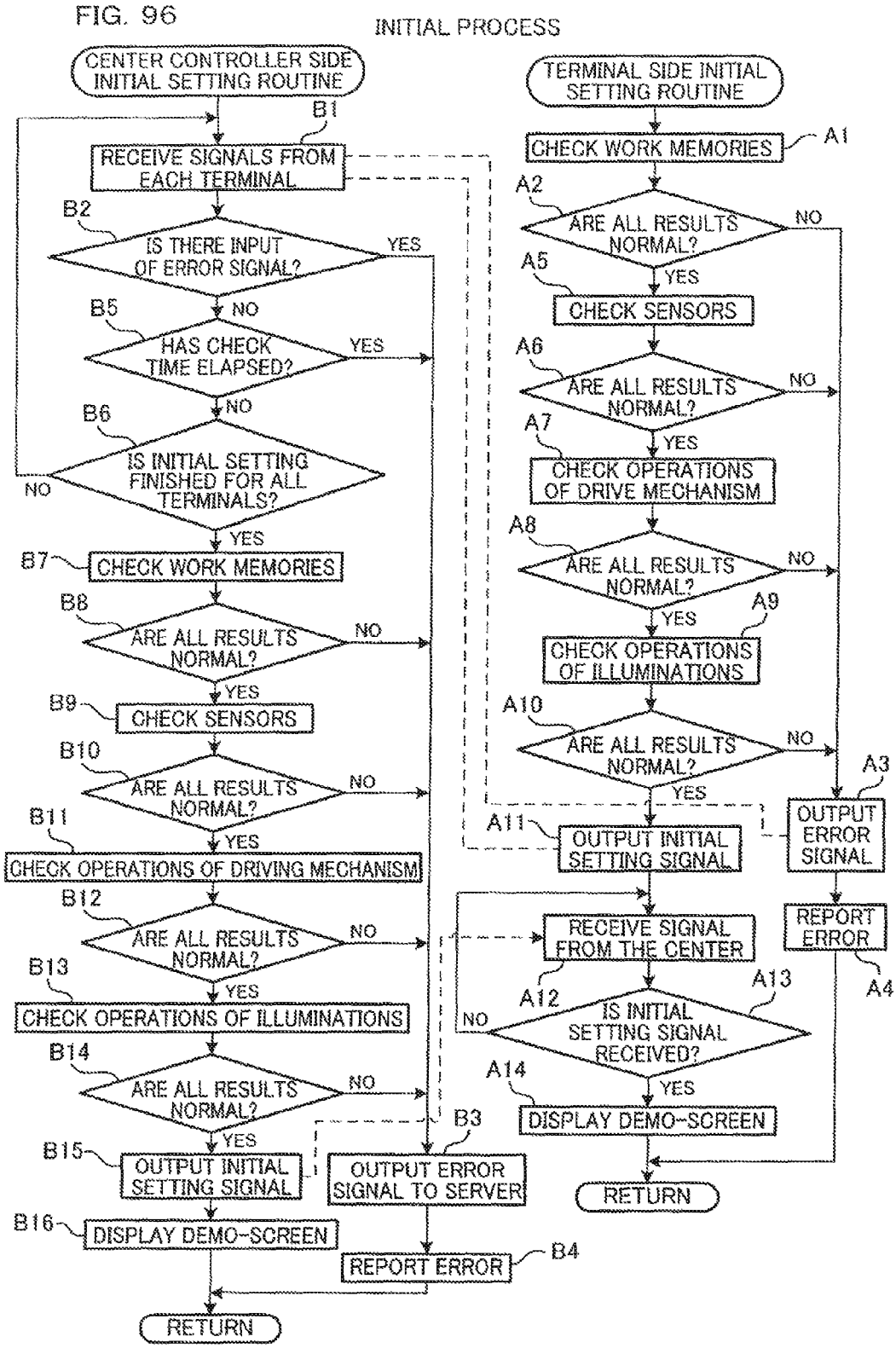
FIG. 96 is a flowchart illustrating an initial process executed by the gaming terminal and the center controller.

After this, the main CPUs 41 and 241 each performs an initial process of FIG. 96.

[Operation of Gaming Machine 1: Initial Process]

Figure 95:
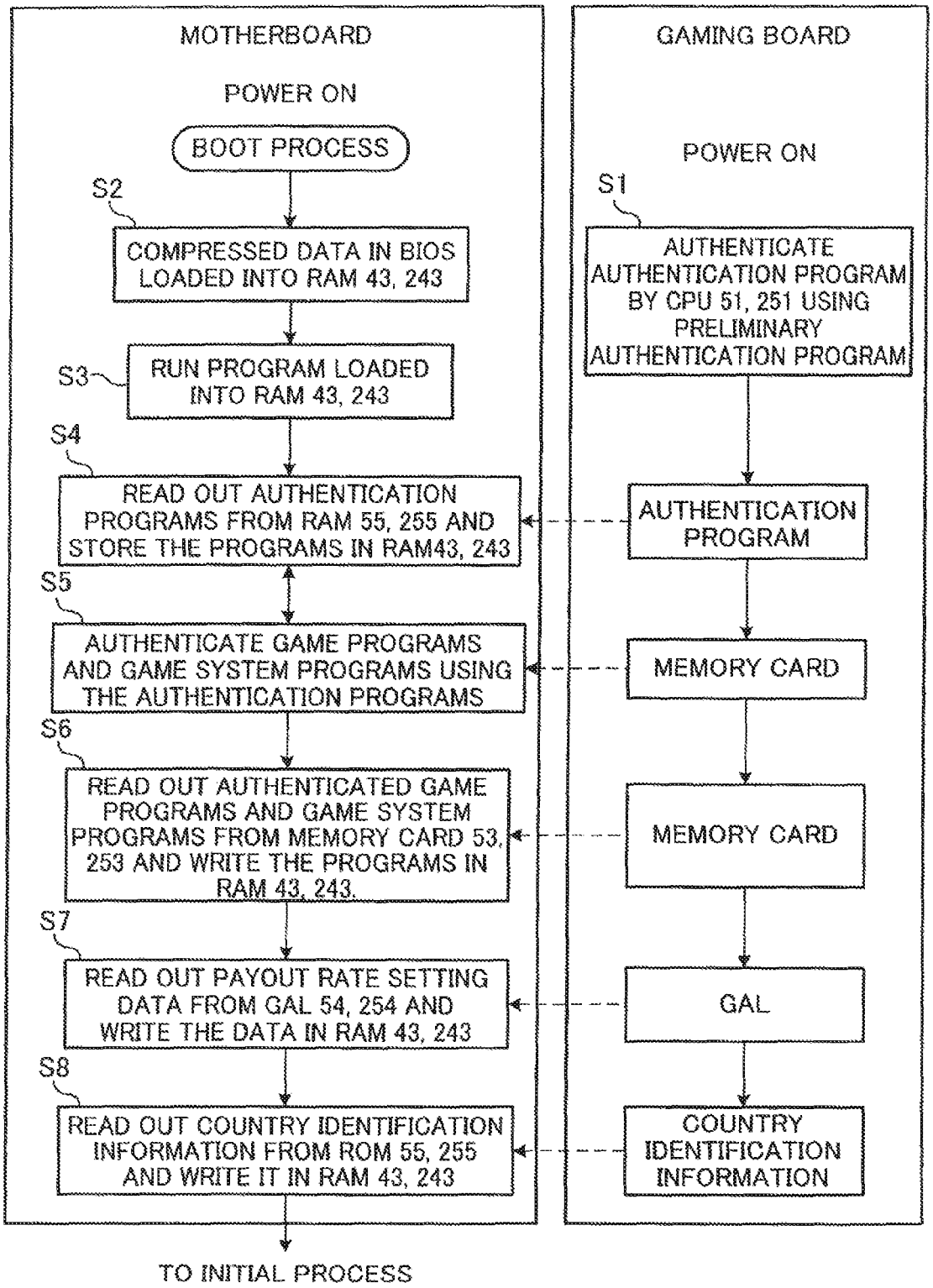
FIG. 95 is a flow chart illustrating a boot process executed by the gaming terminal and the center controller.

The following describes an initial process which takes place in the gaming machine 1. When the boot process of FIG. 95 is completed, the center controller 200 reads out from the RAM 243 a center controller side initial setting routine illustrated in FIG. 96 and executes the routine. Meanwhile, the gaming terminal 10 reads out from the RAM 43 a terminal side initial setting routine illustrated in FIG. 96 and executes the routine. The center controller side and terminal side initial setting routines are executed in parallel.

First, the main CPU 41 of the gaming terminal 10 checks operations of work memories such as the RAM 43 (A1). Then, the main CPU 41 determines if all the check results are normal (A2). If the main CPU 41 determines that the check results contains an error (A2: NO), the main CPU 41 outputs a signal notifying the error (hereinafter, error signal) to the center controller 200 (A3). Further, the main CPU 41 reports the error in the form an alarm sound from a speaker 29 or the like (A4), and then ends the routine.

In A2, on the other hand, if the main CPU 41 determines that all the check results are normal (A2: YES), the main CPU 41 checks operations of various sensors (A5). Then, the main CPU 41 determines if all the check results are normal (A6). If the main CPU 41 determines the check results contain an error (A6: NO), the main CPU 41 executes A3.

On the other hand in A6, if the main CPU 41 determines that all the check results are normal (A6: YES), the main CPU 41 checks operations of various driving mechanisms (A7) Then, the main CPU 41 determines if all the check results are normal (A8) If the main CPU 41 determines the check results contain an error (A8: NO), the main CPU 41 executes A3.

In A8, on the other hand, if the main CPU 41 determines that all the check results are normal (A8: YES), the main CPU 41 checks operations of various illuminations (A9) Then, the main CPU 41 determines if all the check results are normal (A10) If the main CPU 41 determines the check results contain an error (A10: NO), the main CPU 41 executes A3.

If the main CPU 41 determines that all the check results are normal (A10: YES) after the above process of checking operations of various functions through A1 to A10, the main CPU 41 outputs an initial setting signal to the center controller 200 (A11). Then, an initial setting signal is waited from the center controller 200 (A12, A13: NO).

The main CPU 241 of the center controller 200 receives signals from each of the gaming terminals 10 (B1). Then, the main CPU 241 determines whether a signal received is an error signal (B2). If the main CPU 241 determines that the signal is an error signal (B2: YES), the main CPU 241 outputs an error signal to a not-shown server such as a host computer or the like (B3) to report the error (B4), and ends the routine.

In B2, on the other hand, if the main CPU 241 determines that the signal is not an error signal (B2: NO), the main CPU 241 determines whether a predetermined time (check time) has elapsed from the time of powering on (B5). If the main CPU 241 determines that the check time has elapsed (B5: YES), B3 is executed. On the other hand, if the main CPU 241 determines that the check time has not yet elapsed (B5: NO), it is determined whether an initial setting signal is received from each of the gaming terminals 10 (B6). If the main CPU 241 determines that an initial setting signal from any one of the gaming terminals 10 is not received (B6: NO), the process returns to B1.

On the other hand if the main CPU 241 determines that an initial setting signal is received from every gaming terminal 10 (B6: YES), the main CPU 241 checks operations of work memories such as the RAM 243 (B7). Then, the main CPU 241 determines whether all the check results are normal (B8) If the main CPU 241 determines the check results contain an error (B8: NO), the main CPU 241 executes B3.

In B8, on the other hand, if the main CPU 241 determines that all the check results are normal (B8: YES), the main CPU 241 checks operations of various sensors (B9). Then, the main CPU 241 determines whether all the check results are normal (B10). If the main CPU 241 determines the check results contain an error (B10: NO), the main CPU 241 executes B3.

On the other hand in B10, if the main CPU 241 determines that all the check results are normal (B10: YES), the main CPU 241 checks operations of various driving mechanisms (B11). Then, the main CPU 241 determines whether all the check results are normal (B12). If the main CPU 241 determines the check results contain an error (B12: NO), the main CPU 241 executes B3.

In B12, on the other hand, if the main CPU 241 determines that all the check results are normal (B12: YES), the main CPU 241 checks operations of various illuminations (B13) Then, the main CPU 241 determines whether all the check results are normal (B14). If the main CPU 241 determines the check results contain an error (B14: NO), the main CPU 241 executes B3.

If the main CPU 241 determines that all the check results are normal (B14: YES) after the above process of checking operations of various functions through B7 to B14, the main CPU 241 outputs an initial setting signal to all the gaming terminals 10 (B15), and causes the shared display 510 to display a demo-screen (B16). Then, the main CPU 241 ends the routine.

In A12, the main CPU 41 of each of the gaming terminals 10 determines that an initial setting signal is received from the center controller 200 (A13: YES), and causes the terminal display 101 to display a demo-screen (A14). The main CPU 41 then ends the routine.

[Operation of Gaming Terminal 10: Game Running Process Routine]

Figure 97:
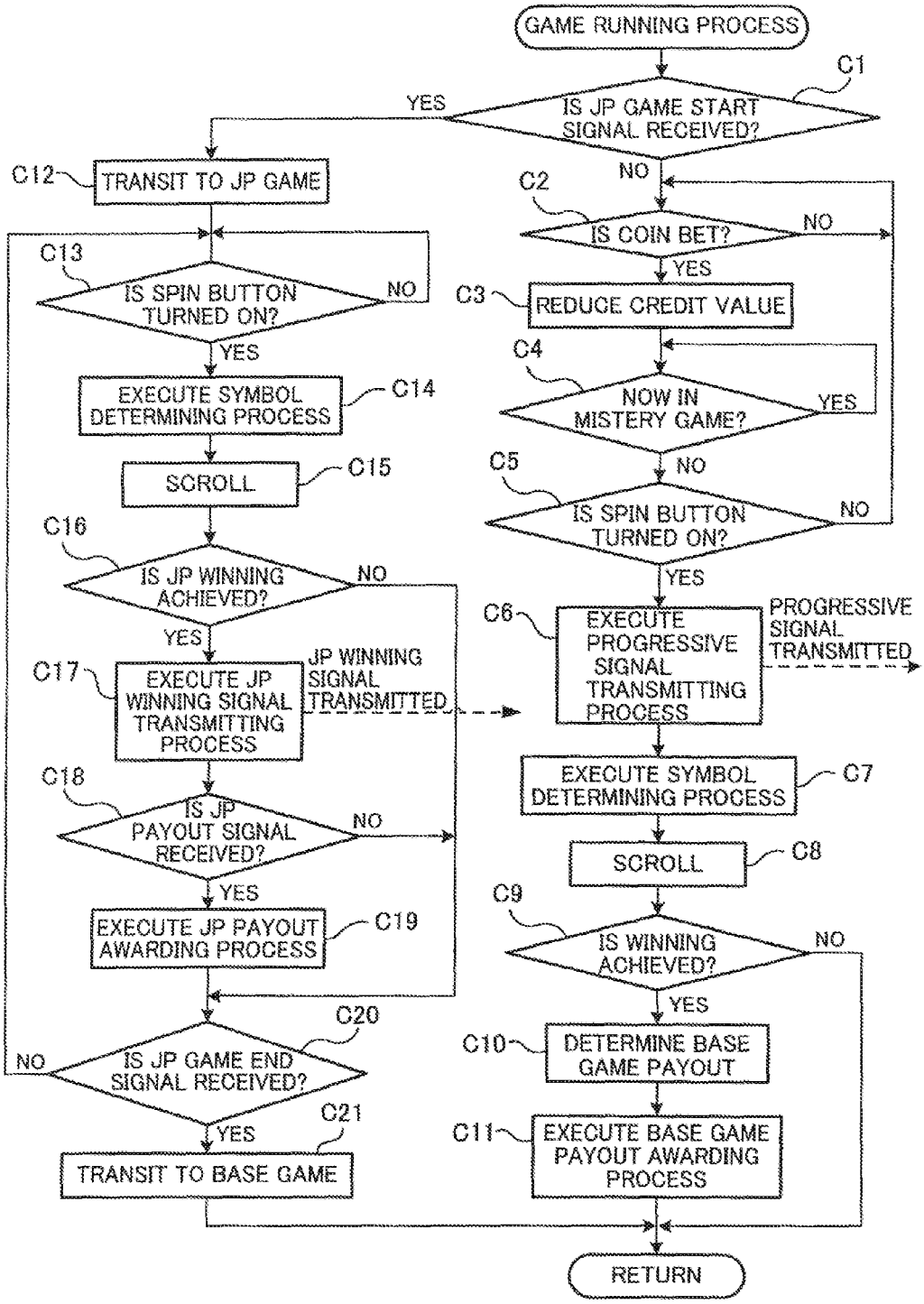
FIG. 97 is a flowchart illustrating a game running process routine executed in the gaming terminal.

After the terminal side initial setting routine of FIG. 96, the main CPU 41 of the gaming terminal 10 performs a game running process routine of FIG. 97. Through this game running process routine executed by the main CPU 41, a game is progressed.

As illustrated in FIG. 97, whether or not a JP game start signal is received from the center controller 200 is determined in the game running process routine (C1). If no JP game start signal is received (C1: NO), whether or not a bet of a coin is made is determined (C2). In this step, whether a signal from the 1-BET switch 26S entered by pressing of the 1-BET button 26 is received or not is determined. Meanwhile, whether a signal from the maximum BET switch 27S entered by pressing of the maximum BET button 27 is received or not is determined. If no coin is BET (C2: NO), C2 is repeated until a coin is bet.

On the other hand, if a coin is bet (C2: YES), the credit value stored in the RAM 43 is reduced according to the number of coins bet (C3). When the number of coins bet is greater than the number of coins equivalent to the credit value stored in the RAM 43, the process goes to a later-described step C4 without reduction of the credit value. When the number of coins bet exceeds the maximum number of coins bettable in one game (50 pieces in this embodiment), the process goes to the step C4 without reduction of the credit value.

Then, whether a mystery game is being run or not is determined (C4). When it is determined that a mystery game is being run (C4: YES), the step C4 is repeated to continue a standby state until the mystery game ends. When it is determined that a mystery game is not being run (C4: NO), the process goes to a step C5 which will be detailed later.

Then, whether the spin button 23 is turned on or not is determined (C5). When the spin button 23 is not turned on (C5: NO), the process returns to C2. Here, in the case where the spin button 23 is not turned on (for example, a command to end the game is input without turning on of the spin button 23), the reduction of the credit value performed in C3 is canceled.

On the other hand, when the spin button 23 is turned on (C5: YES), a progressive signal transmitting process is executed (C6). That is, a progressive signal indicative of a progressive value having been bet is transmitted to the center controller 200.

Next executed is a symbol determining process for a base game (C7). That is, the stop symbol determining program stored in the RAM 43 is run to determine symbols 180 to be arranged in the matrix 156. Through this, a symbol combination to be formed along the payline L is determined.

Then, a scrolling process is executed to scroll symbols 180 on the lower image display panel 16 (C8). In the scrolling process, symbols 180 are scrolled in a direction indicated by an arrow symbol, and then the symbols 180 determined in C7 are stopped (rearranged) in the matrix 156.

Next, whether a combination of symbols 180 rearranged in the matrix 156 achieves a winning or not is determined (C9). If it is determined that a winning is achieved (C9: YES), a payout for the winning achieved in the base game is determined (C10). Next executed is a process of awarding the payout determined in C10 (C11). More specifically, the number of coins according to the winning is calculated. On the other hand, if it is determined that no winning has been achieved (C9: NO), this routine is ended.

In C1, if a JP game start signal is received from the center controller 200 (C1: YES), a JP game is run instead of the base game (C12).

Then, whether the spin button 23 is turned on or not is determined (C13). When the spin button 23 is not turned on (C13: NO), a standby state continues until the spin button 23 is turned on.

On the other hand, when the spin button 23 is turned on (C13: YES), the symbol determining process for a JP game is executed (C14). Then, a scrolling process is executed to scroll symbols 180 on the lower image display panel 16 (C15).

Next, whether a combination of symbols 180 rearranged in the matrix 156 achieves a JP winning or not is determined (C16). When it is determined that no JP winning has been achieved (C16: NO), whether or not a JP game end signal is received from the center controller 200 is determined (C20)

When it is determined that no JP game end signal is received (C20: NO), the step C13 is re-executed. On the other hand, when it is determined that a JP game end signal is received (C20: YES), the JP game ends and a transition to the base game occurs (C21). Then, this routine ends.

In C16, on the other hand, when it is determined that a JP winning is achieved (C16: YES), a JP winning signal is transmitted to the center controller 200 (C17). Next, whether or not a JP payout signal is received from the center controller 200 is determined (C18). If it is determined that no JP payout signal is received (C18: NO), a step C20 is executed. If it is determined that a JP payout signal is received (C18: YES), a JP payout is awarded based on the information in the JP payout signal (C19). At that time, the upper image display panel 33 of the gaming terminal 10B displays an image showing that a Jackpot has been achieved. Then, the step C20 is executed.

[Operation of Gaming Terminal 10: Mystery Game Running Process Routine]

Figure 98:
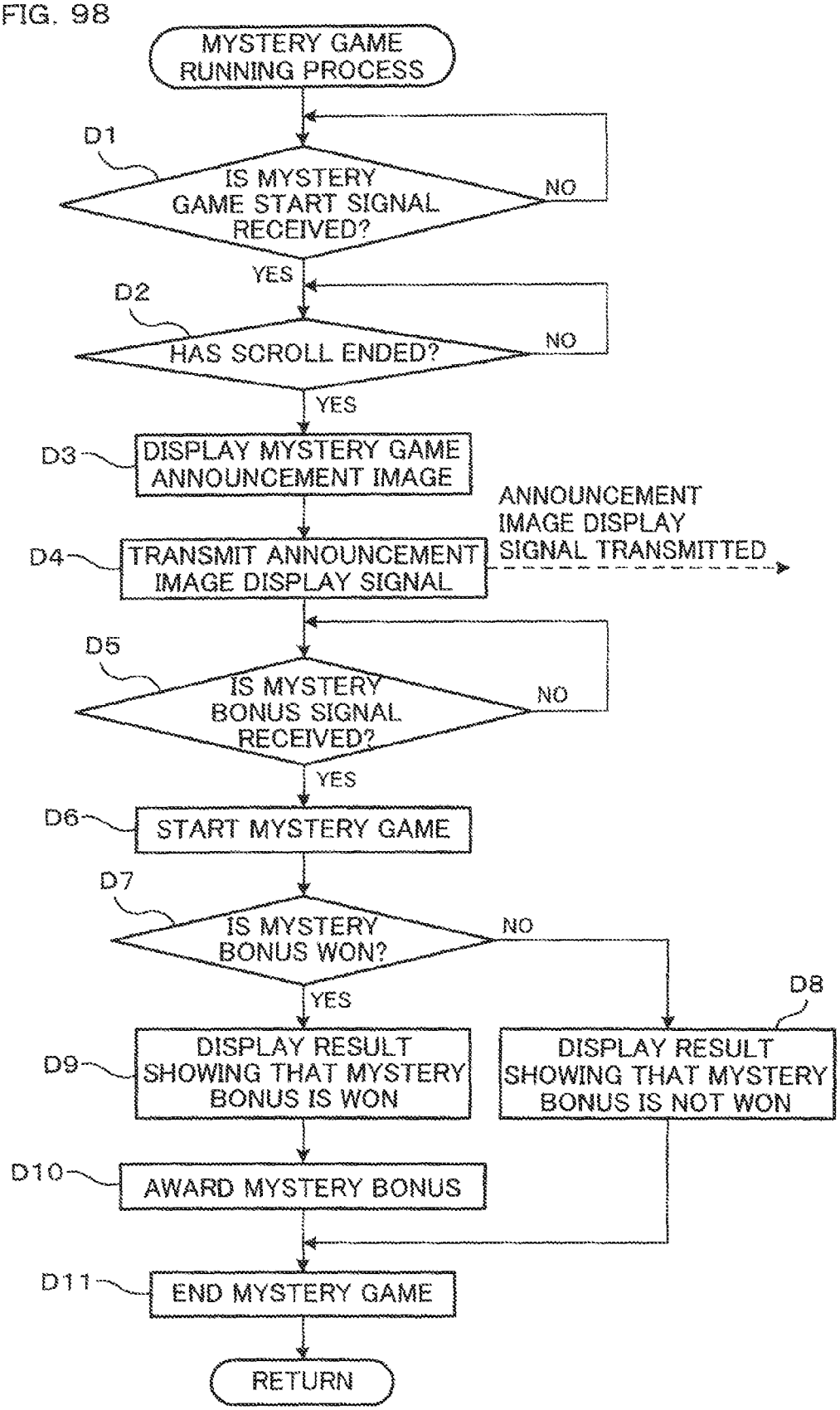
FIG. 98 is a flowchart illustrating a mystery game running process routine executed in the gaming terminal.

FIG. 98 shows a mystery game running process routine executed in the gaming terminal 10. When the main CPU 41 of the gaming terminal 10 runs a mystery game running process routine, whether a mystery game start signal is received from the center controller 200 or not is first determined (D1). When it is determined in D1 that a mystery game start signal is not received (D1: NO), reception of a mystery game start signal is waited (D1).

When it is determined in D1 that a mystery game start signal is received (D1: YES), whether scroll of symbols 180 on the lower image display panel 16 has ended or not is determined (D2). When it is determined in D2 that scroll of symbols 180 has not ended yet (D2: NO), a standby state continues until scroll of the symbols 180 ends (D2) When it is determined in D2 that scroll of symbols 180 has ended (D2: YES), a mystery game announcement image is displayed on the upper image display panel 33 (D3). Then, an announcement image display signal is transmitted to the center controller 200 (D4).

Then, whether a mystery bonus signal is received from the center controller 200 or not is determined (D5). When it is determined in D5 that a mystery bonus signal is not received (D5: NO), reception of a mystery bonus signal is waited (D5). During this waiting time, the mystery game announcement image is displayed on the upper image display panel 33, and a base game is not run. When it is determined in D5 that a mystery bonus signal is received (D5: YES), a mystery game is started (D6).

Then, whether a mystery bonus is won or not is determined based on information included in the mystery bonus signal thus received (D7). When it is determined that a mystery bonus is not won (D7: NO), the upper image display panel 33 displays thereon a result showing that a mystery bonus is not won (D8). Then, the mystery game ends (D11), and this routine ends.

When it is determined that a mystery bonus is won (D7: YES), the upper image display panel 33 displays thereon a result showing that a mystery bonus is won (D9), and a mystery bonus is awarded (D10). Then, the mystery game ends (D11), and this routine ends.

[Operation of Center Controller 200: Progressive Value Adding Process Routine]

Figure 99:
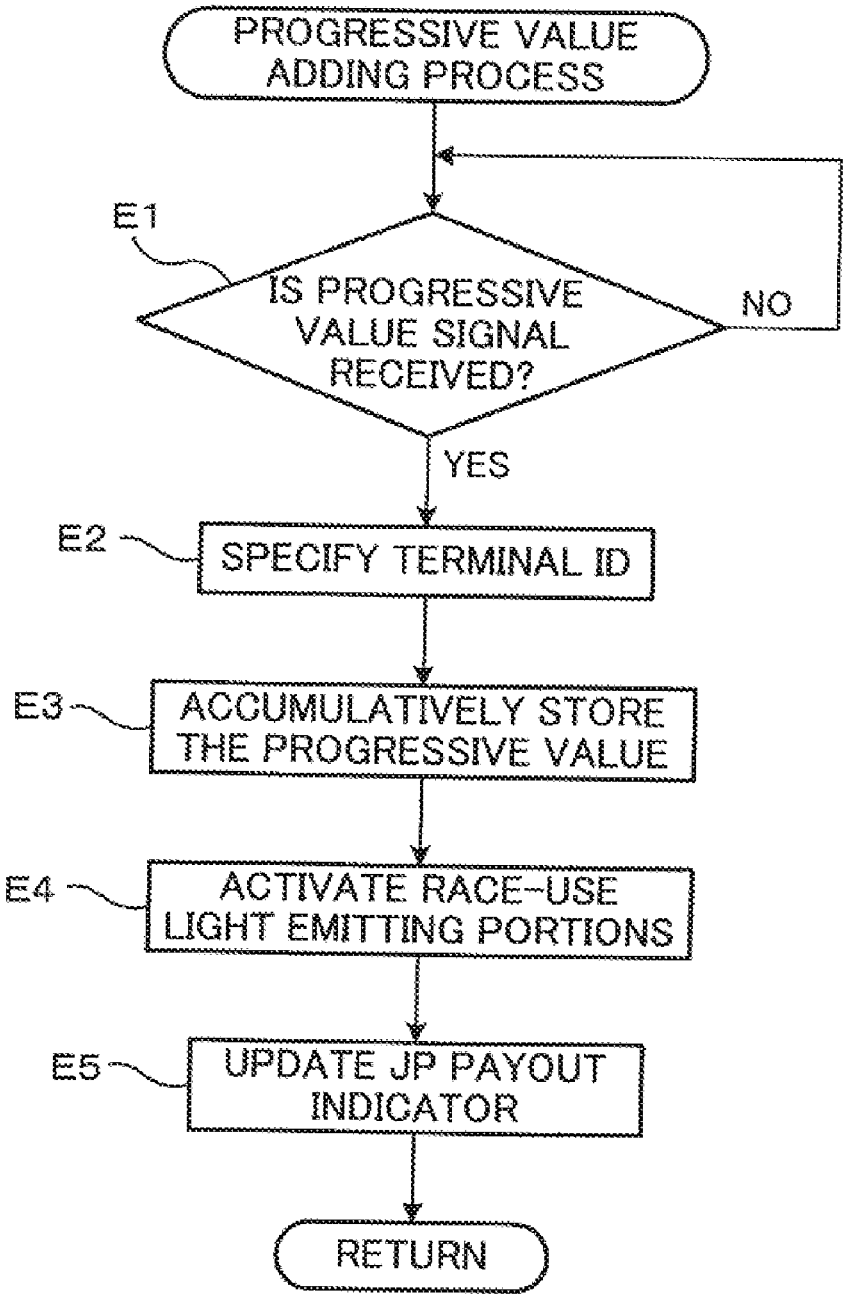
FIG. 99 is a flowchart illustrating a progressive value adding process routine executed in the center controller.

FIG. 99 illustrates a progressive value adding process routine taking place in the center controller 200. When the progressive value adding process routine is executed, the center controller 200 determines whether or not a progressive signal is received from the terminal controller 100 of a gaming terminal 10 (E1). When the center controller 200 determines that no progressive signal is received (E1; NO), the progressive signal is waited (E1).

In E1, if the center controller 200 determines that a progressive signal is received from the terminal controller 100 (E1: YES), a terminal code assigned to the gaming terminal 10 having sent the progressive signal is specified based on the progressive signal received (E2), and the progressive value obtained is accumulatively stored in the RAM 243 (E3). Next, according to the amount of the progressive value obtained, a predetermined number of the race-use light emitting portions 2 associated with the gaming terminal 10 specified in E1 are turned active (E4). Further, a total of progressive values obtained from all the gaming terminals 10, which is displayed on the JP payout indicator 400, is updated (E5). Then, this routine ends.

[Operation of Center Controller 200: JP Game Running Process Routine]

Figure 100:
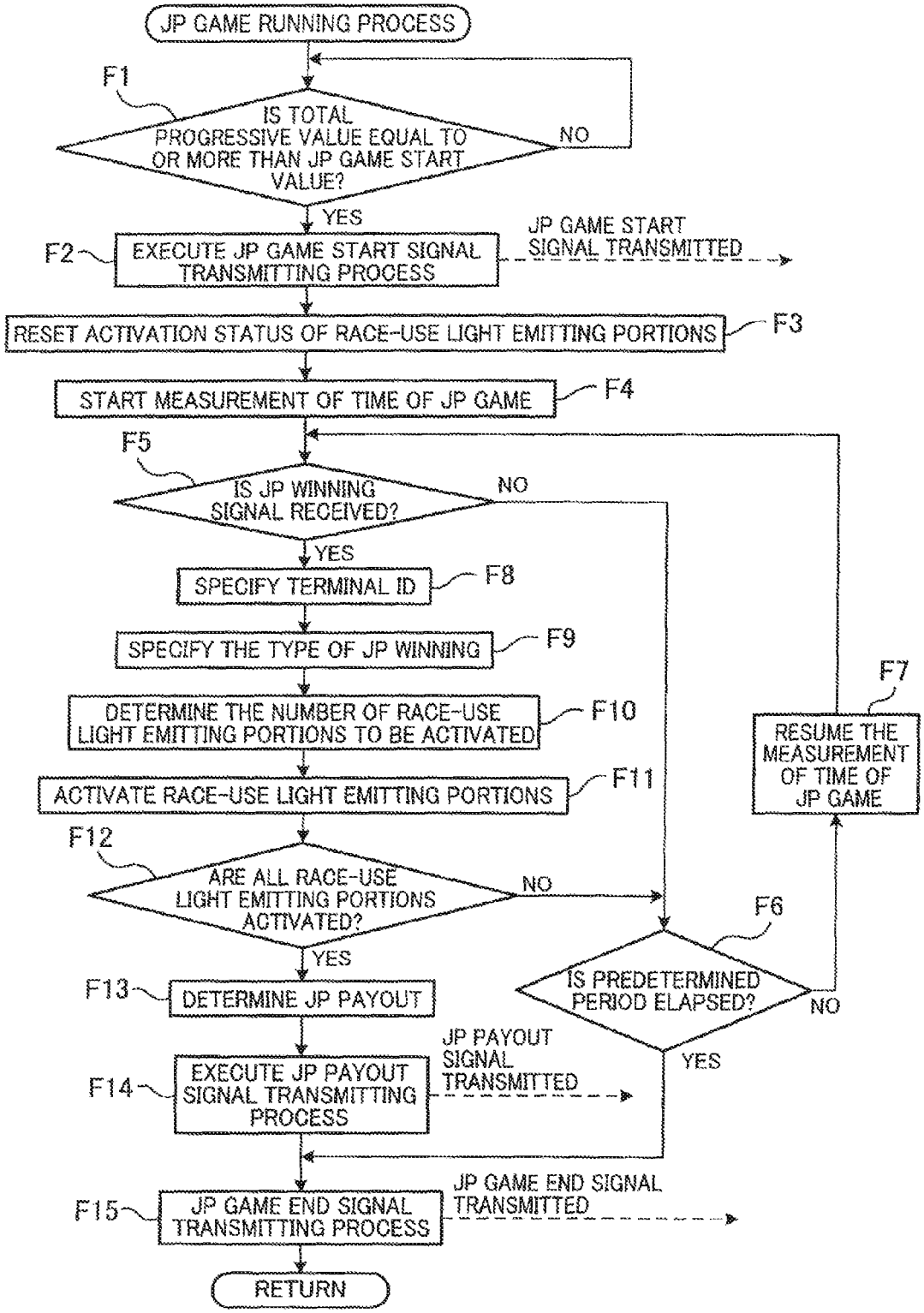
FIG. 100 is a flowchart illustrating a JP game running process routine executed by the center controller.

FIG. 100 illustrates a JP game running process routine which takes place in the center controller 200. When the JP game running process routine is executed, the center controller 200 refers to the "total progressive value" field of the progressive value table which is stored in the RAM 243, so as to determine whether or not a total of the progressive values obtained from the gaming terminals 10 is equal to or greater than the JP game start value (F1). If it is determined that the total is less than the JP game start value (F1: NO), the step F1 is repeated until the total reaches the JP game start value or higher.

If it is determined that the total is equal to or greater than the JP game start value (F1: YES), a JP game start signal is transmitted to all the gaming terminals 10 (F2). The JP game start signal includes information for starting a JP game.

Then, activation of the race-use light emitting portions 2, which were activated when the progressive value was obtained during the base game, is rest (F3). Then, time measurement of the JP game starts (F4).

Next, whether or not a JP winning signal is received from any of the gaming terminals 10 is determined (F5). If it is determined that no JP winning signal is received (F5: NO), whether a predetermined period has elapsed since the start of the time measurement in F4 is determined (F6). If it is determined that the predetermined period has not yet elapsed (F6: NO), the time measurement resumes (F7), and the process returns to F5. On the other hand, if it is determined that the predetermined period has elapsed (F6: YES), a JP game end signal is transmitted to all the gaming terminals 10 (F15). Then, this routine ends.

If it is determined that a JP winning signal is received from a gaming terminal 10 (F5: YES), the terminal code of the gaming terminal 10 is specified based on the JP winning signal received (F8). Further, a combination of the JP winning formed in the JP game played on the gaming terminal 10 is derived based on the JP winning signal received (F9). Then, the number of race-use light emitting portions 2 to be activated is determined (F10), and the race-use light emitting portions 2 are activated (F11).

Next, by activating the race-use light emitting portions 2 in F11, whether or not all the race-use light emitting portions 2 are turned active is determined (F12). In other words, whether or not the race-use light emitting portions 2, in F11, have turned active all the way to the JP payout indicator 400 along the race line unit 300 is determined. If it is determined that not all the race-use light emitting portions 2 have turned active (F12: NO), whether or not the JP game has been run for a predetermined period in F6 is determined. If it is determined that all the race-use light emitting portions 2 have turned active (F12: YES), a JP payout is determined based on a total of the accumulated progressive values (F13). Next, a JP payout signal containing information of the JP payout determined in F13 is transmitted to the gaming terminal 10 specified in F8 (F14). Then, a JP game end signal is transmitted (F15), and this routine ends.

[Operation of Center Controller 200: Mystery Game Running Process Routine]

Figure 101:
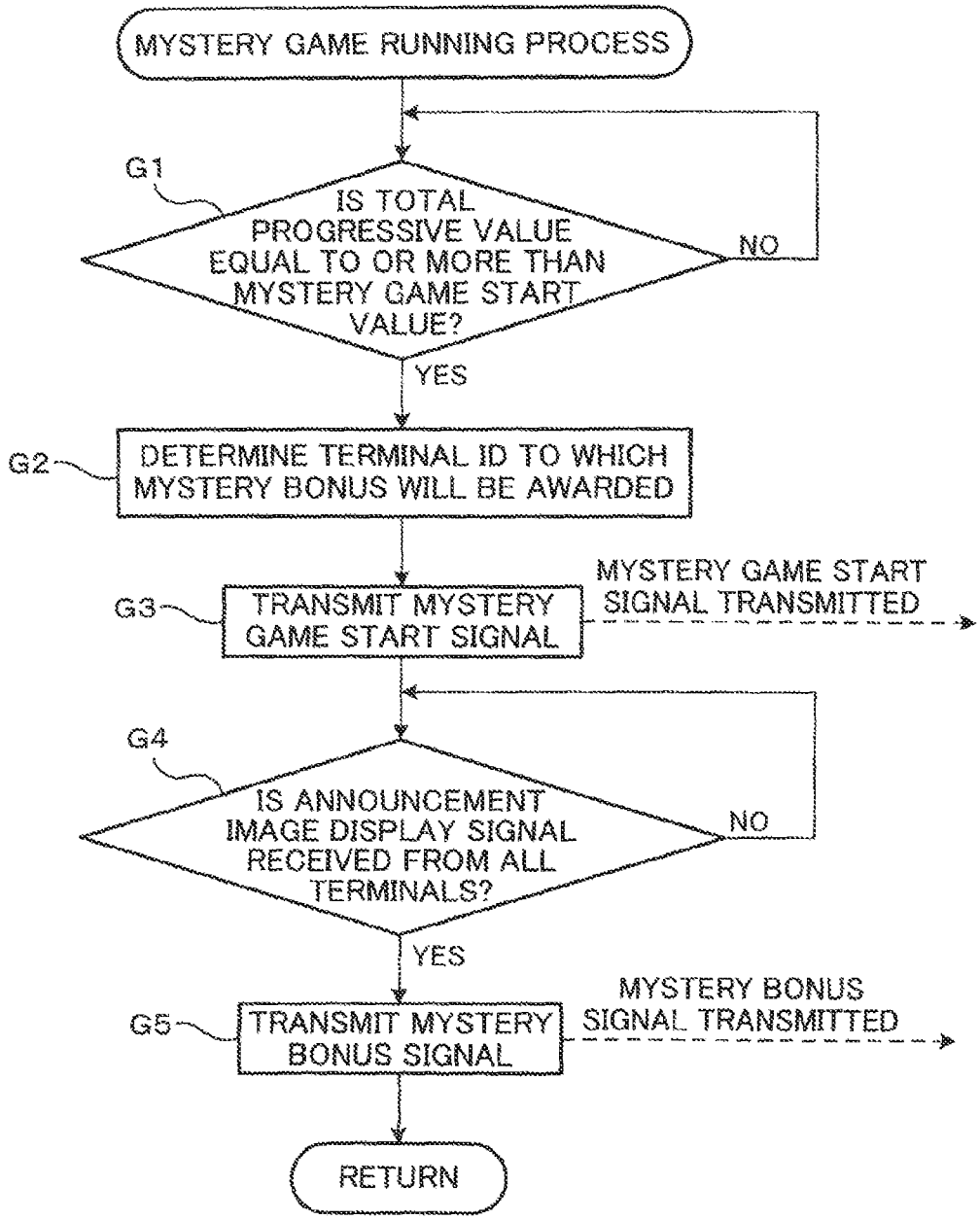
FIG. 101 is a flowchart illustrating a mystery game running process routine executed in the center controller.

FIG. 101 shows a mystery game running process routine executed in the center controller 200. When a mystery game running process routine is executed, the center controller 200 refers to the "total progressive value" field of the progressive value table which is stored in the RAM 243, so as to determine whether or not a total of the progressive values obtained from the gaming terminals 10 is equal to or greater than the mystery game start value (G1). If it is determined that the total is less than the mystery game start value (G1: NO), the step G1 is repeated until the total reaches the mystery game start value or higher.

If it is determined that the total is equal to or greater than the mystery game start value (G1: YES), a terminal code of a gaming terminal to which a mystery bonus is awarded is determined (G2). Then, a mystery game start signal is transmitted to all the gaming terminals 10 (G3).

Then, whether an announcement image display signal is received from all the gaming terminals 10 or not is determined (G4). When it is determined that an announcement image display signal is not received from all the gaming terminals 10 (G4: NO), the process returns to the step G4, and a standby state continues until an announcement image display signal is received from all the gaming terminals 10 (G4).

When it is determined that an announcement image display signal is received from all the gaming terminals 10 (G4: YES), a mystery bonus signal is transmitted to all the gaming terminals 10 (G5). Then, this routine ends.

By the above-described operations of the gaming machine, the base game is run in each of the gaming terminals 10. When the total progressive value exceeds the mystery game start value, whether the base game being run has ended or not is determined in each gaming terminal 10. Then, the gaming terminals 10, sequentially from the one having determined that the base game has ended, have the mystery game announcement image displayed on their terminal displays 101 (upper image display panels 33). When the mystery game announcement image is displayed on the terminal displays 101 (upper image display panels 33) of all the gaming terminals 10, the mystery game is run all at once in all the gaming terminals 10. When the mystery game is run all at once, a mystery bonus is awarded to each gaming terminal 10 in accordance with a result of the mystery game. Thus, in all the gaming terminals 10, the mystery game is run all at once after the base game ends. Accordingly, a player can share his/her expectation for the mystery bonus with other players. In addition, the gaming terminals 10, sequentially from the one having ended the base game, have the mystery game announcement image displayed on the terminal displays 101. This can give a player expectation for the mystery game starting soon, even before the other gaming terminals 10 end the base game. Like this, a player may enjoy the mystery game with sympathy with players playing on the other gaming terminals 10, as compared with when the mystery game is individually run in one gaming terminal 10 independently of in another gaming terminal 10.

In the above, the embodiment 4-1 of the present invention was described. The present invention, however, is not limited to the embodiment described above.

Embodiment 4-2

Figure 102:
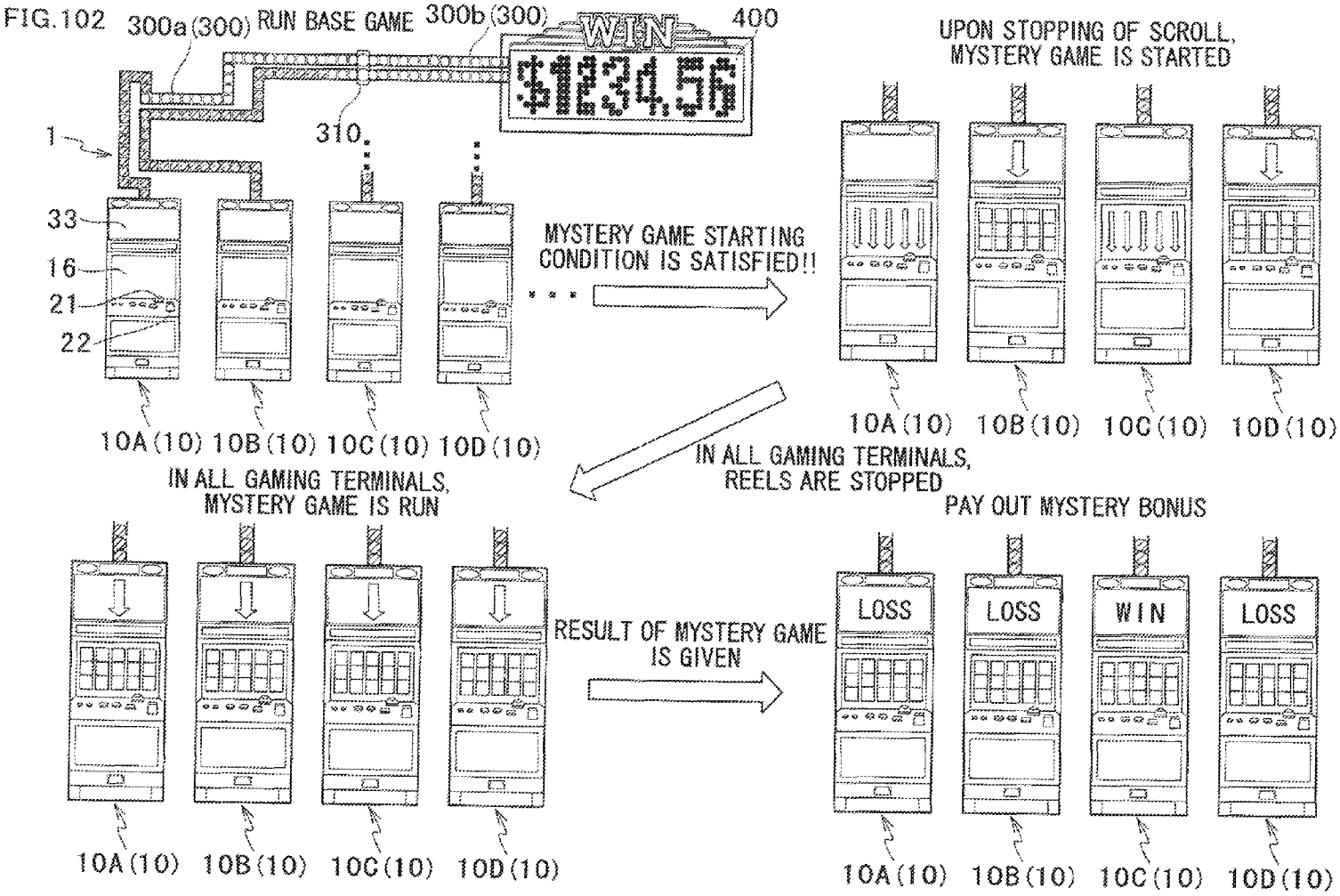
FIG. 102 is an explanatory diagram illustrating a gaming machine and a playing method thereof, according to an embodiment 4-2 of the present invention.

In the following, the embodiment 4-2 of the present invention will be described. FIG. 102 is an explanatory diagram illustrating a gaming machine 1 and a playing method thereof, according to the embodiment 4-2 of the present invention.

As shown in FIG. 102, a gaming machine 1 according to the embodiment 4-2 of the present invention includes a plurality of gaming terminals 10 and a center controller 200. Each of the gaming terminals 10 includes a terminal controller 100 and runs a base game to award a payout corresponding to a predetermined winning and a mystery game to award a mystery bonus which is greater than the payout of the base game. The terminal controller 100 is programmed to perform the steps of: (c1) running the base game and awarding a payout corresponding to a predetermined winning, independently of another terminal controller 100 of another gaming terminal 10; (c2) determining whether the base game has ended or not, based on a mystery game start signal from the center controller 200; (c3) running the mystery game, when it is determined that the base game has ended; and (c4) awarding the mystery bonus in accordance with a result of the mystery game, based on a mystery bonus signal from the center controller 200. The center controller 200 is programmed to perform the steps of: (d1) outputting a mystery game start signal to all of the gaming terminals 10, when a predetermined condition is satisfied (e.g., when a total progressive value exceeds a mystery game start value); and (d2) outputting a mystery bonus signal to all of the gaming terminals 10, when the mystery game is run in every gaming terminal 10.

Now, a description will be made of different points between the embodiment 4-1 described above and the embodiment 4-2 shown in FIG. 102. In the embodiment 4-2, as in the embodiment 4-1, when the mystery game starting condition is satisfied, whether the base game run in each gaming terminal 10 has ended or not is determined. Then, unlike the embodiment 4-1, a mystery game is run in the gaming terminals 10, sequentially from the gaming terminal 10 having determined that the base game being run has ended (see an upper right view of FIG. 102). Then, when a predetermined period of time elapses after the mystery game is run in all the gaming terminals 10 (see a lower left view of FIG. 102), a result of the mystery game is all at once displayed on the upper image display panels 33 of the respective gaming terminals 10 (see a lower right view of FIG. 102).

[Timing Chart of Mystery Game according to Embodiment 4-2]

Figure 103:
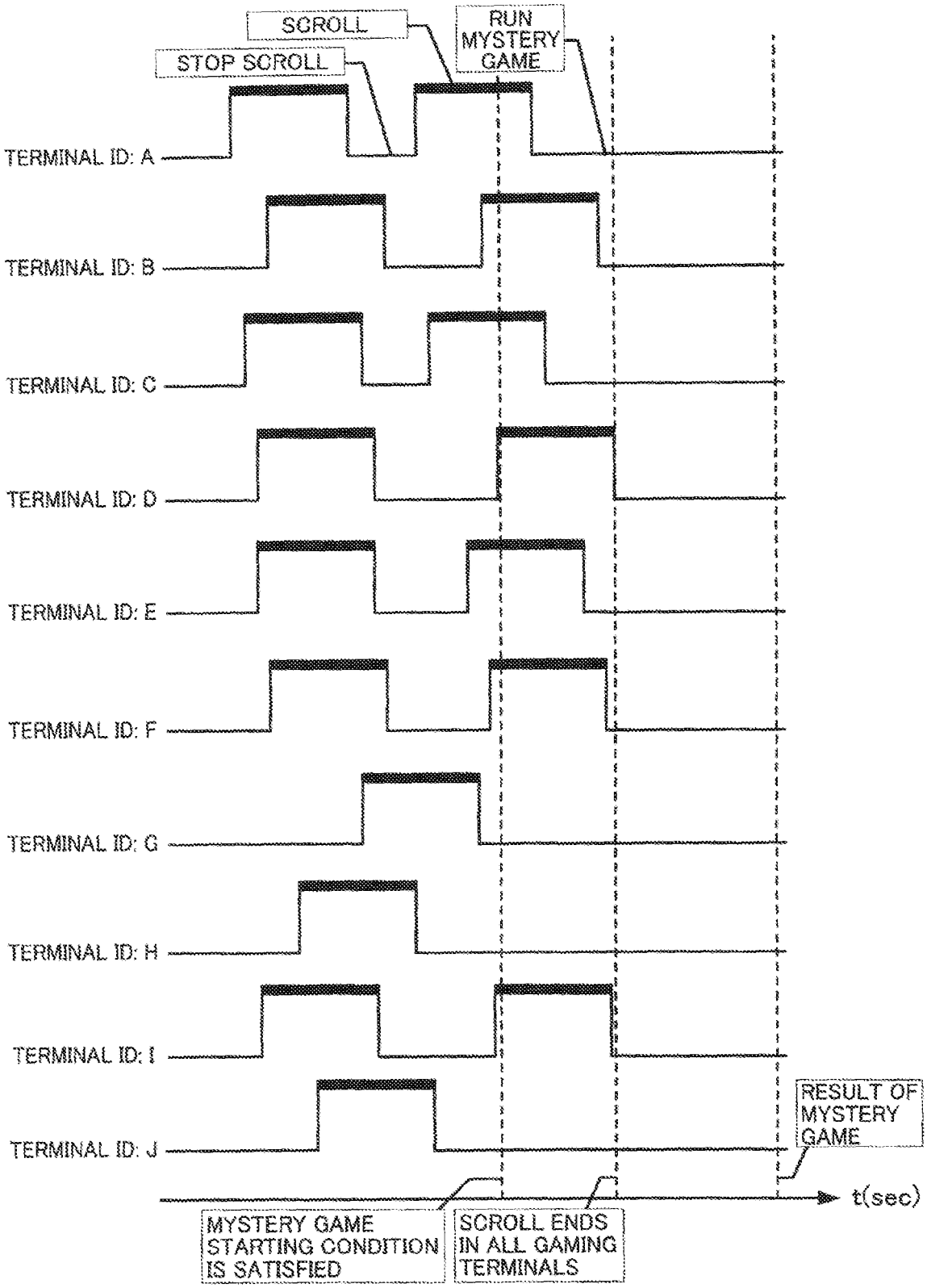
FIG. 103 is a diagram illustrating a timing chart in action of a mystery game according to the embodiment 4-2 of the present invention.

FIG. 103 is a diagram illustrating a timing chart in action of a mystery game in the embodiment 4-2. As shown in FIG. 103, in each of ten gaming terminals 10 (having terminal codes A to J), symbols 180 are repeatedly scrolled and stopped during the base game. When the mystery game starting condition is satisfied, a mystery game is run in the gaming terminals 10, sequentially from the gaming terminal 10 in which scroll of the symbols 180 is stopped. In a case of FIG. 103, at the time when the mystery game starting condition is satisfied, the gaming terminals 10 with terminal codes G, H, and J do not yet start scrolling symbols. Therefore, in these gaming terminals 10, the mystery game is run without scrolling symbols thereafter.

Then, in all the gaming terminals 10, scroll of the symbols 180 is stopped (in the case of FIG. 103, the gaming terminal 10 with the terminal code D is the last to stop the scroll), and the mystery game is run. In this case, after a predetermined period of time elapses since then, a result of the mystery game is all at once displayed in all the gaming terminals 10. In each gaming terminal 10, a mystery bonus is awarded in accordance with the result of the mystery game.

[Operation of Gaming Terminal 10 according to Embodiment 4-2: Mystery Game Running Process Routine]

Figure 104:
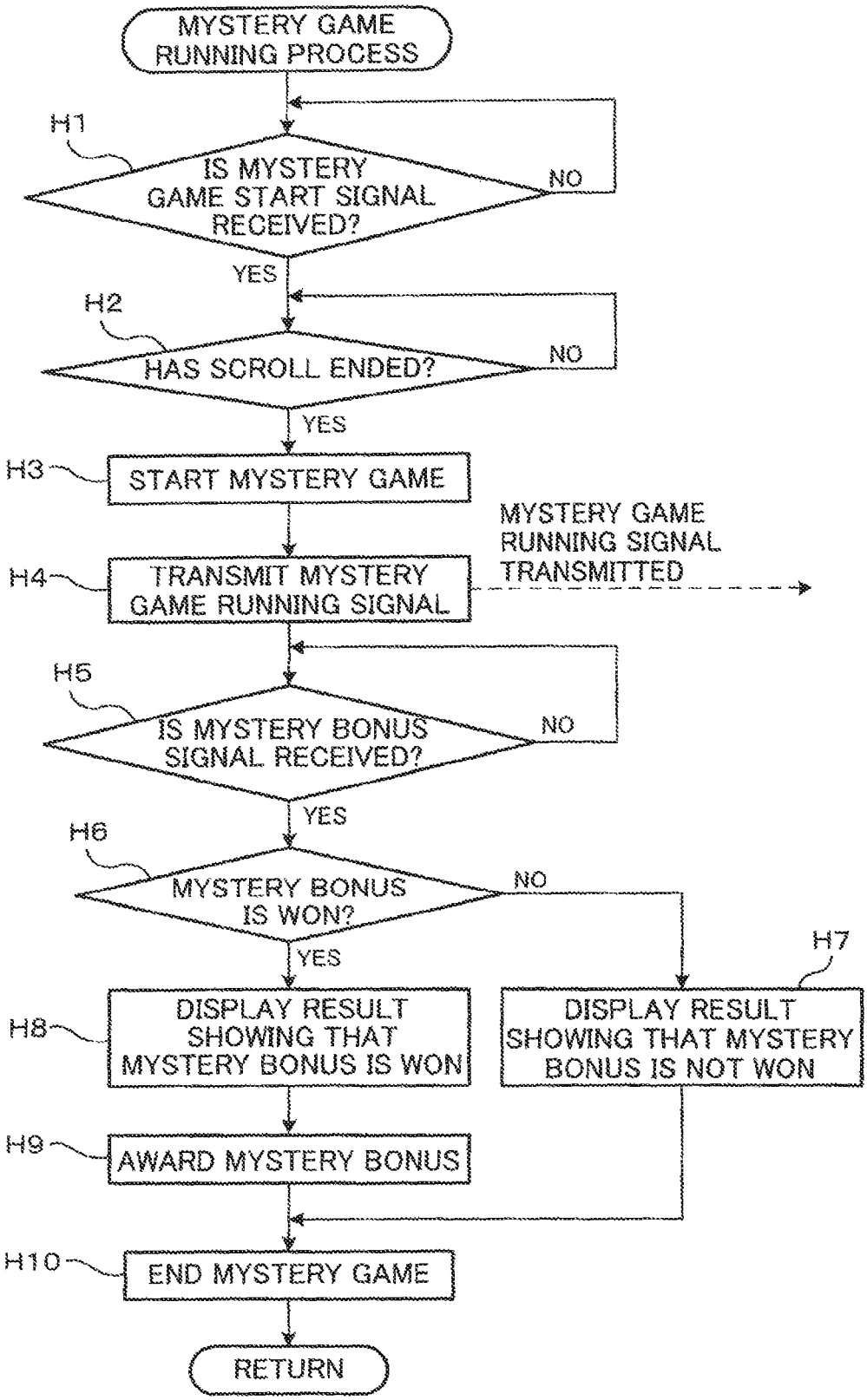
FIG. 104 is a flowchart illustrating a mystery game running process routine executed in a gaming terminal according to the embodiment 4-2 of the present invention.

FIG. 104 shows a mystery game running process routine executed in the gaming terminal 10. When the main CPU 41 of the gaming terminal 10 runs a mystery game running process routine, whether a mystery game start signal is received from the center controller 200 or not is first determined (H1). When it is determined in H1 that a mystery game start signal is not received (H1: NO), reception of a mystery game start signal is waited (H1).

When it is determined in H1 that a mystery game start signal is received (H1: YES), whether scroll of symbols 180 on the lower image display panel 16 has ended or not is determined (H2). When it is determined in H2 that scroll of symbols 180 has not ended yet (H2: NO), a standby state continues until scroll of the symbols 180 ends (H2). When it is determined in H2 that scroll of symbols 180 has ended (H2: YES) a mystery game is started (H3). Then, a mystery game running signal is transmitted to the center controller 200 (H4).

Then, whether a mystery bonus signal is received from the center controller 200 or not is determined (H5). When it is determined in H5 that a mystery bonus signal is not received (H5: NO), reception of a mystery bonus signal is waited (H5) During this waiting time, the "LOSS" image and the "WIN" image are alternately displayed on the upper image display panel 33, which means that the mystery game is being run.

When it is determined in H5 that a mystery bonus signal is received (H5: YES), whether a mystery bonus is won or not is determined based on information included in the mystery bonus signal thus received (H6). When it is determined that a mystery bonus is not won (H6: NO), the upper image display panel 33 displays thereon a result showing that a mystery bonus is not won (H7). Then, the mystery game ends (H10), and this routine ends.

When it is determined that a mystery bonus is won (H6: YES), the upper image display panel 33 displays thereon a result showing that a mystery bonus is won (H8), and a mystery bonus is awarded (H9). Then, the mystery game ends (H10), and this routine ends.

[Operation of Center Controller 200 according to Embodiment 4-2: Mystery Game Running Process Routine]

Figure 105:
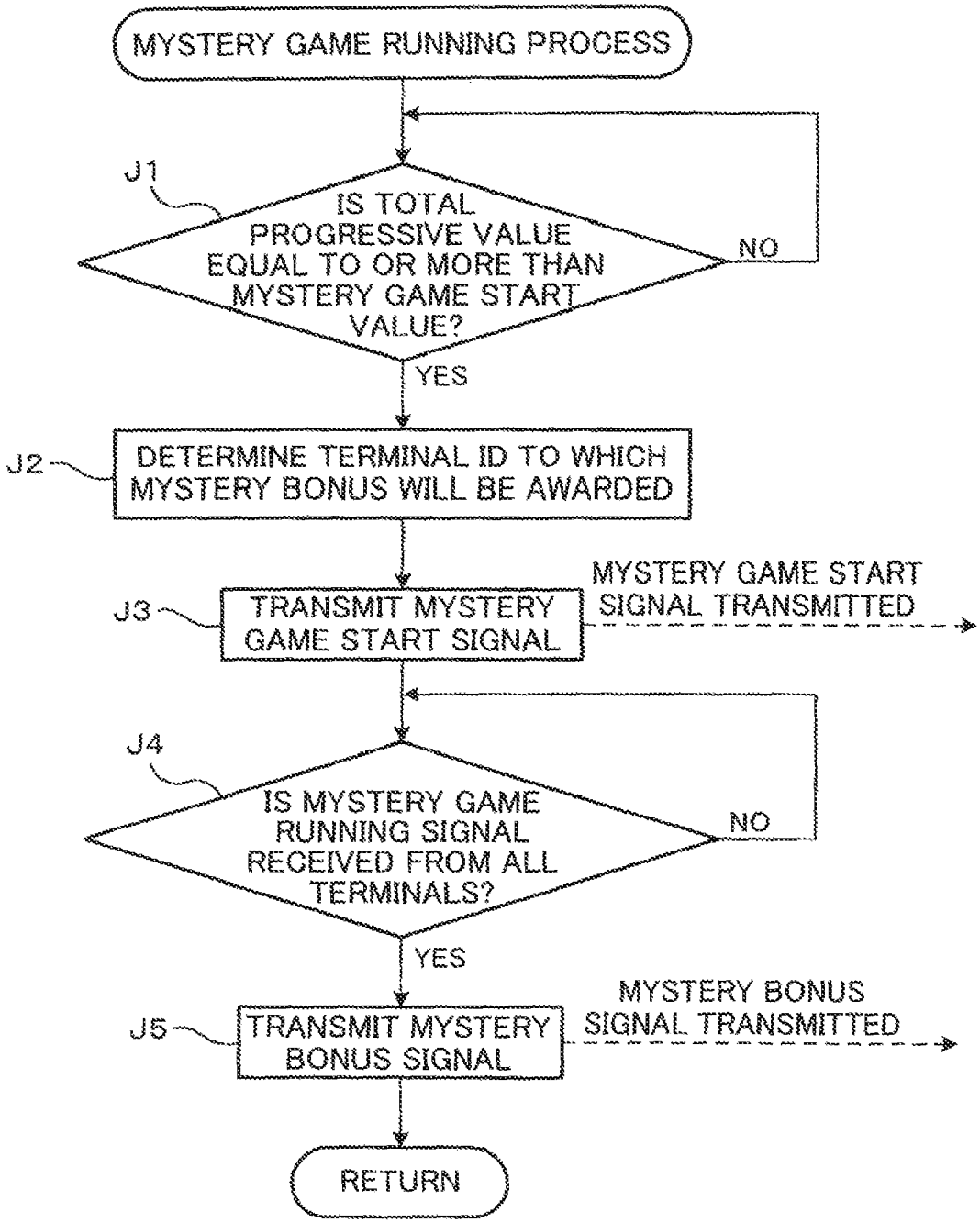
FIG. 105 is a flowchart illustrating a mystery game running process routine executed in a center controller according to the embodiment 4-2 of the present invention.

FIG. 105 shows a mystery game running process routine executed in the center controller 200. When a mystery game running process routine is executed, the center controller 200 refers to the "total progressive value" field of the progressive value table which is stored in the RAM 243, so as to determine whether or not a total of the progressive values obtained from the gaming terminals 10 is equal to or greater than the mystery game start value (J1). If it is determined that the total is less than the mystery game start value (J1: NO), the step J1 is repeated until the total reaches the mystery game start value or higher.

If it is determined that the total is equal to or greater than the mystery game start value (J1: YES), a terminal code of a gaming terminal to which a mystery bonus is awarded is determined (J2). Then, a mystery game start signal is transmitted to all the gaming terminals 10 (J3).

Then, whether a mystery game running signal is received from all the gaming terminals 10 or not is determined (J4). When it is determined that a mystery game running signal is not received from all the gaming terminals 10 (J4: NO), the process returns to the step J4, and a standby state continues until a mystery game running signal is received from all the gaming terminals 10 (J4).

When it is determined that a mystery game running signal is received from all the gaming terminals 10 (J4: YES), a mystery bonus signal is transmitted to all the gaming terminals 10 (J5) Then, this routine ends.

As described above, the base game is run in each of the gaming terminals 10. When the total progressive value exceeds the mystery game start value, whether the base game being run has ended or not is determined in each gaming terminal 10. The gaming terminals 10, sequentially from the one having determined that the base game has ended, start a mystery game. After the mystery game is run in all the gaming terminals 10, a mystery bonus is awarded to each of the gaming terminals 10 in accordance with a result of the mystery game. Thus, in all the gaming terminals 10, after the base game ends, the mystery bonus is awarded in accordance with the result of the mystery game. Accordingly, a player can share his/her expectation for the mystery bonus with other players. In addition, the gaming terminals 10, sequentially from the one having ended the base game, start the mystery game. This can give a player expectation for the mystery bonus being awarded soon, even before the other gaming terminals 10 end the base game. Like this, a player may enjoy the mystery game with sympathy with players playing on the other gaming terminals 10, as compared with when the mystery game is individually run in one gaming terminal 10 independently of in another gaming terminal 10.

In the above, the embodiment 4-2 of the present invention was described. Next, the embodiment 4-3 of the present invention will be described.

[Operation of Gaming Terminal 10 according to Embodiment 4-3: Mystery Game Running Process Routine]

In the following, the embodiment 4-3 of the present invention will be described. The embodiment 4-3 is the same as the embodiment 4-1, except that the process concerning the mystery game is performed not by the center controller 200 but by each of the gaming terminals 10.

To be specific, a gaming machine 1 according to the embodiment 4-3 of the present invention has a plurality of gaming terminals 10 each of which runs a base game to award a payout corresponding to a predetermined winning and a mystery game to award a mystery bonus which is greater than the payout of the base game. The gaming terminal 10 includes a terminal display 101 (the upper image display panel 33, the lower image display panel 16) which displays an image, and a terminal controller 100. The terminal controller 100 is programmed to perform the steps of: (e1) running the base game and awarding a payout corresponding to a predetermined winning, independently of another terminal controller 100 of another gaming terminal 10; (e2) determining whether the base game has ended or not, when a predetermined condition is satisfied (e.g., when a predetermined zero hour comes); (e3) displaying on the terminal display 101 a mystery game image concerning the mystery game (e.g., the mystery game announcement image), when it is determined that the base game has ended; (e4) running the mystery game, after all the other gaming terminals 10 display a mystery game image on their terminal displays 101; and (e5) awarding the mystery bonus in accordance with a result of the mystery game, after running the mystery game.

Figure 106:
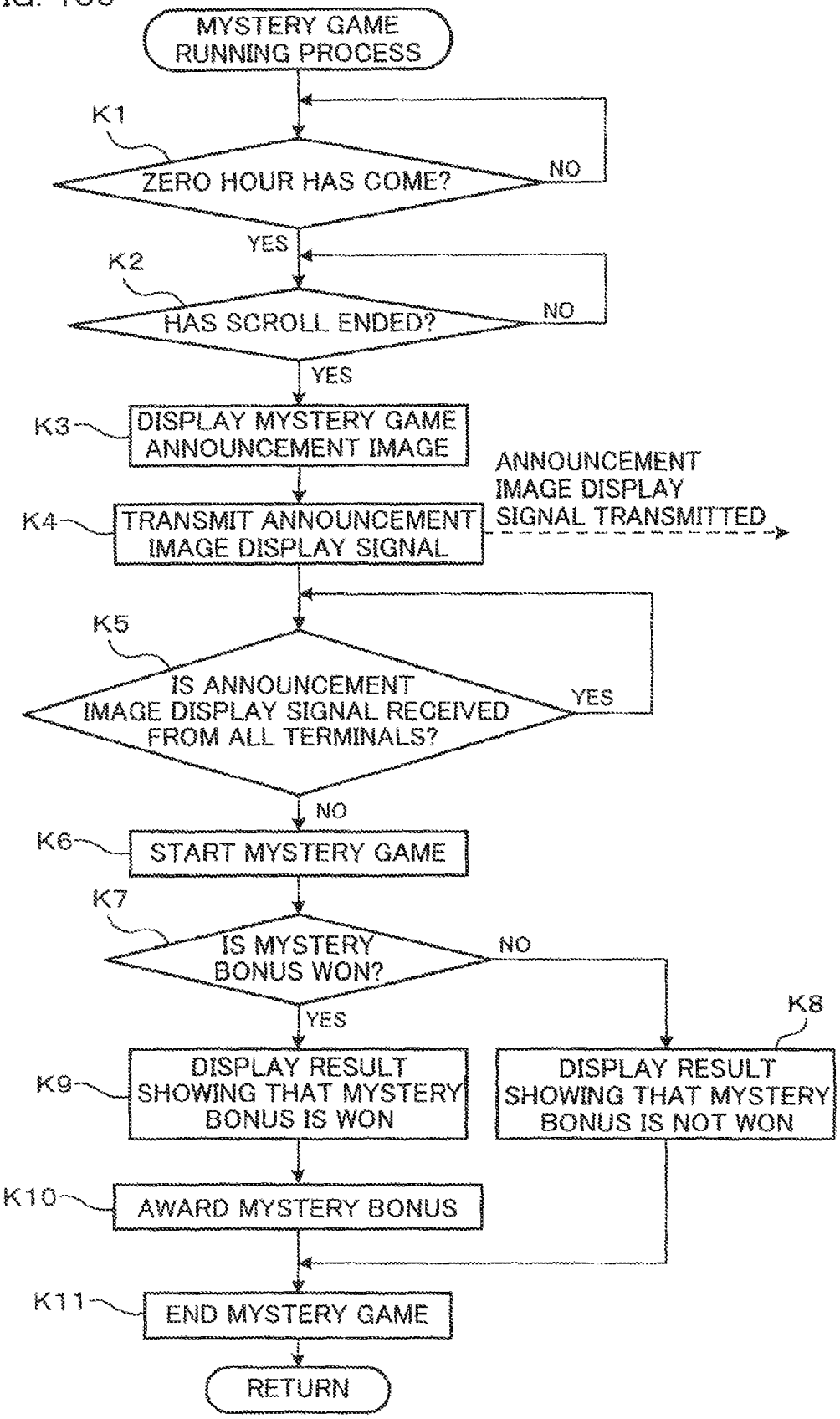
FIG. 106 is a flowchart illustrating a mystery game running process routine executed in a gaming terminal according to an embodiment 4-3 of the present invention.

FIG. 106 shows a mystery game running process routine executed in the gaming terminal 10 of the embodiment 4-3. When the main CPU 41 of the gaming terminal 10 runs a mystery game running process routine, whether a predetermined zero hour has come or not is first determined (K1). When it is determined that the zero hour has not yet come (K1: NO), a waiting state continues until the zero hour comes (K1). In the embodiment 4-3, the zero hour for every gaming terminal 10 is the same. Therefore, the mystery game starting condition is concurrently satisfied in all the gaming terminals 10.

When it is determined that the zero hour has come (K1: YES), whether scroll of symbols 180 on the lower image display panel 16 has ended or not is determined (K2). When it is determined in K2 that scroll of symbols 180 has not ended yet (K2: NO), a standby state continues until scroll of the symbols 180 ends (K2). When it is determined in K2 that scroll of symbols 180 has ended (K2: YES), a mystery game announcement image is displayed on the upper image display panel 33 (K3) Then, an announcement image display signal is transmitted to all the other gaming terminals 10 (K4).

Then, whether an announcement image display signal is received from all the other gaming terminals 10 or not is determined (K5). When it is determined that an announcement image display signal is not received from all the other gaming terminals 10 (K5: NO), the announcement image display signal is waited (K5). During this waiting time, the mystery game announcement image is displayed on the upper image display panel 33, and the base game is not being run. When it is determined that an announcement image display signal is received from all the other gaming terminals 10 (K5: YES), a mystery game is started (K6). Here, in the embodiment 4-1, when the center controller 200 receives the announcement image display signal from all the gaming terminals 10, the center controller 200 causes the gaming terminals 10 to start the mystery game. However, in the embodiment 4-3, when each gaming terminal 10 receives the announcement image display signal from all the other gaming terminals 10, each gaming terminal 10 individually starts the mystery game.

Then, whether a mystery bonus is won or not is determined based on a result of the mystery game run (K7). Here, in the embodiment 4-1, the center controller 200 determines which gaming terminal 10 will be awarded a mystery bonus. However, in the embodiment 4-3, whether a mystery bonus should be awarded or not is predetermined for every gaming terminal 10.

When it is determined that a mystery bonus is not won (K7: NO), the upper image display panel 33 displays thereon a result showing that a mystery bonus is not won (K8). Then, the mystery game ends (K11), and this routine ends.

When it is determined that a mystery bonus is won (K7: YES), the upper image display panel 33 displays thereon a result showing that a mystery bonus is won (K9), and a mystery bonus is awarded (K10). Then, the mystery game ends (K11), and this routine ends.

As described above, the base game is run in each of the gaming terminals 10. When the zero hour comes, whether the base game being run has ended or not is determined in each of the gaming terminals 10. The gaming terminals 10, sequentially from the one having determined that the base game has ended, display the mystery game announcement image on their terminal displays 101 (upper image display panels 33). When the mystery game announcement image is displayed on the terminal displays 101 (upper image display panels 33) of all the gaming terminals 10, the mystery game is run all at once in all the gaming terminals 10. When the mystery game is run all at once, a mystery bonus is awarded to each gaming terminal 10 in accordance with a result of the mystery game. Thus, in all the gaming terminals 10, the mystery game is run all at once after the base game ends. Accordingly, a player can share his/her expectation for the mystery bonus with other players. In addition, the gaming terminals 10, sequentially from the one having ended the base game, have the mystery game announcement image displayed on the terminal displays 101 (upper image display panels 33). This can give a player expectation for the mystery game starting soon, even before the other gaming terminals 10 end the base game. Like this, a player may enjoy the mystery game with sympathy with players playing on the other gaming terminals 10, as compared with when the mystery game is individually run in one gaming terminal 10 independently of in another gaming terminal 10.

In the above, the embodiment 4-3 of the present invention was described. Next, the embodiment 4-4 of the present invention will be described.

[Operation of Gaming Terminal 10 according to Embodiment 4-4: Mystery Game Running Process Routine]

In the following, the embodiment 4-4 of the present invention will be described. The embodiment 4-4 is the same as the embodiment 4-2, except that the process concerning the mystery game is performed not by the center controller 200 but by each of the gaming terminals 10.

To be specific, a gaming machine 1 according to the embodiment 4-4 of the present invention has a plurality of gaming terminals 10 each of which includes a terminal controller 100 and runs a base game to award a payout corresponding to a predetermined winning and a mystery game to award a mystery bonus which is greater than the payout of the base game. The terminal controller 100 is programmed to perform the steps of: (f1) running the base game and awarding a payout corresponding to a predetermined winning, independently of another terminal controller 100 of another gaming terminal 10; (f2) determining whether the base game has ended or not, when a predetermined condition is satisfied (e.g., a predetermined zero hour comes); (f3) running the mystery game, when it is determined that the base game has ended; (f4) awarding the mystery bonus in accordance with a result of the mystery game, after the mystery game is run in all the other gaming terminals 10.

Figure 107:
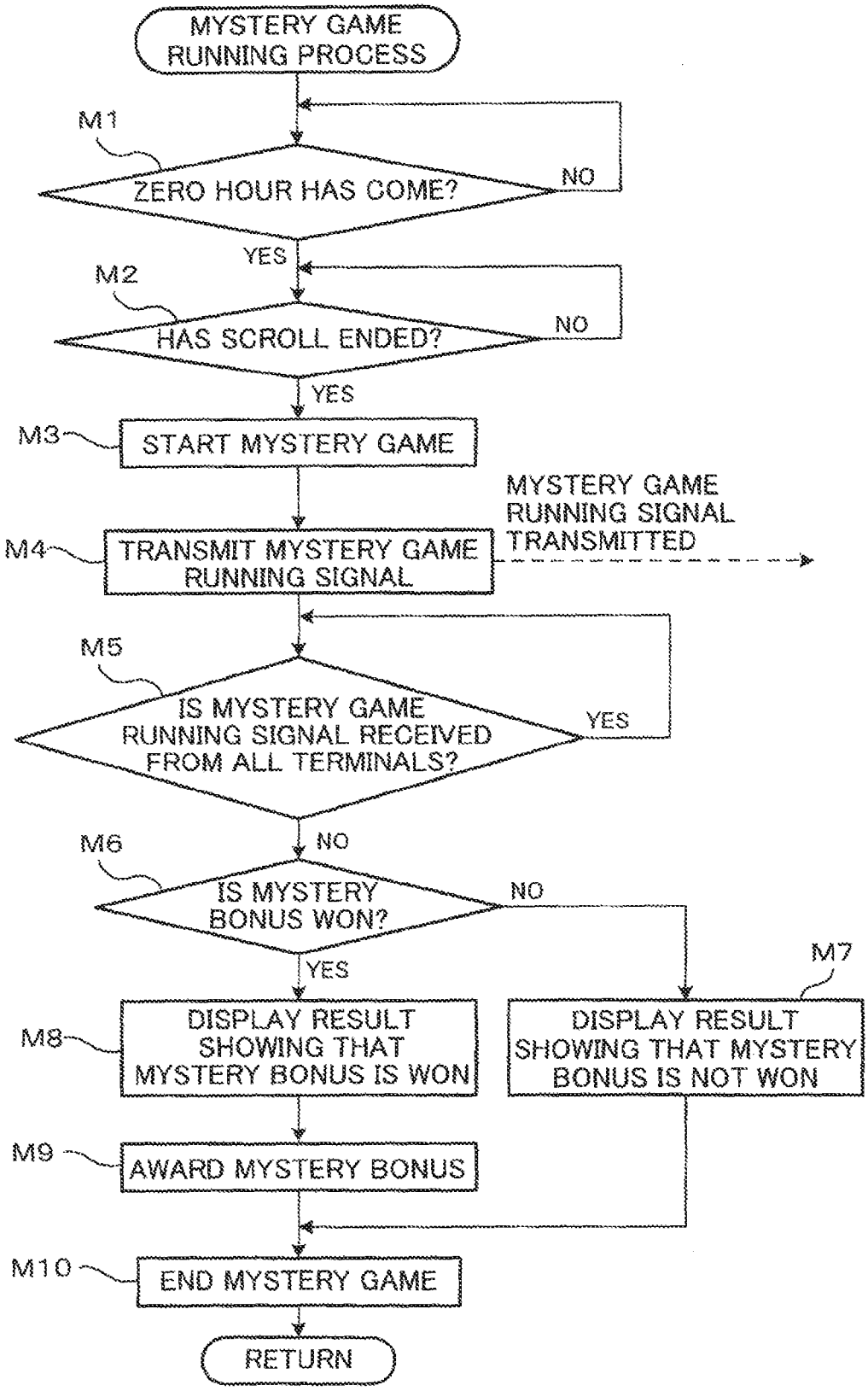
FIG. 107 is a flowchart illustrating a mystery game running process routine executed in a gaming terminal according to an embodiment 4-4 of the present invention.

FIG. 107 shows a mystery game running process routine executed in the gaming terminal 10 of the embodiment 4-4. When the main CPU 41 of the gaming terminal 10 runs a mystery game running process routine, whether a predetermined zero hour has come or not is first determined (M1). When it is determined that the zero hour has not yet come (M1: NO), a waiting state continues until the zero hour comes (M1).

When it is determined that the zero hour has come (M1: YES), whether scroll of symbols 180 on the lower image display panel 16 has ended or not is determined (M2). When it is determined in M2 that scroll of symbols 180 has not ended yet (M2: NO), a standby state continues until scroll of the symbols 180 ends (M2). When it is determined in M2 that scroll of symbols 180 has ended (M2: YES), a mystery game is started (M3) Then, a mystery game running signal is transmitted to all the other gaming terminals 10 (M4).

Then, whether a mystery game running signal is received from all the other gaming terminals 10 or not is determined (M5). When it is determined that a mystery game running signal is not received from all the other gaming terminals 10 (M5: NO), a mystery game running signal is waited (M5). During this waiting time, the "LOSS" image and the "WIN" image are alternately displayed on the upper image display panel 33, which means that the mystery game is being run. When it is determined that a mystery game running signal is received from all the other gaming terminals 10 (M5: YES), whether a mystery bonus is won or not is determined based on a result of the mystery game run (M6). Here, in the embodiment 4-2, when the center controller 200 receives the mystery game running signal from all the gaming terminals 10, the center controller 200 causes the gaming terminals 10 to display a result of the mystery game. However, in the embodiment 4-4, when each gaming terminal 10 receives the mystery game running signal from all the other gaming terminals 10, each gaming terminal 10 individually displays a result of the mystery game. Further, in the embodiment 4-2, the center controller 200 determines which gaming terminal 10 will be awarded a mystery bonus. However, in the embodiment 4-4, whether a mystery bonus should be awarded or not is predetermined for every gaming terminal 10.

When it is determined that a mystery bonus is not won (M6: NO), the upper image display panel 33 displays thereon a result showing that a mystery bonus is not won (M7). Then, the mystery game ends (M10), and this routine ends.

When it is determined that a mystery bonus is won (M6: YES), the upper image display panel 33 displays thereon a result showing that a mystery bonus is won (M8), and a mystery bonus is awarded (M9). Then, the mystery game ends (M10), and this routine ends.

As described above, the base game is run in each of the gaming terminals 10. When the zero hour comes, whether the base game being run has ended or not is determined in each of the gaming terminals 10. The gaming terminals 10, sequentially from the one having determined that the base game has ended, start a mystery game. After the mystery game is run in all the gaming terminals 10, a mystery bonus is awarded to each of the gaming terminals 10 in accordance with a result of the mystery game. Thus, in all the gaming terminals 10, after the base game ends, the mystery bonus is awarded in accordance with the result of the mystery game. Accordingly, a player can share his/her expectation for the mystery bonus with other players. In addition, the gaming terminals 10, sequentially from the one having ended the base game, start the mystery game. This can give a player expectation for the mystery bonus being awarded soon, even before the other gaming terminals 10 end the base game. Like this, a player may enjoy the mystery game with sympathy with players playing on the other gaming terminals 10, as compared with when the mystery game is individually run in one gaming terminal 10 independently of in another gaming terminal 10.

In the above-described embodiments 4-3 and 4-4, the process concerning the mystery game is performed not by the center controller 200 but by each of the gaming terminals 10. However, this is not limitative. For example, it may be possible that, instead of the center controller 200, any of the gaming terminals 10 performs the process concerning the mystery game.

[Base Game in Gaming Machine according to Variation of the Fourth Embodiment]

A variation of the fourth embodiment of the invention is also possible, as described below. The following will describe a base game in a gaming machine according to a variation of the fourth embodiment of the present invention.

Figure 108:
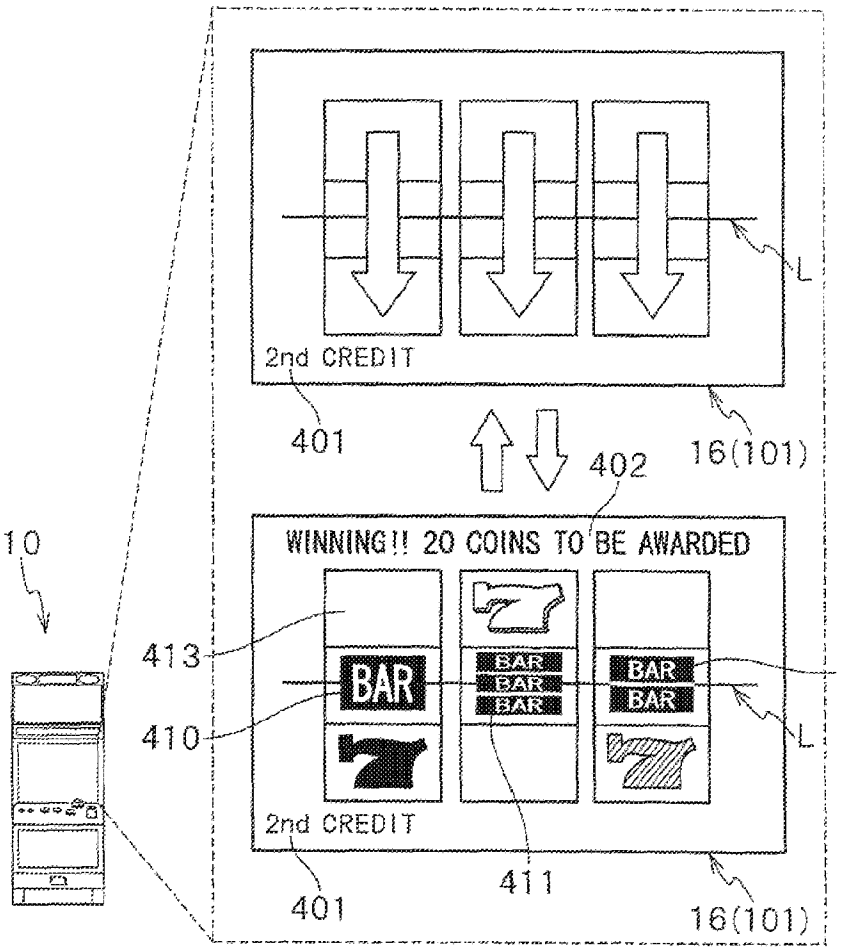
FIG. 108 is an explanatory diagram concerning a base game in a gaming machine according to a variation of the fourth embodiment of the present invention.

A terminal display 101 according to this variation includes arrangement areas having a matrix of three rows and three columns, as shown in FIG. 108. The arrangement areas in the middle row make up the payline L. When a predetermined winning is achieved by the relation between the symbols rearranged in the payline L, a payout is awarded according to the winning achieved. The terminal display 101 displays a credit 401 indicative of the amount of the progressive value bet.

In the example shown in FIG. 108, the credit 401 indicates "2nd CREDIT", meaning that the progressive value bet is equivalent of two coins. As a result of symbol rearrangement, symbols 410, 411, and 412 are rearranged as "1BAR", "3BAR", and "2BAR", respectively, in the payline L. These symbols make "ANY-BAR" "ANY-BAR" "ANY-BAR", which is a winning combination for credit 401 equivalent of two coins. As a payout for this winning, twenty coins are awarded.

FIG. 109 shows a basic game payout table according to the variation of the fourth embodiment of the present invention described above. The base game payout table is used when the main CPU 41 determines a winning in a base game, and when the main CPU 41 awards a payout according to the winning. The base game payout table includes a bet number field, a winning combination field, and a payout amount field. The bet number field indicates the number of coins bet. In the winning combination field, combinations of symbols rearranged in the payline L are shown, which are conditions necessary for meeting winnings. The payout amount field shows the number of coins to be paid out when a winning is met. An example shown in FIG. 109 will be described now. When the symbols "3BAR" "3BAR" "3BAR" are rearranged in the payline L, the payout amount is 60 when the number of bet is 1, and 120 when the number of bet is 2. When the symbols "2BAR" "2BAR" "2BAR" are rearranged in the payline L, the payout amount is 40 when the number of bet is 1, and 80 when the number of bet is 2. When the symbols "1BAR" "1BAR" "1BAR" are rearranged in the payline L, the payout amount is 20 when the number of bet is 1, and 40 when the number of bet is 2. When the symbols "ANY-BAR" "ANY-BAR" "ANY-BAR" are rearranged in the payline L, the payout amount is 10 when the number of bet is 1, and 20 when the number of bet is 2. When the symbols "BLANK" "BLANK" "BLANK" are rearranged in the payline L, the payout amount is 1 when the number of bet is 1, and 2 when the number of bet is 2. When the symbols "Blue 7" "Blue 7" "Blue 7" are rearranged in the payline L, the payout amount is 1800 when the number of bet is 3. When the symbols "Red 7" "Red 7" "Red 7" are rearranged in the payline L, the payout amount is 100 when the number of bet is 3. When the symbols "ANY-7" "ANY-7" "ANY-7" are rearranged in the payline L, the payout amount is 100 when the number of bet is 3. In this manner, the payout amount awarded when a winning is achieved increases as the number of bets is increased. This can increase the progressive value (number of bets) made by players.

[JP Game in Gaming Machine according to Variation]

The following will describe a JP game in a gaming machine according to the variation of the fourth embodiment of the present invention. In a JP game according to this variation, points are awarded that reflect a predetermined JP winning. A predetermined number of the race-use light emitting portions 2, according to an accumulated value of the points having been awarded, are turned active sequentially towards the JP payout indicator 400.

Figure 110:
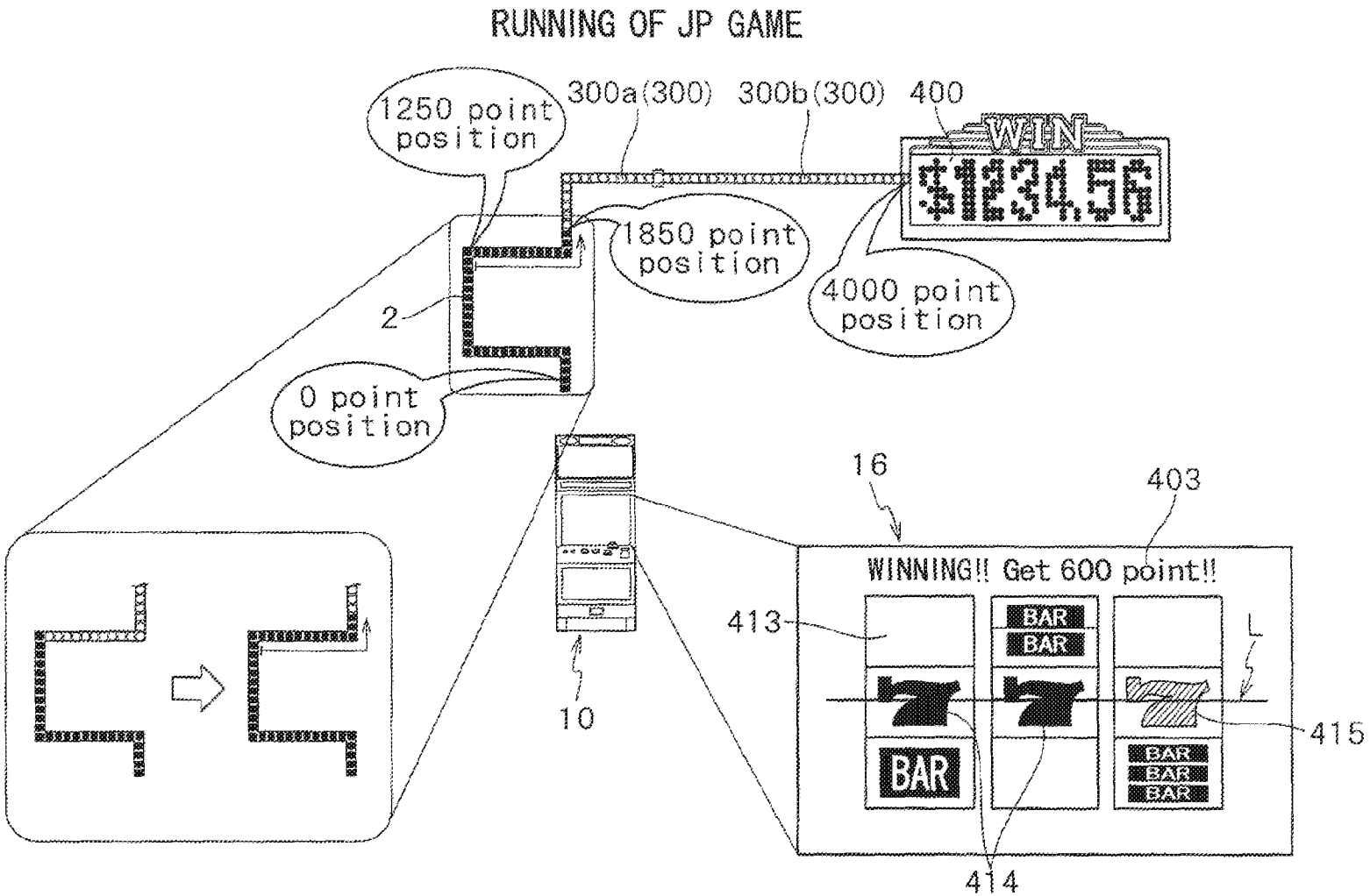
FIG. 110 is an explanatory diagram concerning a JP game in a gaming machine according to the variation of the fourth embodiment of the present invention.

An example shown in FIG. 110 will be described now. The position corresponding to the gaming terminal 10 has an associated value of 0 point, and the position at the JP payout indicator 400 has an associated value of 4000 points. In the gaming terminal 10, 1250 points have been awarded and accumulated, and the race-use light emitting portions 2 in the race line unit 300 (curve 300*a* and straight part 300*b*) have been activated up to the position corresponding to 1250 points. Here, JP winnings are achieved by rearrangement of symbols 414 as "Red 7" and a symbol 415 as "Blue 7", respectively, in the payline L. Three JP winning are met. Rearrangement of one symbol 414 in the payline L makes two JP winnings, and rearrangement of one symbol 415 in the payline L makes another JP winning. The payout for the JP winning achieved by each symbol 414 is 150 points, and the payout for the JP winning achieved by the symbol 415 is 300 points. Accordingly, the three JP winnings make a total payout of 600 points. Awarding 600 points to the gaming terminal 10 makes the cumulative points of 1250+600=1850 points. Then, the race-use light emitting portions 2 are turned active up to a position corresponding to 1850 points. In this manner, during a JP game, points are awarded according to a predetermined JP winning, and a jackpot is awarded when the points is accumulated up to a predetermined value (4000 points).

FIG. 111 illustrates a JP game payout table of the variation. The JP game payout table is used when the main CPU 41 determines a JP winning in a JP game, and when the main CPU 241 awards payout points according to the JP winning. The JP game payout table contains a JP winning combination field and a payout point field. In the JP winning combination field, combinations of symbols rearranged in the payline L are shown, which are conditions necessary for meeting winnings. The payout point field indicates the number of points paid out when a JP winning is met. An example shown in FIG. 111 will be described now. When symbols "Blue 7" "Blue 7" "Blue 7" are rearranged in the payline L, 7000 points are paid out. When a symbol "Blue 7" is rearranged in the payline L, 300 points are paid out. When a symbol "Red 7" is rearranged in the payline L, 150 points are paid out. When a symbol "3BAR" is rearranged in the payline L, 30 points are paid out. When a symbol "2BAR" is rearranged in the payline L, 20 points are paid out. When a symbol "1BAR" is rearranged in the payline L, 10 points are paid out.

Here, the gaming machine 1 is described that is configured to award a jackpot when the awarded points have accumulated to a predetermined value (4000 points). However, the invention is not limited to this example. For example, the gaming machine 1 may be configured to award a jackpot when the awarded points have accumulated to a value which varies within a predetermined range of, for example, 3000 to 5000, in each JP game.

The detailed description of the present invention provided hereinabove mainly focused on characteristics thereof for the purpose of easier understanding; however, the scope of the present invention shall be construed as broadly as possible, encompassing various forms of other possible embodiments, and therefore the present invention shall not be limited to the above description. Further, the terms and phraseology used in the present specification are adopted solely to provide specific illustration of the present invention, and in no case should the scope of the present invention be limited by such terms and phraseology. Further, it will be obvious for those skilled in the art that the other structures, systems, methods or the like are possible, within the spirit of the invention described in the present specification. The description of claims therefore shall encompass structures equivalent to the present invention, unless otherwise such structures are regarded as to depart from the spirit and scope of the present invention. Further, the abstract is provided to allow, through a simple investigation, quick analysis of the technical features and essences of the present invention by an intellectual property office, a general public institution, or one skilled in the art who is not fully familiarized with patent and legal or professional terminology. It is therefore not an intention of the abstract to limit the scope of the present invention which shall be construed on the basis of the description of the claims. To fully understand the object and effects of the present invention, it is strongly encouraged to sufficiently refer to disclosures of documents already made available.

The detailed description of the present invention provided hereinabove includes a process executed on a computer or computer network. The above descriptions and expressions are provided to allow the one skilled in the art to most efficiently understand the present invention. A process performed in or by respective steps yielding one result or blocks with a predetermined processing function described in the present specification shall be understood as a process with no self-contradiction. Further, the electrical or magnetic signal is transmitted/received and written in the respective steps or blocks. It should be noted that such a signal is expressed in the form of bit, value, symbol, text, terms, number, or the like solely for the sake of convenience. Although the present specification occasionally personifies the processes performed in the steps or blocks, these processes are essentially executed by various devices. Further, the other structures necessary for the steps or blocks are obvious from the above descriptions.

What is claimed is:

1. A gaming machine comprising:

a plurality of terminal devices each of which executes a base game with a game value being bet and awards a prize according to a predetermined winning condition;

a plurality of routes each of which is formed by continuously disposing a plurality of route light emitters from a corresponding terminal device out of the terminal devices to a common display;

the common display having a plurality of common display light emitters arranged in a matrix and a plurality of route light emitters arranged so as to form a plurality of straight lines each acting as an extension route, the common display being detachably unitized with the plurality of routes; and a jackpot controller which is programmed to execute the steps of:

(a1) accumulating a percentage of the game value which is bet in each base game executed at each of the terminal devices;

(a2) causing the common display to display the accumulated percentage of the game value;

(a3) every time the predetermined winning condition is achieved at a terminal device after the accumulated percentage of the game value reaches a predetermined amount, causing a preset number of route light emitters to be turned on toward the common display so as to emit light, the preset number of route light emitters being disposed on a route corresponding to the terminal device having the predetermined winning condition and/or on an extension route associated with that route; and (a4) when all route light emitters disposed on any one route of the plurality of routes and an extension route associated with that route are turned on to emit light, awarding the accumulated percentage of the game value to a terminal device corresponding to that route and that extension route on which all the route light emitters emit light.

2. The gaming machine according to claim 1, wherein a lateral length of the common display is smaller than a total sum of respective lateral lengths of the plurality of terminal devices used in the gaming machine.

3. The gaming machine according to claim 1, wherein the route light emitters and the common display light emitters are constituted by LEDs.

4. The gaming machine according to claim 1, wherein the route light emitters are constituted by at least three types of LEDs including a red-base LED, a green-base LED, and a blue-base LED; and wherein the common display light emitters are constituted by one or two types of LEDs.

5. A gaming machine comprising:

a plurality of gaming teminals, each having a terminal display unit that has a background display area for displaying a background image and a terminal controller programmed for carrying out the following steps (a1) to (a3);

a color-setting unit that sets a color corresponding to each of the gaming terminals;

a bonus payout display unit which displays a bonus payout in a bonus game, the bonus payout being greater than a base payout of a base game, the base game awarding the base payout according to a predetermined winning condition;

a plurality of paths, each corresponding to one of the plurality of gaming terminals, wherein a plurality of light-emitting portions that emit light are successively arranged from a first end of each path proximate a corresponding gaming terminal to a second end proximate the bonus payout display unit;

and a center controller programmed to carry out the following steps of (b1) to (b3 ), wherein the terminal controller carries out the steps of:

(a1) running the base game independently of another gaming terminal and awarding the base payout according to the predetermined winning condition;

(a2) displaying the background image according to a color that is set by the color-setting unit in the background display area of the gaming terminal, wherein the background image is displayed after a predetermined amount of time has elapsed at the gaming terminal; and (a3) awarding the bonus payout based on a command from the center controller, wherein the center controller carries out the steps of:

(b1) running the base game;

(b2) each time that the predetermined winning condition is achieved in one of the gaming terminals, additionally turning on a light-emitting portion with a light-emitting color based on the color that is set by the color-setting unit in an order from the first end to the second end of the path associated with the gaming terminal;

(b3) when one of the paths is turned on up to a light-emitting portion at the second end of the path, commanding the terminal controller of the gaming terminal associated with the path to award the bonus payout.

6. A gaming machine comprising:

a base game;

a plurality of gaming terminals each having a terminal controller programmed to carry out the following steps of (a1) to (a3);

and a center controller programmed to carry out the following steps of (b1) to (b3 ), wherein the terminal controller carries out the steps of:

(a1) running the base game independently of any other gaming terminals, wherein, in the base game, a unit game consuming a time is run in response to a bet and a payout is awarded according to a result of the unit game;

(a2) prohibiting a new unit game from being run on the gaming terming to which the terminal controller is associated based on a unit game prohibition command from the center controller;

(a3) based on an event start command from the center controller, participating in an event started in accordance with a condition of running the bonus game, wherein the plurality of gaming terminals can participate in the event;

the center controller carries out the steps of:

(b1) determining whether the condition of running the bonus game is satisfied;

(b2) when the condition has been satisfied, running the unit game prohibition command in the terminal controller of one or more of the plurality of gaming terminals and counting down a standby time that is longer than the time consumed in the unit game; and (b3) when the standby time is counted down to zero, running the event start command in the terminal controller of one or more of the plurality of gaming terminals and running the event.

7. A gaming machine comprising:

a plurality of gaming terminals each of which runs a base game to award a payout corresponding to a predetermined winning condition of the base game and a bonus game to award a bonus payout which is greater than the payout of the base game, the gaming terminal including a terminal controller and a terminal display which displays an image; and a center controller, wherein the terminal controller is programmed to perform the steps of:

(a1) running the base game and awarding a payout corresponding to the predetermined winning condition, independently of another terminal controller of another gaming terminal;

(a2) determining whether the base game has ended or not, based on a first command from the center controller;

(a3) displaying on the terminal display a bonus game screen concerning the bonus game, when it is determined that the base game has ended;

(a4) running the bonus game based on a second command from the center controller simultaneously with all other gaming terminals; and (a5) awarding the bonus payout in accordance with a result of the bonus game, after running the bonus game, wherein the center controller is programmed to perform the steps of:

(b1) outputting the first command to all of the gaming terminals, when a condition for running the bonus game is satisfied; and (b2) outputting the second command to all of the gaming terminals, when the bonus game screen is displayed on the terminal display of every gaming terminal.

* * * * *